US011299952B2

(12) United States Patent
Robichaux et al.

(10) Patent No.: US 11,299,952 B2
(45) **Date of Patent: *Apr. 12, 2022**

(54) ROTATING AND RECIPROCATING SWIVEL APPARATUS AND METHOD

(71) Applicant: Mako Rentals, Inc., Schriever, LA (US)

(72) Inventors: Kip M. Robichaux, Houma, LA (US); Kenneth G. Caillouet, Thibodaux, LA (US); Terry P. Robichaux, Houma, LA (US)

(73) Assignee: Mako Rentals, Inc., Schriever, LA (US)

( * ) Notice: Subject to any disclaimer, the term of this patent is extended or adjusted under 35 U.S.C. 154(b) by 42 days.

This patent is subject to a terminal disclaimer.

(21) Appl. No.: 16/799,926

(22) Filed: Feb. 25, 2020

(65) Prior Publication Data

US 2020/0263515 A1 Aug. 20, 2020

Related U.S. Application Data

(63) Continuation of application No. 16/004,604, filed on Jun. 11, 2018, now Pat. No. 10,570,691, which is a (Continued)

(51) Int. Cl.
*E21B 33/064* (2006.01)
*E21B 33/076* (2006.01)
(Continued)

(52) U.S. Cl.
CPC ..... *E21B 33/064* (2013.01); *E21B 17/01* (2013.01); *E21B 17/05* (2013.01);
(Continued)

(58) Field of Classification Search
CPC ..... E21B 33/064; E21B 33/06; E21B 33/076; E21B 17/01; E21B 17/05; E21B 17/1007; E21B 21/00; E21B 21/001
See application file for complete search history.

(56) References Cited

U.S. PATENT DOCUMENTS 1,708,316 A * 4/1929 Macclatchie ..... E21B 33/06 277/326
3,457,991 A * 7/1969 Sizer ..... E21B 33/064 166/363
(Continued)

*Primary Examiner* — Aaron L Lembo
(74) *Attorney, Agent, or Firm* — Roy Kiesel Ford Doody & North, APLC; Brett A. North

(57) ABSTRACT

What is provided is a method and apparatus wherein a swivel can be detachably connected to an annular blowout preventer thereby separating the drilling fluid or mud into upper and lower sections and allowing the fluid to be displaced in two stages, such as while the drill string is being rotated and/or reciprocated. In one embodiment the sleeve or housing can be rotatably and sealably connected to a mandrel. The swivel can be incorporated into a drill or well string and enabling string sections both above and below the sleeve to be rotated in relation to the sleeve. In one embodiment the drill or well string does not move in a longitudinal direction relative to the swivel. In one embodiment, the drill or well string does move longitudinally relative to the sleeve or housing of the swivel.

19 Claims, 76 Drawing Sheets

Related U.S. Application Data continuation of application No. 15/407,402, filed on Jan. 17, 2017, now Pat. No. 9,995,101, which is a continuation of application No. 14/709,912, filed on May 12, 2015, now Pat. No. 9,546,531, which is a continuation of application No. 14/077,581, filed on Nov. 12, 2013, now Pat. No. 9,027,649, which is a continuation of application No. 13/086,828, filed on Apr. 14, 2011, now Pat. No. 8,579,033, which is a continuation-in-part of application No. 12/942,411, filed on Nov. 9, 2010, now Pat. No. 8,118,102, and a continuation of application No. 11/745,899, filed on May 8, 2007, now Pat. No. 7,828,064.

(60) Provisional application No. 61/324,536, filed on Apr. 15, 2010, provisional application No. 60/890,068, filed on Feb. 15, 2007, provisional application No. 60/798,515, filed on May 8, 2006.

(51) Int. Cl.

| | |
|---|---|
| ***E21B 33/06*** | (2006.01) |
| ***E21B 17/01*** | (2006.01) |
| ***E21B 17/05*** | (2006.01) |
| ***E21B 21/00*** | (2006.01) |
| ***E21B 17/10*** | (2006.01) |

(52) U.S. Cl.

CPC ..... *E21B 17/1007* (2013.01); *E21B 21/00* (2013.01); *E21B 21/001* (2013.01); *E21B 33/06* (2013.01); *E21B 33/076* (2013.01)

(56) References Cited

U.S. PATENT DOCUMENTS

| | | | | |
|---|---|---|---|---|
| 2007/0256864 | A1* | 11/2007 | Robichaux ..... | E21B 17/1007 175/57 |
| 2012/0043089 | A1* | 2/2012 | Hoffman ..... | E21B 33/076 166/340 |
| 2013/0264065 | A1* | 10/2013 | Robichaux ..... | E21B 33/038 166/358 |
| 2013/0283919 | A1* | 10/2013 | Coonrod ..... | E21B 47/095 73/632 |
| 2014/0090854 | A1* | 4/2014 | Robichaux ..... | E21B 21/001 166/351 |
| 2019/0218879 | A1* | 7/2019 | Biester ..... | F03G 1/00 |

* cited by examiner

ROTATING AND RECIPROCATING SWIVEL APPARATUS AND METHOD

CROSS-REFERENCE TO RELATED APPLICATIONS

This is a continuation of U.S. patent application Ser. No. 16/004,604, filed Jun. 11, 2018 (U.S. Pat. No. 10,570,691 on Feb. 25, 2020), which is a continuation of U.S. patent application Ser. No. 15/407,402, filed Jan. 17, 2017 (U.S. Pat. No. 9,995,101 on Jun. 12, 2018), which is a continuation of U.S. patent application Ser. No. 14/709,912, filed May 12, 2015 (U.S. Pat. No. 9,546,531 on Jan. 17, 2017), which is a continuation of U.S. patent application Ser. No. 14/077,581, filed Nov. 12, 2013 (U.S. Pat. No. 9,027,649 on May 12, 2015), which is a continuation of U.S. patent application Ser. No. 13/086,828, filed Apr. 14, 2011 (U.S. Pat. No. 8,579,033 on Nov. 12, 2013), which was a non-provisional of U.S. Provisional Patent Application Ser. No. 61/324,536, filed Apr. 15, 2010, and is a continuation-in-part of U.S. patent application Ser. No. 12/942,411, filed Nov. 9, 2010 (U.S. Pat. No. 8,118,102 on Feb. 21, 2012), which application was continuation of U.S. patent application Ser. No. 11/745,899, filed May 8, 2007 (U.S. Pat. No. 7,828,064 on Nov. 9, 2010), which application is a non-provisional of both U.S. provisional patent application Ser. No. 60/890,068, filed on Feb. 15, 2007 and Ser. No. 60/798,515, filed on May 8, 2006.

U.S. Provisional Patent Application Ser. No. 60/954,234, filed 6 Aug. 2007, is incorporated herein by reference.

Patent Cooperation Treaty Patent Application serial number PCT/US2008/072335, with international filing date of Aug. 6, 2008 (WIPO publication number WO2009/021037), is incorporated herein by reference.

U.S. Provisional Patent Application Ser. No. 61/324,536, filed Apr. 15, 2010, is incorporated herein by reference.

U.S. patent application Ser. No. 13/086,828, filed Apr. 14, 2011, is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND

In deepwater drilling rigs, marine risers extending from a wellhead fixed on the ocean floor have been used to circulate drilling fluid or mud back to a structure or rig. The riser must be large enough in internal diameter to accommodate a drill string or well string that includes the largest bit and drill pipe that will be used in drilling a borehole. During the drilling process drilling fluid or mud fills the riser and wellbore.

After drilling operations, when preparing the wellbore and riser for production, it is desirable to remove the drilling fluid or drilling mud. Removal of drilling fluid or drilling mud is typically done through a displacement using a completion fluid.

Because of its relatively high cost, this drilling fluid or drilling mud is typically recovered for use in another drilling operation. Displacing the drilling fluid or drilling mud in multiple sections is desirable because the amount of drilling fluid or mud to be removed during completion is typically greater than the storage space available at the drilling rig for either completion fluid and/or drilling fluid or drilling mud.

It is contemplated that the term drill string or well string as used herein includes a completion string and/or displacement string. It is believed that rotating the drill string or well string (e.g., completion string) during the displacement process helps to better remove the drilling fluid or mud along with down hole contaminants such as mud, debris, and/or other items. It is believed that reciprocating the drill or well string during the displacement process also helps to loosen and/or remove unwanted downhole items by creating a plunging effect. Reciprocation can also allow scrapers, brushes, and/or well patrollers to better clean desired portions of the walls of the well bore and casing, such as where perforations will be made for later production.

During displacement there is a need to allow the drilling fluid or mud to be displaced in two or more sections. During displacement there is a need to prevent intermixing of the drilling fluid or mud with displacement fluid. During displacement there is a need to allow the drill or well string to rotate while the drilling fluid or mud is separated into two or more sections.

During displacement there is a need to allow the drill string or well string to reciprocate longitudinally while the drilling fluid or mud is separated into two or more sections.

BRIEF SUMMARY

The method and apparatus of the present invention solves the problems confronted in the art in a simple and straightforward manner.

One embodiment relates to a method and apparatus for deepwater rigs. In particular, one embodiment relates to a method and apparatus for removing or displacing working fluids in a well bore and riser.

In one embodiment displacement is contemplated in water depths in excess of about 5,000 feet (1,524 meters).

One embodiment provides a method and apparatus having a swivel which can operably and/or detachably connect to an annular blowout preventer thereby separating the drilling fluid or mud into upper and lower sections and allowing the drilling fluid or mud to be displaced in two stages or operations under a well control condition.

In one embodiment a swivel can be used having a sleeve or housing that is rotatably and sealably connected to a mandrel. The swivel can be incorporated into a drill or well string.

In one embodiment the sleeve or housing can be fluidly sealed to and/or from the mandrel.

In one embodiment the sleeve or housing can be fluidly sealed with respect to the outside environment.

In one embodiment the sealing system between the sleeve or housing and the mandrel is designed to resist fluid infiltration from the exterior of the sleeve or housing to the interior space between the sleeve or housing and the mandrel.

In one embodiment the sealing system between the sleeve or housing and the mandrel has a higher pressure rating for pressures tending to push fluid from the exterior of the sleeve or housing to the interior space between the sleeve or housing and the mandrel than pressures tending to push fluid from the interior space between the sleeve or housing and the mandrel to the exterior of the sleeve or housing.

In one embodiment a swivel having a sleeve or housing and mandrel is used having at least one flange, catch, or upset to restrict longitudinal movement of the sleeve or housing relative to the annular blow out preventer. In one embodiment a plurality of flanges, catches, or upsets are used. In one embodiment the plurality of flanges, catches, or upsets are longitudinally spaced apart with respect to the sleeve or housing.

One embodiment allows separation of the drilling fluid or mud into upper and lower sections.

One embodiment restricts intermixing between the drilling fluid or mud and the displacement fluid during the displacement process.

One embodiment allows the riser and well bore to be separated into two volumetric sections where the rigs can carry a sufficient amount of displacement fluid to remove each section without stopping during the displacement process. In one embodiment, fluid removal of the two volumetric sections in stages can be accomplished, but there is a break of an indefinite period of time between stages (although this break may be of short duration).

In one embodiment displacement is performed in the upper portion before displacement in the lower portion second.

In one embodiment displacement is performed in the lower portion before the displacement in the upper portion.

In one embodiment a displacement fluid is used in at least one of the sections before a completion fluid is used.

In one embodiment, at least partly during the time the riser and well bore are separated into two volumetric sections, the drill or well string does not move in a longitudinal direction relative to the swivel during displacement of fluid.

In one embodiment, at least partly during the time the riser and well bore are separated into two volumetric sections, the drill or well string is reciprocated longitudinally during displacement of fluid. In one embodiment a reciprocation stroke of about 65.5 feet (20 meters) is contemplated. In one embodiment about 20.5 feet (6.25 meters) of the stroke is contemplated for allowing access to the bottom of the well bore. In one embodiment about 35, about 40, about 45, and/or about 50 feet (about 10.67, about 12.19, about 13.72, and/or about 15.24 meters) of the stroke is contemplated for allowing at least one pipe joint-length of stroke during reciprocation. In one embodiment reciprocation is performed up to a speed of about 20 feet per minute (6.1 meters per minute).

In one embodiment, at least partly during the time the riser and well bore are separated into two volumetric sections, the drill or well string is intermittently reciprocated longitudinally during displacement of fluid. In one embodiment the rotational speed is reduced during the time periods that reciprocation is not being performed. In one embodiment the rotational speed is reduced from about 60 revolutions per minute to about 30 revolutions per minute when reciprocation is not being performed.

In one embodiment, at least partly during the time the riser and well bore are separated into two volumetric sections, the drill or well string is continuously reciprocated longitudinally during displacement of fluid.

In one embodiment, at least partly during the time the riser and well bore are separated into two volumetric sections, the drill or well string is reciprocated longitudinally the distance of at least the length of one joint of pipe during displacement of fluid.

In one embodiment, at least partly during the time the riser and well bore are separated into two volumetric sections, the drill or well string is rotated during displacement of fluid. In one embodiment rotation of speeds up to 60 revolutions per minute are contemplated. In one embodiment, at least partly during the time the riser and well bore are separated into two volumetric sections, the drill or well string is intermittently rotated during displacement of fluid.

In one embodiment, at least partly during the time the riser and well bore are separated into two volumetric sections, the drill or well string is continuously rotated during displacement of fluid of at least one of the volumetric sections.

In one embodiment, at least partly during the time the riser and well bore are separated into two volumetric sections, the drill or well string is alternately rotated during displacement of fluid during.

In one embodiment, at least partly during the time the riser and well bore are separated into two volumetric sections, the direction of rotation of the drill or well string is changed during displacement of fluid.

In various embodiments, at least partly during the time the riser and well bore are separated into two volumetric sections, the drill or well string is reciprocated longitudinally the distance of at least about 1 inch (2.54 centimeters), about 2 inches (5.08 centimeters), about 3 inches (7.62 centimeters), about 4 inches (10.16 centimeters), about 5 inches (12.7 centimeters), about 6 inches (15.24 centimeters), about 1 foot (30.48 centimeters), about 2 feet (60.96 centimeters), about 3 feet (91.44 centimeters), about 4 feet (1.22 meters), about 6 feet (1.83 meters), about 10 feet (3.048 meters), about 15 feet (4.57 meters), about 20 feet (6.096 meters), about 25 feet (7.62 meters), about 30 feet (9.14 meters), about 35 feet (10.67 meters), about 40 feet (12.19 meters), about 45 feet (13.72 meters), about 50 feet (15.24 meters), about 55 feet (16.76 meters), about 60 feet (18.29 meters), about 65 feet (19.81 meters), about 70 feet (21.34 meters), about 75 feet (22.86 meters), about 80 feet (24.38 meters), about 85 feet (25.91 meters), about 90 feet (27.43 meters), about 95 feet (28.96 meters), and about 100 feet (30.48 meters) during displacement of fluid and/or between the ranges of each and/or any of the above specified lengths.

In various embodiments, the height of the swivel's sleeve or housing compared to the length of its mandrel is between two and thirty times. Alternatively, between two and twenty times, between two and fifteen times, two and ten times, two and eight times, two and six times, two and five times, two and four times, two and three times, and two and two and one half times. Also alternatively, between 1.5 and thirty times, 1.5 and twenty times, 1.5 and fifteen times, 1.5 and ten times, 1.5 and eight times, 1.5 and six times, 1.5 and five times, 1.5 and four times, 1.5 and three times, 1.5 and two times, 1.5 and two and one half times, and 1.5 and two times.

In one embodiment one or more brushes and/or scrapers are used in the method and apparatus.

In one embodiment a mule shoe is used in the method and apparatus.

In one embodiment the mule shoe is spaced relative to the sleeve such that it is about 53 feet (16.15 meters) above the true depth of the well bore. In one embodiment the quick lock/quick unlock system is moved to an unlocked state using about 35,000 or 40,000 pounds (156 or 178 kilo newtons) of longitudinal thrust load between the mandrel and the sleeve.

In one embodiment a single action bypass sub is used in the method and apparatus.

In one embodiment a single action bypass sub jetting tool is used in the method and apparatus.

In one embodiment most of the upper volumetric section is first displaced with sea water.

In one embodiment the upper volumetric section (e.g., riser) is displaced with a first fluid (such as brine or seawater). The annular blow out preventer can be open during this step. Next, drilling fluid or mud is circulated in the lower volumetric section (e.g., well bore) at the same time rotation and/or reciprocation of the drill or well string is performed (at least intermittently) until the circulated drilling fluid or mud meets specified criteria. The annular seal of the blowout preventer is closed on the sleeve or housing of the swivel during this step. Next, the drilling fluid or mud in the lower stage is displaced with a second fluid (e.g., a completion fluid such as calcium bromide) and the second fluid is circulated until it meets specified criteria. The annular seal of the annular blowout preventer is still closed during this step. Finally, the first fluid in the upper volumetric section is displaced with the second fluid by pumping the second fluid both through the bottom of the drill or well string, and through the booster line, and then the second fluid is circulated until the second fluid exiting the riser meets specified criteria. The annular seal is opened during this step. Increased flow rates in the upper volumetric section can be achieved by simultaneously pumping fluid down the drill or work string along with pumping through the booster line. In various of the above stages cleaning pills of certain fluids can be pumped in before the second fluid is used to displace. The upper and lower volumetric sections can be completed using the above steps.

In one embodiment performing displacement in two or more stages while the annular blowout preventer is closed on a swivel having rotation and/or reciprocation allows for better management of the large amounts of fluids involved in the displacement process. Additionally, such process allows for the entire completion string to be rotated and/or reciprocated while the annular blowout preventer is sealed on the sleeve or housing of the swivel thereby providing a well control condition during displacement while allowing rotation and/or reciprocation. Without inserting the rotating and/or reciprocating swivel, sealing the annular blowout preventer on the completion string would effectively prevent rotation and/or reciprocation of the completion string during displacement (because rotation and/or reciprocation of the string while the annular BOP is sealed would prematurely damage the sealing element of the annular BOP). With the rotating and/or reciprocating swivel there is well control with rotation and/or reciprocation during the displacement process.

In one embodiment high capacity thrust bearings (external and/or internal to the housing or sleeve) can be incorporated to address the possibility that an operator will cause the sleeve or housing of the swivel to reach the end of its stroke and contact a stop on the end of the mandrel. In this situation the thrust bearing transmits the thrust load from the sleeve or housing through the thrust bearing and to the mandrel. Additionally, the thrust bearing can allow the sleeve to rotate relative to the stop which it contacted so that rotation can be achieve even at the longitudinal limits of reciprocation.

In one embodiment is provided a rotating and reciprocating tool which allows the completion process to be separated into two stages or divided into two separate processes with each process having its own distinctive starting and stopping point. Normally, completion would be performed as a single stage process.

After drilling is complete, drilling mud and debris are removed from the well bore and subsea riser and replaced with a clean, weighted completion fluid. The area in and around the well production zone is of great importance. During the completion (cleaning and weighting) process dirty drilling mud can be pushed out of the well using a series of chemical pills (each pill comprising several barrels of a particular chemical composition) followed by the inert weighted completion fluid.

Considering the high costs for hourly rig operations and costs for chemicals and fluids used during the completion process, shortening this completion time and reducing the volumes of fluids and chemicals used are desirable.

Typically, a well bore will have connected thereto a subsea riser which extends from the sea floor to the rig. In a single stage completion process (e.g., one not using the rotating and reciprocating tool) chemical pills, followed by clean, weighted completion fluid, can be pumped at a maximum speed down to the bottom of the well bore through the bore of completion string. After exiting the bore of the completion string this pumped fluid turns direction and flows up the well bore (through the well bore annulus) and continues up the subsea riser to the rig. One concern with single stage completions is the risk that, at any time in the single stage completion process, the flow will be substantially slowed or stopped causing different weights mud, chemical pills, and final weighted completion fluid to intermix. Such intermixing will cause the overall completion process to fail requiring the completion process to be started over or accepted with a less than perfect completion. Both options are disadvantageous and can increase the overtime production rate of the well.

The rotating and reciprocating tool can be closed on by the annular blowout preventer ("annular BOP"). Typically, the annular BOP is located immediately above the ram BOP which ram BOP is located immediately above the sea floor and mounted ON THE well head. As an integral part of the string, the mandrel of the rotating and reciprocating tool supports the full weight, torque, and pressures of the entire string located below the mandrel.

The rotating and reciprocating tool allows the completion process to be separated into two volumetric stages: (a) the volume below the annular BOP and (b) the volume above the annular BOP. Separation is advantageous because it allows the smaller (but more difficult) volume of fluid to be completed separately from the completion of the larger (but easier) volume fluid. The fluid to be displaced and completed above the annular BOP is in a relatively large diameter and volume riser (compared to the volume of the well bore), but such riser fluid is typically easier to bring up to completion standards because, among other reasons, the walls of the riser are typically cleaner (and easier to clean) compared to the walls of the wellbore. The fluid to be displaced and completed below the annular BOP is in a relatively smaller volume (compared to the riser), but is typically more difficult to bring up to completion standards because, among other reasons, the walls of the well bore are not as clean as the walls of the riser. By separating these two volumetric sections, the smaller, more difficult volume to complete (for the wellbore) can be completed without combining or intermixing such volume with the larger more easily completed volume (for the riser).

In one example of two stage displacement job, the riser can have a volume capacity of approximately 2000 barrels of fluid where the well bore had a volume capacity of approximately 1000 barrels. It can be more efficient and simpler to prepare for a six hour displacement of the 1000 barrels of fluids in the well bore with the fluids returning to the rig floor in a path other than through the riser (i.e., through the choke line). This can be performed while the riser fluid is separated from the well bore fluid by the closed and sealed annular BOP. By comparison, a single stage displacement of the same well and riser would take approximately 18 hours to displace the 3000 barrels of fluid volumes (the volumes in both the riser and wellbore) all of which are in direct contact with each other and can intermix. In the first stage, where the well bore is being completed/cleaned, the fluid below the annular BOP is displaced with completion fluid until a predetermined standard for the fluid is achieved. During this first stage both riser and wellbore volumes are secured from intermixing with each other (completing only ⅓ of the total fluid volume—compared to the total volumes of both wellbore and riser—and ⅓ of the total time required in a single stage completion process). In the second stage, where the riser fluid is being completed/cleaned, the fluid above the annular BOP is separated and secured from intermixing with the now completed well bore fluid. For the riser fluid cleaning pills and completion fluids are pumped from the rig floor, down the boost line to the bottom of the subsea riser just above the annular BOP. These fluids then flow up the riser until a predetermined standard for completion of the riser fluid is obtained. After the riser fluid has achieved the predetermined completion standard, the annular BOP can be opened allowing the riser and wellbore volumes to contact each other. At this point additional completion fluid can be pumped down the center of the completion string's bore to the bottom of the well where it turns and flows up the already completed/cleaned wellbore. Because the annular BOP is opened, this completed/cleaned wellbore fluid now flows through the open annular BOP and around the rotating and reciprocating tool and combines with additional completion fluid which can be pumped into the riser through the boost line, thereby increasing fluid velocity through the riser which can have a substantially larger diameter than the wellbore.

After completion of the first stage of a two stage completion process the wellbore is now clean, completed, and secure. The rig personnel can take a break, manage, and prepare for performing the second stage of the two stage completion (the displacement/completion of the subsea riser). This preparation may require the transfer of fluids to waiting boats, cleaning of tanks, lines, and other equipment. When the preparation for the second stage is finished, 2000 barrels of riser fluid can be displaced, taking 12 hours. The first stage well bore completion (under the annular BOP) remains secure because the annular BOP does not open until sufficient completion fluid is in the riser which will allow sufficient time to close the annular BOP if a problem occurred.

Having the annular BOP closed on the housing of the rotating and reciprocating tool during the first and/or second stages, allows the completion string to be rotated and reciprocated (while the annular BOP separates riser and wellbore volumes) along with having mud, pills, and/or completion fluid pumped through the string's center bore to the wellbore, up the well bore, and up the choke or kill lines to the rig. During the completion process movement, rotation, reciprocation or a combination of these helps keep unwanted material from setting in and hampering completion. Preferably, rotation speeds are high to get maximum effect. However, it is not recommended that rotation speeds exceed 60 revolutions per minute, as these can cause a whip effect in the completion string and also cause problems for brush and wipers installed along the completion string.

Completion engineers believe it is important to have access to as close as possible to the bottom of the wellbore to properly address this bottom area. In a preferred embodiment the rotating and reciprocating tool provides 63 feet (19.2 meters) of reciprocating stroke. This 63 foot (19.2 meter) stroke provides a nominal working stroke of 45 foot (13.72 meters) (preferably equal to the length of a single joint of pipe) with an 18 foot (5.49 meter) extra stroke capacity. The extra stroke capacity provides a factor of safety for dealing with errors in determining the Total Depth to the bottom of the wellbore. For example, if the true Total Depth is actually 10 feet (3 meters) deeper than the calculated Total Depth, the rotating and reciprocating tool has enough excess stroke capacity to absorb the 10 foot (3 meter) error in depth allowing the bottom of the completion string to reach the true bottom of the wellbore (i.e., true Total Depth) so that this bottom area can be properly addressed. If the extra stroke capacity had not been in place and there was an error in calculating Total Depth (e.g., 10 feet or 3 meters), the bottom of the string would not reach the bottom of the wellbore (missing by the 10 foot or 3 meter error) and effectively prevent the unreached part of the wellbore from being properly completed. Alternatively, the entire completion string could be tripped out of the hole, an extra length of string added to the string, and having to trip back in the entire completion string—assuming the necessary additional amount of string can actually be determined—and causing a large amount of wasted time).

If the true Total Depth was actually shorter than calculated the error would effectively limit the amount of stroke of the mandrel and string relative to the sleeve would be shorted by the bottom of the completion string being stopped by the bottom of the wellbore. This shortened stroke would prevent a portion of each full joint of casing from seeing a stroke. Particularly in deviated wells where at least part of the string is in contact with the sidewall of the wellbore, reciprocation of a full joint length of pipe allows the pipe joint connection upsets that are in contact with the sides of the casing to scrape (and at least partially clean) the side of the casing for at least the length of contact (and possibly for the entire length of reciprocation) which assists in completing the wellbore such as by helping eliminate areas where unwanted material might tend to accumulate and/or settle.

In one embodiment, a sheer pin can be used to lock the sleeve relative to the mandrel. Although, a sheer pin can be used to lock the sleeve relative to the mandrel, it has the disadvantage that it can be used only once. While the sheer pin can hold the sleeve in a fixed longitudinal position relative to the mandrel, in order to allow the mandrel to reciprocate relative to the sleeve, the sheer pin must be sheered (such as by pushing and/or pulling on the mandrel at a time when the annular BOP is closed on the sleeve, the closed annular BOP exerting a longitudinal shearing force, such as on one of the catches, until the longitudinal force is sufficient sheer the pin). Once sheered, the pin can no longer be used to lock the sleeve and mandrel relative to each other. If the annular BOP is opened and the mandrel moved up and/or down, the position of the unlocked sleeve relative to the mandrel can change (as described below) and subsequently become uncertain so that the sleeve's position thereafter cannot be practically determined.

Although one methodology for locating the sleeve relative to the mandrel without a quick lock/quick unlock system can be to position the sleeve at either the upper most (or lower most) point of reciprocation between the sleeve and mandrel; and assume that the sleeve will remain in such position when the completion engineer attempts again close the annular BOP on the sleeve. There is a certain amount of friction (between the sleeve and the mandrel) which will tend to keep the sleeve and mandrel in one longitudinal position relative to each other. Additionally, if the sleeve is located at the lowermost point of reciprocation, gravity acting on the sleeve will also tend to keep the sleeve at this lowermost point for positioning the sleeve. However, this procedure has the risk that something with occur which causes the sleeve to be moved relative to the mandrel. For example, the sleeve may be knocked against and/or catch on something downhole (e.g., a discontinuity in the wall) causing the sleeve to move longitudinally relative to the mandrel. Once moved, the position of the sleeve relative to the mandrel will no longer be known, and attempts to determine such position face many difficulties. If the sleeve is moved relative to the mandrel while the sleeve is outside of the annular BOP, the entire completion string may have to be pulled (or tripped out) so that the sleeve can be again positioned relative to the mandrel, causing much wasted time and effort. Alternatively, iterative attempts to close the annular BOP on the sleeve may be made, such as by positioning the mandrel and closing the annular BOP (hoping that the annular BOP closes on the sealing area of the sleeve). If the annular BOP is not successfully closed in the sleeve during the first attempt, then the mandrel can be positioned at a different point and another attempt made to close the annular BOP on the sleeve. However, this iterative process is extremely time consuming which extra time can cause problems with the completion process (such as by letting fluids interact with each other and/or separate). Furthermore, even if by luck the annular BOP actually closes on the sealing area of the sleeve, this may not be known by the operator or completion engineer—as the operator or completion engineer may not be able to tell from the rig that proper closure of the annular BOP on the sleeve has occurred (or at least whether proper closed has been obtained may be uncertain). Additionally, the annular BOP may attempt to seal on the non-sealing area of the sleeve, or mandrel which could harm the annular BOP and/or sleeve, and/or cause the sleeve to again move longitudinally (which new longitudinal movement may resist new attempts to close on the sleeve.

Catches

The annular BOP is designed to fluidly seal on a large range of different sized items—e.g., from 0 inches to 18¾ inches (0 to 47.6 centimeters) (or more). However, when an annular BOP fluid seals on the sleeve of the rotating and reciprocating tool, fluid pressures on the sleeve's exposed effective cross sectional area exert longitudinal forces on the sleeve. These longitudinal forces are the product of the fluid pressure on the sleeve and the sleeve's effective cross sectional area. Where different pressures exist above and below the annular BOP (which can occur in completions having multiple stages), a net longitudinal force will act on the sleeve tending to push it in the direction of the lower fluid pressure. If the differential pressure is large, this net longitudinal force can overcome the frictional force applied by the closed annular BOP on the sleeve and the fractional forces between the sleeve and the mandrel. If these frictional forces are overcome, the sleeve will tend to slide in the direction of the lower pressure and can be "pushed" out of the closed annular BOP. In one embodiment catches are provided which catch onto the annular BOP to prevent the sleeve from being pushed out of the closed annular BOP.

For example, lighter sea water above the annular BOP seal and heavier drilling mud, or weighted pills, and/or weighted completion fluid, or a combination of all of these can be below the annular BOP requiring an increased pressure to push such fluids from below the annular BOP up through the choke line and into the rig (at the selected flow rate). This pressure differential (in many cases causing a net upward force) acts on the effective cross sectional area of the tool defined by the outer diameter of the string (or mandrel) and the outer diameter of the sleeve. For example, the outer sealing diameter of the tool sleeve can be 9¾ inches (24.77 centimeters) and the outer diameter of the tool mandrel can be 7 inches (17.78 centimeters) providing an annular cross sectional area of 9¾ inches (24.77 centimeters) OD and 7 inches ID (17.78 centimeters). Any differential pressure will act on this annular area producing a net force in the direction of the pressure gradient equal to the pressure differential times the effective cross sectional area. This net force produces an upward force which can overcome the frictional force applied by the annular BOP closed on the tool's sleeve causing the sleeve to be pushed in the direction of the net force (or slide through the sealing element of the annular BOP). To resist sliding through the annular BOP, catches can be placed on the sleeve which prevent the sleeve from being pushed through the annular BOP seal.

In an of the various embodiments the following differential pressures (e.g., difference between the pressures above and below the annular BOP seal) can be axially placed upon the sleeve or housing against which the catches can be used to prevent the sleeve from being axially pushed out of the annular BOP (even when the annular BOP seal has been closed)—in pounds per square inch: 500, 750, 1000, 1250, 1500, 1750, 2000, 2250, 2500, 2750, 3000, 3250, 3,500, 3750, 4,000, 4,250, 4,500, 4,750, 5,000, or greater (3,450, 5,170, 6,900, 8,620, 10,340, 12,070, 13,790, 15,510, 17,240, 18,960, 20,690, 22,410, 24,130, 25,860, 27,700, 29,550, 31,400, 33,240, 35,090, 36,940 kilopascals). Additionally, ranges between any two of the above specified pressures are contemplated. Additionally, ranges above any one of the above specified pressures are contemplated. Additionally, ranges below any one of the above specified pressures are contemplated. This differential pressures can be higher below the annular BOP seal or above the annular BOP seal.

Interchangeable Fittings for the Catches

The annular seals and/or physical structure of different types/brands of annular BOPs can be substantially different requiring the use of different catches. To facilitate the use of the rotating and reciprocating tool in different types/brands of annular BOPs, the sleeve can be comprised of a generic or base sleeve with attachable (and/or detachably connectable) specialized annular BOP fittings. In one embodiment, a generic or base sleeve with a generic base catch is provided. However, in one embodiment a plurality of specialized adaptors or catch attachments may be detachably connectable to the generic or base sleeve allowing the conversion of the generic or base sleeve to a specialized sleeve with one or more catches for a particular type/brand of annular BOP. This embodiment avoids the need to manufacture multiple specialized sleeves for a plurality of types/brands of annular BOPs. In one embodiment the specialized adapters can be flange adapters that are designed to fit the closed annular seal and not damage the seal when the sleeve is pushed or pulled against the annular sleeve.

Radial Bearings

In one embodiment the rotating and reciprocating tool can include large radial bearing capacity, the radial bearings working in an oil bath. The large capacity bearings can address the wiping loads that will exist when the completion string is run at high speeds.

Thrust Bearings

In one embodiment the rotating and reciprocating tool can include a thrust bearing on its pin end to allow free relative rotation between the mandrel and sleeve even where the completion string with mandrel is pulled up to (and possibly beyond) the upper stroke extent of the rotating and reciprocating tool. The closed annular BOP holds the sleeve rotationally fixed notwithstanding the mandrel being rotated and/or reciprocated and the bottom catch would limit upward movement of the sleeve within the annular BOP. If, for whatever reason, the operator, attempts to pull up the completion string/mandrel to the upper limit of the stroke between the sleeve and mandrel, the sleeve will be pulled up the annular BOP until its lower catch interacts with the annular BOP to prevent further upward movement of the sleeve. At this point a longitudinal thrust load between the sleeve and the mandrel will be created. The thrust bearing will absorb this thrust load while facilitating relative rotation between the sleeve and the mandrel (so that the sleeve can remain rotationally fixed relative to the annular BOP). Without the thrust bearing, frictional and/or other forces between the sleeve and the mandrel caused by the thrust load can cause the sleeve to start rotating along with the mandrel, and then relative to the annular BOP. Relative rotation between the sleeve and annular BOP is not desired as it can cause wear/damage to the annular BOP and/or the annular seal. In one embodiment this thrust bearing is an integral part of a clutch/latch/bearing assembly.

In one embodiment the rotating and reciprocating tool can include a thrust bearing on its box end to allow free relative rotation between the mandrel and sleeve even where the completion string with mandrel is pushed down to (and possibly beyond) the lower stroke extent of the rotating and reciprocating tool. The closed annular BOP holds the sleeve rotationally fixed notwithstanding the mandrel being rotated and/or reciprocated and the upper catch would limit downward movement of the sleeve within the annular BOP. If, for whatever reason, the operator, attempts to push down the completion string/mandrel to the lower limit of the stroke between the sleeve and mandrel, the sleeve will be pushed down the annular BOP until its upper catch interacts with the annular BOP to prevent further downward movement of the sleeve. At this point a longitudinal thrust load between the sleeve and the mandrel will be created. The thrust bearing will absorb this thrust load while facilitating relative rotation between the sleeve and the mandrel (so that the sleeve can remain rotationally fixed relative to the annular BOP). Without the thrust bearing, frictional and/or other forces between the sleeve and mandrel caused by the thrust load can cause the sleeve to start rotating along with the mandrel, and then relative to the annular BOP. Relative rotation between the sleeve and annular BOP is not desired as it can cause wear/damage to the annular BOP and/or the annular seal. In one embodiment, this thrust bearing is an outer thrust bearing.

Quick Lock/Quick Unlock

After the sleeve and mandrel have been moved relative to each other in a longitudinal direction, a downhole/underwater locking/unlocking system is needed to lock the sleeve in a longitudinal position relative to the mandrel (or at least restricting the available relative longitudinal movement of the sleeve and mandrel to a satisfactory amount compared to the longitudinal length of the sleeve's effective sealing area). Additionally, an underwater locking/unlocking system is needed which can lock and/or unlock the sleeve and mandrel a plurality of times while the sleeve and mandrel are underwater.

In one embodiment is provided a system wherein the underwater position of the longitudinal length of the sleeve's sealing area (e.g., the nominal length between the catches) can be determined with enough accuracy to allow positioning of the sleeve's effective sealing area in the annular BOP for closing on the sleeve's sealing area. After the sleeve and mandrel have been longitudinally moved relative to each other when the annular BOP was closed on the sleeve, it is preferred that a system be provided wherein the underwater position of the sleeve can be determined even where the sleeve has been moved outside of the annular BOP.

In one embodiment is provided a quick lock/quick unlock system for locating the relative position between the sleeve and mandrel. Because the sleeve can reciprocate relative to the mandrel (i.e., the sleeve and mandrel can move relative to each other in a longitudinal direction), it can be important to be able to determine the relative longitudinal position of the sleeve compared to the mandrel at some point after the sleeve has been reciprocated relative to the mandrel. For example, in various uses of the rotating and reciprocating tool, the operator may wish to seal the annular BOP on the sleeve sometime after the sleeve has been reciprocated relative to the mandrel and after the sleeve has been removed from the annular BOP.

To address the risk that the actual position of the sleeve relative to the mandrel will be lost while the tool is underwater, a quick lock/quick unlock system can detachably connect the sleeve and mandrel. In a locked state, this quick lock/quick unlock system can reduce the amount of relative longitudinal movement between the sleeve and the mandrel (compared to an unlocked state) so that the sleeve can be positioned in the annular BOP and the annular BOP relatively easily closed on the sleeve's longitudinal sealing area. Alternatively, this quick lock/quick unlock system can lock in place the sleeve relative to the mandrel (and not allow a limited amount of relative longitudinal movement). After being changed from a locked state to an unlocked state, the sleeve can experience its unlocked amount of relative longitudinal movement.

In one embodiment is provided a quick lock/quick unlock system which allows the sleeve to be longitudinally locked and/or unlocked relative to the mandrel a plurality of times when underwater. In one embodiment the quick lock/quick unlock system can be activated using the annular BOP.

In one embodiment the sleeve and mandrel can rotate relative to one another even in both the activated and un-activated states. In one embodiment, when in a locked state, the sleeve and mandrel can rotate relative to each other. This option can be important where the annular BOP is closed on the sleeve at a time when the string (of which the mandrel is a part) is being rotated. Allowing the sleeve and mandrel to rotate relative to each other, even when in a locked state, minimizes wear/damage to the annular BOP caused by a rotationally locked sleeve (e.g., sheer pin) rotating relative to a closed annular BOP. Instead, the sleeve can be held fixed rotationally by the closed annular BOP, and the mandrel (along with the string) rotate relative to the sleeve.

In one embodiment, when the locking system of the sleeve is in contact with the mandrel, locking/unlocking is performed without relative rotational movement between the locking system of the sleeve and the mandrel—otherwise scoring/scratching of the mandrel at the location of lock can occur. In one embodiment, this can be accomplished by rotationally connecting to the sleeve the sleeve's portion of quick lock/quick unlock system. In one embodiment a locking hub is provided which is rotationally connected to the sleeve.

In one embodiment a quick lock/quick unlock system on the rotating and reciprocating tool can be provided allowing the operator to lock the sleeve relative to the mandrel when the rotating and reciprocating tool is downhole/underwater. Because of the relatively large amount of possible stroke of the sleeve relative to the mandrel (i.e., different possible relative longitudinal positions), knowing the relative position of the sleeve with respect to the mandrel can be important. This is especially true at the time the annular BOP is closed on the sleeve. The locking position is important for determining relative longitudinal position of the sleeve along the mandrel (and therefore the true underwater depth of the sleeve) so that the sleeve can be easily located in the annular BOP and the annular BOP closed/sealed on the sleeve.

During the process of moving the rotating and reciprocating tool underwater and downhole, the sleeve can be locked relative to the mandrel by a quick lock/quick unlock system. In one embodiment the quick lock/quick unlock system can, relative to the mandrel, lock the sleeve in a longitudinal direction. In one embodiment the sleeve can be locked in a longitudinal direction with the quick lock/quick unlock system, but the sleeve can rotate relative to the mandrel during the time it is locked in a longitudinal direction. In one embodiment the quick lock/quick unlock system can simultaneously lock the sleeve relative to the mandrel, in both a longitudinal direction and rotationally. In one embodiment the quick lock/quick unlock system can relative to the mandrel, lock the sleeve rotationally, but at the same time allow the sleeve to move longitudinally.

Activation by Relative Longitudinal Movement

In one embodiment the quick lock/quick unlock system can be activated (and placed in a locked state) by movement of the sleeve relative to the mandrel in a first longitudinal direction. In one embodiment the quick lock/quick unlock system is deactivated (and placed in an unlocked state) by movement of the sleeve relative to the mandrel in a second longitudinal direction, the second longitudinal direction being substantially in the opposite longitudinal direction compared to the first longitudinal direction.

In one embodiment the first longitudinal direction is toward one of the longitudinal ends of the mandrel. In one embodiment the second longitudinal direction is toward the longitudinal center of the mandrel.

In one embodiment the quick lock/quick unlock system can be changed from an activated to a deactivated state when the sleeve is at least partially located in the annular BOP. In one embodiment the quick lock/quick unlock system can be changed from a deactivated state to an activated state when the sleeve is at least partially located in the annular BOP.

In one embodiment the quick lock/quick unlock system can be changed from an activated to a deactivated state when the annular BOP is closed on the sleeve. In one embodiment the quick lock/quick unlock system can be changed from a deactivated state to an activated state when the annular BOP is closed on the sleeve.

In one embodiment the quick lock/quick unlock system can be changed from an activated to a deactivated state when the sleeve is sealed with respect to the annular BOP. In one embodiment the quick lock/quick unlock system can be changed from a deactivated state to an activated state when the sleeve is sealed with respect to the annular BOP.

In one embodiment, at a time when the sleeve is at least partially located in the annular BOP, the quick lock/quick unlock system can be activated (and placed in a locked state) by movement of the sleeve relative to the mandrel in a first longitudinal direction to a locking location. In one embodiment, at a time when the sleeve is at least partially located in the annular BOP, the quick lock/quick unlock system is deactivated (and placed in an unlocked state) by movement of the sleeve relative to the mandrel in a second longitudinal direction away from the locking location, the second longitudinal direction being substantially in the opposite direction compared to the first longitudinal direction.

In one embodiment, direction at a time when the annular BOP is closed on the sleeve, the quick lock/quick unlock system is activated (and placed in a locked state) by movement of the sleeve relative to the mandrel in a first longitudinal. In one embodiment, at a time when the annular BOP is closed on the sleeve, the quick lock/quick unlock system is deactivated (and placed in an unlocked state) by movement of the sleeve relative to the mandrel in a second longitudinal direction, the second longitudinal direction being substantially in the opposite longitudinal direction compared to the first longitudinal direction.

In one embodiment, at a time when the sleeve is sealed with respect to the annular BOP, the quick lock/quick unlock system is activated (and placed in a locked state) by movement of the sleeve relative to the mandrel in a first longitudinal direction. In one embodiment, at a time when the sleeve is sealed with respect to the annular BOP, the quick lock/quick unlock system is deactivated (and placed in an unlocked state) by movement of the sleeve relative to the mandrel in a second longitudinal direction, the second longitudinal direction being substantially in the opposite longitudinal direction compared to the first longitudinal direction.

Activation by Moving to a Locking Position

In one embodiment, at a time when the sleeve is at least partially located in the annular BOP, the sleeve is moved to a locking position relative to the mandrel. In one embodiment, at a time when the sleeve is at least partially located in the annular BOP, a quick lock/quick unlock system is changed from a deactivated state to an activated state by moving the sleeve to specified locking position on the mandrel. In one embodiment, at a time when the sleeve is at least partially located in the annular BOP, a quick lock/quick unlock system is changed from an activated state to a deactivated activated state by moving the sleeve away from a specified position on the mandrel.

In one embodiment, at a time when the annular BOP is closed on the sleeve, the sleeve is moved to a locking position relative to the mandrel. In one embodiment, at a time when the annular BOP is closed on the sleeve, a quick lock/quick unlock system is changed from a deactivated state to an activated state by moving the sleeve to specified locking position on the mandrel. In one embodiment, at a time when the annular BOP is closed on the sleeve, a quick lock/quick unlock system is changed from an activated state to a deactivated activated state by moving the sleeve away from a specified position on the mandrel.

In one embodiment, at a time when the sleeve is sealed in the annular BOP, the sleeve is moved to a locking position relative to the mandrel. In one embodiment, at a time when the sleeve is sealed in the annular BOP, a quick lock/quick unlock system is changed from a deactivated state to an activated state by moving the sleeve to specified locking position on the mandrel. In one embodiment, at a time when the sleeve is sealed in the annular BOP, a quick lock/quick unlock system is changed from an activated state to a deactivated activated state by moving the sleeve away from a specified position on the mandrel.

Activation by Exceeding a Specified Minimum Locking Force

In one embodiment the quick lock/quick unlock system is activated when at least a first specified minimum longitudinal force is placed on the sleeve relative to the mandrel. In one embodiment the first specified minimum longitudinal force is used to determine whether the sleeve is locked relative to the mandrel. That is where the sleeve cannot absorb at least the first specified minimum longitudinal the quick lock/quick unlock system can be considered in a deactivated state. In one embodiment, the specified minimum longitudinal force is a predetermined force.

In one embodiment the quick lock/quick unlock system is deactivated when at least a second specified minimum longitudinal force is placed on the sleeve relative to the mandrel. In one embodiment the second specified minimum longitudinal force is used to determine whether the sleeve is locked relative to the mandrel. That is where the sleeve cannot absorb at least the second specified minimum longitudinal the quick lock/quick unlock system can be considered in a deactivated state. In one embodiment the first specified minimum longitudinal force is substantially equal to the second specified minimum longitudinal force. In one embodiment the first specified minimum longitudinal force is substantially greater than the second specified minimum longitudinal force. In one embodiment the first specified minimum longitudinal force takes into account the amount of longitudinal friction between the sleeve and the mandrel. In one embodiment the second specified minimum longitudinal force takes into account the amount of longitudinal friction between the sleeve and the mandrel. In one embodiment both the first specified minimum longitudinal force and the second specified minimum longitudinal force take into account the amount of longitudinal friction between the sleeve and the mandrel. In one embodiment the first specified minimum longitudinal force takes into account the longitudinal force applied to the sleeve based on differing pressures above and below the annular BOP. In one embodiment the second specified minimum longitudinal force takes into account the longitudinal force applied to the sleeve based on differing pressures above and below the annular BOP. In one embodiment both the first specified minimum longitudinal force and the second specified minimum longitudinal force take into account the longitudinal force applied to the sleeve based on differing pressures above and below the annular BOP.

Example of a Specified Minimum Locking Force

In one example of operation with deep water wells, the annular BOP can be located between 6000 to 7000 feet (1,830 to 2,130 meters) below the rig floor. The quick lock/quick unlock system can be activated by closing the annular BOP on the sleeve and pulling up with a force of approximately 35,000 or 40,000 pounds (156 or 178 kilo newtons). The quick lock/quick unlock system can be deactivated by closing the annular BOP on the sleeve and lowering the mandrel relative to the sleeve. When approximately 35,000 or 40,000 pounds (156 or 178 kilo newtons) of longitudinal force (e.g., exerted by the weight of the string not being supported by the rig) is created between the mandrel and the sleeve, the quick lock/quick unlock system can become deactivated and unlock the sleeve from the mandrel so that the mandrel can be reciprocated relative to the sleeve (where the annular BOP is closed on the sleeve). For this example, the specified minimum differential longitudinal force of 35,000 or 40,000 pounds (156 or 178 kilo newtons) can be used to overcome 5,000 or 10,000 pounds (22 or 45 kilo newtons) of longitudinal friction (such as seal friction) and 30,000 pounds (134 kilo newtons) from the quick lock/quick unlock system. This minimum longitudinal force (e.g., 35,000 or 40,000 pounds (156 or 178 kilo newtons)) can address the risk that the sleeve does not get bumped out of its locked longitudinal position when the sleeve is moved outside of the annular BOP (i.e., unlocking the quick lock/quick unlock system and causing the operator to lose the position of the sleeve relative to the mandrel). The minimum longitudinal force also ensures that the sleeve will not float up/sink down the mandrel as a result of fluid flow around the sleeve when the annular BOP is open (such as when returns are taken up the riser).

In another example the longitudinal frictional force (such as seal friction) can be reduced from 10,000 pounds to about 5,000 pounds (45 to 22 kilo newtons)(such as where fluid pressure from above the box end of the sleeve or house is allowed to migrate to the seals on the pin end of the sleeve or housing thereby reducing the net pressure on the seals of the bottom end). In this case a force of approximately 35,000 pounds (156 kilo newtons) would activate the quick lock/quick unlock system.

Various Options for Allowable Reciprocation when in a Locked State

In one embodiment is provided a quick lock/quick unlock system where the sleeve and mandrel reciprocate relative to each other a specified distance even when locked, however, the amount of relative reciprocation increases when unlocked. In one embodiment the amount of allowable relative reciprocation even in a locked state facilitates operation of a clutching system between the sleeve and mandrel. In one embodiment the amount of allowable relative reciprocation even in a locked state allows relative longitudinal and rotational movement between a locking hub and the sleeve to allow a clutching system to align the hub for interlocking with a fluted area of the mandrel. In one embodiment the amount of allowable relative reciprocation even in a locked state is between 0 and 12 inches (0 and 30.48 centimeters), between 0 and 11 inches (0 and 27.94 centimeters), 10, 9, 8, 7, 6, 5, 4, 3, 2, 1, ¾, ½, ¼, ⅛ inches (25.4, 22.86, 20.32, 17.78, 15.24, 12.7, 10.16, 7.62, 5.08, 2.54, 1.91, 1.27, 0.64, 0.32 centimeters). In one embodiment the amount of allowable relative reciprocation even in a locked state is between ⅛ inch (0.32 centimeters) and any of the specified distances up to 12 inches (30.48 centimeters). In other embodiments the amount of allowable relative reciprocation even in a locked state is between ¼ inches (0.64 centimeters) and any of the specified distances up to 12 inches (30.48 centimeters). In other embodiments the amount of allowable relative reciprocation even in a locked state is between ½, ¾, 1, etc. and any of the specified distances. In other embodiments the amount of allowable relative reciprocation even in a locked state is between any possible permutation of the specified distances.

Spring Lock/Unlock

In one embodiment a spring and latch quick lock/quick unlock system is provided between the sleeve and the mandrel. The spring can comprise one or more fingers (or a single ring) which detachably connects to a connector located on the mandrel, such as a locking valley. In one embodiment a ramp on the mandrel can be provided facilitating the bending of the one or more fingers (or ring) before they lock/latch into the connecting valley. In one embodiment is provided a backstop to resist longitudinal movement of the sleeve relative to the mandrel after the one or more fingers (or ring) have locked/latched into the valley.

In one embodiment is provided a quick lock/quick unlock system which locks and unlocks on a non-fluted area of the mandrel. In one embodiment this system can include a locking hub with fingers which detachably locks on a raised area of the mandrel where the raised area does not include radial discontinuities (e.g., it is not fluted). In one embodiment is provided a locking hub that can rotate relative, but is restricted on the amount of longitudinal movement relative to the sleeve, the rotational movement of the hub with the sleeve reducing rotational wear between the hub and mandrel (as the locking hub can remain rotationally static relative to the sleeve). In one embodiment the locking hub can be restricted from longitudinally moving relative to the sleeve. In one embodiment locking hub can be used without a clutching system. In one embodiment bearing surfaces can be provided between the sleeve and locking hub to facilitate relative rotational movement between the sleeve and the hub. In one embodiment the mandrel is about 7 inches in outer diameter and shoulder area is about 7½ inches (19.05 centimeters).

In one embodiment is provided a quick lock/quick unlock system which includes a hub rotationally connected to the sleeve, and the hub can have a plurality of fingers, the mandrel can have a longitudinal bearing area and a locking area (located adjacent to the bearing area). In one embodiment the fingers can pass over the bearing area without touching the bearing area. In one embodiment the fingers can be radially expanded by the locking area, and then lock in the locking area. In one embodiment longitudinal movement of the sleeve relative to the mandrel can be restricted by the shoulder area. In one embodiment longitudinal movement of the hub relative to the mandrel can be restricted by the shoulder area. In one embodiment longitudinal movement of the sleeve relative to the mandrel can be restricted by the shoulder area contacting the hub and the hub contacting thrusting against the sleeve.

Fluted Mandrel

In one embodiment the pin end of the mandrel can include a plurality of flutes to facilitate fluid flow past the pin end as it passes though the well head. Because of the loads which the pin end of the mandrel is expected to absorb (e.g., the weight of the string and tools located below the mandrel), the mandrel should be designed with sufficient strength to safely absorb these loads. However, the size of the mandrel at the pin end to safely absorb these loads can be such that it tends to severely restrict fluid flow through the wellhead when the pin end of the mandrel passes through the wellhead. That is, the annular space created between the pin end of the mandrel and the inner diameter of the well head is sufficiently small that it can excessively restrict fluid flow through this annular space. This space restriction would only occur at times when the pin end of the mandrel is located at the well head and may not substantially impair the completion operations of many completion operations. However, in an abundance of caution this possible restriction has been addressed by providing a fluted area around the pin end. The fluted area would allow a plurality of flow paths (in the valleys of the flutes) to reduce the resistance to fluid flow when the pin end is within the wellhead.

These flutes, however, provide a challenge to the operation of the quick lock/quick unlock system as the flutes provide rotational discontinuities. Because the sleeve and mandrel may be rotating relative to each other at the time that the quick lock/quick unlock system is to be activated (i.e., locked) and/or deactivated (i.e., unlocked), these rotational discontinuities may damage or cause other problems when the locking system is activated and/or deactivated. Because the relative rotational position between the sleeve and the mandrel may not be known at the time of activation/deactivation, a positioning or clutching system can be used to properly align/locate the quick lock/quick unlock system for activation/deactivation. The clutching system can also prevent relative rotation between the locking/unlocking system and the locking area of the mandrel thus resisting scratching/scarring/wearing between these two areas if relative rotation was allowed during locking/unlocking.

Clutch

In one embodiment, to insure that the latch fingers align with the locking grooves in the mandrel, the locking hub can be rotatable relative to the sleeve and clutching guide bosses can be provided on the locking hub. These guide bosses can engage the spaces in the flute grooves and prevent further relative rotation between the locking hub and the mandrel. Furthermore, these guide bosses can align the fingers of the locking hub with the locking areas on the mandrel to set of the predetermined amount of locking force. Without the alignment, the amount of locking force could be changed base on the relative alignment between that fingers and the locking areas of the mandrel (e.g., if only five percent of the fingers are in contact with the mandrel's locking areas then the locking force would be less than if one hundred percent of the fingers are in contact with the mandrel's locking areas). The guide bosses can be aligned in the valleys of flutes thereby aligning the fingers of the locking hub with the locking areas on the mandrel. The guide bosses aligning in the valleys can also cause the locking hub to remain rotationally static relative to the mandrel and rotate relative to the sleeve. When the latch fingers contact the upset of the upsets of the latching groove (e.g., latching area) cut in the raised flute of the fluted area of the mandrel, the latch fingers push the longitudinally and rotationally floating thrust hub longitudinally up against the bearing surface of the sleeve's pin end. As the pin end of the mandrel continues to move longitudinally towards the center of the sleeve, the latch fingers are forced over the upsets of the latching groove and into the groove. A little further movement makes the leading beveled ends of the raised flutes contact the locking hub (which hub is now in contact with the bearing area of the sleeve) which transfers further upward mandrel load to the sleeve through the thrust bearing of the locking hub.

Additional Clearance Design for High Pressures

In one embodiment the rotating and reciprocating tool is designed to work under high external pressure. This design requires that fits be allowed with sufficient clearance at sea level so that when the tool reaches its working depth and pressures the proper manufacturing clearances exist. In order to accomplish this dimensional changes to the sleeve and mandrel based on the change in external pressure from the surface to the sea floor are taken into account.

In another embodiment, the rotating and reciprocating tool is designed to allow fluid pressure to migrate from the box end to the pin end to reduce the net pressure in bending on the interior and exterior of the sleeve along with the net pressure in bending on the interior and exterior of the mandrel.

General Method Steps

In one embodiment the method can comprise the following steps:

(a) lowering the rotating and reciprocating tool to the annular BOP, the tool comprising a sleeve and mandrel;

(b) after step "a", having the annular BOP close on the sleeve;

(c) after step "b", causing relative longitudinal movement between the sleeve and the mandrel;

(d) after step "c", moving the sleeve outside of the annular BOP;

(e) after step "d", moving the sleeve inside of the annular BOP and having the annular BOP close on the sleeve;

(f) after step "e", causing relative longitudinal movement between the sleeve and the mandrel.

In one embodiment, during step "a", the sleeve is longitudinally locked relative to the mandrel.

In one embodiment, after step "b", the sleeve is unlocked longitudinally relative to the mandrel.

In one embodiment, after step "c", the sleeve is longitudinally locked relative to the mandrel.

In one embodiment, during step "c" operations are performed in the wellbore.

In one embodiment, during step "f" operations are performed in the wellbore.

In one embodiment, during step "c" the tool is fluidly connected to a string having a bore and fluid is pumped through at least part of the string's bore.

In one embodiment, during step "f" the tool is fluidly connected to a string having a bore and fluid is pumped through at least part of the string's bore.

In one embodiment, during step "c" the tool is fluidly connected to a string having a bore and fluid is pumped through at least part of the string's bore and a jetting tool is used to jet a portion of the wellbore, BOP, and/or riser. In one embodiment the jetting tool is a SABS jetting tool.

In one embodiment, during step "f" the tool is fluidly connected to a string having a bore and fluid is pumped through at least part of the string's bore and a jetting tool is used to jet a portion of the wellbore, BOP, and/or riser. In one embodiment the jetting tool is a SABS jetting tool.

In one embodiment, longitudinally locking the sleeve relative to the mandrel shortens an effective stroke length of the sleeve from a first stroke to a second stroke.

In one embodiment, during step "a", the mandrel can freely rotate relative to the sleeve.

In one embodiment, after step "b", the mandrel can freely rotate relative to the sleeve.

In one embodiment, after step "c", the mandrel can freely rotate relative to the sleeve. (Longer to Shorter) In one embodiment, while underwater, the sleeve is changed from a state of having a first length of longitudinal stroke relative to the mandrel to a state of having a second length of longitudinal stroke relative to the mandrel, the second length of longitudinal stroke being shorter than the first length of longitudinal stroke. In one embodiment the second length of longitudinal stroke is substantially zero. In one embodiment the changing of states in longitudinal stroke is accomplished at a time when the annular BOP is closed on the sleeve. In one embodiment, subsequent to the change in states of longitudinal strokes, the sleeve is moved out of the annular BOP (either lowered from and/or raised out of the annular BOP).

(Shorter to Longer) In one embodiment, while underwater and subsequent to the change in state from the first to second longitudinal strokes, the sleeve is changed back from the state of having the second length of longitudinal stroke relative to the mandrel to the state of having the first length of longitudinal stroke relative to the mandrel. In one embodiment the changing of states in longitudinal stroke is accomplished at a time when the annular BOP is closed on the sleeve. In one embodiment, subsequent to the change back in state from the second to the first longitudinal strokes, the mandrel is reciprocated and/or rotated relative to the sleeve while the annular BOP is closed on the sleeve. In one embodiment, subsequent to the change in states of longitudinal strokes, the sleeve is moved out of the annular BOP (either lowered from and/or raised out of the annular BOP).

(Longer to Shorter) In one embodiment the sleeve, while underwater and subsequent to the change in state from second to first lengths of longitudinal strokes, the state of longitudinal stroke is changed again from the first to the second lengths. In one embodiment the changing of states in longitudinal stroke is accomplished at a time when the annular BOP is closed on the sleeve. In one embodiment, subsequent to the change in states of longitudinal strokes, the sleeve is moved out of the annular BOP (either lowered from and/or raised out of the annular BOP).

(Shorter to Longer) In one embodiment, while underwater and subsequent to the changes in state from the first to second, second to first, and first to second longitudinal strokes, the sleeve is changed back from the state of having the second length of longitudinal stroke relative to the mandrel to the state of having the first length of longitudinal stroke relative to the mandrel. In one embodiment the changing of states in longitudinal stroke is accomplished at a time when the annular BOP is closed on the sleeve. In one embodiment, subsequent to the change back in state from the second to the first longitudinal strokes, the mandrel is reciprocated and/or rotated relative to the sleeve while the annular BOP is closed on the sleeve. In one embodiment, subsequent to the change in states of longitudinal strokes, the sleeve is moved out of the annular BOP (either lowered from and/or raised out of the annular BOP).

In any of the various embodiments disclosed herein, while underwater the entire time, the sleeve is changed between the first and second states of longitudinal strokes (from the first to the second or from the second to the first) 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, or more times, or any range between, below, or above any of the above specified number of times. These options of changing from states while underwater is assisted by the quick lock/quick unlock system.

SAB's Jetting Tool

In one embodiment the sleeve at the pin end has beveled edge that matches the well head bushing. This can be helpful where the operator lowers rotating and reciprocating tool with the sleeve locked on the mandrel to a point where it contacts the wellhead bushing. The beveled edge of the end of the sleeve will allow it to rest safely on the wellhead bushing until the wellhead bushing provides a large enough longitudinal force on the sleeve to cause the quick lock/quick unlock system deactivate and enter an unlocked state allowing the sleeve to move longitudinally relative to the mandrel and limit the reactive force placed on the wellhead bushing preventing damage to the wellhead bushing. Additionally, the matching bevel of the sleeve with the bevel of the wellhead prevents the sleeve from getting stuck in the well head bushing.

To provide the completion engineers with the flexibility:

(a) to use the rotating and reciprocating tool while the annular BOP is sealed on the sleeve and while taking return flow up the choke or kill line (i.e., around the annular BOP); or (b) to open the annular BOP and take returns up the subsea riser (i.e., through the annular BOP); or (c) to open the annular BOP and move the completion string with the attached rotating and reciprocating tool out of the annular BOP (such as where the completion engineer wishes to use the SABs jetting tool to jet the BOP stack or perform other operations required the completion string to be raised to a point beyond where the effective stroke capacity of the rotating and reciprocating tool can absorb the upward movement by the sleeve moving longitudinally relative to the mandrel) and, at a later point in time, reseal the annular BOP on the sleeve of the rotating and reciprocating tool.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Figure 1:
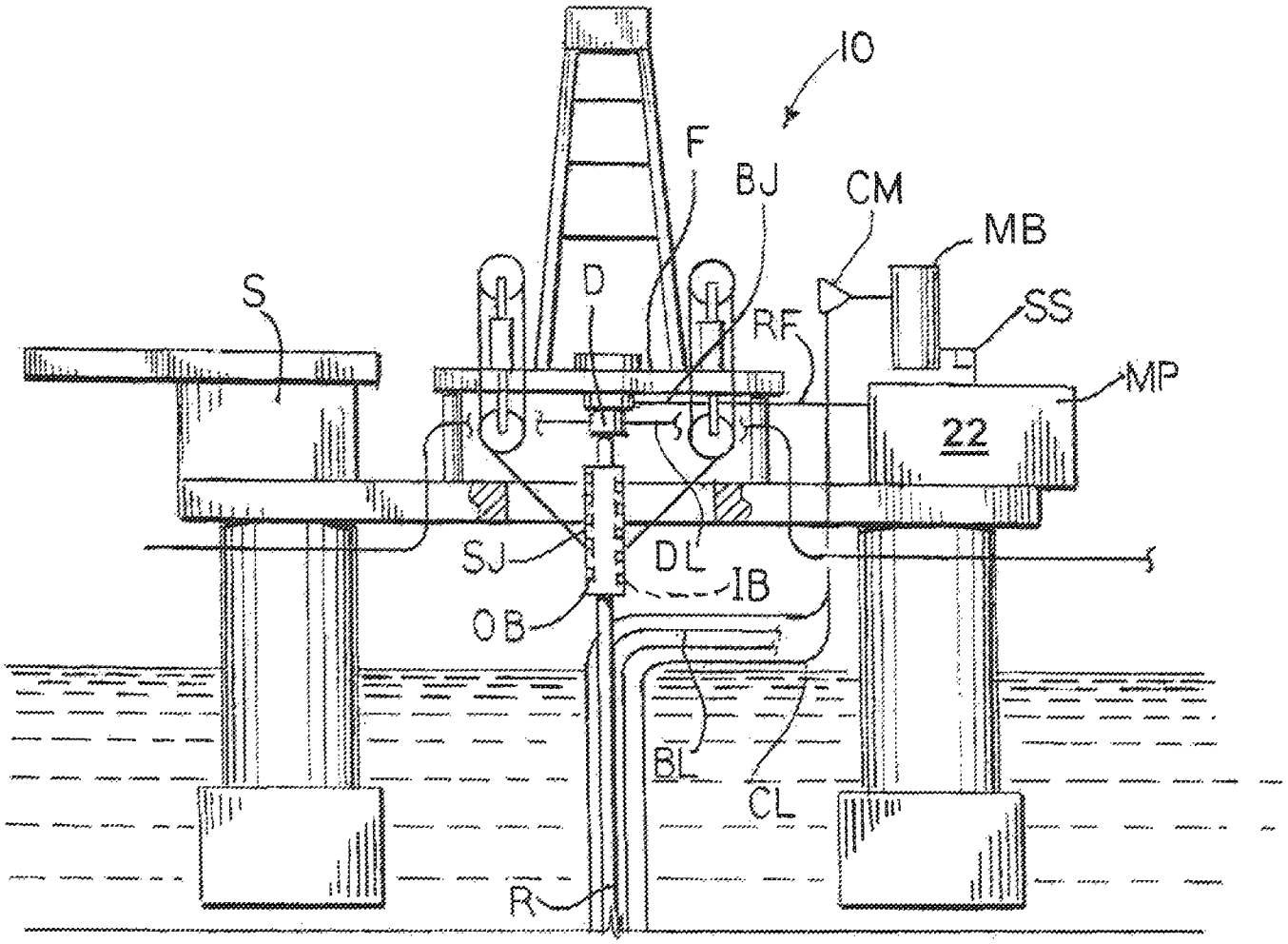
FIGS. 1-1A are schematic diagrams showing a deep water drilling rig with riser and annular blowout preventer.
Figure 2:
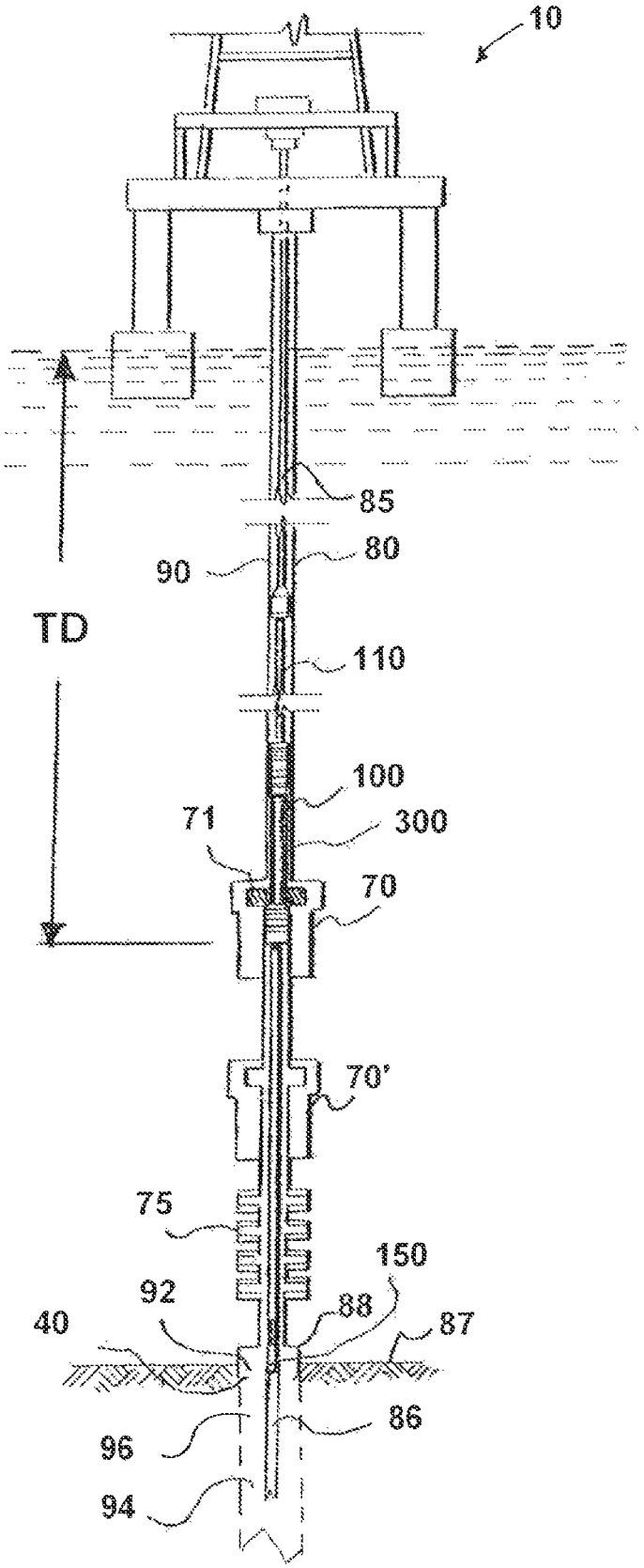
FIG. 2 is another schematic diagram of a deep water drilling rig showing a swivel detachably connected to an annular blowout preventer (a second annular blowout preventer is also shown)

FIGS. 1 and 2 show generally the preferred embodiment of the apparatus of the present invention, designated generally by the numeral 10. Drilling apparatus 10 employs a drilling platform S that can be a floating platform, spar, semi-submersible, or other platform suitable for oil and gas well drilling in a deep water environment. For example, the well drilling apparatus 10 of FIGS. 1 and 2 and related method can be employed in deep water of for example deeper than 5,000 feet (1,500 meters), 6,000 feet (1,800 meters), 7,000 feet (2,100 meters), 10,000 feet (3,000 meters) deep, or deeper.

Figure 1A:
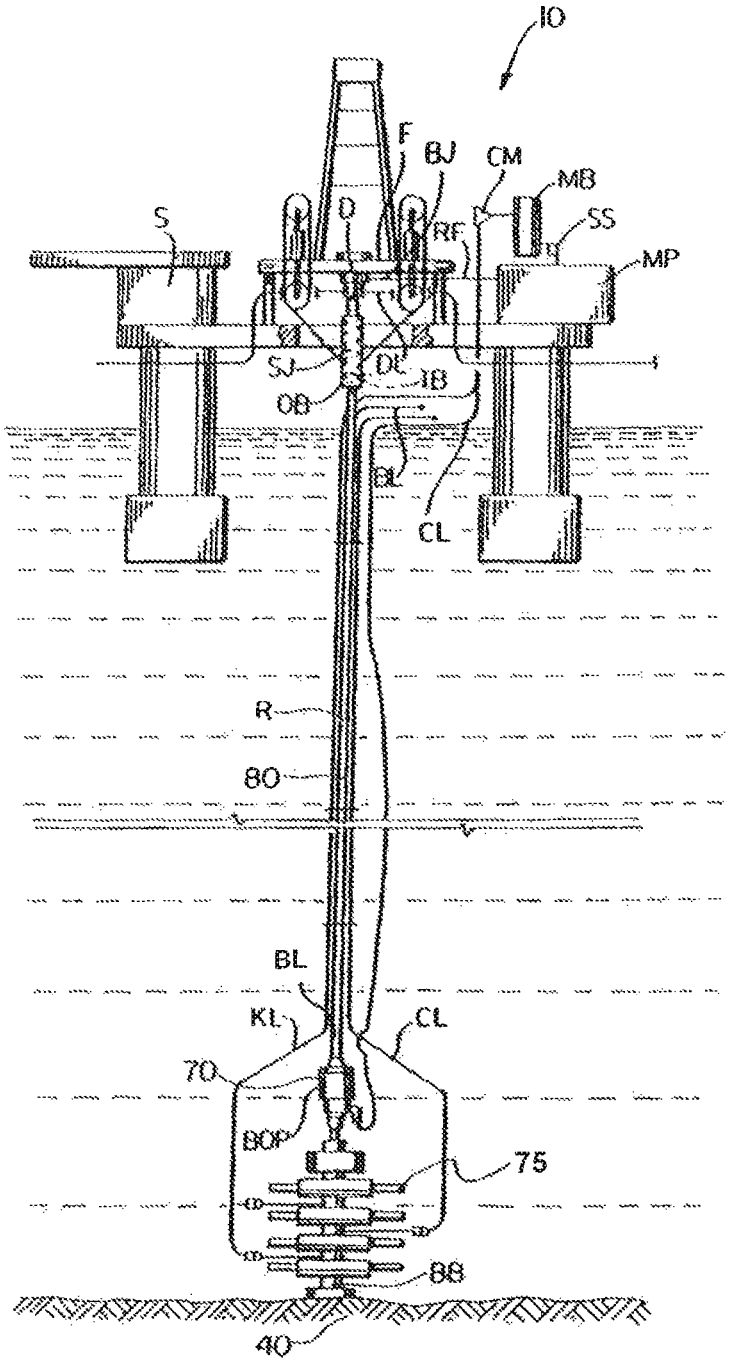

In FIGS. 1A and 2, an ocean floor or seabed 87 is shown. Wellhead 88 is shown on seabed 11. One or more blowout preventers can be provided including stack 75 and annular blowout preventer 70. The oil and gas well drilling platform S thus can provide a floating structure S having a rig floor F that carries a derrick and other known equipment that is used for drilling oil and gas wells. Floating structure S provides a source of drilling fluid or drilling mud 22 contained in mud pit MP. Equipment that can be used to recirculate and treat the drilling mud can include for example a mud pit MP, shale shaker SS, mud buster or separator MB, and choke manifold CM.

An example of a drilling rig and various drilling components is shown in FIG. 1 of U.S. Pat. No. 6,263,982 (which patent is incorporated herein by reference). In FIGS. 1, 1A, and 2 conventional slip or telescopic joint SJ, comprising an outer barrel OB and an inner barrel IB with a pressure seal therebetween can be used to compensate for the relative vertical movement or heave between the floating rig S and the fixed subsea riser R. A Diverter D can be connected between the top inner barrel IB of the slip joint SJ and the floating structure or rig S to control gas accumulations in the riser R or low pressure formation gas from venting to the rig floor F. A ball joint BJ between the diverter D and the riser R can compensate for other relative movement (horizontal and rotational) or pitch and roll of the floating structure S and the riser R (which is typically fixed).

The diverter D can use a diverter line DL to communicate drilling fluid or mud from the riser R to a choke manifold CM, shale shaker SS or other drilling fluid or drilling mud receiving device. Above the diverter D can be the flowline RF which can be configured to communicate with a mud pit MP. A conventional flexible choke line CL can be configured to communicate with choke manifold CM. The drilling fluid or mud can flow from the choke manifold CM to a mud-gas buster or separator MB and a flare line (not shown). The drilling fluid or mud can then be discharged to a shale shaker SS, and mud pits MP. In addition to a choke line CL and kill line KL, a booster line BL can be used.

FIG. 2 is an enlarged view of the drill string or work string 60 that extends between rig 10 and seabed 87 having wellhead 88. In FIG. 2, the drill string or work string 60 is divided into an upper drill or work string 85 and a lower drill or work string 86. Upper string 85 is contained in riser 80 and extends between well drilling rig S and swivel 100. An upper volumetric section 90 is provided within riser 80 and in between drilling rig 10 and swivel 100. A lower volumetric section 92 is provided in between wellhead 88 and swivel 100. The upper and lower volumetric sections 90, 92 are more specifically separated by annular seal unit 71 that forms a seal against sleeve 300 of swivel 100. Blowout preventer 70 is positioned at the bottom of riser 80 and above stack 75. A well bore 40 extends downwardly from wellhead 88 and into seabed 87. Although shown in FIG. 2, in many of the figures the lower completion or drill string 86 (which would be connected to and supported by pin end 150 of mandrel 110) has been omitted for purposes of clarity.

After drilling operations, when preparing the wellbore 40 and riser R for production, it is desirable to remove the drilling fluid or mud. Removal of drilling fluid or mud is typically done through displacement by a completion fluid. Because of its relatively high cost, this drilling fluid or drilling mud is typically recovered for use in another drilling operation. Displacing the drilling fluid or mud in multiple sections is desirable because the amount of drilling fluid or mud to be removed during completion is typically greater than the storage space available at the drilling rig S for either completion fluid and/or drilling fluid or drilling mud.

In deep water settings, after drilling is stopped, the total volume of drilling fluid or drilling mud in the well bore 40 and the riser R can be in excess of the storage capacity of the rig S. Many rigs S do not have the capacity for storing this total volume of drilling mud and/or supplying the total volume of completion fluid when displacing in one step the total volume of drilling fluid or drilling mud in the well bore 40 and riser R. Accordingly, displacement is typically done in two or more stages. Additionally, displacing in two stages is believed to reduce the total volume of completion fluid required versus that required in a single stage displacement. Furthermore, logistical benefits can be obtained by displacing in two stages by dealing with smaller volumes of displacement fluid in each stage along with the ability to prepare certain operations for the second displacement stage simultaneously with displacing the first stage. Additionally, where a problem occurs during one of the stages only the fluid impacted by that stage need be addressed which is a smaller volume than the fluid for displacing riser and well bore in a single stage.

Where the displacement process is performed in two or more stages, there is a risk that, during the time period between stages, the displacing fluid will intermix or interface with the drilling fluid or mud thereby causing the drilling fluid or mud to be unusable or require extensive and expensive reclamation efforts before being usable.

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 3:
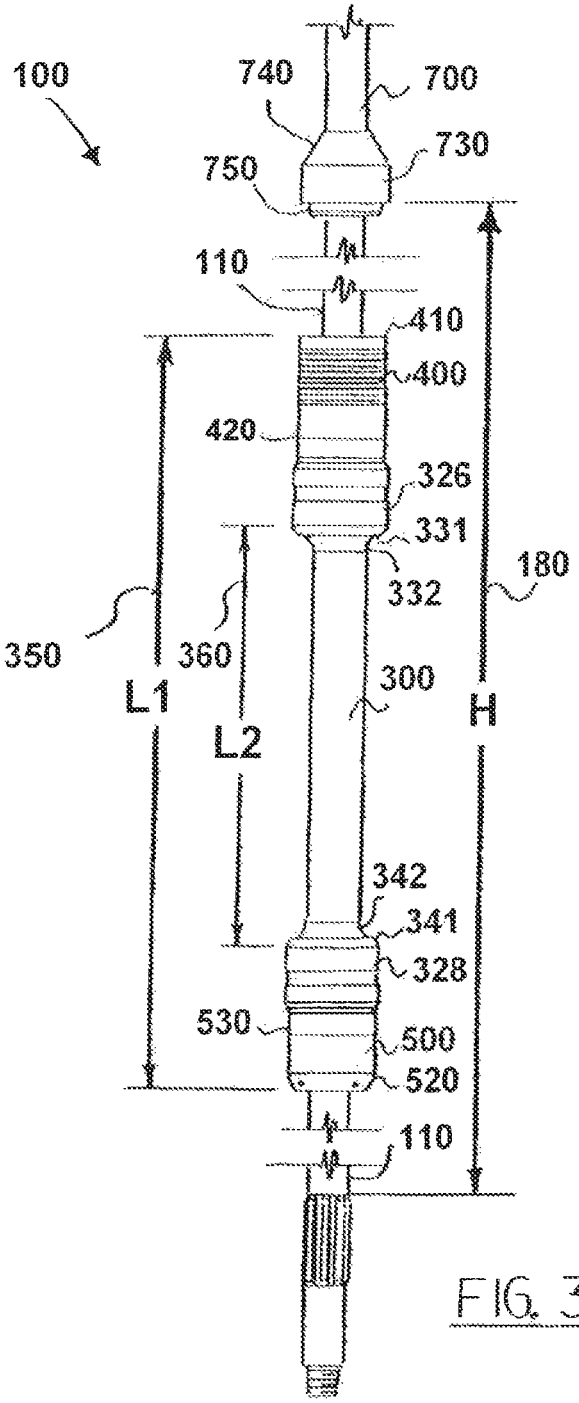
FIG. 3 is a schematic diagram of one embodiment of a reciprocating and/or rotating swivel.
Figures 4A, 4B, 4C:
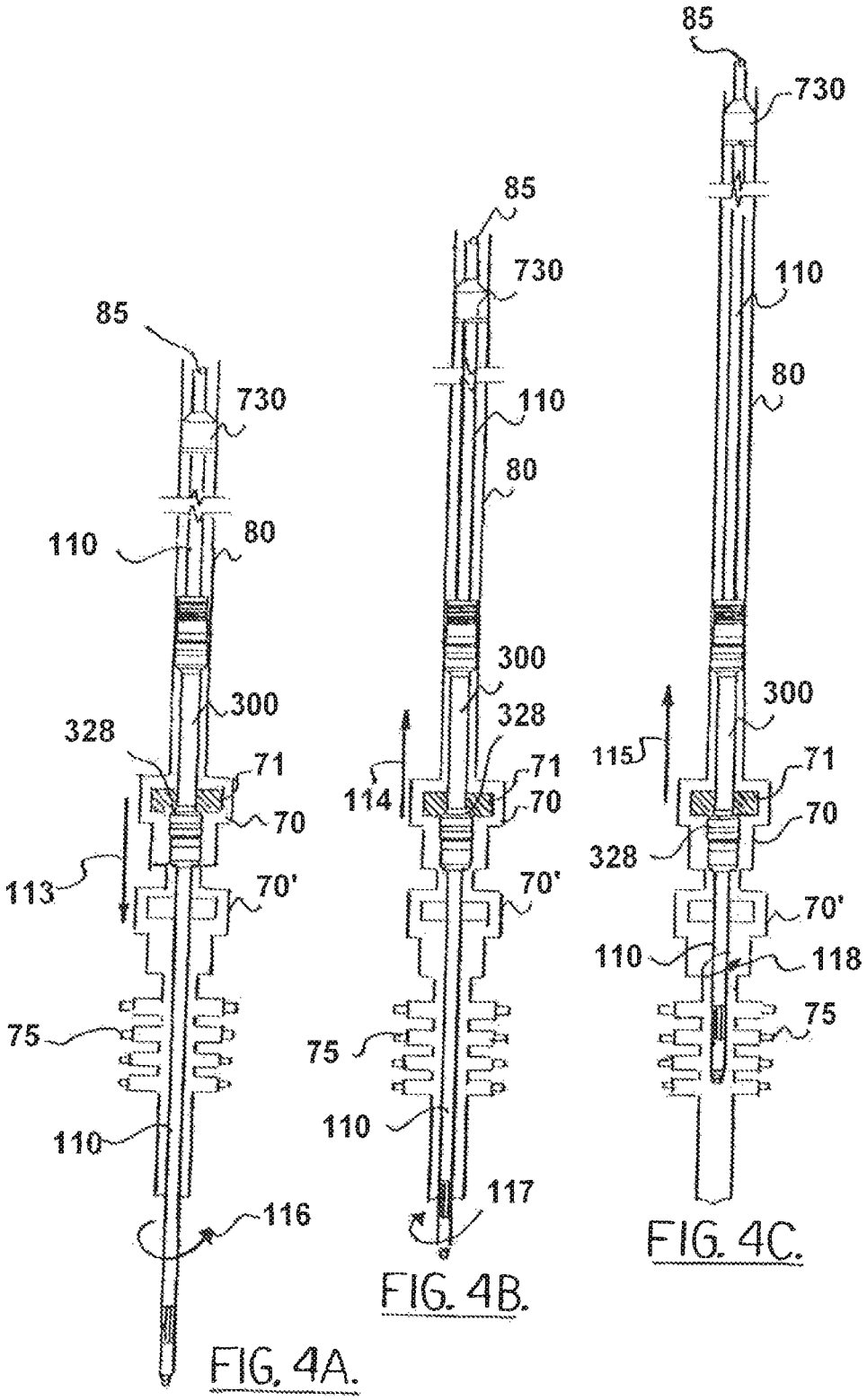
FIGS. 4A through 4C are schematic diagrams illustrating reciprocating motion of a drill or well string through an annular blowout preventer.

FIGS. 1-1A are schematic views showing oil and gas well drilling rig 10 connected to riser 80 and having annular blowout preventer 70 (commercially available). FIG. 2 is a schematic view showing rig 10 with swivel 100 separating upper drill or well string 85 and lower drill or well string 86. Swivel 100 is shown detachably connected to annular blowout preventer 70 through annular packing unit seal 71. FIG. 3 is a schematic diagram of one embodiment of a swivel 100 which can rotate and/or reciprocate. With such construction drill or well string 85, 86 can be rotated and/or reciprocated while annular blowout preventer 70 is sealed around swivel 100 thereby separating a fluid in riser R into upper and lower longitudinal sections. FIGS. 4A through 4C are schematic diagrams illustrating reciprocating motion of drill or well string 85,86 through annular blowout preventer 70.

Swivel 100 can be seen in more detail in FIG. 3. Swivel 100 includes a sleeve or housing 300. Mandrel 110 is contained within a bore of sleeve 300 (see FIGS. 7 and 8). FIG. 3 shows a fragmentary view of the preferred embodiment of the apparatus of the present invention, particularly illustrating swivel 100. Swivel 100 includes an outer sleeve or housing 300 having a generally vertically oriented open-ended bore that is occupied by mandrel 110. Mandrel 110 provides upper and lower end portions. The upper end portion has joint of pipe 700 and enlarged area 730. The lower end portion of mandrel 110 has fluted area 135 and saver sub 800 (see FIG. 13). Joint of pipe 700 and enlarged area 730 provide frustoconical area 740, protruding section 750, and upper portion 710 of joint of pipe 700 (see FIG. 15).

In FIG. 3, sleeve 300 provides upper radiused area 332 that connects with base 331. Sleeve 300 also provides lower radiused area 342 that is connected to lower base 341. Upper catch, shoulder or flange 326 is connected to upper base 331. Similarly, lower catch, shoulder or flange 328 connects to lower base 341. Upper retainer cap 400 is connected to upper catch, shoulder or flange 326 while lower retainer cap 500 is connected to lower catch, shoulder or flange 328 as shown. In FIG. 3, 410 designates the tip of retainer cap 400. In FIG. 3, the numeral 520 designates the tip of retainer cap 500. The base 530 of retainer cap 500 defines the connection with lower catch, shoulder or flange 328.

FIGS. 3 and 4A through 4C schematically illustrating reciprocating motion of sleeve or housing 300 relative to mandrel 110. The length 180 of mandrel 110 compared to the overall length 350 of sleeve or housing 300 can be configured to allow sleeve or housing 300 to reciprocate (e.g., slide up and down) relative to mandrel 110. FIGS. 4A through 4C are schematic diagrams illustrating reciprocation and/or rotation between sleeve or housing 300 along mandrel 110 (allowing reciprocation and/or rotation between drill or work string 85,86 at a time when the volume of fluid is desireably to be separated into two volumetric sections by the closing of annular blowout preventer 70.

In FIG. 4A, arrow 113 schematically indicates that mandrel 110 is moving downward relative to sleeve or housing 300. Arrows 114 and 115 in FIGS. 4B-4C schematically indicate upward movement of mandrel 110 relative to sleeve or housing 300. In FIGS. 4A and 4C, arrows 116 and 118 schematically indicate counterclockwise rotation between mandrel 110 and sleeve or housing 300. In FIG. 4B, arrow 117 schematically indicates clockwise rotation between mandrel 110 and sleeve or housing 300. The change in direction between arrows 113 and 114,115 schematically indicates a reciprocating motion. The change in direction between arrows 116,118 and 117 schematically indicates an alternating type of rotational movement.

Swivel 100 can be made up of mandrel 110 to fit in line of a drill or work string 85,86 and sleeve or housing 300 with a seal and bearing system to allow for the drill or work string 85, 86 to be rotated and reciprocated while swivel 100 where annular seal unit 71 (see FIGS. 2, 4A-4C) separates the fluid column in riser 80 from the fluid column in wellbore 40. This can be achieved by locating swivel 100 in the annular blow out preventer 70 where annular seal unit 71 can close around sleeve or housing 300 forming a seal between sleeve or housing 300 and annular seal unit 71, as seen in FIGS. 2, 4A-4C, and the sealing system between sleeve or housing 300 and mandrel 110 of swivel 100 forming a seal between sleeve or housing 300 and mandrel 110, thus separating the two fluid columns 90, 92 (above and below annular seal unit 71) allowing the fluid columns 90, 92 to be displaced individually.

In deep water settings, after drilling is stopped the total volume of drilling fluid 22 in the well bore 40 and the riser 80 can be in excess of about 5,000 barrels. This drilling fluid or mud 22 must be removed to ready the well for completion (usually ultimately replaced by a completion fluid). Because of its relatively high cost this drilling fluid or mud 22 is typically recovered for use in another drilling operation. Removal of drilling fluid or mud 22 is typically done through displacement by a completion fluid 96 or displacement fluid 94. However, many rigs 10 do not have the capacity to store and/or supply 5,000 plus barrels of completion fluid 96, displacement fluid 94, and/or drilling fluid or mud 22 and thereby displace "in one step" the total volume of drilling fluid or mud 22 in the well bore 40 and riser 80 volumes. Accordingly, the displacement process is done in two or more stages. However, where the displacement process is performed in two or more stages, there is a high risk that, during the time period between the stages, the displacing fluid 94 and/or completion fluid 96 will intermix and/or interface with the drilling fluid or mud 22 thereby causing the drilling fluid or mud 22 to be unusable or require extensive and expensive reclamation efforts before being used again.

Additionally, it has been found that, during displacement of the drilling fluid or mud 22, rotation of the drill or well string 85, 86 causes a rotation of the drilling fluid or mud 22 in the riser 80 and well bore 40 and obtains a better overall recovery of the drilling fluid or mud 22 and/or completion of the well. Additionally, during displacement there may be a need to move in a vertical direction (e.g., reciprocate) and/or rotate the drill or well string 85,86 while performing displacement and/or completion operations, such as cleaning, scraping, and/or brushing the sides of the well bore.

In one embodiment the riser 80 and well bore 40 can be separated into two volumetric sections 90, 92 (e.g., 2,500 barrels each) where the rig 10 can carry a sufficient amount of displacement fluid 94 and/or completion fluid 96 to remove each section without stopping during the displacement process. In one embodiment, fluid removal of the two volumetric sections 90, 92 in stages can be accomplished, but there is a break of an indefinite period of time between stages (although this break may be of short duration).

In one embodiment swivel 100 is provided which can be detachably connected to an annular blowout preventer 70 thereby separating the drilling fluid or mud 22 into upper and lower sections 90, 92 (roughly in the riser 80 and well bore 40) and allowing the or mud 22 to be removed in two stages while the drill or well string 85,86 is rotated and/or reciprocated.

In one embodiment, at least partly during the time the riser 80 and well bore 40 are separated into two volumetric sections, the drill or well string 85,86 is reciprocated longitudinally during displacement. In one embodiment, at least partly during the time the riser 80 and well bore 40 are separated into two volumetric sections, the drill or well string 85, 86 is intermittently reciprocated longitudinally during displacement of fluid.

In one embodiment, at least partly during the time the riser 80 and well bore 40 are separated into two volumetric sections, the drill or well string 85, 86 is continuously reciprocated longitudinally during displacement. In one embodiment, at least partly during the time the riser 80 and well bore 40 are separated into two volumetric sections, the drill or well string 85, 86 is reciprocated longitudinally the distance of at least the length of one joint of pipe during displacement of fluid.

In one embodiment, at least partly during the time the riser 80 and well bore 40 are separated into two volumetric sections, the drill or well string 85, 86 is rotated during displacement of fluid. In one embodiment, at least partly during the time the riser 80 and well bore 40 are separated into two volumetric sections, the drill or well string 85, 86 is intermittently rotated during displacement of fluid. In one embodiment, at least partly during the time the riser 80 and well bore 40 are separated into two volumetric sections, the drill or well string 85, 86 is continuously rotated during displacement of fluid.

In one embodiment, at least partly during the time the riser 80 and well bore 40 are separated into two volumetric sections, the drill or well string 85,86 is alternately rotated during displacement of fluid. In one embodiment, at least partly during the time the riser 80 and well bore 40 are separated into two volumetric sections, the direction of rotation of the drill or well string 85, 86 is changed during displacement of fluid.

In FIGS. 1-3, 4A-4C swivel 100 can also be used for reverse displacement in which the fluid is pumped in through the choke/kill lines down the annular of wellbore 40 and back up drill workstring 85,86. This process would help to remove items and/or debris which had fallen to the bottom of wellbore 40 that are difficult to remove using forward displacement (where the fluid is pumped down the workstring 85,86 displacing up through the annular to the choke/kill lines).

The amount of reciprocation (or stroke) can be controlled by the difference between the length of mandrel 110 and the length 350 of the sleeve or housing 300. As shown in FIG. 3, the stroke of swivel 100 can be the difference between height H 180 of mandrel 110 and length L1 350 of sleeve or housing 300. In one embodiment height H 180 can be about eighty feet (24.38 meters) and length L1 350 can be about eleven feet (3.35 meters). In other embodiments the length L1 350 can be about 1 foot (30.48 centimeters), about 2 feet (60.98 centimeters), about 3 feet (91.44 centimeters), about 4 feet (122.92 centimeters), about 5 feet (152.4 centimeters), about 6 feet (183.88 centimeters), about 7 feet (213.36 centimeters), about 8 feet (243.84 centimeters), about 9 feet (274.32 centimeters), about 10 feet (304.8 centimeters), about 12 feet (365.76 centimeters), about 13 feet (396.24 centimeters), about 14 feet (426.72 centimeters), about 15 feet (457.2 centimeters), about 16 feet (487.68 centimeters), about 17 feet (518.16 centimeters), about 18 feet (548.64 centimeters), about 19 feet (579.12 centimeters), and about 20 feet (609.6 centimeters) (or about midway spaced between any of the specified lengths). In various embodiments, the length of the swivel's sleeve or housing 300 compared to the length H180 of its mandrel 110 is between two and thirty times. Alternatively, between two and twenty times, between two and fifteen times, two and ten times, two and eight times, two and six times, two and five times, two and four times, two and three times, and two and two and one half times. Also alternatively, between 1.5 and thirty times, 1.5 and twenty times, 1.5 and fifteen times, 1.5 and ten times, 1.5 and eight times, 1.5 and six times, 1.5 and five times, 1.5 and four times, 1.5 and three times, 1.5 and two times, 1.5 and two and one half times, and 1.5 and two times.

In various embodiments, at least partly during the time the riser 80 and well bore 40 are separated into two volumetric sections, the drill or well string 85,86 is reciprocated longitudinally the distance of at least about ½ inch (1.27 centimeters), about 1 inch (2.54 centimeters), about 2 inches (5.04 centimeters), about 3 inches (7.62 centimeters), about 4 inches (10.16 centimeters), about 5 inches (12.7 centimeters), about 6 inches 15.24 centimeters), about 1 foot (30.48 centimeters), about 2 feet (60.96 centimeters), about 3 feet (91.44 centimeters), about 4 feet (1.22 meters), about 6 feet (1.83 meters), about 10 feet (3.048 meters), about 15 feet (4.57 meters), about 20 feet (6.096 meters), about 25 feet (7.62 meters), about 30 feet (9.14 meters), about 35 feet (10.67 meters), about 40 feet (12.19 meters), about 45 feet (13.72 meters), about 50 feet (15.24 meters), about 55 feet (16.76 meters), about 60 feet (18.29 meters), about 65 feet (19.81 meters), about 70 feet (21.34 meters), about 75 feet (22.86 meters), about 80 feet (24.38 meters), about 85 feet (25.91 meters), about 90 feet (27.43 meters), about 95 feet (28.96 meters), about 100 feet (30.48 meters), and/or between the range of each or a combination of each of the above specified distances.

Figure 5:
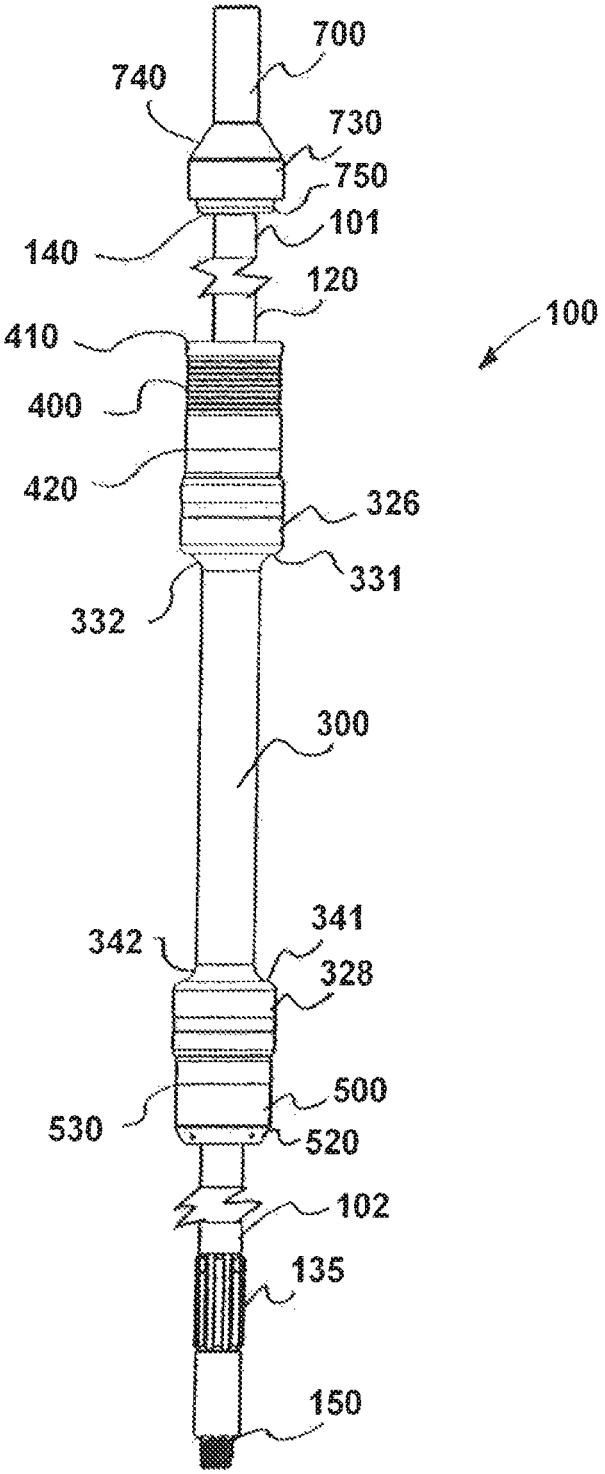
FIG. 5 is a side view of a swivel where sections from the upper and lower portions of the mandrel have been omitted in order to show in a single figure (to scale) the entire swivel.
Figure 6:
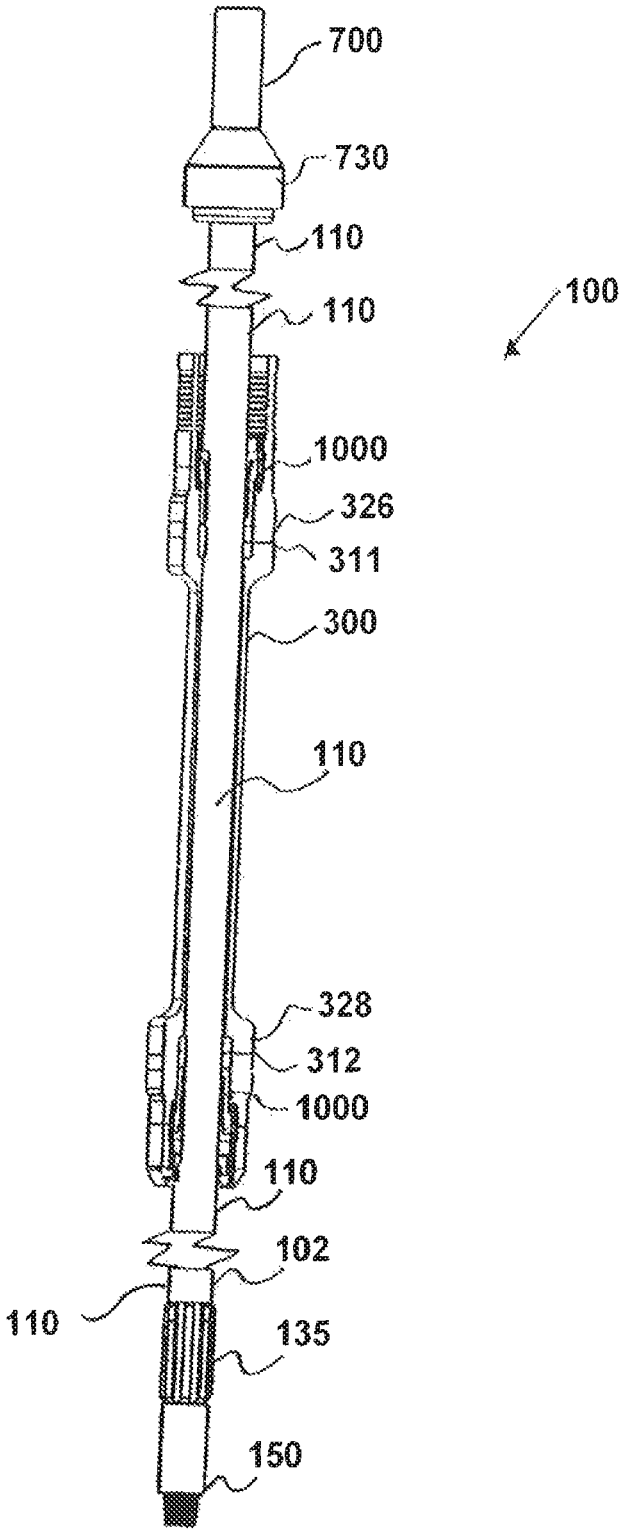
FIG. 6 is a sectional side view of the swivel in FIG. 5 where part of the sleeve or housing has been removed.
Figure 7:
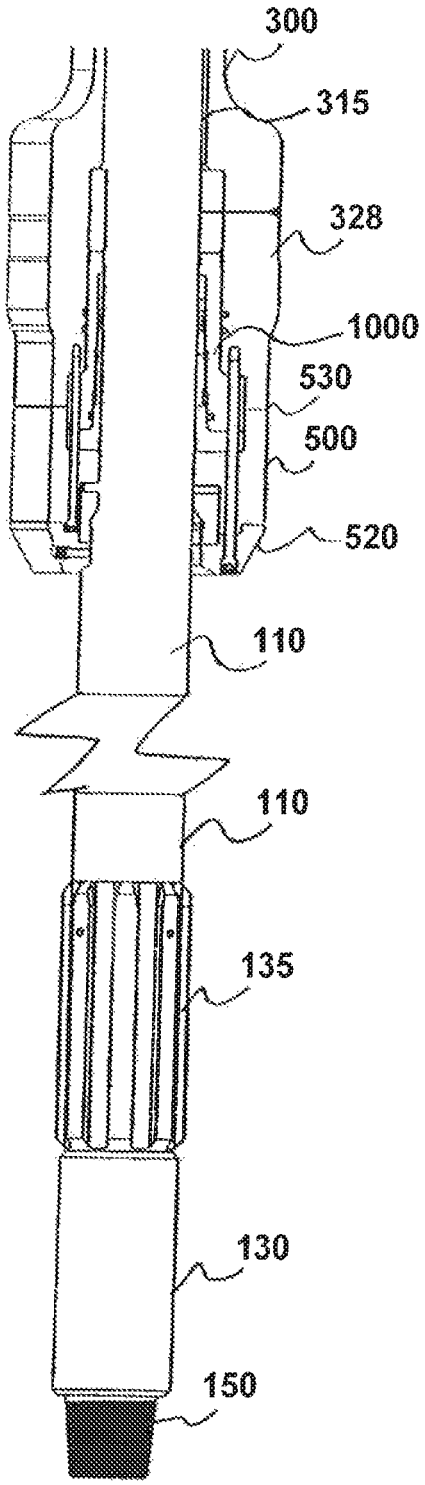
FIG. 7 is a sectional view of the bottom portion of the swivel of FIG. 5 where part of the sleeve or housing has been removed.
Figure 8:
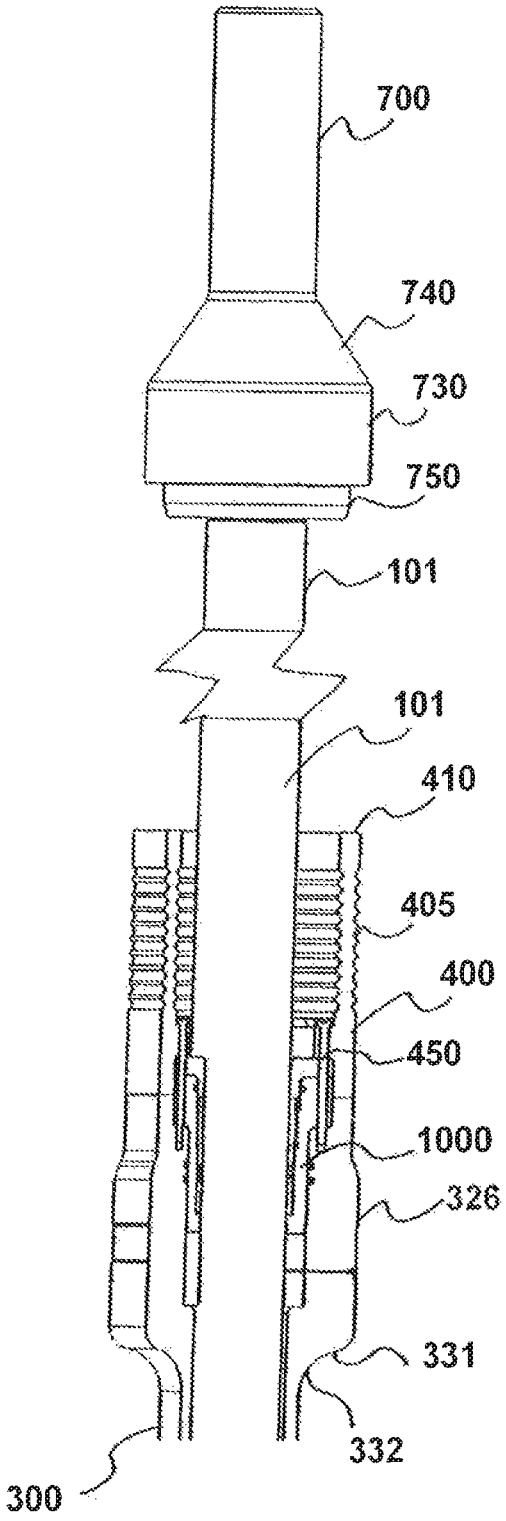
FIG. 8 is a sectional view of the top portion of the swivel of FIG. 5 where part of the sleeve or housing has been removed.
Figure 9:
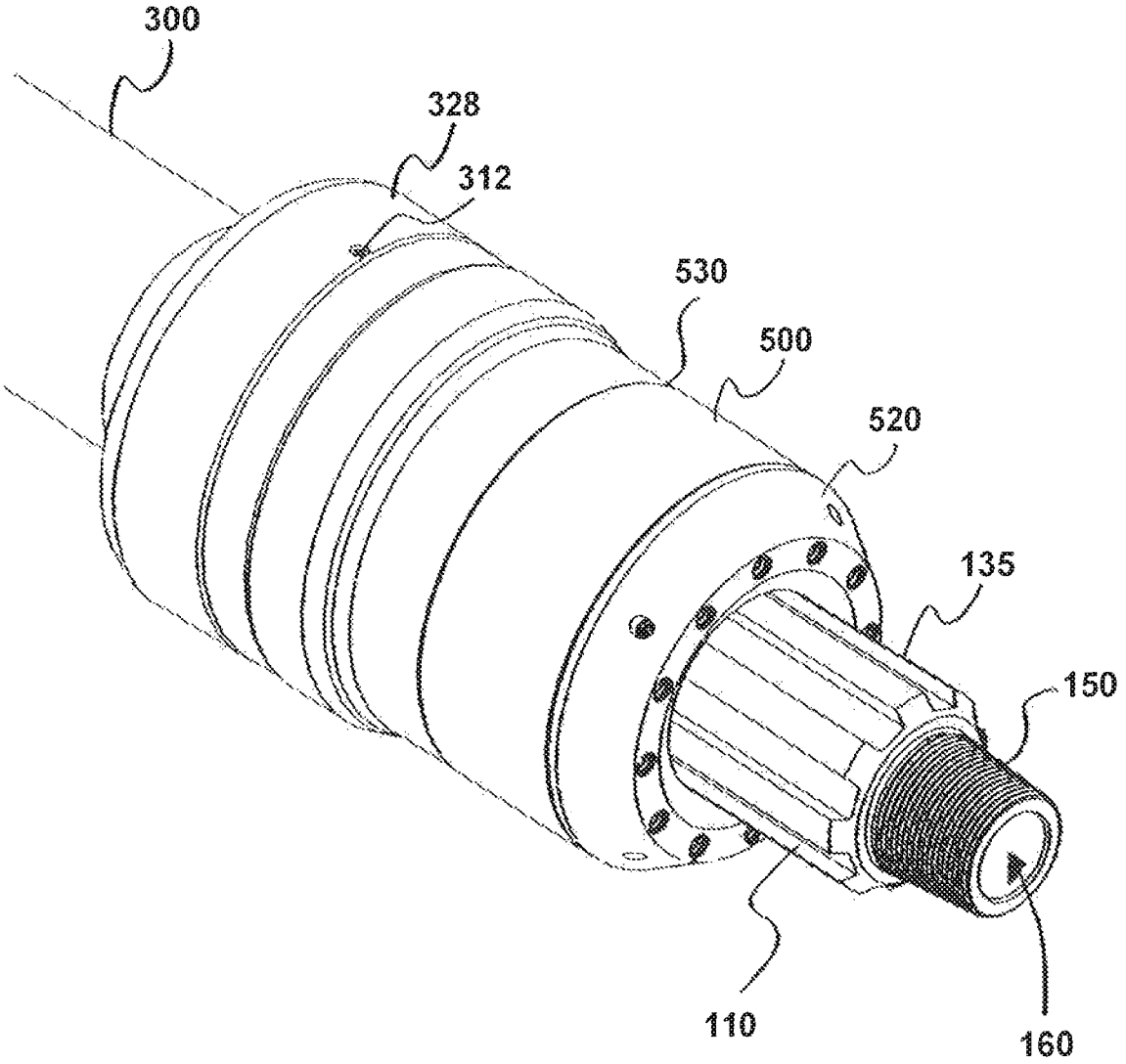
FIG. 9 is a perspective view of the bottom portion of the swivel of FIG. 5 where the sleeve or housing has been moved to the bottom portion of the mandrel.
Figure 10:
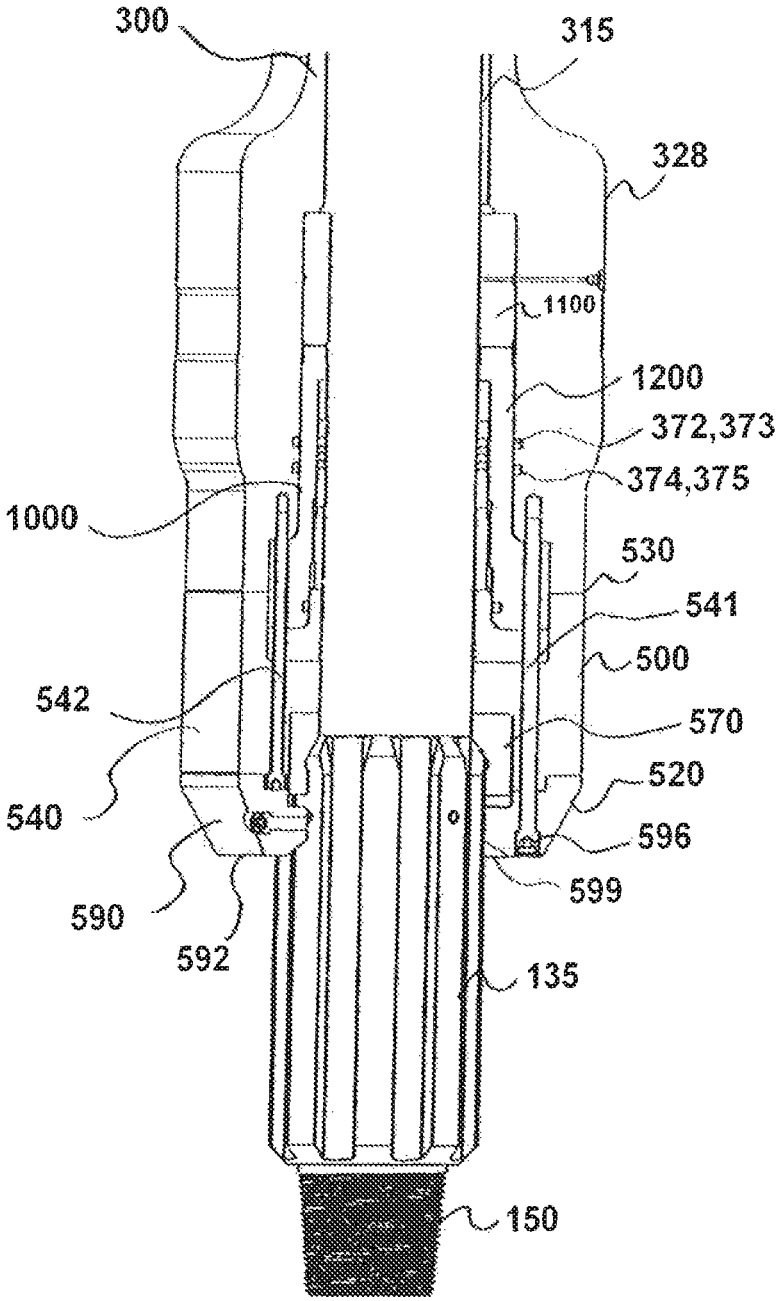
FIG. 10 is a sectional view of the swivel shown in FIG. 9 where part of the sleeve or housing has been removed to show various internal components.
Figure 11:
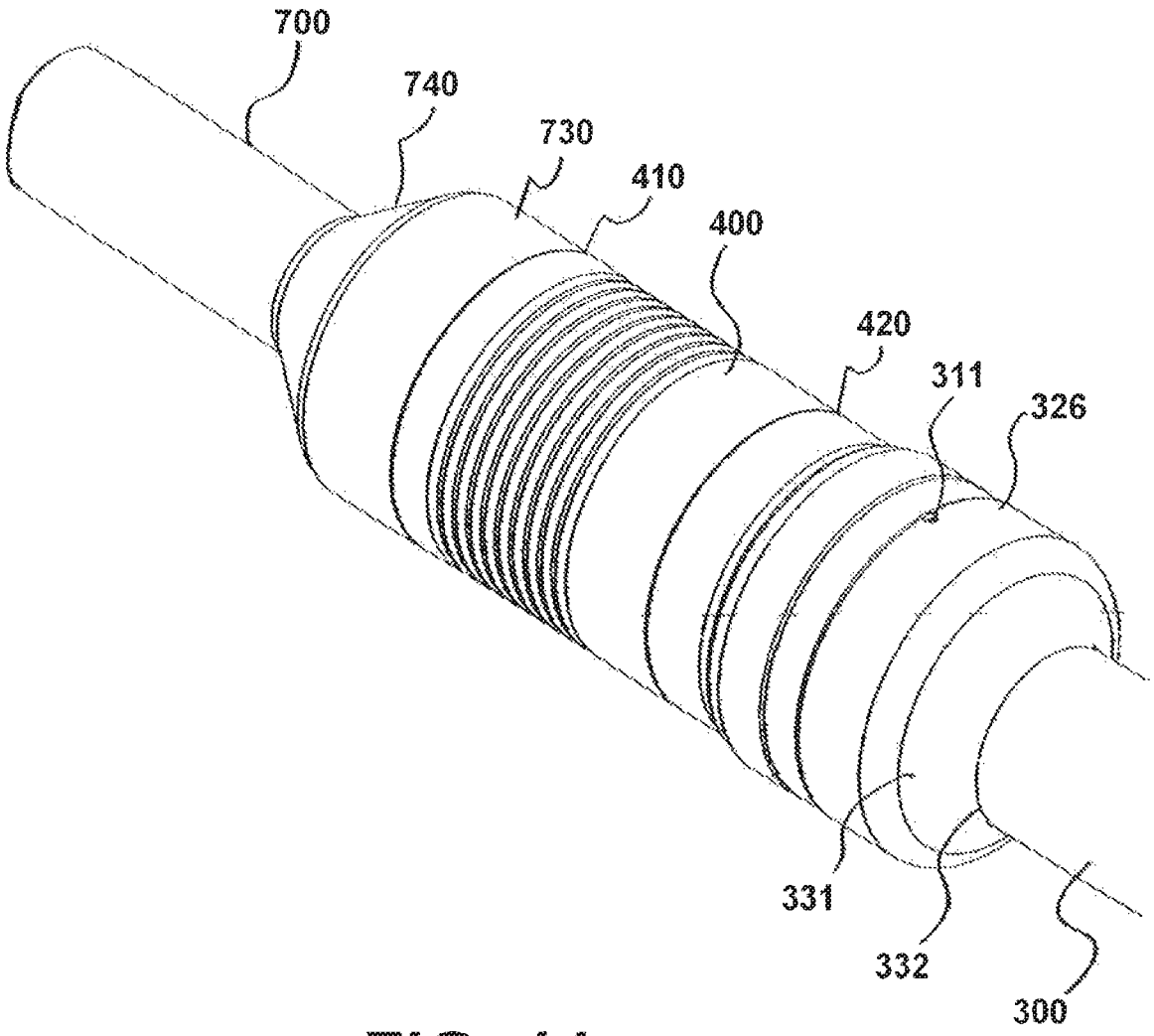
FIG. 11 is a perspective view of the top portion of the swivel of FIG. 5 where the sleeve or housing has been moved to the top portion of the mandrel.
Figure 12:
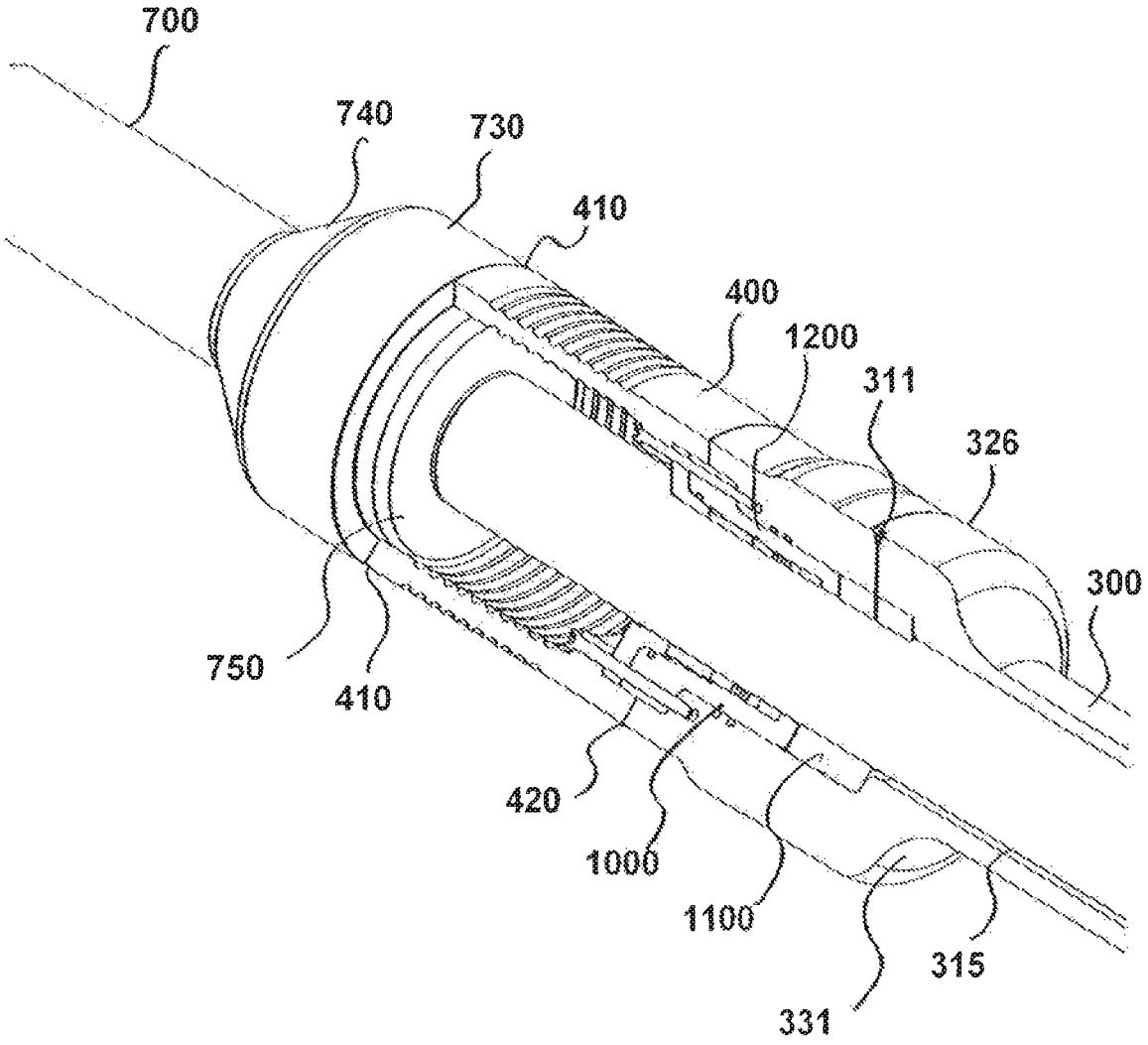
FIG. 12 is a sectional view of the swivel shown in FIG. 11 where part of the sleeve or housing has been removed to show various internal components.

FIGS. 3, 4A-4C, 5 through 12 show one embodiment of swivel 100. FIG. 5 is a side view of swivel 100 where sections from the upper and lower portions of mandrel 110 have been omitted to show swivel 100 in a single figure. FIG. 6 is a sectional side view of swivel 100 where part of the sleeve or housing 300 has been removed. FIG. 7 is a sectional view of the bottom portion of the swivel 100. FIG. 8 is a sectional view of the top portion of swivel 100. FIG. 9 is a perspective view of the bottom portion of the swivel of FIG. 5 where sleeve or housing 300 has been moved to the bottom portion of mandrel 110. FIG. 10 is a sectional view of swivel 100 where part of the sleeve or housing 300 has been removed to show various internal components. FIG. 11 is a perspective view of the top portion of swivel 100 where sleeve or housing 300 has been moved to the upper portion 120 of mandrel 110. FIG. 12 is a sectional view of swivel 100 where part of sleeve or housing 300 has been removed to show various internal components.

Swivel 100 can be comprised of mandrel 110 and sleeve or housing 300. Sleeve or housing 300 can be rotatably, reciprocably, and/or sealably connected to mandrel 110. Accordingly, when mandrel 110 is rotated and/or reciprocated sleeve or housing 300 can remain stationary to an observer insofar as rotation and/or reciprocation is concerned. Sleeve or housing 300 can fit over mandrel 110 and can be rotatably, reciprocably, and sealably connected to mandrel 110.

In FIG. 3, sleeve or housing 300 can be rotatably connected to mandrel 110 by one or more bushings and/or bearings 1100, preferably located on opposed longitudinal ends of sleeve or housing 300.

In FIG. 3, sleeve or housing 300 can be sealingly connected to mandrel 110 by a one or more seals, preferably located on opposed longitudinal ends of sleeve or housing 300. The seals can seal the gap 315 between the interior 310 of sleeve or housing 300 and the exterior of mandrel 110.

In FIG. 3, sleeve or housing 300 can be reciprocally connected to mandrel 110 through the geometry of mandrel 110 which can allow sleeve or housing 300 to slide relative to mandrel 110 in a longitudinal direction (such as by having a longitudinally extending distance H 180 of the exterior surface of mandrel 110 a substantially constant diameter).

In FIG. 3, bushings and/or bearings 1100 can include annular bearings, tapered bearings, ball bearings, teflon bearing sleeves, and/or bronze bearing sleeves, allowing for low friction levels during rotating and/or reciprocating procedures.

The various components of swivel 100 will be individually described below.

Mandrel

Figure 13:
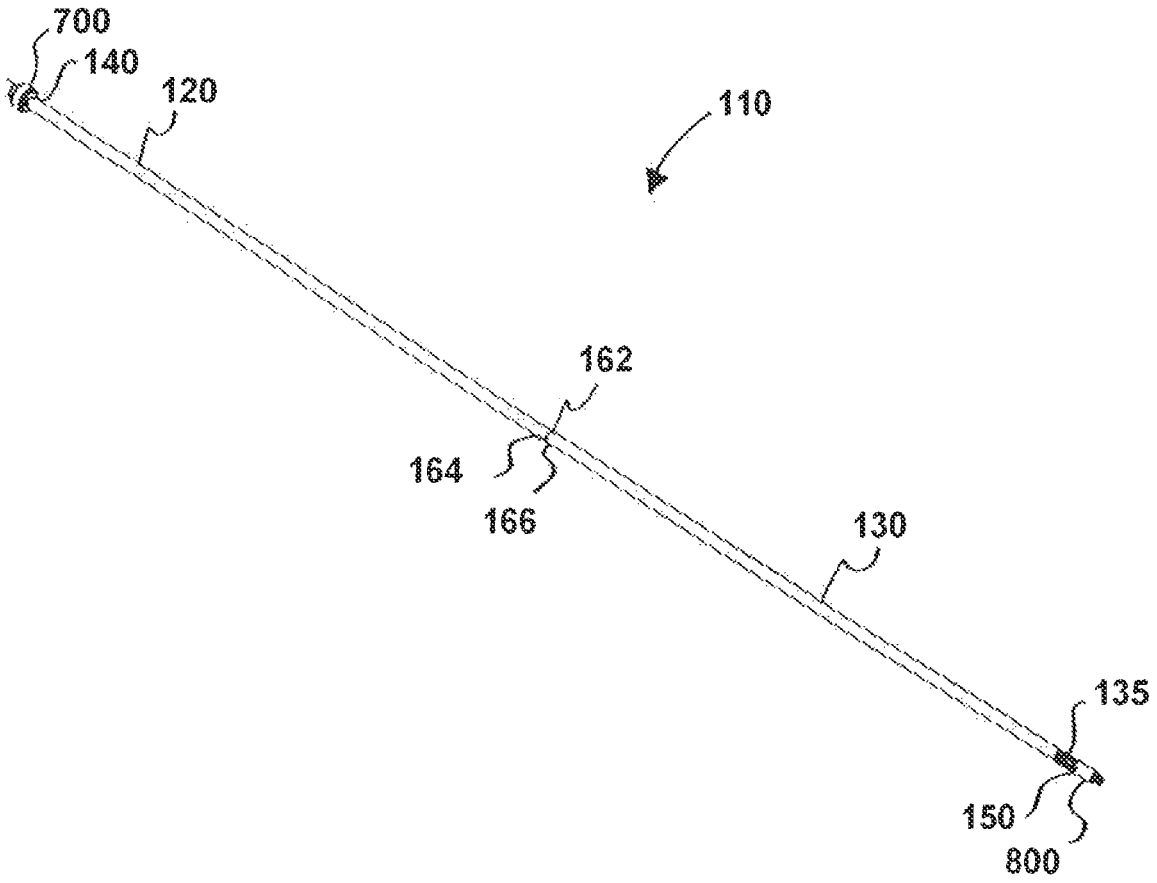
FIG. 13 is a perspective view of a mandrel for the swivel of FIG. 5.
Figure 14:
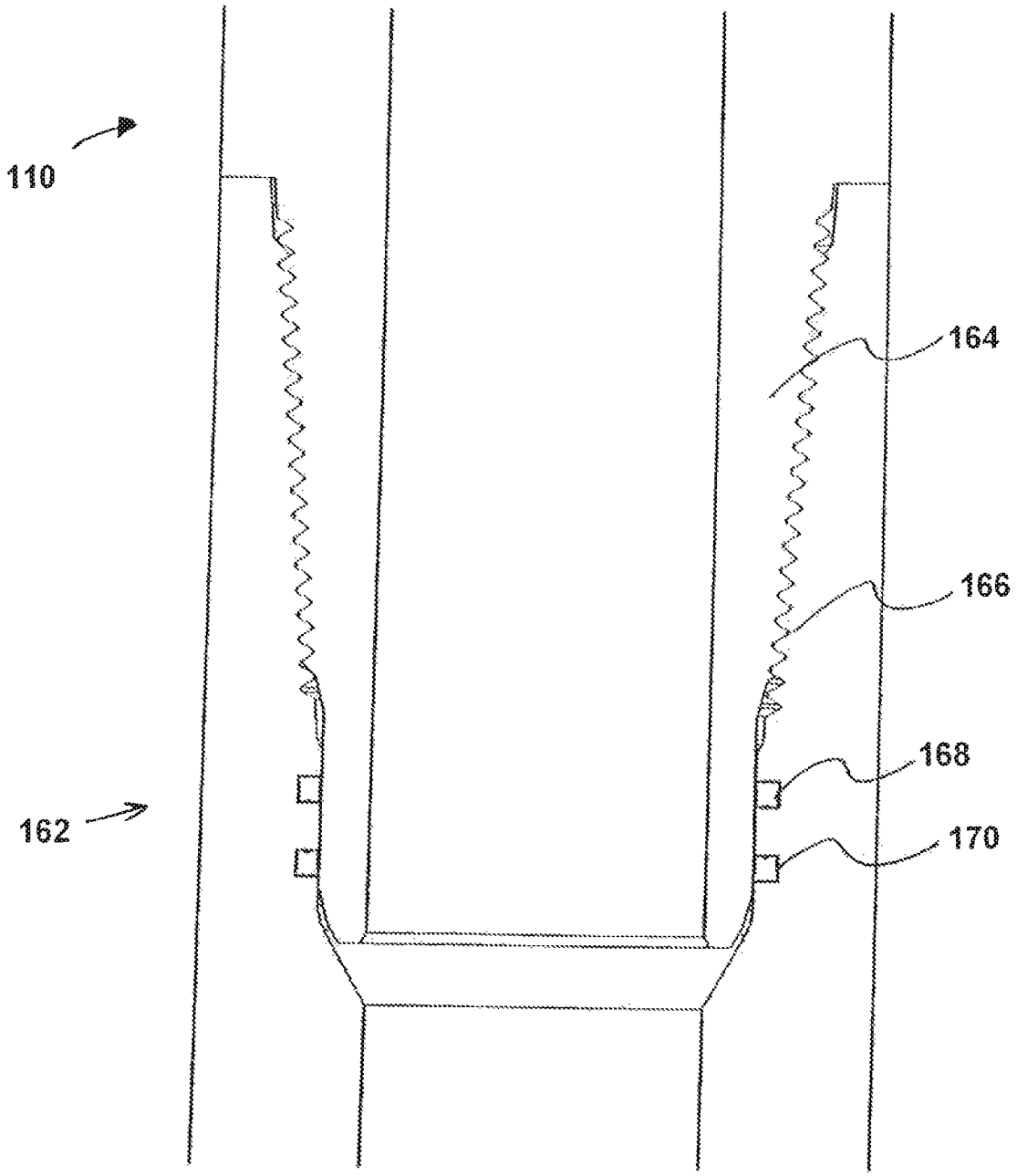
FIG. 14 is a sectional view of the middle portion of the mandrel of FIG. 13.
Figure 15:
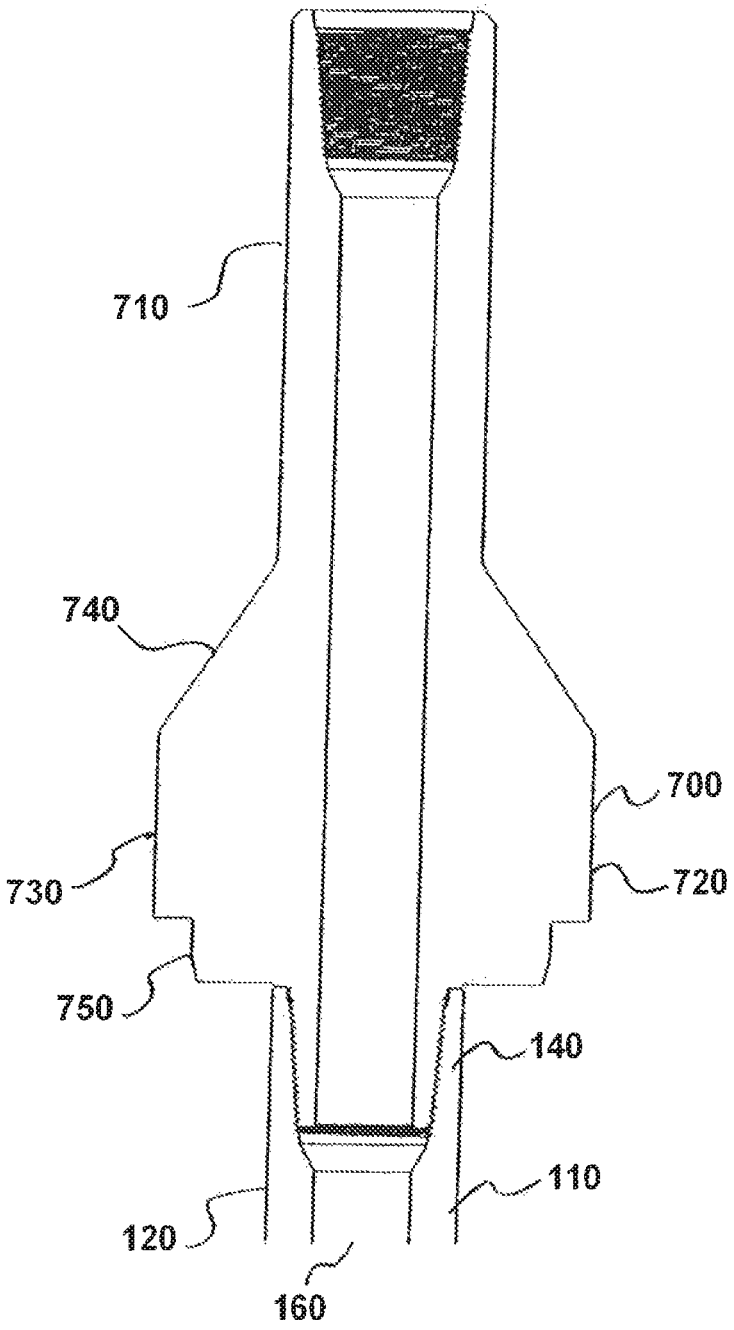
FIG. 15 is a sectional view of the upper portion of the mandrel of FIG. 13.
Figure 16:
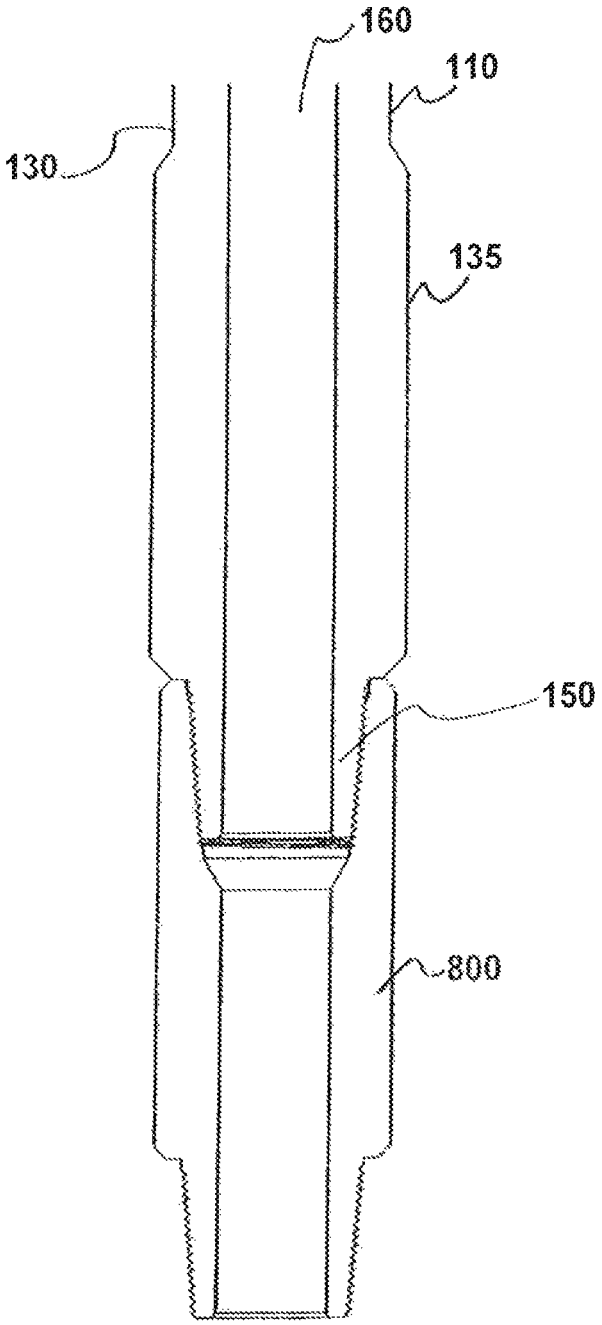
FIG. 16 is a sectional view of the bottom portion of the mandrel of FIG. 13.

FIG. 13 is a perspective view of mandrel 110. FIG. 14 is a sectional view of the middle portion of mandrel 110. FIG. 15 is a sectional view of the upper portion of mandrel 110. FIG. 16 is a sectional view of the bottom portion of mandrel 110. Mandrel 110 can comprise upper end 120 and lower end 130. Mandrel 110 preferably is designed to take substantially all of the structural load from upper well string 85 and lower well string 86 (at least the load of lower well string 86). Mandrel 110 lower end 130 can include a pin connection 150 or any other conventional connection. Upper end 120 can include box connection 140 or any other conventional connection. Central longitudinal passage 160 (see FIG. 16) can extend from upper end 120 through lower end 130. As shown in FIGS. 2-3, mandrel 110 can in effect become a part of upper and lower well string 85,86. Because of a long desired length for mandrel 110, it can include two sections—upper end or section 120 and lower end or section 130 which are connected at connection point 162. At connection point 162 upper end 120 can include a pin connection 164 and lower end can include a box connection 166 (although other conventional type connections can be used). To assist in sealing central longitudinal passage 160, at connection 162 one, two, or more seals can be used (such as polypack seals 168, 170 or other seals).

In one embodiment upsets, such as joints of pipe can be placed respectively on upper and lower sections 120, 130 of mandrel 110 which act as stops for longitudinal movement of sleeve 300. Upset or joints of pipe can include larger diameter sections than the outer diameter of mandrel. Having larger diameters can prevent sleeve 300 from sliding off of mandrel 110. Joints of pipe can act as saver subs for the ends of mandrel 110 which take wear and handling away from mandrel 110. Joints of pipe are preferably of shorter length than a regular 20 or 40 foot joint of pipe, however, can be of the same lengths. In one embodiment joints of pipe include saver portions which engage sleeve or housing 300 at the end of mandrel 110. Saver portions can be shaped to cooperate with the ends of sleeve or housing 300. Saver portions can be of the same or a different material than sleeve or housing 300, such as polymers, teflon, rubber, or other material which is softer than steel or iron. In one embodiment a portion or portions of mandrel 110 itself can be enlarged to act as a stop(s) for movement of sleeve 300.

As shown in FIGS. 13 and 15, joint of pipe 700 can be connected to upper portion 120 of mandrel 110. Joint 700 can comprise upper portion 710, lower portion 720, enlarged area 730, frustoconical area 740, and protruding section 750. Joint 700 can limit the upper range of reciprocal motion between sleeve or housing 300 and mandrel 110. As shown in FIGS. 13 and 15, lower portion 130 of mandrel can include As shown in FIGS. 13 and 16, lower portion 130 of mandrel 110 can include enlarged fluted area 135. Fluted area 135 can be used to limit the maximum downward movement by sleeve or housing 300 relative to mandrel 110. This area can be fluted to assist in fluid flow between the external diameter of fluted area and the internal diameter of a passageway through which fluted area is passing (for example, the internal diameter of well head 88). Where these two diameters are relatively close to each other, the flutes can assist in fluid flow between the two diameters. FIG. 16 also shows a saver sub 800 connected to the pin end 150 of mandrel 110, which can protect or save the threaded area of pin end 150.

To reduce friction between mandrel 110 and sleeve 300 during rotational and/or reciprocational type movement, mandrel 110 can include a hard chromed area on its outer diameter throughout the travel length (or stroke) of sleeve 300 which can assist in maintaining a seal between mandrel 110 and sleeve or housing 300's sealing area during rotation and/or reciprocation activities or procedures. Alternatively, the outer diameter throughout the travel length (or stroke) of sleeve or housing 300 can be treated, coated, and/or sprayed welded with a materials of various compositions, such as hard chrome, nickel/chrome or nickel/aluminum (95 percent nickel and 5 percent aluminum) A material which can be used for coating by spray welding is the chrome alloy TAFA 95MX Ultrahard Wire (Armacor M) manufactured by TAFA Technologies, Inc., 146 Pembroke Road, Concord N.H. TAFA 95 MX is an alloy of the following composition: Chromium 30 percent; Boron 6 percent; Manganese 3 percent; Silicon 3 percent; and Iron balance. The TAFA 95 MX can be combined with a chrome steel. Another material which can be used for coating by spray welding is TAFA BONDARC WIRE-75B manufactured by TAFA Technologies, Inc. TAFA BONDARC WIRE—75B is an alloy containing the following elements: Nickel 94 percent; Aluminum 4.6 percent; Titanium 0.6 percent; Iron 0.4 percent; Manganese 0.3 percent; Cobalt 0.2 percent; Molybdenum 0.1 percent; Copper 0.1 percent; and Chromium 0.1 percent. Another material which can be used for coating by spray welding is the nickel chrome alloy TAFALOY NICKEL-CHROME-MOLY WIRE-71T manufactured by TAFA Technologies, Inc. TAFALOY NICKEL-CHROME-MOLY WIRE-71T is an alloy containing the following elements: Nickel 61.2 percent; Chromium 22 percent; Iron 3 percent; Molybdenum 9 percent; Tantalum 3 percent; and Cobalt 1 percent. Various combinations of the above alloys can also be used for the coating/spray welding. The exterior of mandrel 110 can also be coated by a plating method, such as electroplating or chrome plating. Its surface and its surface can be ground/polished/finished to a desired finish to reduce friction packing assemblies.

Mandrel 110 can be machined from a 4340 heat treated steel bar stock or heat treated forgings (alternatively, can be from a rolled forging). Preferably, ultra sound inspections are performed using ASTM A388. Preferably, internal and external surfaces are wet magnetic particle inspected using ASTM 709 (No Prods/No Yokes). The preferred overall length of mandrel 110 is about 77 feet (23.5 meters). The preferred length of upper end 120 is 38.64 feet (11.78 meters) and lower end 130 is about 38.5 feet (11.73 meters). Preferably pin end 150 and box end 140 can be joined through a modified 5½ inch (14 centimeter) FH connection. Preferably, design of these connections is based on a 7½ inch (19 centimeter) outer diameter, 3½ inch (8.9 centimeter) inner diameter and a material yield strength of 135,000 psi (931,000 kilopascals). Mandrel 110 is preferably designed to handle the tensile and torsional loads that a completion string supports (such as from annular blowout preventer 70 to the bottom of well bore 40) and meet the requirements of API Specifications 7 and 7G.

The following properties are preferred:

| | |
|---|---|
| minimum tensile yield strength | 135,000 psi (931,000 kilopascals) (Tensile tested per ASTM A370, 2% offset method). |
| minimum elongation percent | 13% |
| Brinell hardness range | 341/388 BHN |
| impact strength | average impact value not less than 27 foot-pounds with no single value below 12 foot-pounds when tested at −4 degrees F. (−20 degrees C.) as per ASTM E23. |

Mandrel's 100 box 140 and pin 150 rotary shouldered connections preferably conform to dimensions provided in tables 25 and 26 of API specification 7.

At connection 162, there is preferably included connecting portions with 7 inch outer diameter s and 3½ inch (8.9 centimeters) inner diameters having a material yield strength of 135,000 psi (931,000 kilopascals). The two connecting portions 120, 130 are preferably center piloted to insure that their outer diameters remain concentric after makeup. Preferably, the box and pin bevel diameter is eliminated at connection 162 and dual high pressure seals are used to seal from fluids migration both internally and externally. Preferably, fluid tongs are used to make up connection 162 to prevent scarring or damage to the exterior surface of mandrel 110.

In an alternative embodiment o-rings with one or two backup rings on either side can be used. Strength and Design Formulas of API 7G-APPENDIX A provide the following load carrying specifications for mandrel 110.

| | |
|---|---|
| End Connections | |
| Torque To Yield Rotary Shoulder connection | 90,400 foot-pounds (122.5 kN-M); |
| Recommended makeup torque at 60% of Yield Stress | 54,250 foot-pounds (73.6 kN-M); |
| Tensile Load to Yield at 0 psi internal pressure | 2,011,500 pounds (9,140 kilo newtons); |
| Center Connection | |
| Torque To Yield Rotary Shoulder connection | 70,800 foot-pounds (96 kN-M); |
| Recommended makeup torque at 60% of Yield Stress | 42,500 foot-pounds (57.6 kN-M); |
| Tensile Load to Yield at 0 psi internal pressure | 2,011,500 pounds (9,140 kilonewtons); |
| *These center connection ratings also apply to connections between the upper end and the box end limit sub. The maximum make up torque for wet tongs is believed to be 34,000 foot-pounds. | |
| Mandrel burst pressure | 55,500 psi (383,000 kilopascals) |
| Mandrel collapse pressure | 40,500 psi (279,000 kilopascals) |

Sleeve or Housing

Figure 17:
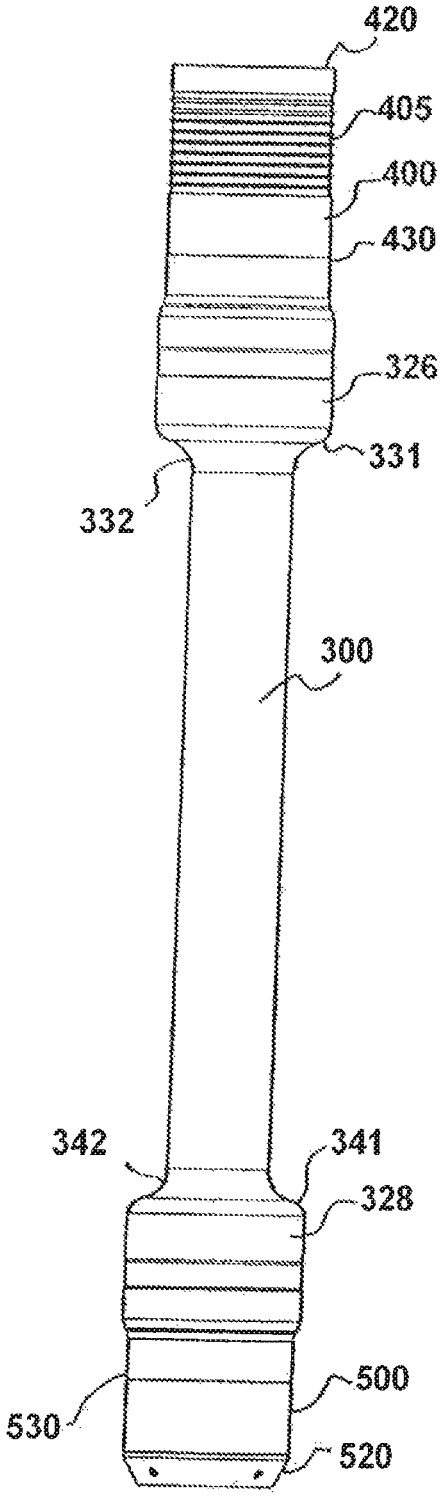
FIG. 17 is a view of the sleeve or housing for the mandrel of FIG. 5 with end caps attached.
Figure 18:
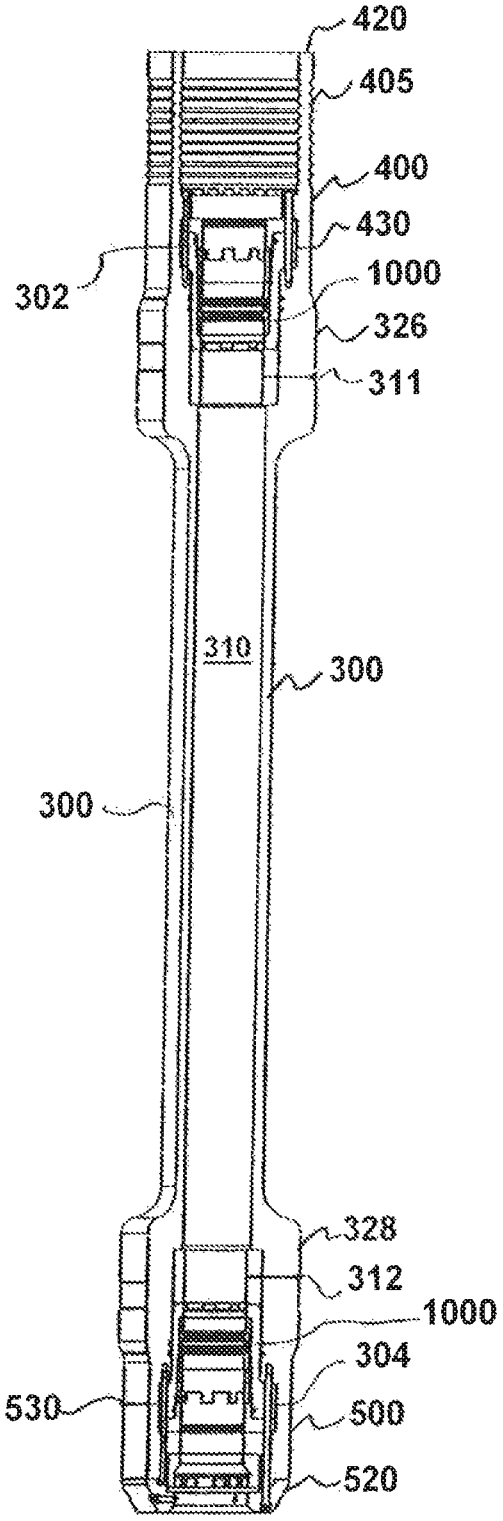
FIG. 18 is a sectional view of the sleeve or housing of FIG. 17 showing various components.
Figure 19:
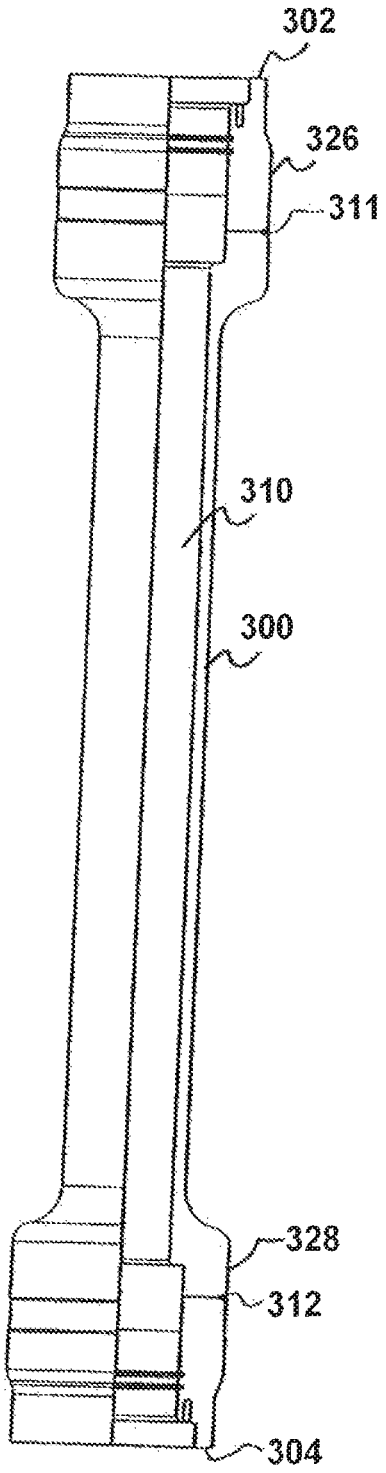
FIG. 19 is a sectional view of the sleeve or housing for the mandrel of FIG. 5 with all attachments removed.
Figure 20:
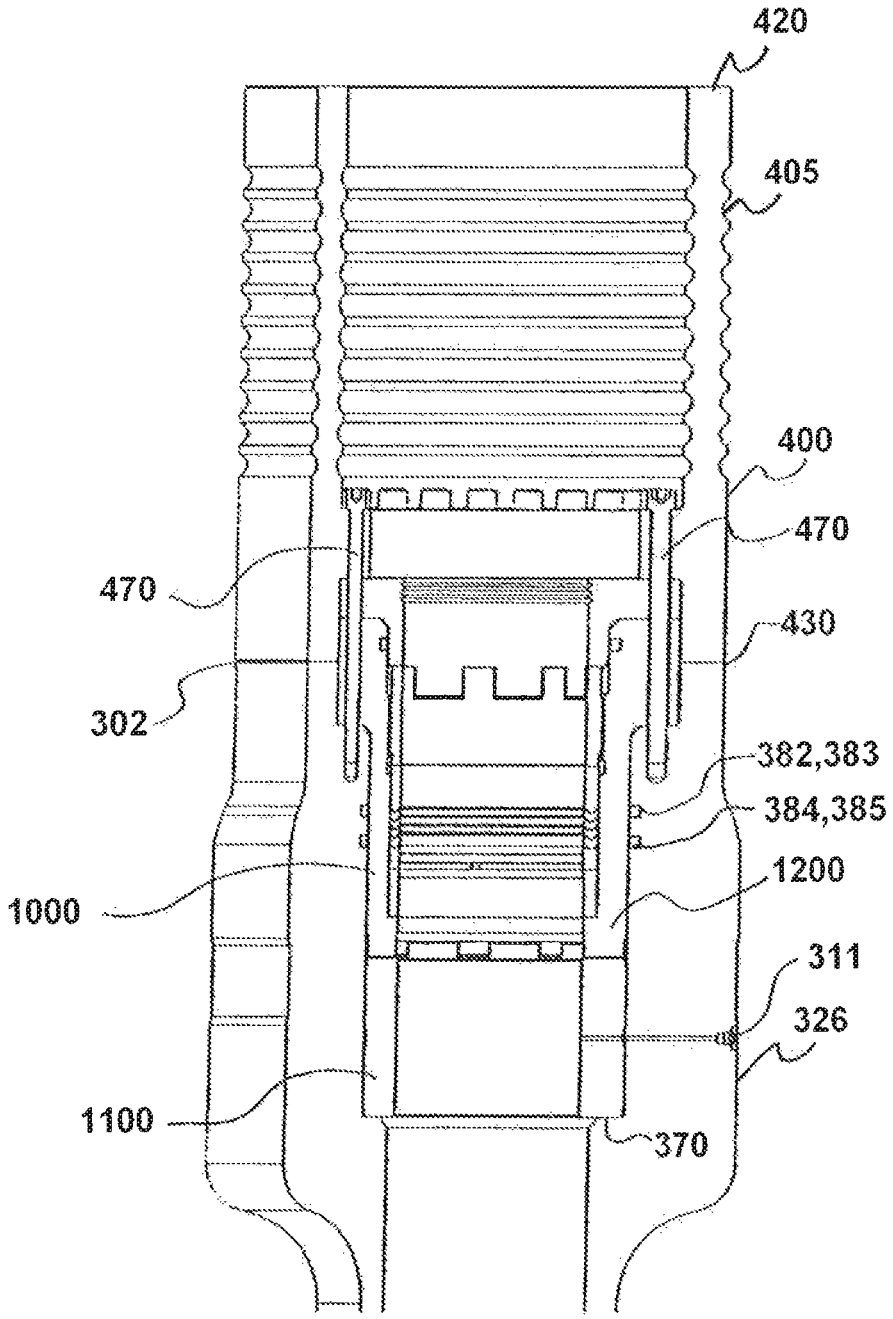
FIG. 20 is a sectional view of the upper portion of the sleeve or housing of FIG. 17.
Figure 21:
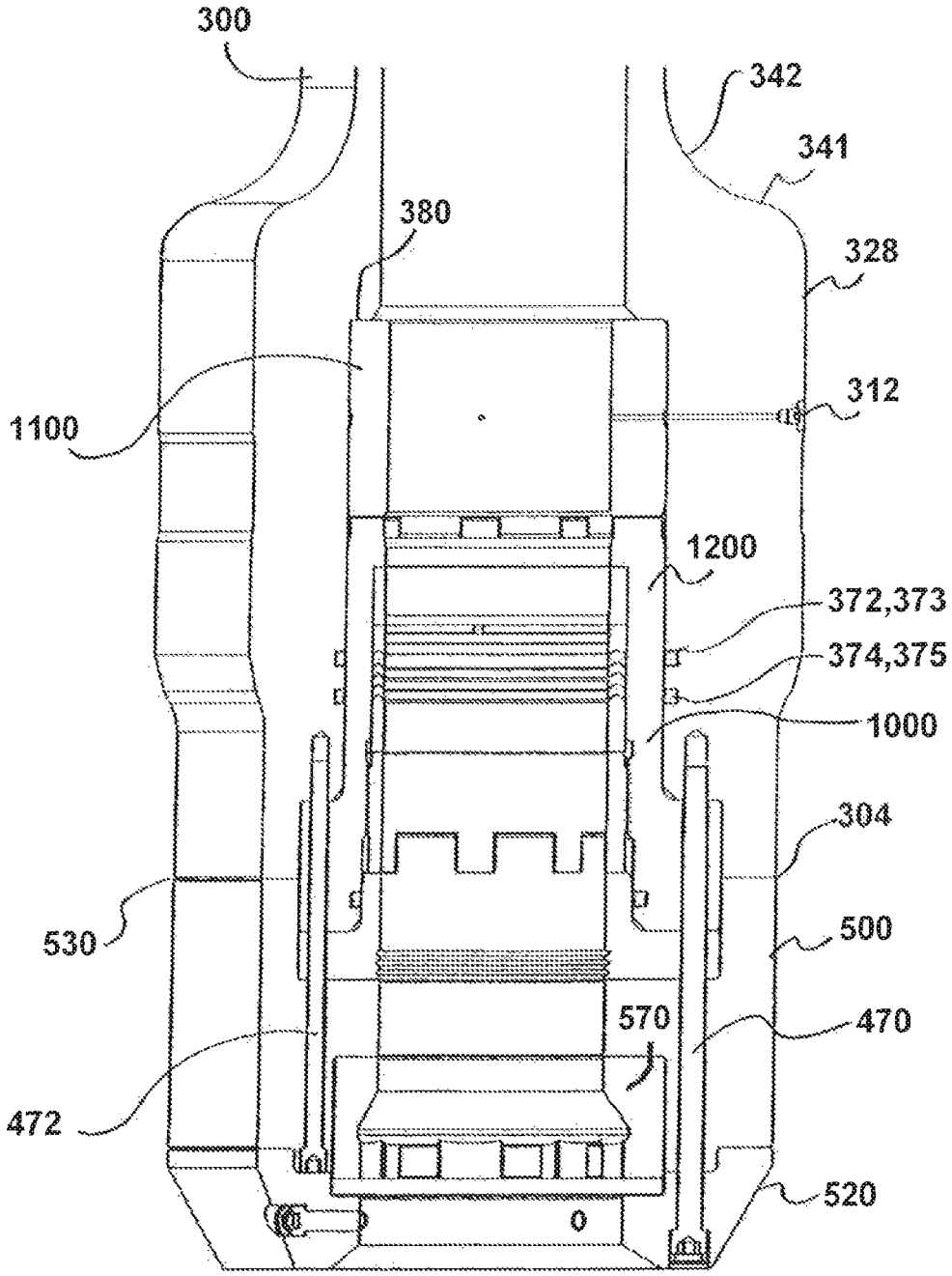
FIG. 21 is a sectional view of the lower portion of the sleeve or housing of FIG. 17.

FIG. 17 is a top view of sleeve or housing 300. FIG. 18 is a sectional view of sleeve or housing 300 showing various components. FIG. 19 is a longitudinal sectional view of sleeve or housing 300 with attachments removed. FIG. 21 is a sectional view of the lower portion of sleeve or housing 300. FIG. 20 is a sectional view of the upper portion of sleeve or housing 300.

Sleeve or housing 300 can include upper end 302 (FIG. 20), lower end 304 (FIG. 21), and interior section 310. In one embodiment sleeve or housing 300 can slide and/or reciprocate relative to mandrel 110. At least a portion of the surface of sleeve or housing 300 can be designed to increase its frictional coefficient, such as by knurling, etching, rings, ribbing, etc. This can increase the gripping power of annular seal 71 (of blow-out preventer 70) against sleeve or housing 300 where there exists high differential pressures above and below blow-out preventer 70 which differential pressures tend to push sleeve or housing 300 in a longitudinal direction.

Sleeve or housing can include upper and lower catches, shoulders, flanges 326,328 (or upsets) on sleeve or housing 300. Upper and lower catches, shoulders, flanges 326,326 restrict relative longitudinal movement of sleeve or housing 300 with respect to blow out preventer 70 where high differential pressures exist above and or below blow-out preventer 70 which differential pressures tend to push sleeve or housing 300 in a longitudinal direction.

When displacing, housing or sleeve 300 is preferably located in annular blowout preventer 70 with annular seal 71 closed on sleeve or housing 300 between upper and lower catches, shoulders, flanges 326, 328. As displacement is performed differential pressures tend to push up or down on sleeve or housing 300 causing one of the catches, flanges, shoulders to be pushed against annular blowout preventer 70 seal 71. It is believed that this differential pressure acts on the cross sectional area of sleeve or housing 300 (ignoring the catch, shoulder, sleeve) and the mandrel's 110 seven inch diameter. One example of a differential force is 125,000 pounds (556 kilo newtons) of thrust which sleeve or housing 300 transfers to annular blowout preventer 70. These forces should be taken into account when designing catches, shoulders, flanges to transfer such forces to blowout preventer 70, such as through annular seal 71 or back support for this annular seal.

Upper and lower catches, shoulders, flanges 326, 328 can be integral with or attachable to sleeve or housing 300. In one embodiment one or both catches, shoulders, flanges 326, 328 are integral with and machined from the same piece of stock as sleeve or housing 300. In one embodiment one or both catches, shoulders, flanges 326, 328 can be threadably connected to sleeve or housing 300. In one embodiment one or both catches, shoulders, flanges 326, 328 can be welded or otherwise connected to sleeve or housing 300. In one embodiment one or both catches, shoulders, flanges 326, 328 can be heat or shrink fitted onto sleeve or housing 300. In one embodiment upper and lower catches, shoulders, flanges 326, 328 are of similar construction. In one embodiment upper and lower catches, shoulders, flanges 326, 328 have shapes which are curved or rounded to resist cutting/tearing of annular seal unit 71 if by chance annular seal unit 71 closes on either upper or lower catch, shoulder, flange 326, 328. In one embodiment upper and lower catches 326, 328 have are constructed to avoid any sharp corners to minimize any stress enhances (e.g., such as that caused by sharp corners) and also resist cutting/tearing of other items.

In one embodiment the largest radial distance (i.e., perpendicular to the longitudinal direction) from end to end for either catch, shoulder, flange 326, 328 is less than the size of the opening in the housing for blow-out preventer 70 so that sleeve or housing 300 can pass completely through blow-out preventer 70. In one embodiment the upper surface of upper catch, shoulder, flange 326 and/or the lower surface of lower catch, shoulder, flange 328 have frustoconical shapes or portions which can act as centering devices for sleeve or housing 300 if for some reason sleeve or housing 300 is not centered longitudinally when passing through blow-out preventer 70 or other items in riser 80 or well head 88. In one embodiment upper catch, shoulder, flange 326 is actually larger than the size of the opening in the housing for blow-out preventer 70 which will allow sleeve or housing to make metal to metal contact with the housing for blow-out preventer 70.

In one embodiment the largest distance from either catch, shoulder, flange 326,328 is less than the size of the opening in the housing for blow-out preventer 70, but large enough to contact the supporting structure for annular seal unit 71 thereby allowing metal to metal contact either between upper catch, shoulder, flange 326 and the upper portion of supporting structure for seal unit 71 or allowing metal to metal contact between lower catch, shoulder, flange 328 and the lower portion of supporting structure for seal unit 71. This allows either catch, shoulder, flange to limit the extent of longitudinal movement of sleeve or housing 300 without relying on frictional resistance between sleeve or housing 300 and annular seal unit 71. Preferably, contact is made with the supporting structure of annular seal unit 71 to avoid tearing/damaging seal unit 71 itself.

In one embodiment non-symmetrical upper and lower catches, shoulders, flanges 326, 328 can be used. For example a plurality of radially extending prongs can be used. As another example a single prong can be used. Additionally, channels, ridges, prongs or other upsets can be used. The catches or upsets to not have to be symmetrical. Whatever the configuration upper and lower catches, shoulders, flanges 326, 328 should be analyzed to confirm that they have sufficient strength to counteract longitudinal forces and/or thrust loads expected to be encountered during use.

Upper catch, shoulder, flange 326 can include base 331, radiused area 332, and upper end 302. Upper end 302 can be shaped to fit with upper retainer cap 400. Upper retainer cap 400 can itself include upper surface 420 which accepts thrust loads on sleeve or housing 300. In one embodiment, upper surface 420 can be shaped to avoid sharp corners and act as a centering device when being moved uphole, such as up through blow out preventer 70.

Radiused area 332 can be included to reduce or minimize stress enhancers between catch, shoulder, flange 326 and sleeve or housing 300. Other methods of stress reduction can be used. Alternatively radiused area 332 and base 331 can be shaped to coordinate with annular seal member 71 of annular blow-out preventer 70, such as where there will be no metal to metal contact between catch, shoulder, flange 326 and blow-out preventer 70 (e.g., where catch, shoulder, flange 326 only contacts annular seal member 71 and does not contact any of the supporting framework for annular seal member 71). Lower catch, shoulder, flange 328 can be similar to, symmetric with, or identical to upper catch, shoulder, or flange 326.

In an alternative embodiment lower and/or upper catches, shoulders, flanges 328, 326 can be shaped to act as centering devices for swivel 100 if for some reason swivel 100 is not centered longitudinally when passing through blow-out preventer 70.

Sleeve or housing 300 can include upper and lower lubrication ports 311, 312. Ports 311,312 can be used to lubricate the bearings located under the ports. When in service it is preferred that lubrication ports 311,312 be closed through threadable pipe plugs (or any pressure relieving type connection). This will prevent fluid migration through ports 311,312 when swivel 100 is exposed to high pressures (e.g., 5,000 pounds per square inch)(34.48 megapascals) or even higher pressure such as when in deep water service (e.g. 8,600 feet or 2,620 meters). It is preferred that the heads of pipe plugs placed in lubrication ports 311,312 will be flush with the surface. Flush mounting will minimize the risk of having sleeve or housing 300 catch or scratch something when in use.

End caps can be provided for sleeve or housing 300.

Upper end 302 of sleeve or housing 300 can be connected to upper retainer cap 400. Upper retainer cap 400 can serve as a bearing surface where sleeve or housing 300 moves all the way to the upper end of upper portion 120 of mandrel.

Looking at FIG. 5, protruding section 750 of joint 700 will enter tip 420 of retainer cap 400. At this point tip will serve as to transfer loads to sleeve or housing 300. If drill or well string 85,86 is rotating relative to sleeve or housing 300, tip 420 will also serve as a bearing surface. Upper retainer cap 400 can be connected to sleeve or housing 300 using first and second plurality of bolts 470, 472.

Lower end 304 of sleeve or housing 300 can be connected to lower retainer cap 500. Lower retainer cap 500 can serve as a bearing surface where sleeve or housing 300 moves all the way to the lower end of lower portion 120 of mandrel. Looking at FIG. 10, fluted area 135 will operatively connect with bearing 570. At this point fluted section 135 will transfer loads to sleeve or housing 300. If drill or well string 85,86 is rotating relative to sleeve or housing 300, bearing 570 will also serve as a bearing surface. Lower retainer cap 500 can be connected to sleeve or housing 300 using first and second plurality of bolts 541, 545.

Figure 32:
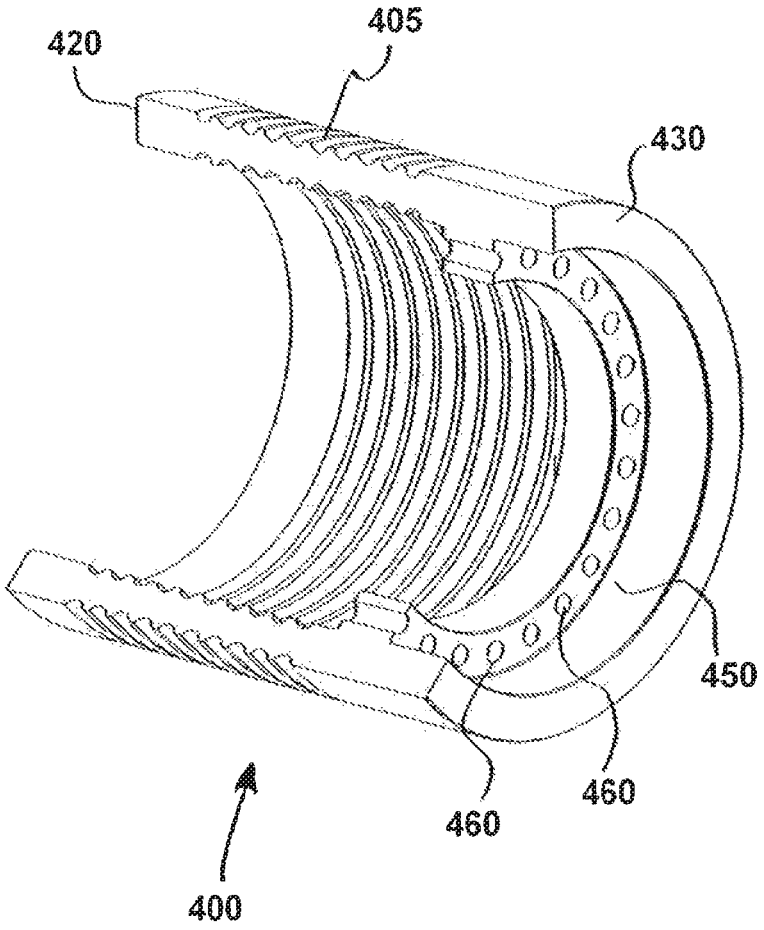
FIG. 32 is a sectional perspective view of a bearing cap for the upper end of the sleeve or housing shown in FIG. 17.

FIG. 32 is a sectional perspective view of one embodiment for an upper bearing cap 400 for the upper end of sleeve or housing 300. Upper retainer cap 400 can comprise tip 420, base 430, plurality of ribs 405. Recessed area 450 and plurality of openings 460 can be used to connect upper bearing cap 400 to upper catch, shoulder, flange 326 of sleeve or housing 300. First plurality of fasteners 470 along with second plurality of fasteners 472 can make such connection.

Figure 33:
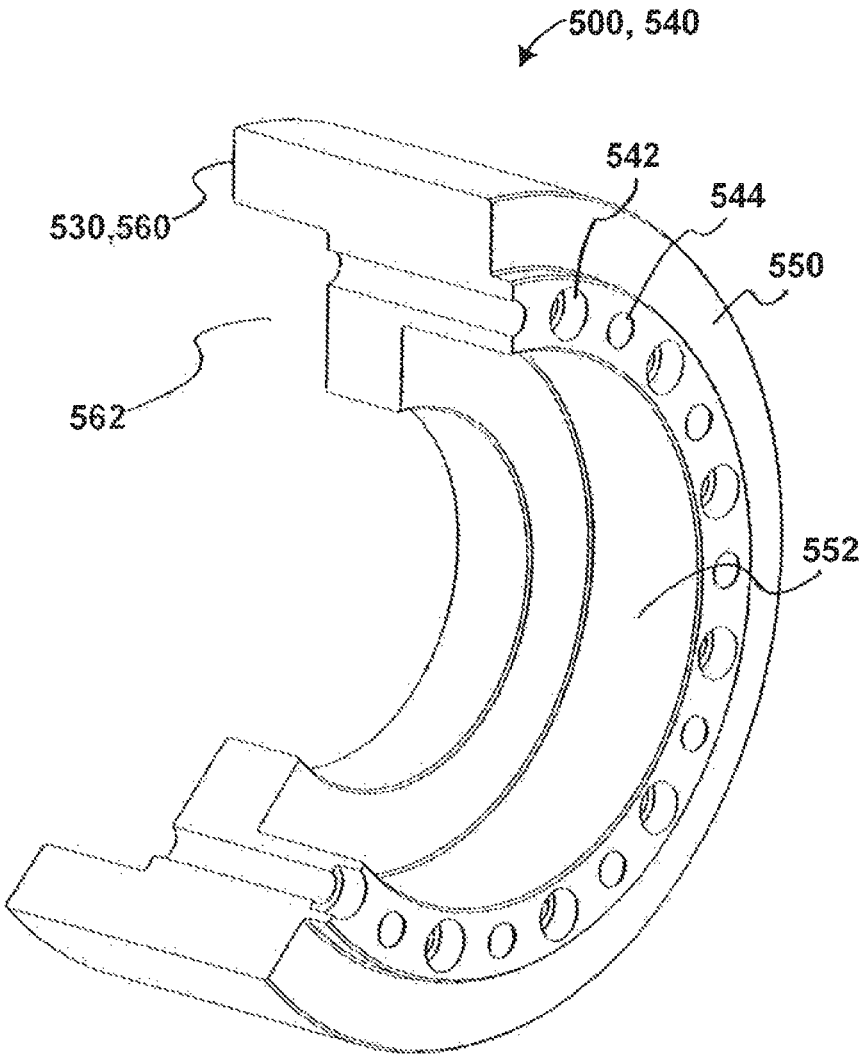
FIG. 33 is a sectional perspective view of the bearing housing for the lower end cap of the sleeve or housing shown in FIG. 17.

FIGS. 10 and 33 through 35 show one embodiment for a lower retainer cap 500 for the lower end of sleeve or housing 300. Lower retainer cap 500 can comprise tip 520, base 530, and housing 540. Housing 540 can include recessed area 552 which can rotatively and slidably support thrust hub or bearing 570. As shown in FIG. 33, base 500 can comprise first end 550 and second end 560. At first end 550 can be recessed area 552 which can accept bearing 570. At second end 560 can be recessed area 562 which can accept end cap 1500 of bearing and packing assembly 1000. Also at second end 560 can be first plurality of openings 542 and second plurality of openings 544 which may extend from second end 560 to recessed area 562.

Figure 34:
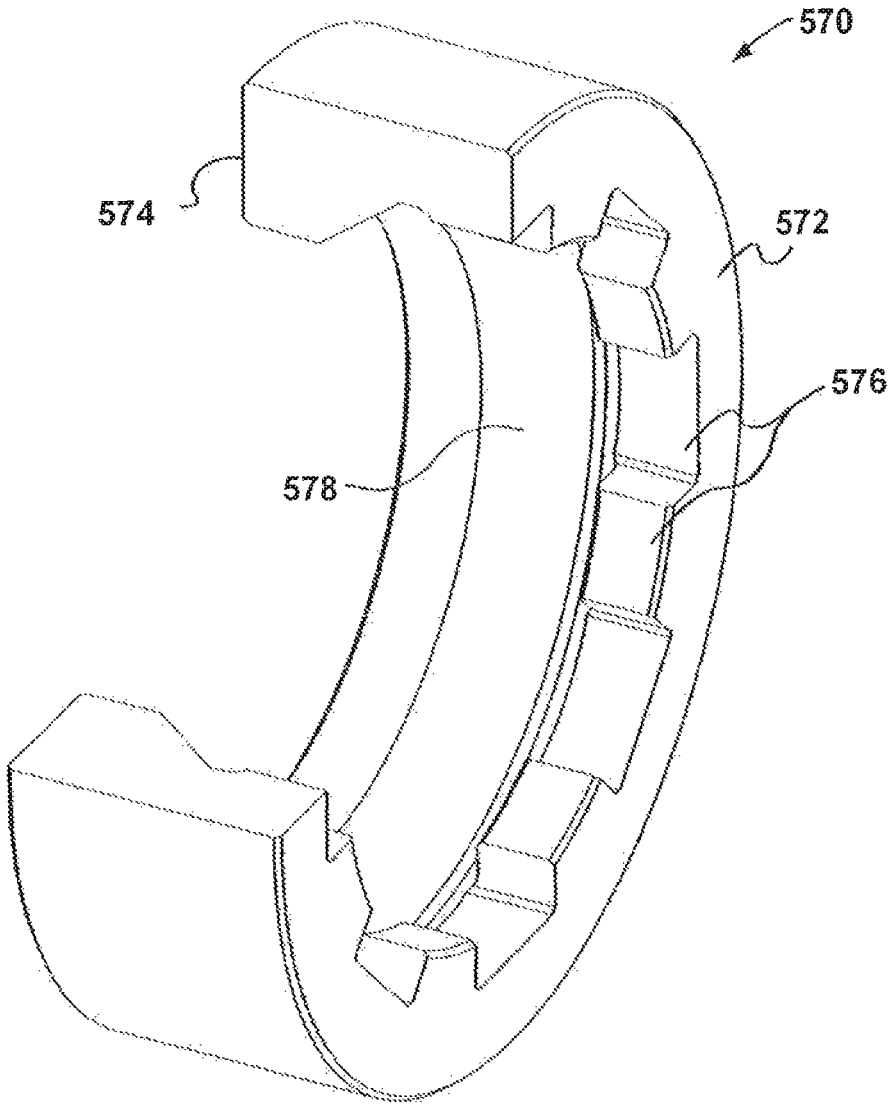
FIG. 34 is a sectional perspective view of a bearing thrust plate for the lower end of the sleeve or housing shown in FIG. 17.

As shown in FIG. 34, bearing 570 can comprise first end 572 and second end 574. At first end can be a plurality of tips and recesses 576 which can detachably interconnect with fluted area 135 of mandrel 110. Additionally angled section 578 can be provided as a bearing surface in the event that a thrust load is transmitted from fluted area 135 to sleeve or housing 300.

Figure 35:
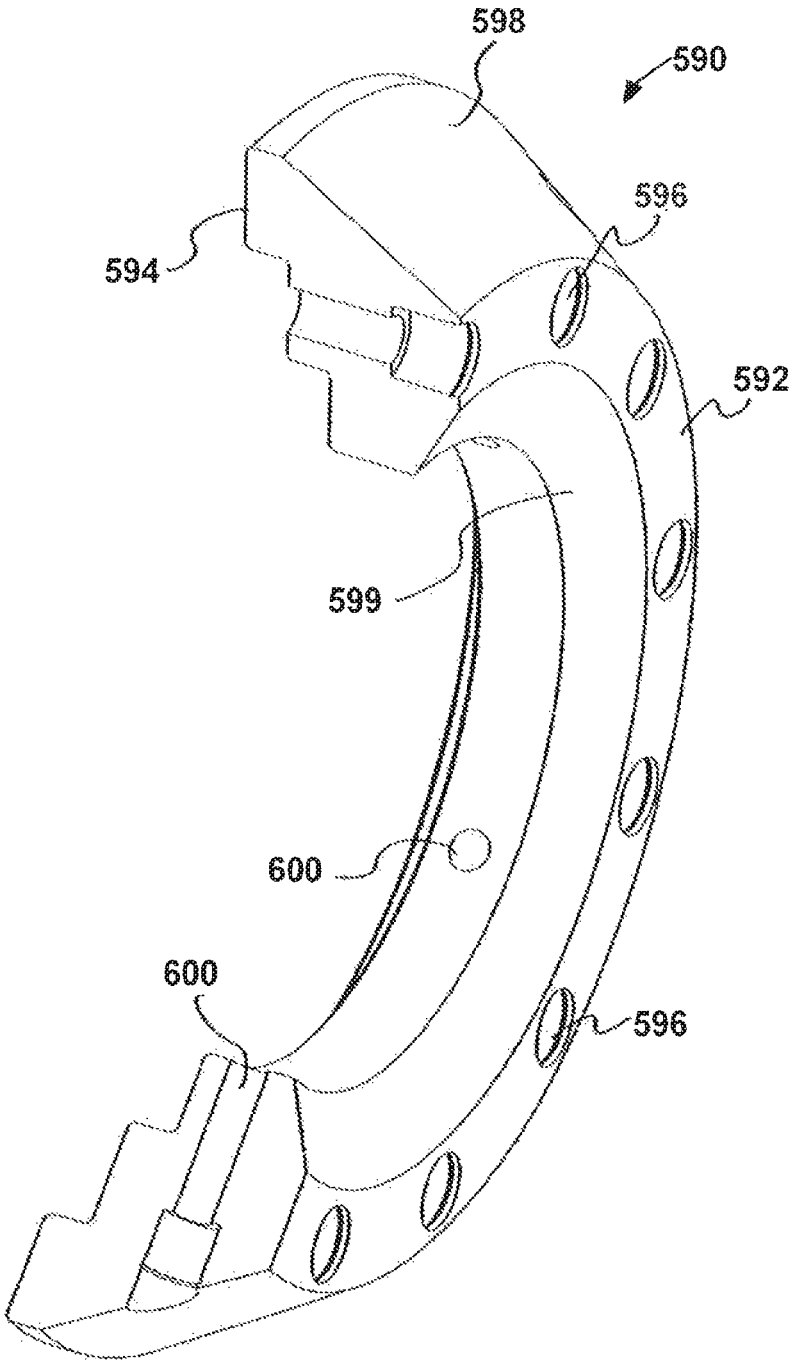
FIG. 35 is a sectional perspective view of a cap for the lower end of the sleeve or housing shown in FIG. 17.

As shown in FIG. 35, cover 590 can comprise first end 592 and second end 594. At first end 592 can be a plurality of openings 596. An exterior angled section 598 can extend from first end 592 to adjacent second end 594. An interior beveled section can be provided. A plurality of radial openings 600 can be provided for shear pins 610. Preferably, four shear pins 610 are used.

In one embodiment a method and apparatus is provided to restrict items which can come loose from swivel 100 and fall downwhole. Various systems can be used to prevent plurality of fasteners 541,542 (shown in FIG. 10) from becoming loose or unfastened during use of swivel 100. One method is to use a specified torquing procedure. A second method is to use a thread adhesive (such as Lock Tite) on fasteners 541,542. Another is to use a plurality of snap rings or set screws above the heads of fasteners 541,542. Tip 520 of retainer cap 500 (FIG. 21) can be designed to prevent the plurality of fasteners 542 from falling out.

Sleeve or housing 300 can be machined from a 4340 heat treated steel bar stock or heat treated forgings (alternatively, can be from a rolled forging). Preferably, ultra sound inspections are performed using ASTM A388. Preferably, internal and external surfaces are wet magnetic particle inspected using ASTM 709 (No Prods/No Yokes). The following properties are preferred:

| | |
|---|---|
| minimum tensile yield strength | 135,000 psi (931,000 kilopascals) (Tensile tested per ASTM A370, 2% offset method). |
| minimum elongation percent | 15% |
| Brinell hardness range | 293/327 BHN |
| impact strength | average impact value not less than 31 foot-pounds (42 N-M) with no single value below 24 foot-pounds (32.5 N-M) when tested at 4 degrees F. (15.6 degrees C.) as per ASTM E23. |
| minimum preferred factor of safety (based on yield strength and pressure at lower choke line valve) | 5.26:1 |
| sleeve or housing burst pressure | 28,500 psi (197,000 kilopascals) |
| sleeve or housing collapse pressure | 23,500 psi (162,000 kilopascals) |

Preferably, on opposed longitudinal ends of sleeve or housing 300 thrust bearings are provide. These thrust bearings can serve as a safety feature where an operator attempts to over-stroke the mandrel 100 relative to the sleeve or housing 300 causing engagement between these two items and creation of a thrust load. The thrust bearing rating is preferably as follows:

| Box End | |
|---|---|
| continuous rating @ 60 RPM (3000 hours) | 200,000 pounds (890 kilo newtons) |
| intermittent rating @ 60 RPM (300 hours) | 400,000 pounds (1,780 kilo newtons) |
| structural rating @ 0 RPM | 1,600,000 pounds (7,100 kilo newtons) |
| **Pin End** | |
| continuous rating @ 60 RPM (3000 hours) | 135,000 pounds (600 kilo newtons) |
| intermittent rating @ 60 RPM (300 hours) | 270,000 pounds (1,200 kilo newtons) |
| structural rating @ 0 RPM | 1,100,000 pounds (4,900 kilo newtons) |

Bearing and Packing Assembly

Figure 22:
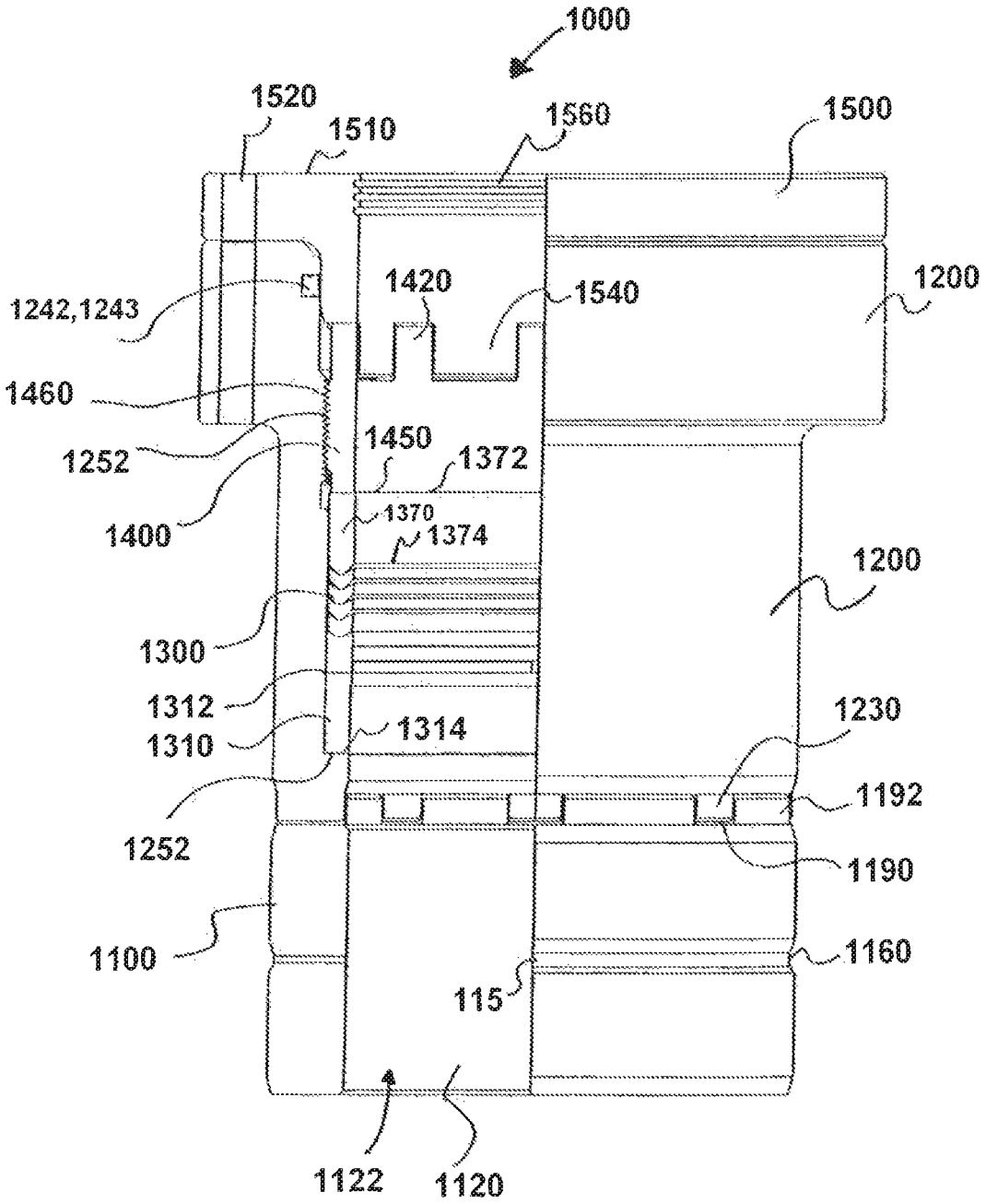
FIG. 22 is a sectional view showing one embodiment for the bearing and packing assembly for the swivel of FIG. 5.
Figure 23:
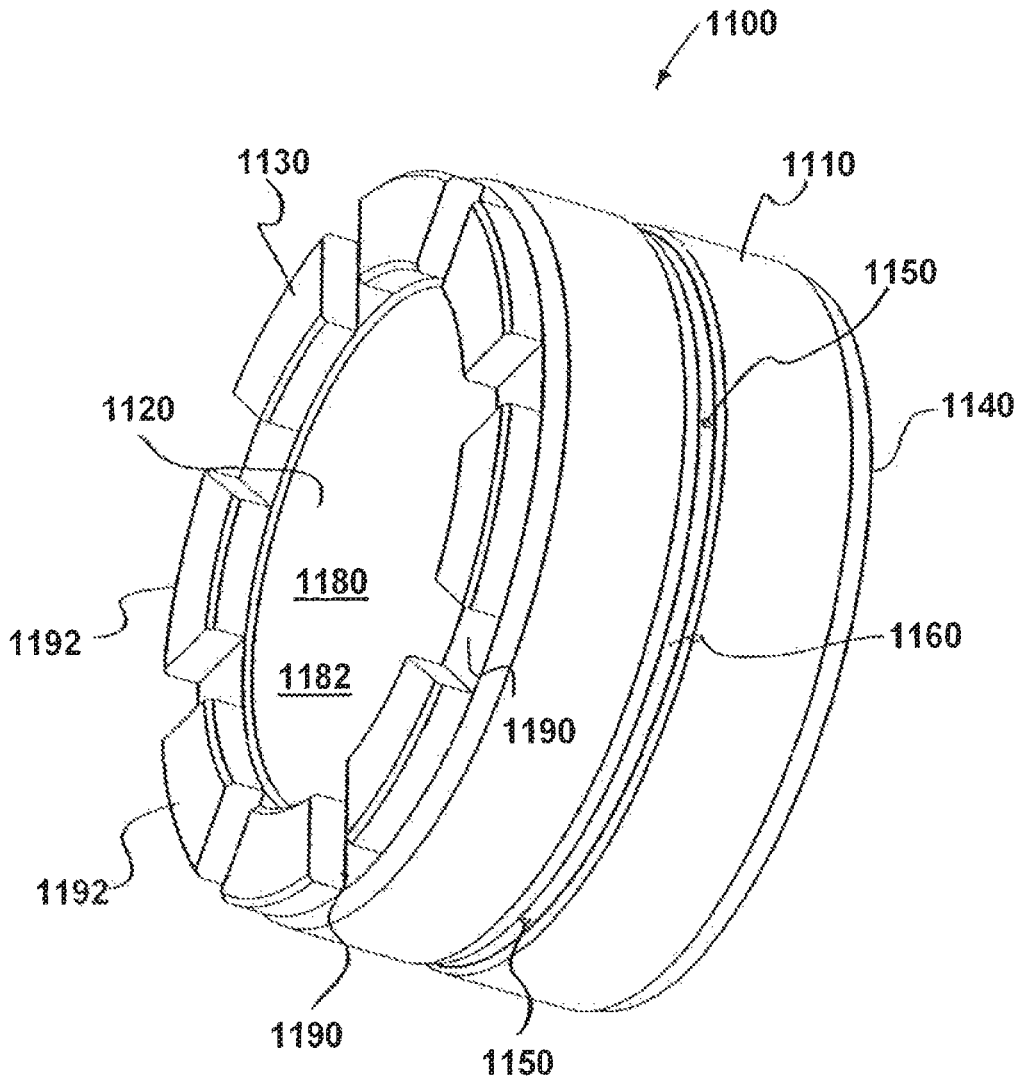
FIG. 23 is a perspective view of a bearing or bushing shown in FIG. 22.
Figure 24:
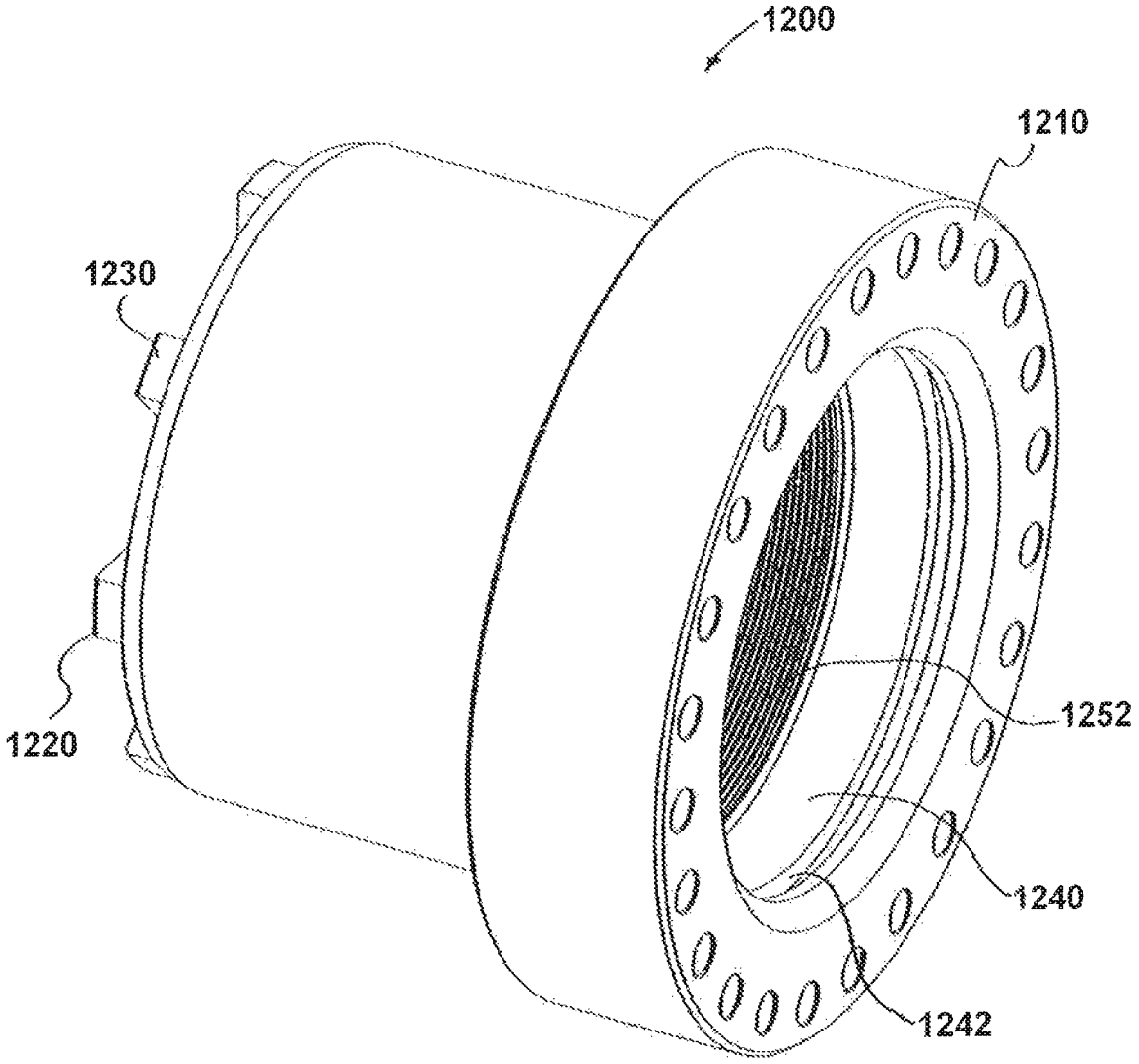
FIG. 24 is a perspective view of the packing housing shown in FIG. 22.
Figure 25:
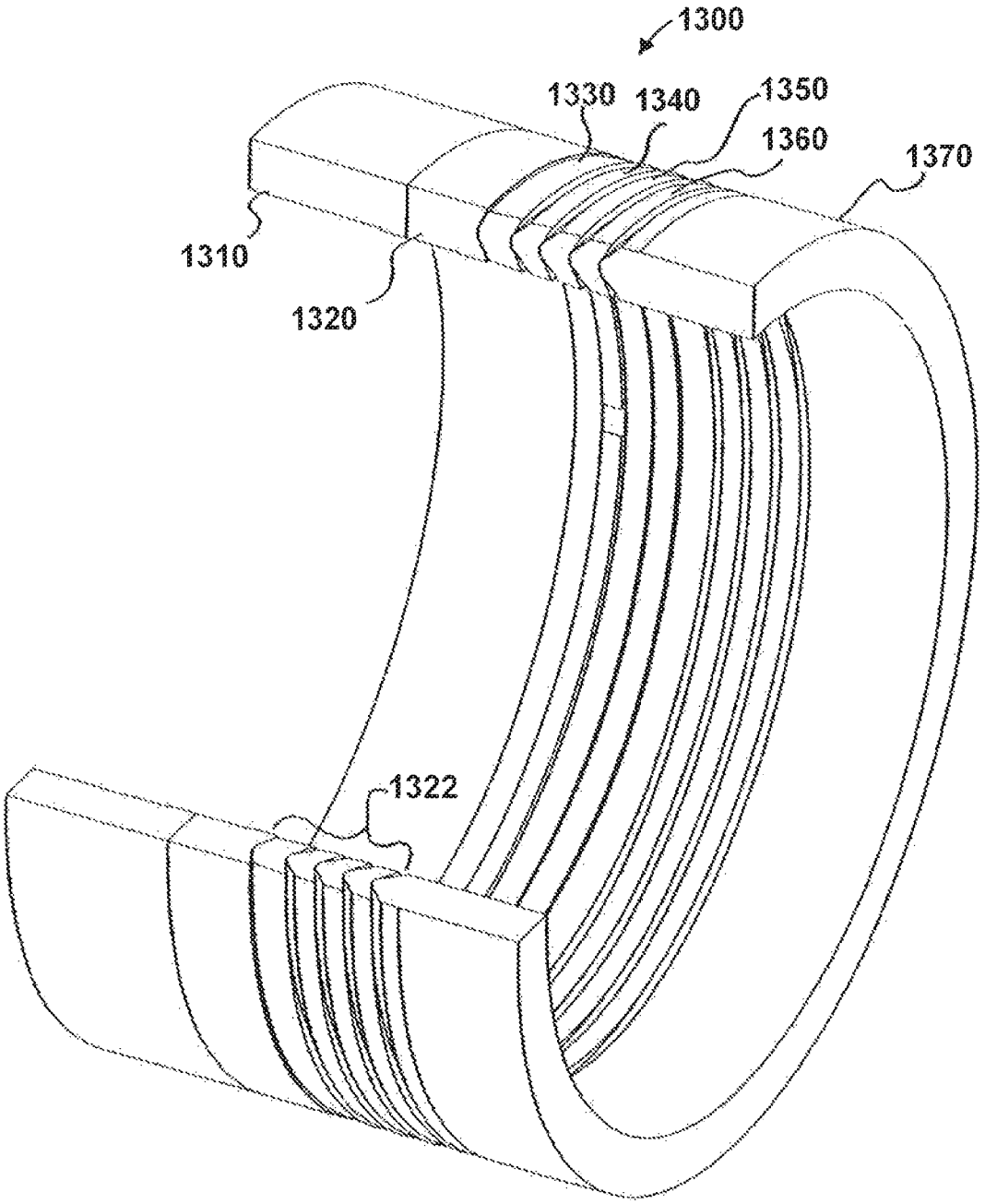
FIG. 25 is a perspective view of the packing housing shown in FIG. 22.
Figure 30:
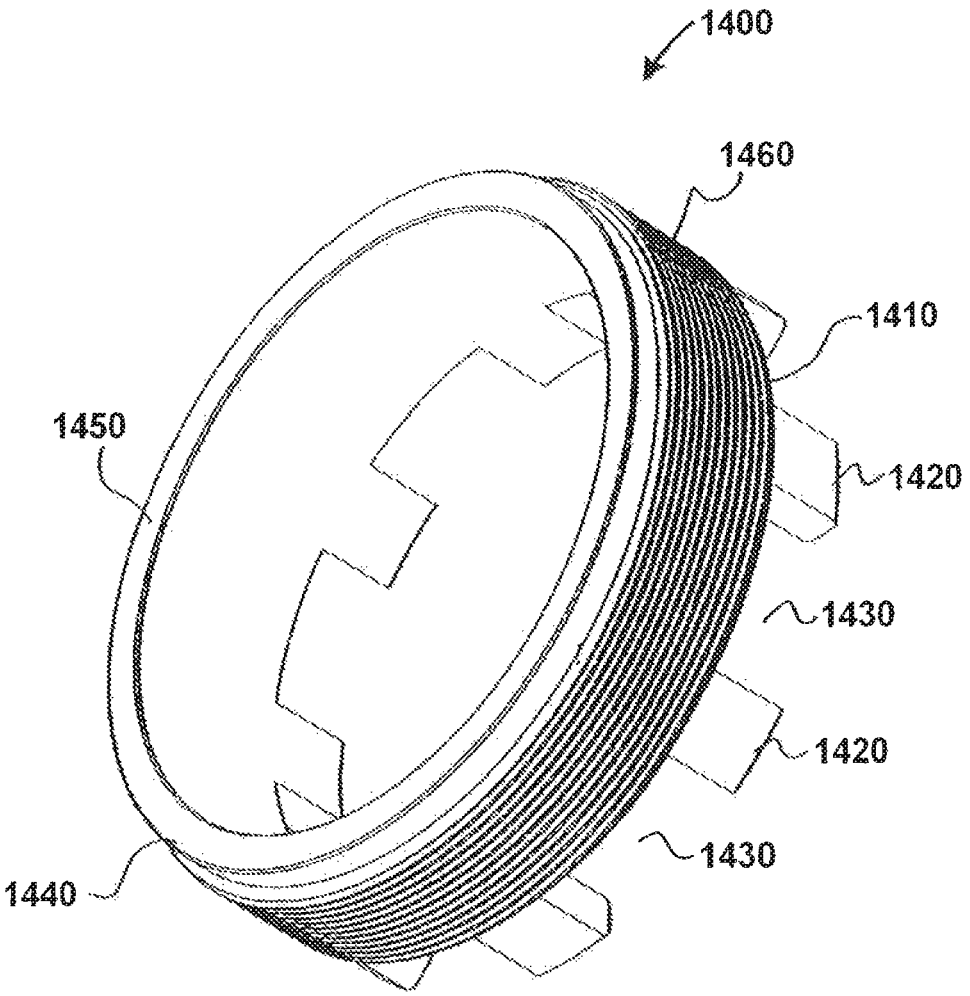
FIG. 30 is a perspective view of a packing nut for the bearing and packing assembly shown in FIG. 22.
Figure 31:
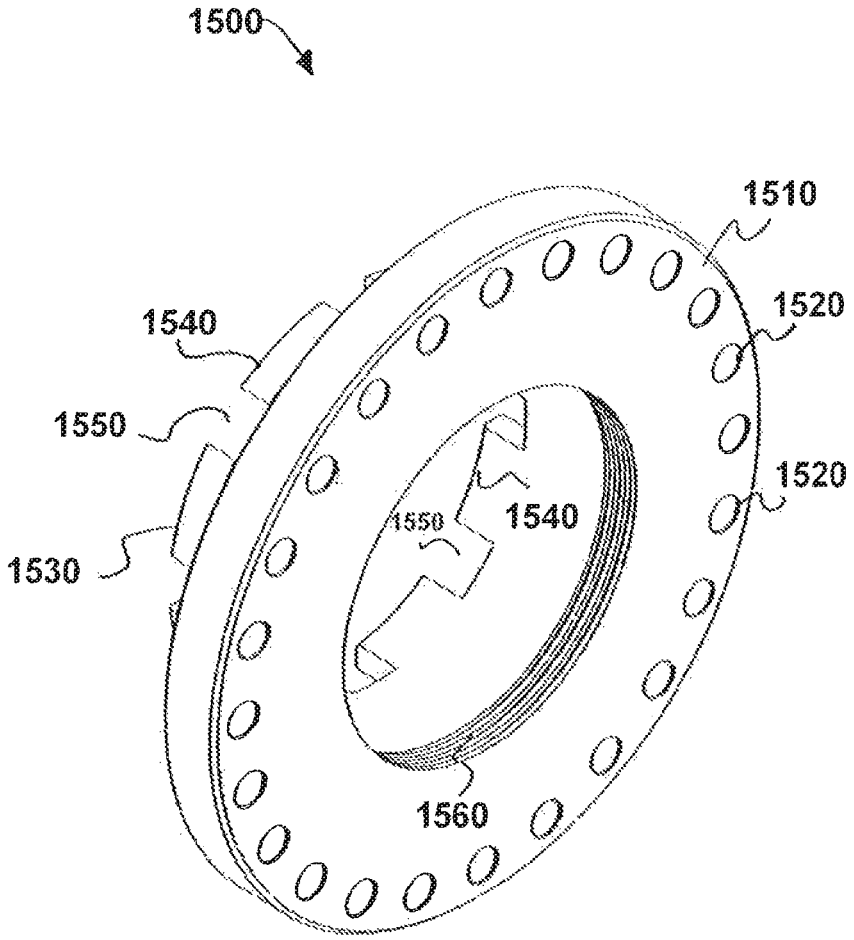
FIG. 31 is a perspective view of a retainer plate for the bearing and packing assembly shown in FIG. 22.

FIG. 22 is a sectional view showing one embodiment for bearing and packing assembly 1000. Bearing and packing assembly can include bearing 1100, packing housing 1200, packing stack 1300, packing retainer nut 1400, and retainer plate 1500. FIG. 23 is a perspective view of a bearing or bushing 1100. FIG. 24 is a perspective view of packing housing 1200. FIG. 25 is a perspective view of packing unit 1300. FIG. 30 is a perspective view of a packing nut 1400. FIG. 31 is a perspective view of a retainer plate 1500. Bearing and packing assembly 1000 can be substantially the same for upper and lower portions of sleeve 300, and only one assembly 1000 will be described below. Lower retainer cap 500 can be used to keep bearing and packing assembly 1000 in sleeve or housing 300. Upper retainer cap 400 can be used to maintain bearing and packing assembly 1000 in sleeve or housing 300.

FIG. 23 is a perspective view of a bearing or busing 1100. Bushing 1100 can be of metal or composite construction—either coated with a friction reducing material and/or comprising a plurality of lubrication enhancing inserts 1182 (not shown). Alternatively, bearing or bushing 1100 can rely on lubrication provided by different metals moving relative to one another. Bushings with lubrication enhancing inserts can be conventionally obtained from Lubron Bearings Systems located in Huntington Beach, Calif. Bushing 1100 is preferably comprised of ASTM B271-C95500 centrifugal cast nickel aluminum bronze base stock with solid lubricant impregnated in the sliding surfaces. Lubrication enhancing inserts preferably comprise PTFE teflon epoxy composite dry blend lubricant (Lubron model number LUBRON AQ30 yield pressure 15,000 psi) and/or teflon and/or nylon. Different inserts can be of similar and/or different construction. Alternatively, lubrication enhancing inserts can be AQ30 PTFE non-deteriorating graphite free solid lubricant suitable for long term submersion in seawater. Preferably, lubrication inserts take up more than 30 percent of the bearing surface areas seeing relative movement. For example one surface of bearing or bushing 1100 can have inserts of one construction/composition while a second surface of can have inserts of a different construction/composition. Additionally, inserts on one surface can be of varying construction/composition. Circular inserts are preferred however, other shaped inserts can be used. Bearing or bushing 1100 can comprise outer surface 1110, inner surface 1120, upper surface 1130, and lower surface 1140. Inserts 1182 can be limited to the surfaces of bearing or bushing 1100 which see movement during relative rotation and/or longitudinal movement between mandrel 110 and sleeve or housing 300 (with swivel 100 this would be the inner surface 1120 of bearing or bushing 1100).

Preferably, bearing or bushing 1100 is a heavy duty sleeve type bearing which is self lubricated and oil bathed. Preferably, it is designed to handle high radial loads and allow mandrel 110 to rotate and reciprocate.

As shown in FIG. 21, bearing or bushing 1100 can be supported between shoulder 380 of sleeve and packing housing 1200. Relative rotation between bearing or bushing 1100 and packing housing 1200 can be prevented by having a plurality of tips 1230 (of housing 1200—see FIG. 24) operatively connected to a plurality of recessed areas 1190 (of bushing 1100). Packing housing 1200 is itself connected to sleeve or housing 300. Accordingly, mandrel 110 will turn relative to bearing or bushing 1100 where mandrel turns relative to sleeve or housing 300, but bearing or bushing 1100 will not turn relative to sleeve or housing 300.

Assisting in lubricating surfaces which move relative to busing or bearing 1100, one or more radial openings 1150 can be radially spaced apart around each bushing or bearing 1100 through a perimeter pathway 1160. Through openings 1150 a lubricant can be injected which can travel to inner surface 1120 along with lower surface 1140 providing a lubricant bath. The lubricant can be grease, oil, teflon, graphite, or other lubricant. The lubricant can be injected through a lubrication port (e.g., upper lubrication port 311 or lower lubrication port 312). Perimeter pathway 1160 can assist in circumferentially distributing the injected lubricant around bearing or bushing 1100, and enable the lubricant to pass through the various openings 1150. Preferably no sharp surfaces/corners exist on outer surface 1110 of bearing or bushing 1100 which can damage seals and/or o-rings when (during assembly and disassembly of swivel 100) bearing or bushing 1100 passes by the seals and/or o-rings. Alternatively, outer surface 1110 can be constructed such that it does not touch any seals and/or o-rings when being inserted into sleeve or housing 300.

FIGS. 10, 12, 20, 21, 22, and 24 best show packing housing 1200. Packing housing 1200 can comprise first end 1210, second end 1220, plurality of tips 1230, first opening 1240, perimeter recess 1242, second opening 1250, and shoulder 1252. Packing housing can hold packing stack 1300 which sealingly connects with mandrel 110. As shown in FIG. 21, packing housing 1200 can be sealingly connected to lower end of sleeve or housing 300 through one or more seals (such as polypack seals) 373, 375, which seals respectively sit in recesses 372,374. Similarly, as shown in FIG. 20, a second packing housing 1200 can be sealingly connected to the upper end of sleeve or housing 300 through one or more seals (such as polypack seals) 383, 385, which seals respectively sit in recesses 382,384.

FIG. 25 is a perspective view of packing unit 1300. Upper and lower packing units 1300 can each comprise male packing ring 1370, plurality of seals 1322, female packing ring 1320, spacer ring 1310, and packing retainer nut 1400 (shown in FIG. 30). Packing retainer nut 1400 can be threadably connected to packing housing 1200 at threaded connection 1460. Tightening packing retainer nut 1400 squeezes plurality of seals 1322 between packing housing 1200 and retainer nut 1400 thereby increasing sealing between sleeve or housing 300 (through packing housing 1200) and swivel mandrel 110.

Figure 26:
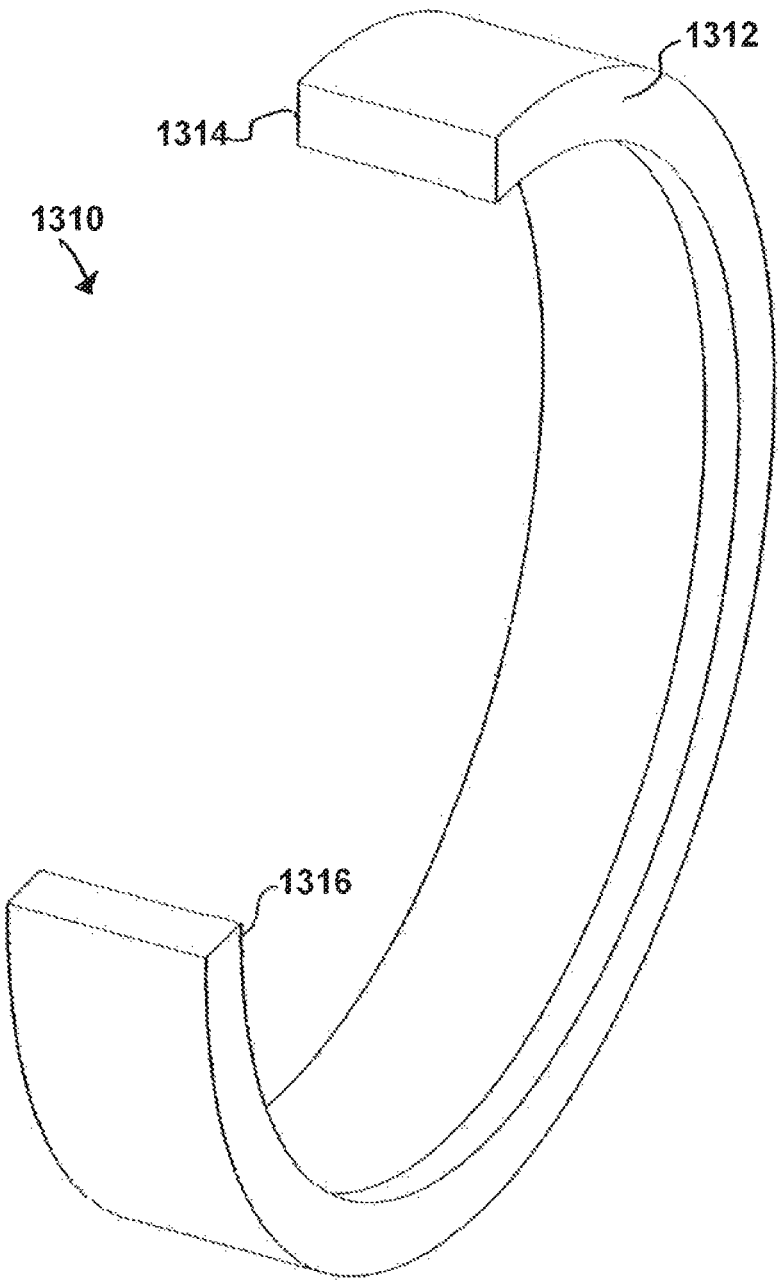
FIG. 26 is a perspective view of a spacer for the bearing and packing assembly shown in FIG. 22.
Figure 27:
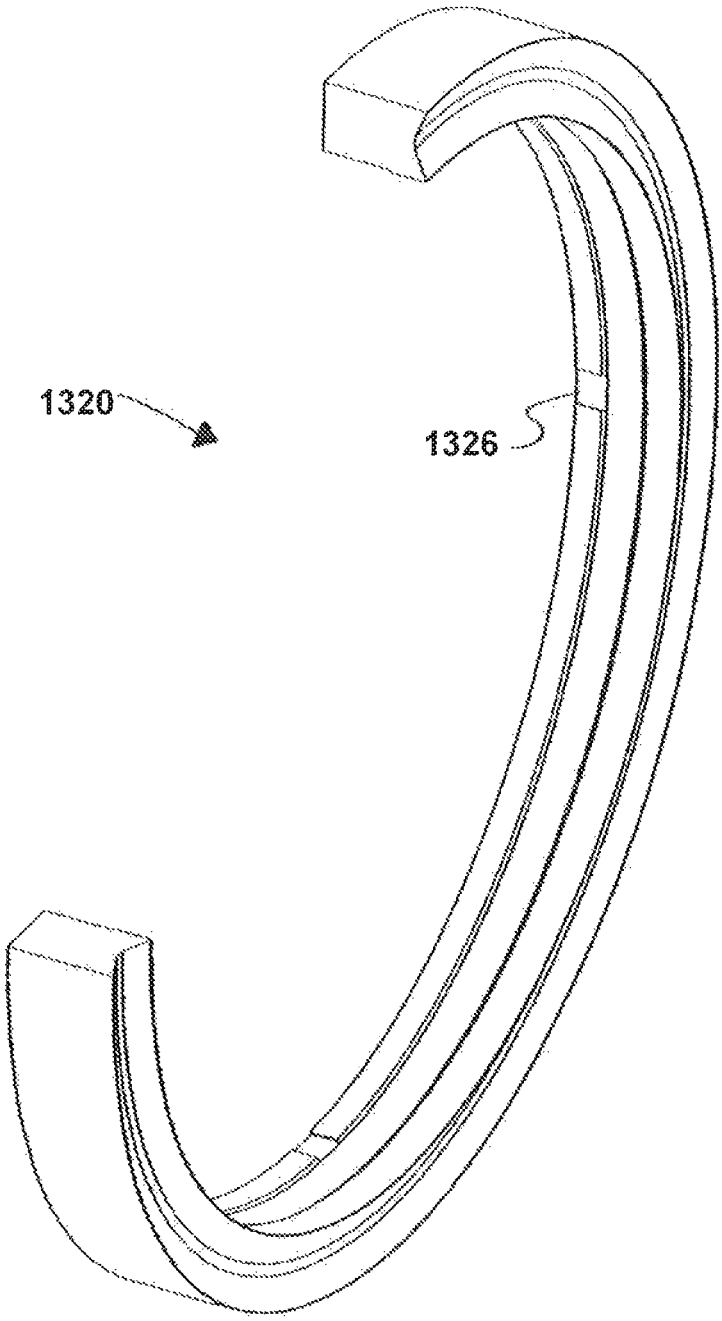
FIG. 27 is a perspective view of female packing ring for the bearing and packing assembly shown in FIG. 22.
Figure 28:
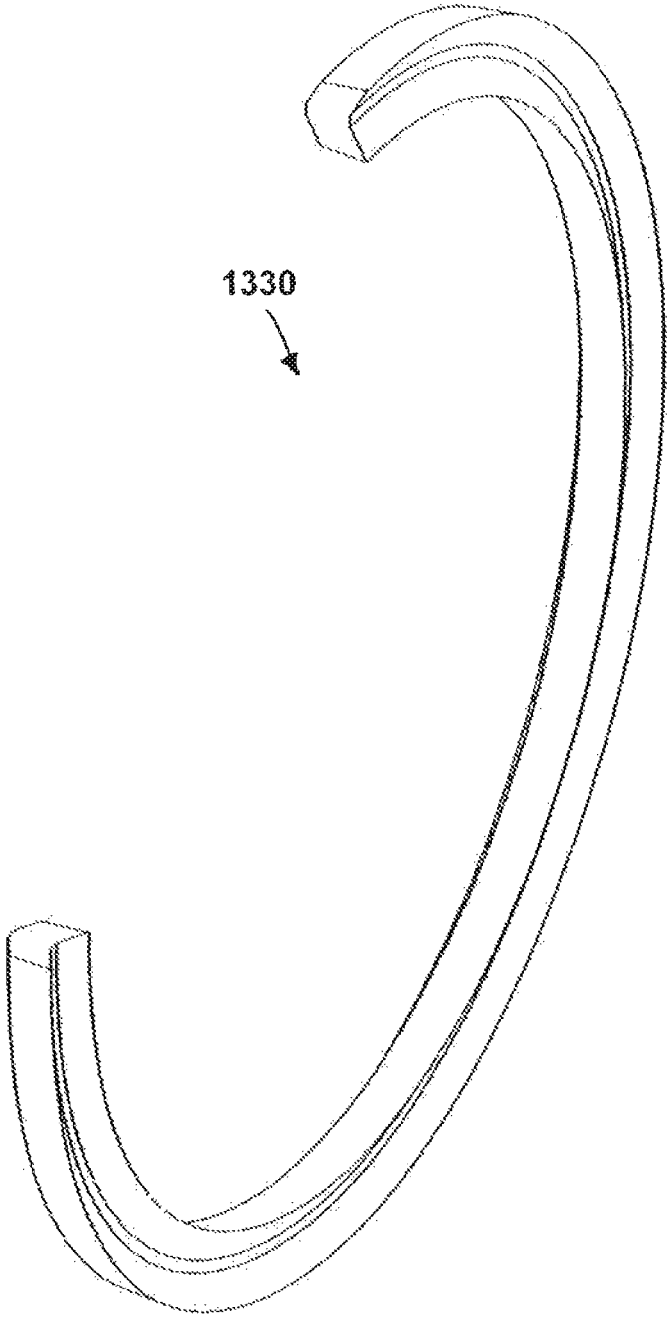
FIG. 28 is a perspective view of a packing ring for the bearing and packing assembly shown in FIG. 22.
Figure 29:
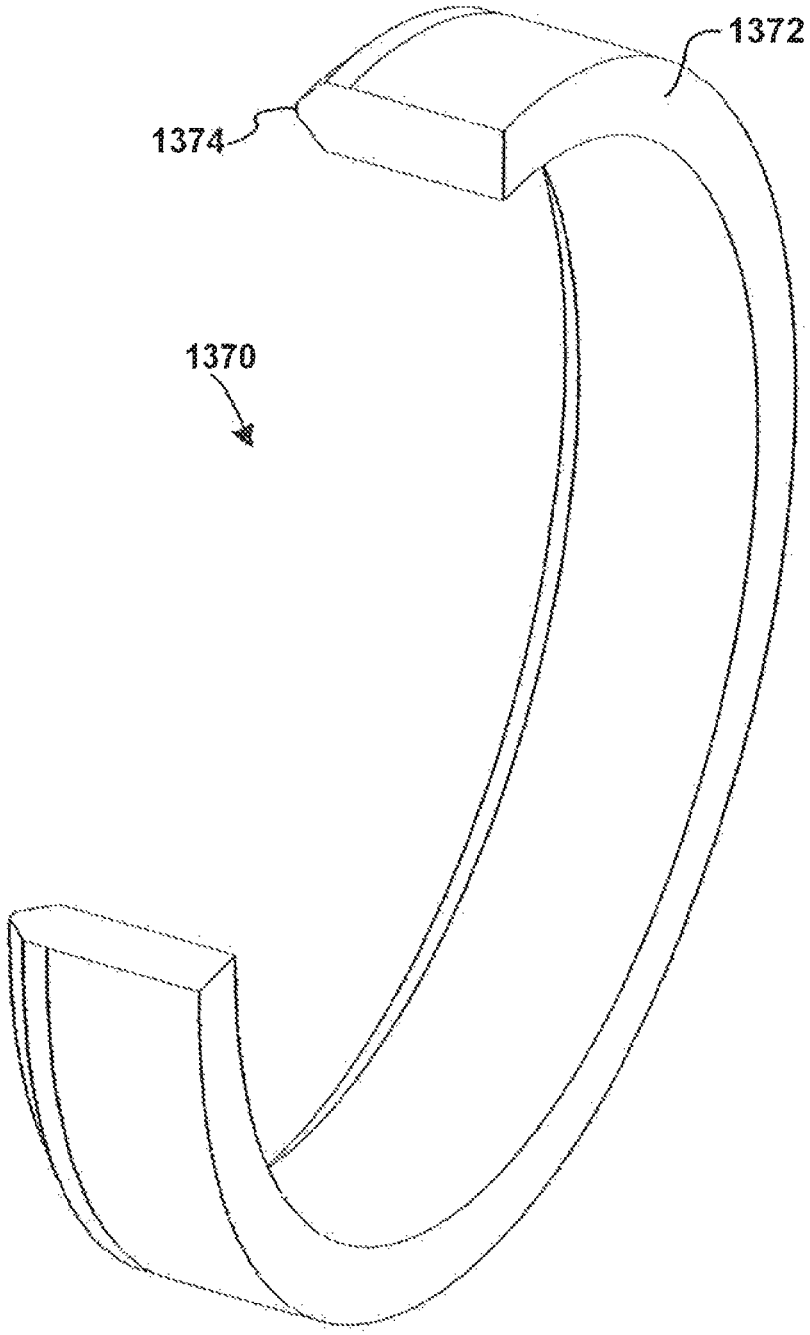
FIG. 29 is a perspective view of a male packing ring for the bearing and packing assembly shown in FIG. 22.

FIG. 26 is a perspective view of a spacer unit 1310 which can comprise first end 1312, second end 1314, and enlarged section 1316 and is preferably from SAE 660 BRONZE or SAE 954 Aluminum Bronze. FIG. 27 is a perspective view of female backup ring (or packing ring) 1320 which can include plurality of grooves for transmission of lubricant to plurality of seals 1322. Preferably, backup ring 1320 is composed of a bearing grade peek material (such as material number 781 supplied by CDI Seals out of Humble, Tex.). FIG. 28 is a perspective view of an exemplar packing ring or seal (e.g., 1330,1340,1350,1360) for the plurality of seals 1322. FIG. 29 is a perspective view of a male packing ring 1370 which can comprise first end 1372 and second end 1374 and is preferably machined from SAE 660 BRONZE or SAE 954 Aluminum Bronze with a flat head and 45 degrees from the vertical.

Plurality of seals 1322 can comprise first seal 1330 (which is preferably a bronze filled teflon v-ring having a 7 inch diameter (17.78 centimeters) and ½ inch (1.27 centimeters) thickness)(such as material number 714 supplied by CDI Seals out of Humble, Tex.); second seal 1340 (which is preferably a teflon v-ring having a 7 inch diameter (17.78 centimeters) and ½ inch (1.27 centimeters) thickness)(such as material number 711 supplied by CDI Seals out of Humble, Tex.); third seal 1350 (which is preferably a viton v-ring having a 7 inch diameter (17.78 centimeters) and ½ inch (1.27 centimeters) thickness)(such as material number 951 supplied by CDI Seals out of Humble, Tex.); and fourth seal 1370 (which is preferably a teflon v-ring having a 7 inch diameter (17.78 centimeters) and ½ inch (1.27 centimeters) thickness)(such as material number 711 supplied by CDI Seals out of Humble, Tex.). Seals can be Chevron type "VS" packing rings. Alternatively, one of the seals can be can be Garlock 8913 rope seals. Rope seals have surprisingly been found to extend the life of remaining plurality of seals because they are believed to secrete lubricants, such as graphite, during use. Where a rope seal is used it is preferable that the rope seal be placed next to first seal 1330. In one embodiment plurality of seals are rated at 10,000 psi (6,900 kilopascals).

FIG. 30 is a perspective view of packing retainer nut 1400. Packing retainer nut 1400 can comprise first end 1410, second end 1440, base 1450, and threaded area. Plurality of tips 1420 and plurality of recessed areas 1430 can be on first end 1410.

FIG. 31 is a perspective view of a retainer plate 1500. Packing retainer plate or end cap 1500 can comprise first end 1510 and second end 1530. On first end 1510 can be a plurality of openings. On second end can be a plurality of tips 1540 and recessed areas 1550. Retainer plate or end cap 1500 can include mechanical seal 1560 to prevent dirt and debris from coming between retainer plate or end cap 1500 and mandrel 110. Similar retainer plates or end caps can be placed in the upper and lower sections of sleeve or housing 300. Retainer plate or end cap 1500 can be used to lock packing retainer nut 1400 in place and prevent retainer nut 1400 from loosening during operation. Plurality of tips 1540 and recessed areas 1550 for retainer plate or end cap 1500 can interlock with plurality of recessed areas 1430 of retainer nut 1400. First plurality of bolts 470 and second plurality of bolts 472 can lock retainer plate or end cap 1500 to sleeve or housing 300.

Figure 44:
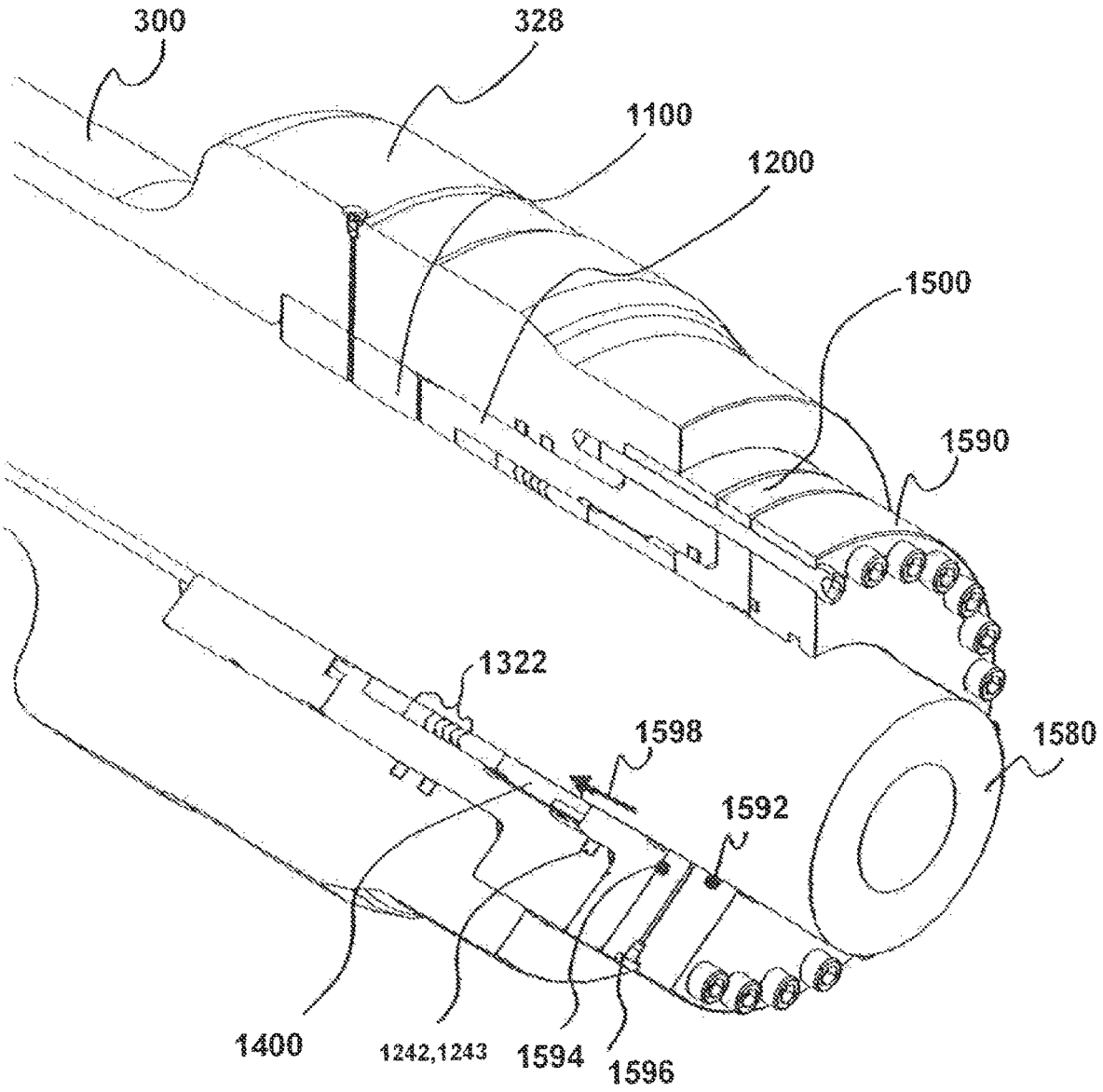
FIG. 44 is a perspective view of a pressure testing apparatus with part of the end sleeve or housing removed to show internal components.

In one embodiment, as shown in FIG. 44 plurality of seals 1322 are pressure tested before being placed in sleeve or housing 300. Pressure testing can be performed using dummy pipe 1580 and testing plate 1590. Testing plate 1590 can include radial injection port 1596 and seals 1592, 1594. Dummy pipe 1580 will tend to seal with plurality of seals 1322. A fluid is pumped into radial port 1596 and travels towards plurality of seals 1322 in the direction of arrow 1598. Plurality of seals 1322, if working, will stop fluid migration. However, plurality of seals 1322 will tend to compress longitudinally in the direction of arrow 1598. After a successful test, plate 1590 is removed and packing retainer nut 1400 is tightened to take up the slack in plurality of seals 1322 caused by the longitudinal compression. Testing and tightening of plurality of seals 1322 are preferably performed where dummy pipe is still contacting plurality of seals, otherwise plurality of seals with tend to radially expand when packing retainer nut 1400 is tightened.

Movement of Swivel to Annular BOP

When being positioned downhole, sleeve or housing 300 can be temporarily set at a fixed position relative to mandrel 110. Fixing the position of sleeve or housing 300 relative mandrel 110 facilitates tracking the position of sleeve or housing 300 as it goes downhole. Otherwise, the allowable stroke of sleeve or housing 300 relative to mandrel 110 would make it difficult to determine a true downhole position of sleeve or housing 300 as it could have slide relative to mandrel 110 as swivel 100 travels downhole. In one embodiment this fixed position is adjacent the upper end 120 of mandrel 110, such as by being shear pinned to upper end or retainer cap 400.

Figure 36:
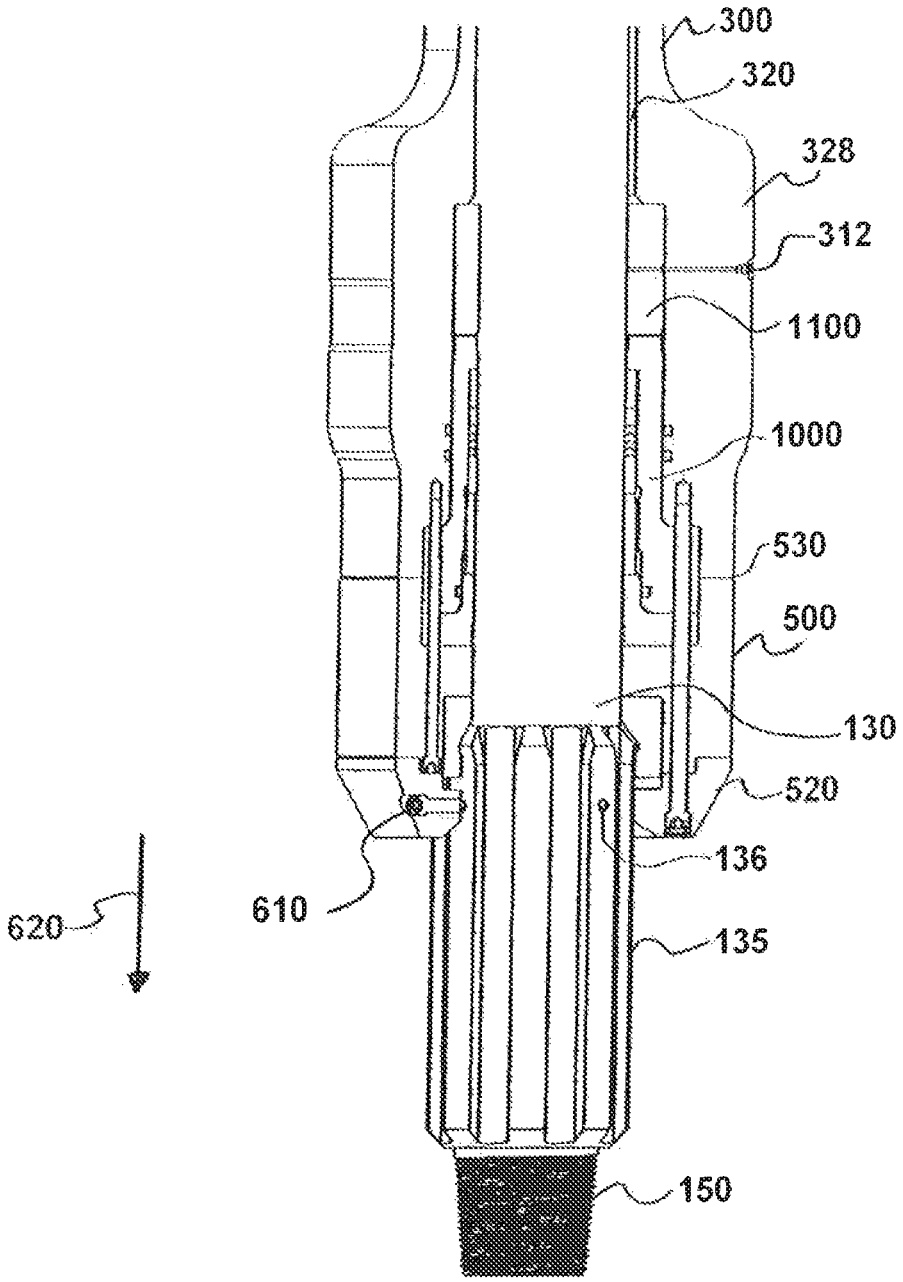
FIG. 36 is a sectional view of showing the sleeve or housing of FIG. 17 shear pinned to the lower end of the mandrel.
Figure 37:
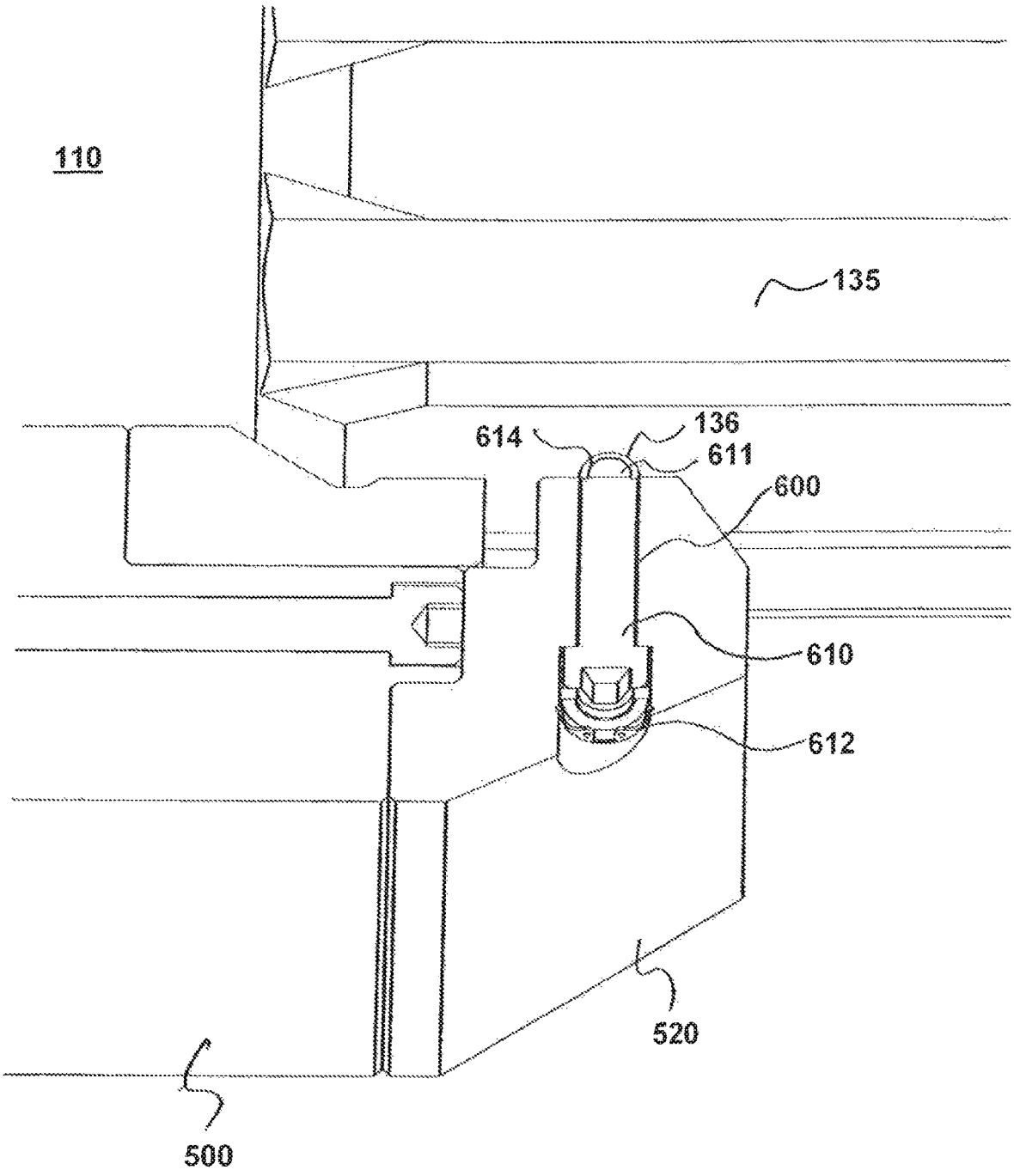
FIG. 37 is an enlarged sectional perspective view showing the sleeve or housing pinned to the mandrel at the lower end of the mandrel.
Figure 38:
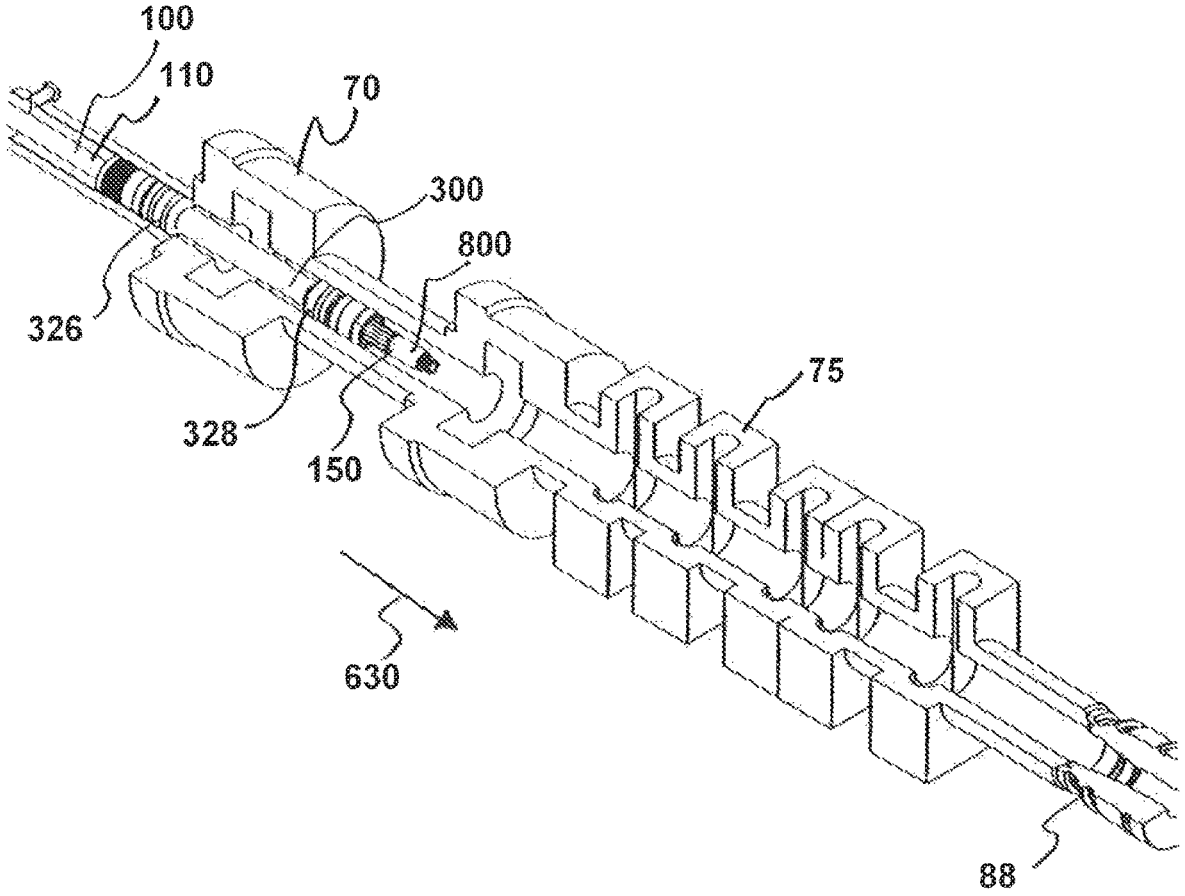
FIG. 38 is a sectional perspective view showing the sleeve or housing for the swivel of FIG. 5 entering the annular blowout preventer where the mandrel is pinned to the sleeve or housing.

In one embodiment this fixed position is adjacent to the lower end 130 of mandrel 110. FIGS. 36 through 38 show sleeve or housing 300 temporarily fixed to a position adjacent the lower end 130 of mandrel 110. Tip 520 of lower retainer cap 500 can include a plurality of openings 596 (see FIG. 35). Fluted area 135 of mandrel 110 can include a plurality of recessed areas 136. A plurality of shear pins 610 can be used to fix sleeve or housing 300 relative to mandrel 110. A plurality of snap rings 612 can be used to fix the plurality of shear pins 610. An adhesive 614, such as Lock Tite, can be used to fix the plurality of tips 611 of the plurality of shear pins 610 inside plurality of openings 136. When sleeve or housing 300 enters annular blowout preventer 70 (shown in FIG. 38), annular seal 71 (not shown for clarity) can be closed maintaining sleeve or housing 300 at a fixed point. Now, the position of sleeve or housing 300 is known based on its relative position to mandrel 110. After annular seal 71 is closed, drill or work string 85,86 can be moved in the direction of arrow 630 in FIG. 38 causing plurality of tips 611 to shear from plurality of pins 610, mandrel 110 to move relative to sleeve or housing 300. Plurality of shear pins 610 will be held in place in plurality of openings 600 by plurality of snap rings 612. Plurality of tips 611 will be held in place in plurality of openings 136 by adhesive 614. In this manner no pieces will fall downhole after shearing takes place. Preferably, shear pins 610 have a torque of 225 inch-pounds (25.42 inch pounds) applied to them and will shear at about 42,200 pounds (188 kilo newtons) providing shear at about 40,000 pounds (178,000 kilo newtons). After shearing, sleeve or housing 300 will be free to reciprocate relative to mandrel 110.

Moving Past Annular BOP

Figure 39:
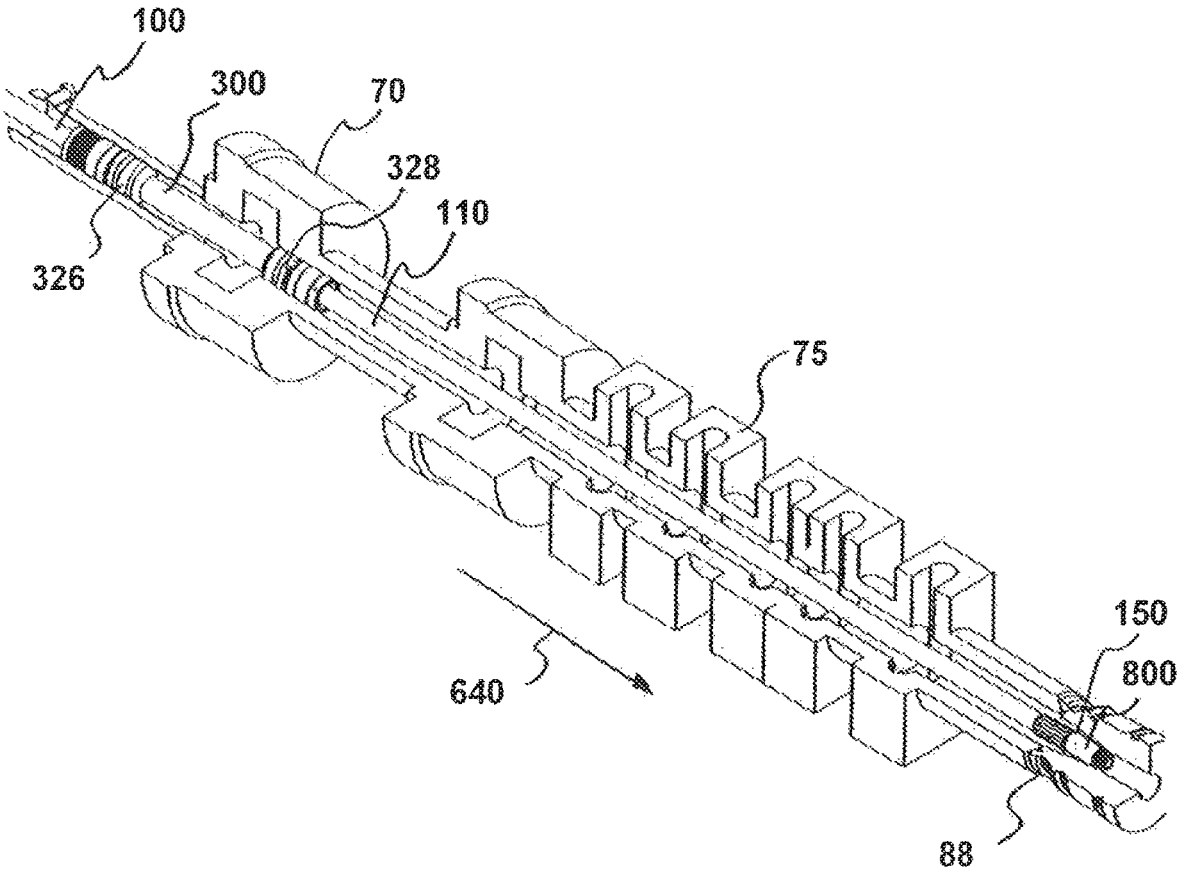
FIG. 39 is a sectional perspective view showing the sleeve or housing for swivel of FIG. 5 in a working position inside the annular blowout preventer (annular seal omitted for clarity) and the mandrel extended downstream of the sleeve or housing.

Sleeve or housing 300 can be designed so that it can be detachably connected to annular blow-out preventer 70 and pass through annular blow-out preventer 70. FIG. 38 is a sectional perspective view showing sleeve or housing 300 entering annular blowout preventer 70 where mandrel 110 is shear pinned to sleeve or housing 300. FIG. 39 is a sectional perspective view showing sleeve or housing 300 in a working position relative to annular blowout preventer 70 wherein mandrel 110 extended downstream (in the direction of arrow 640) of sleeve or housing 300. In this manner annular seal 71 (not shown for clarity) can be used to detachably connect sleeve or housing 300 to annular blow-out preventer 70.

Figure 40:
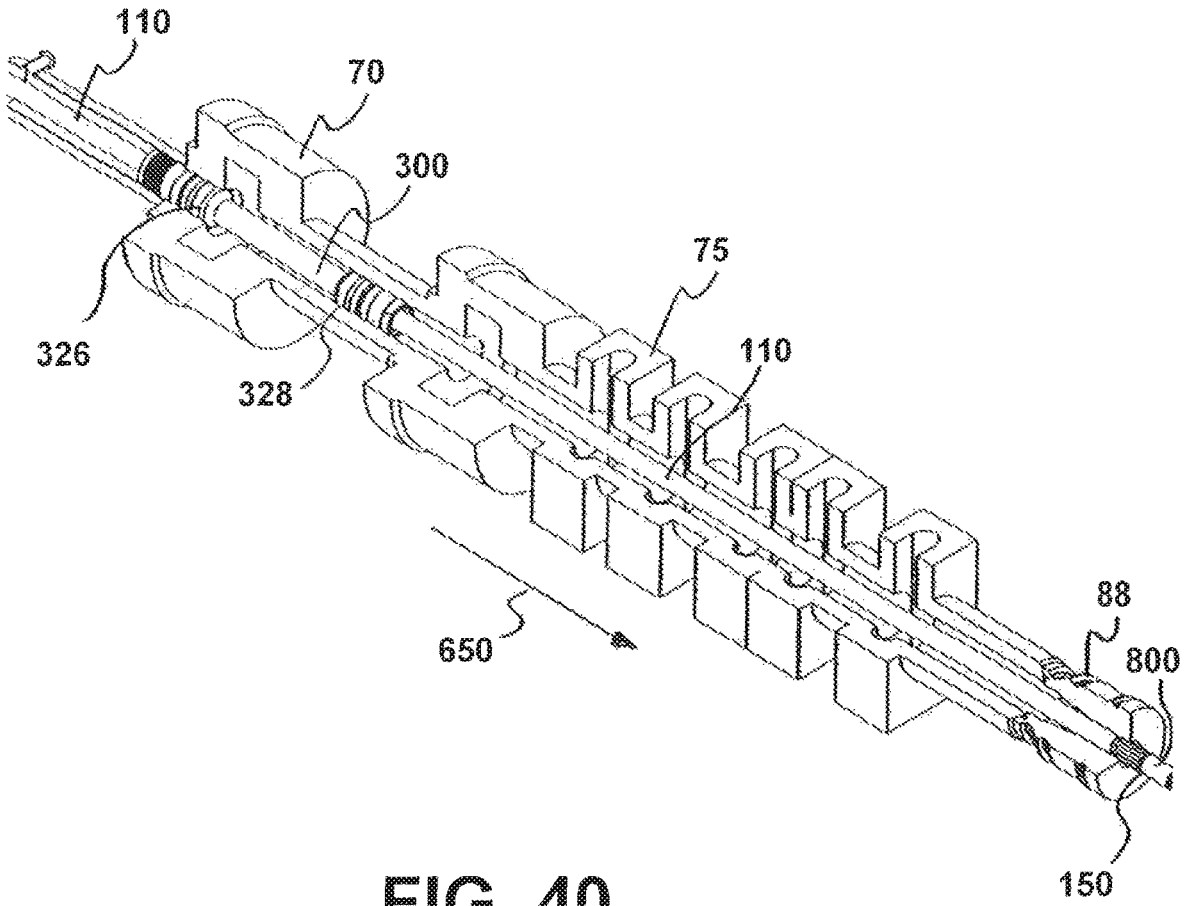
FIG. 40 is a sectional perspective view showing the swivel of FIG. 5 leaving the annular blowout preventer.
Figure 41:
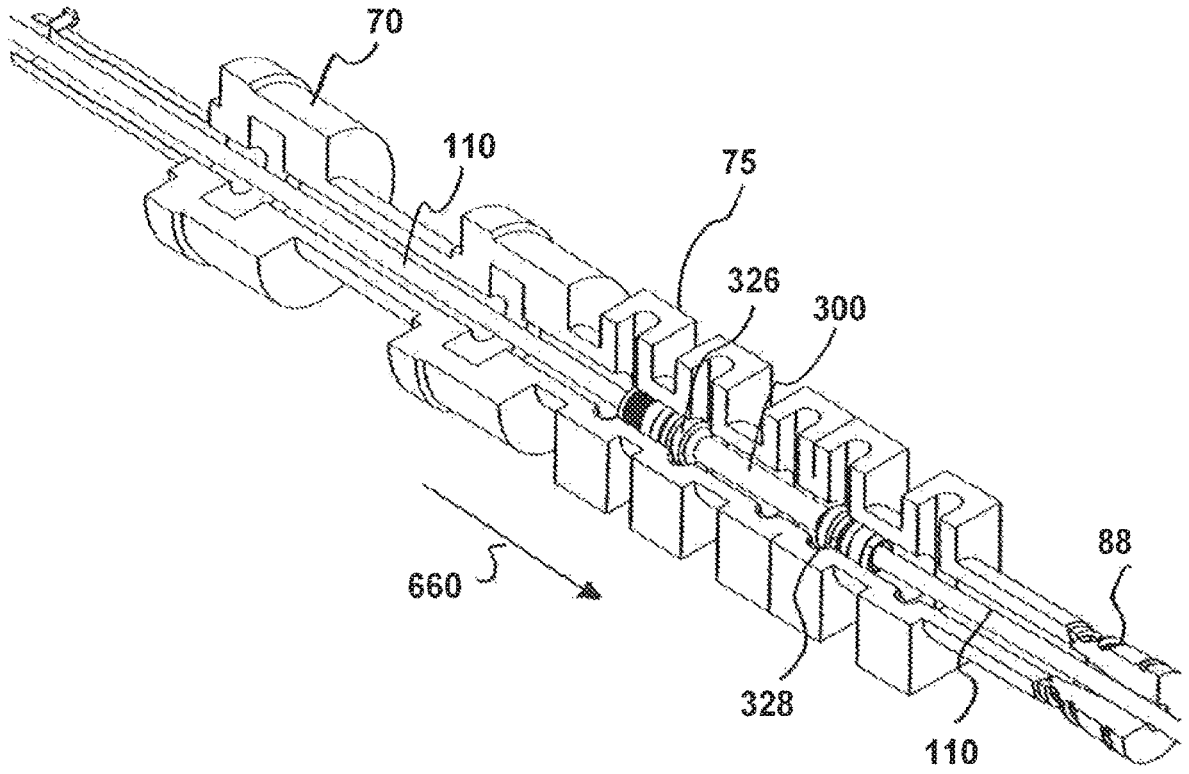
FIG. 41 is a sectional perspective view showing the swivel of FIG. 5 moving down the stack towards the well head.

FIG. 40 is a sectional perspective view showing sleeve or housing 300 of swivel 100 leaving annular blowout preventer 70 in the direction of arrow 650. Here, the annular seal 71 would be opened to allow sleeve or housing 300 to move in the direction of arrow 650. FIG. 41 is a sectional perspective view showing swivel 100 continue moving down stack 75 in the direction of arrow 660 towards wellhead 88.

Figure 42:
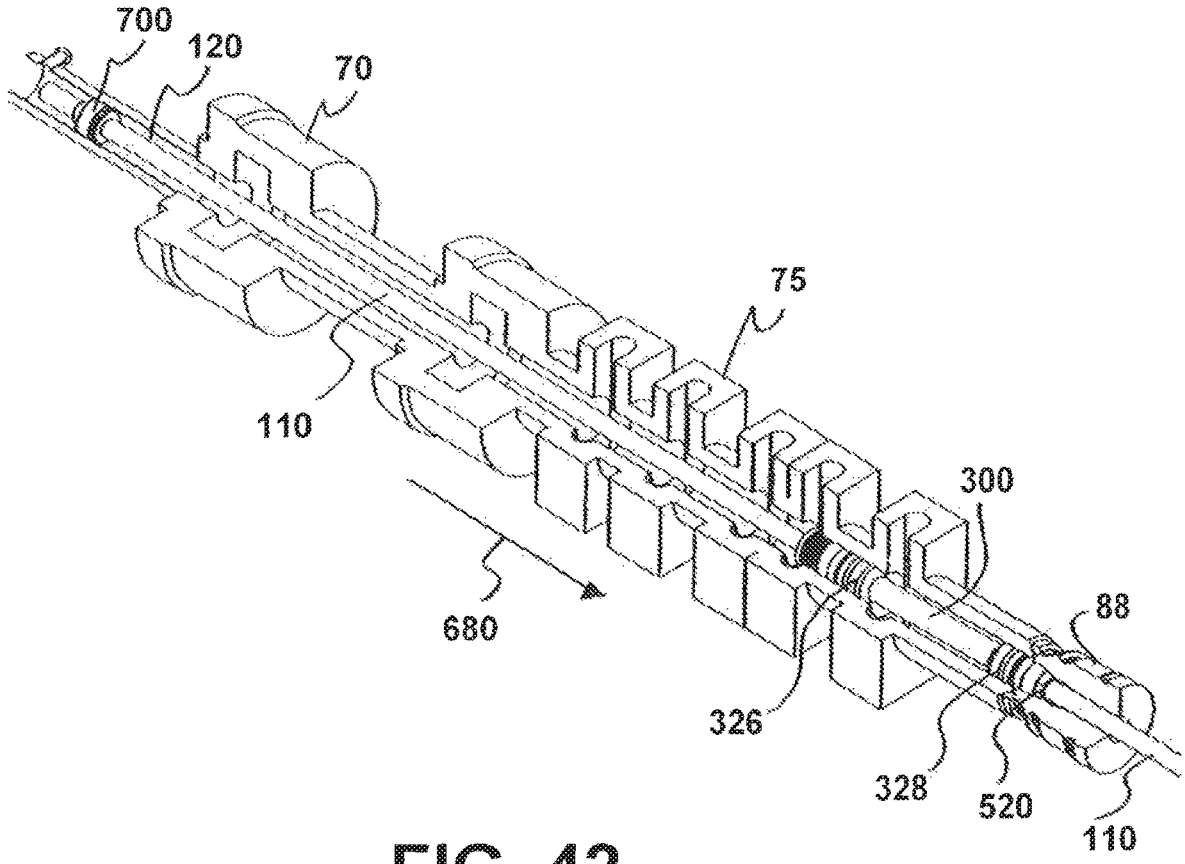
FIG. 42 is a sectional perspective view showing the swivel of FIG. 5 contacting the well head.
Figure 43:
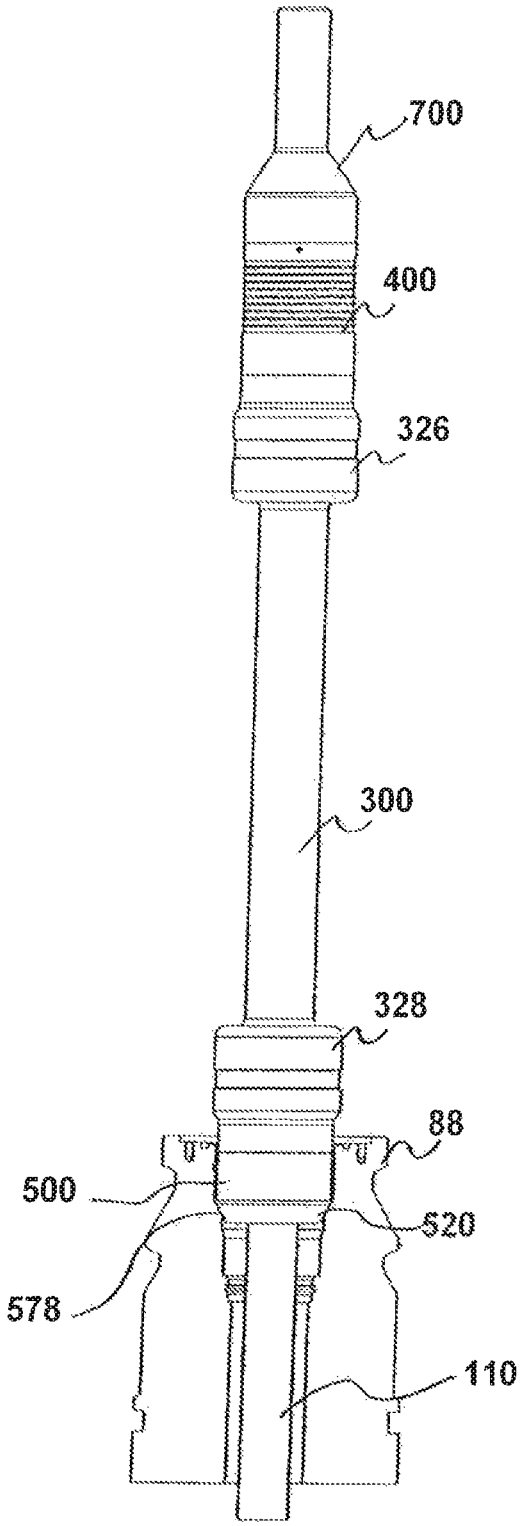
FIG. 43 also shows the swivel of FIG. 5 contacting the top of the well head.

It is preferred that sleeve or housing 300 of swivel 100 be prevented from passing through wellhead 88. Here, this preference is accomplished by making the diameter of lower catch, shoulder, flange 328 larger than the smallest opening in wellhead 88. Additionally, it is preferred that where sleeve or housing 300 and wellhead 88 make contact any damage be reduced. Here, reduction of damage from contact is accomplished by making the contacting portion of swivel 100 conform to the shape of the smallest opening in wellhead 88. FIG. 42 is a sectional perspective view showing swivel 100 contacting well head 88. FIG. 43 also shows swivel 100 contacting the top of well head 88. Tip 520 of lower retainer cap 500 can include angled section 578 which can be designed to sit in the top of riser 88 thereby preventing damage to riser 88 where sleeve or housing 300 contacts or places a thrust load on riser 88. In another embodiment, a contacting surface can be provided, such as hard rubber, polymer, etc.

Upper and lower catches, shoulders, flanges 326, 328 can be positioned/designed/spaced so that they will not coincide with spaced apart longitudinal cavities/openings in stack 75 thereby preventing locking of sleeve or housing 300 with stack 75.

Quick Lock/Quick Unlock

Figure 60:
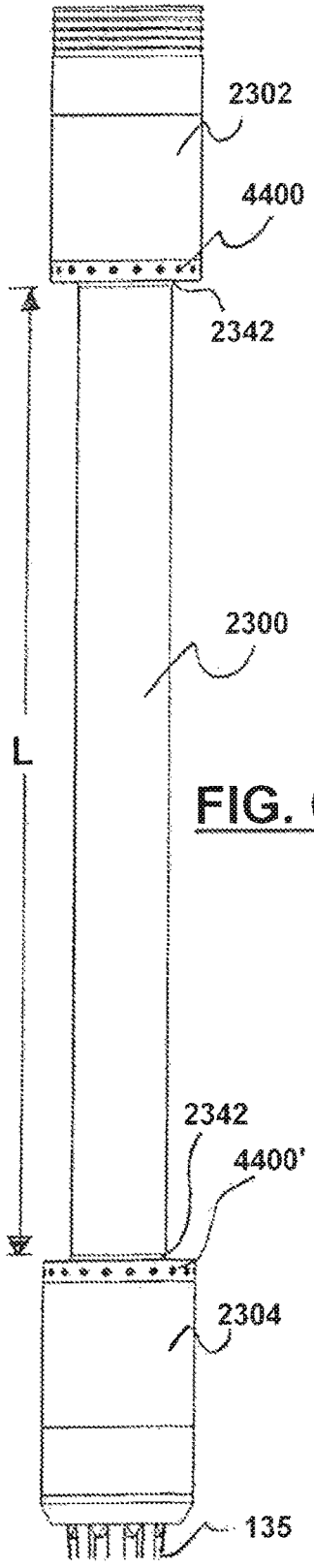

After the sleeve 2300 and mandrel 110 have been moved relative to each other in a longitudinal direction, a downhole/underwater locking/unlocking system 3000 can be used to lock the sleeve 2300 in a longitudinal position relative to the mandrel 110 (or at least restricting the available relative longitudinal movement of the sleeve 2300 and mandrel 110 to a satisfactory amount compared to the longitudinal length of the sleeve's effective sealing area schematically represented as "L" in FIG. 60). Additionally, an underwater locking/unlocking system is needed which can lock and/or unlock sleeve 2300 and mandrel 110 a plurality of times.

In one embodiment is provided a quick lock/quick unlock system 3000 which locks and unlocks on a non-fluted area of mandrel 110. In one embodiment this system 3000 can include a locking hub 3110 with fingers 3120 which detachably locks on a raised area 3400 of mandrel 110 where raised area 3400 does not include radial discontinuities (e.g., it is not fluted). In one embodiment is provided a locking hub 3110 that can rotate relative, but is restricted on the amount of longitudinal movement relative to sleeve 2300, the rotational movement of hub 3110 with sleeve 2300 minimizing rotational wear between hub 3110 and mandrel 110 (as locking hub 3110 can remain rotationally static relative to sleeve 2300). In one embodiment locking hub 3110 can be restricted from moving longitudinally relative to sleeve 2300. In one embodiment locking hub 3110 can be used without a clutching system. In one embodiment bearing surfaces can be provided between sleeve 2300 and locking hub 3110 to facilitate relative rotational movement between sleeve 2300 and hub 3110. In one embodiment mandrel 110 is about 7 inches (17.78 centimeters) in outer diameter and shoulder area 137 is about 7½ inches (19.05 centimeters).

Figure 45:
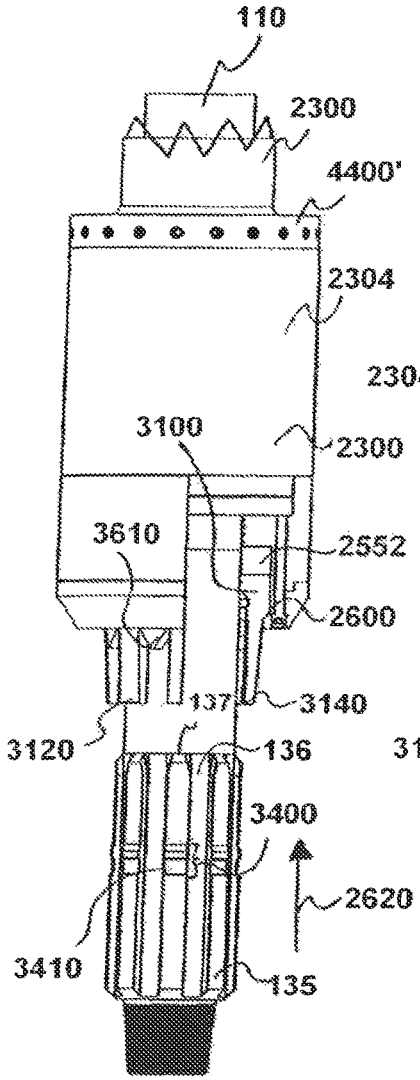
FIGS. 45 through 47 illustrate one embodiment where a quick lock/quick unlock system is placed in a locked state.
Figure 46:
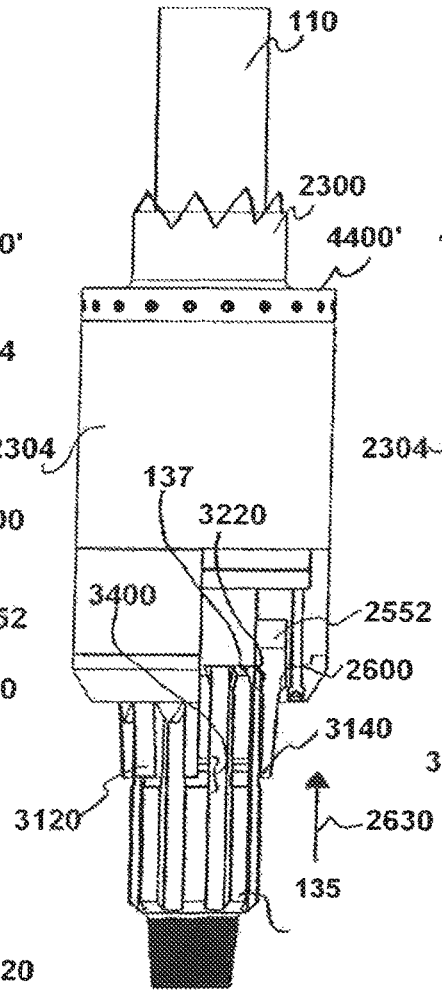
Figure 47:
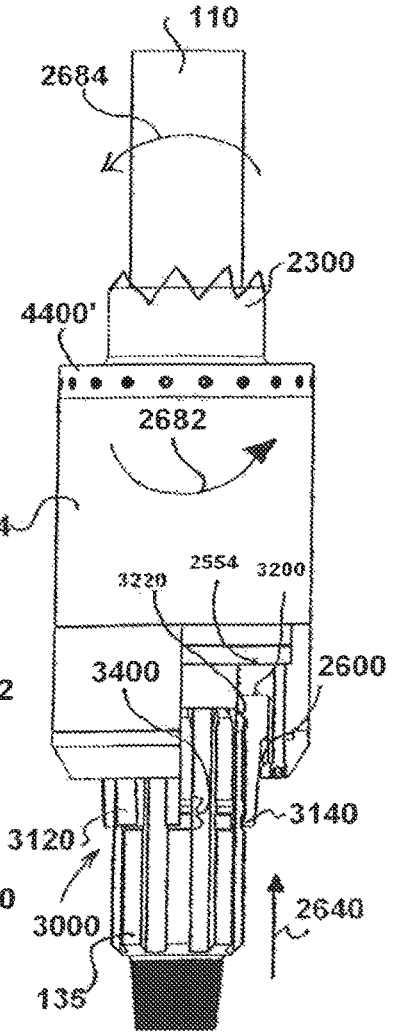
Figure 48:
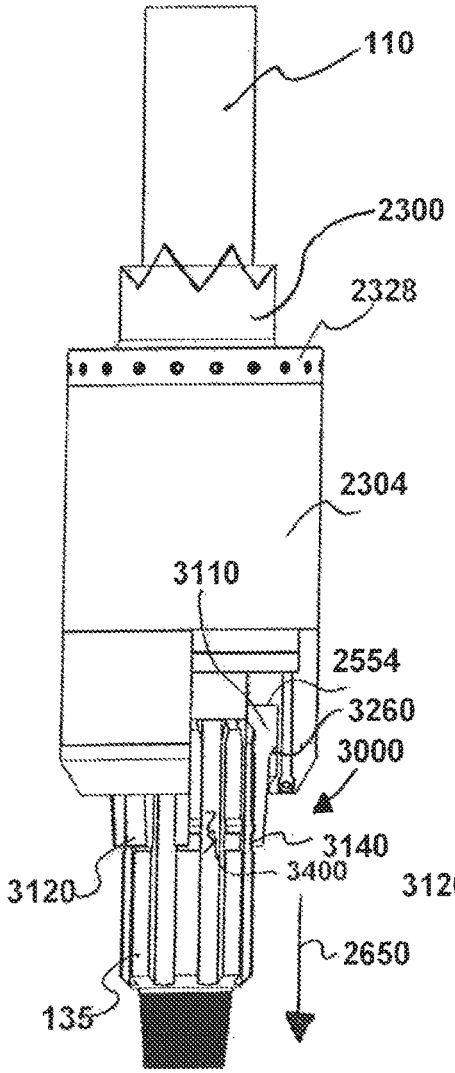
FIGS. 48 through 50 illustrate one embodiment where a quick lock/quick unlock system is placed in an unlocked locked state.
Figure 49:
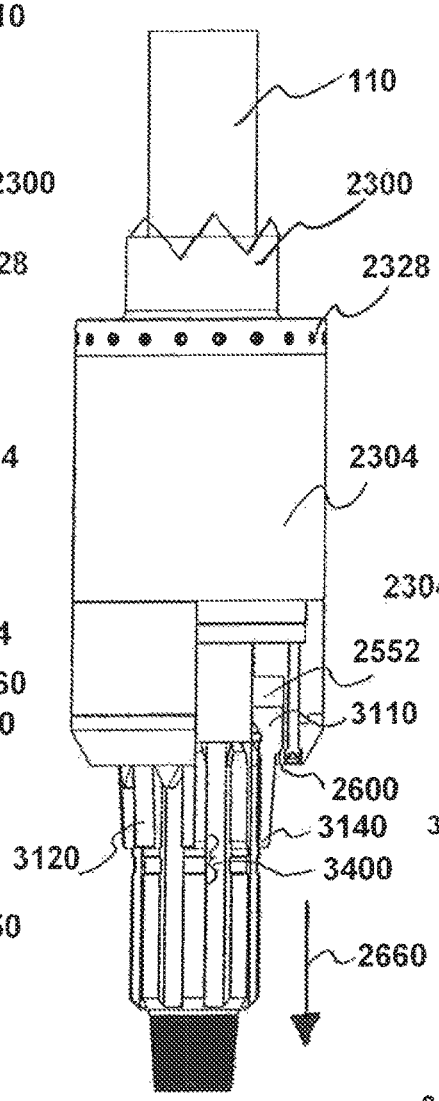
Figure 50:
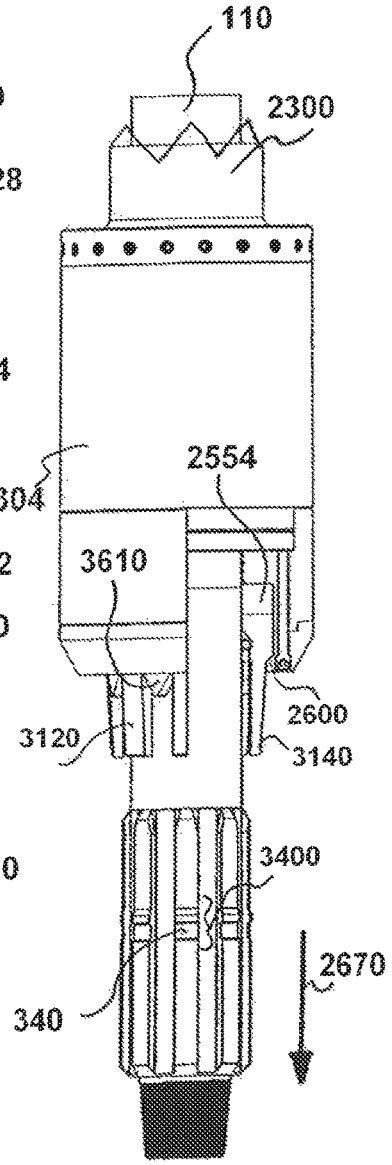
Figure 51:
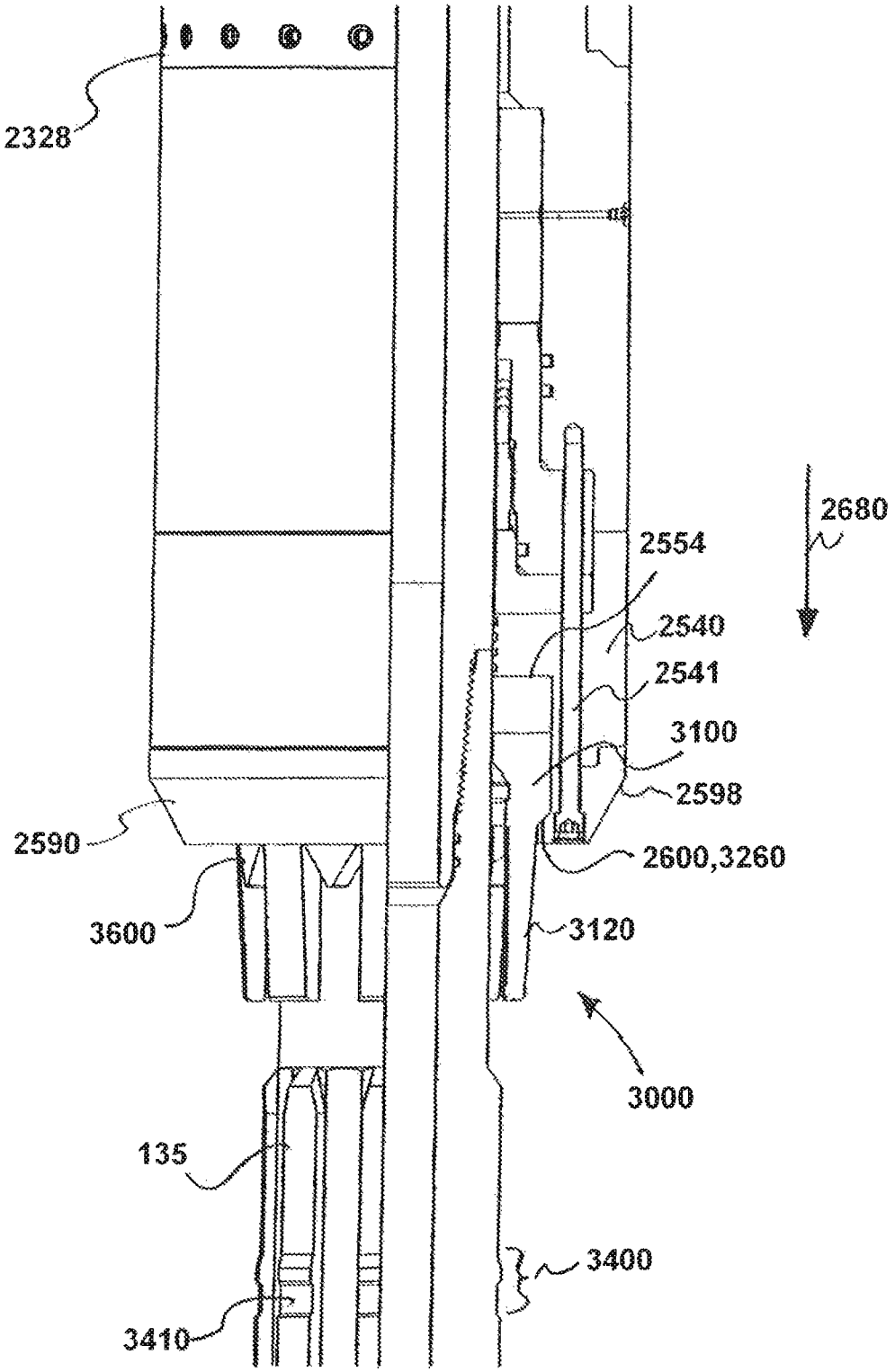
FIG. 51 is an enlarged view of the apparatus in FIG. 45.
Figure 52:
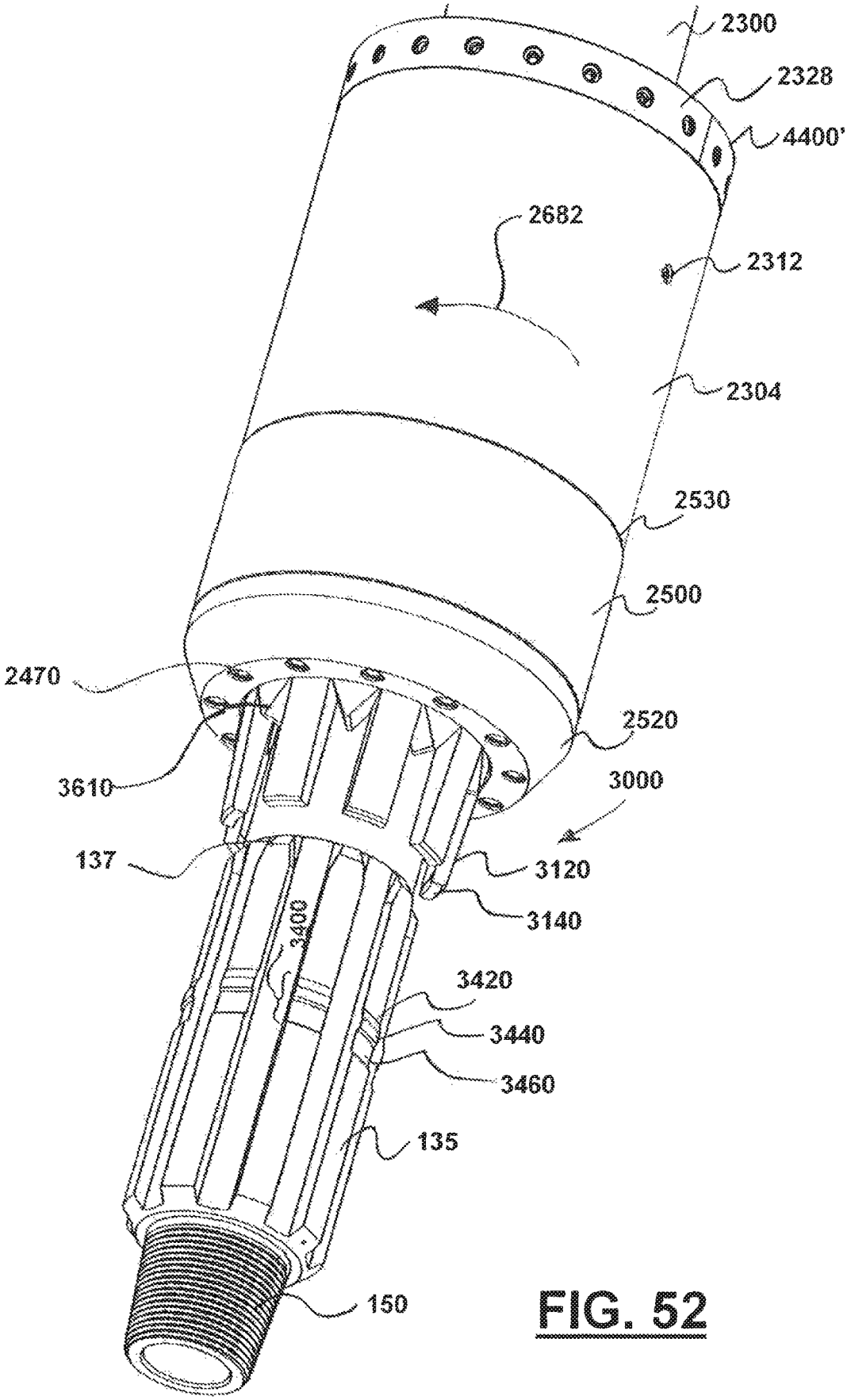
FIG. 52 is a perspective view of the apparatus in FIG. 45.
Figure 53:
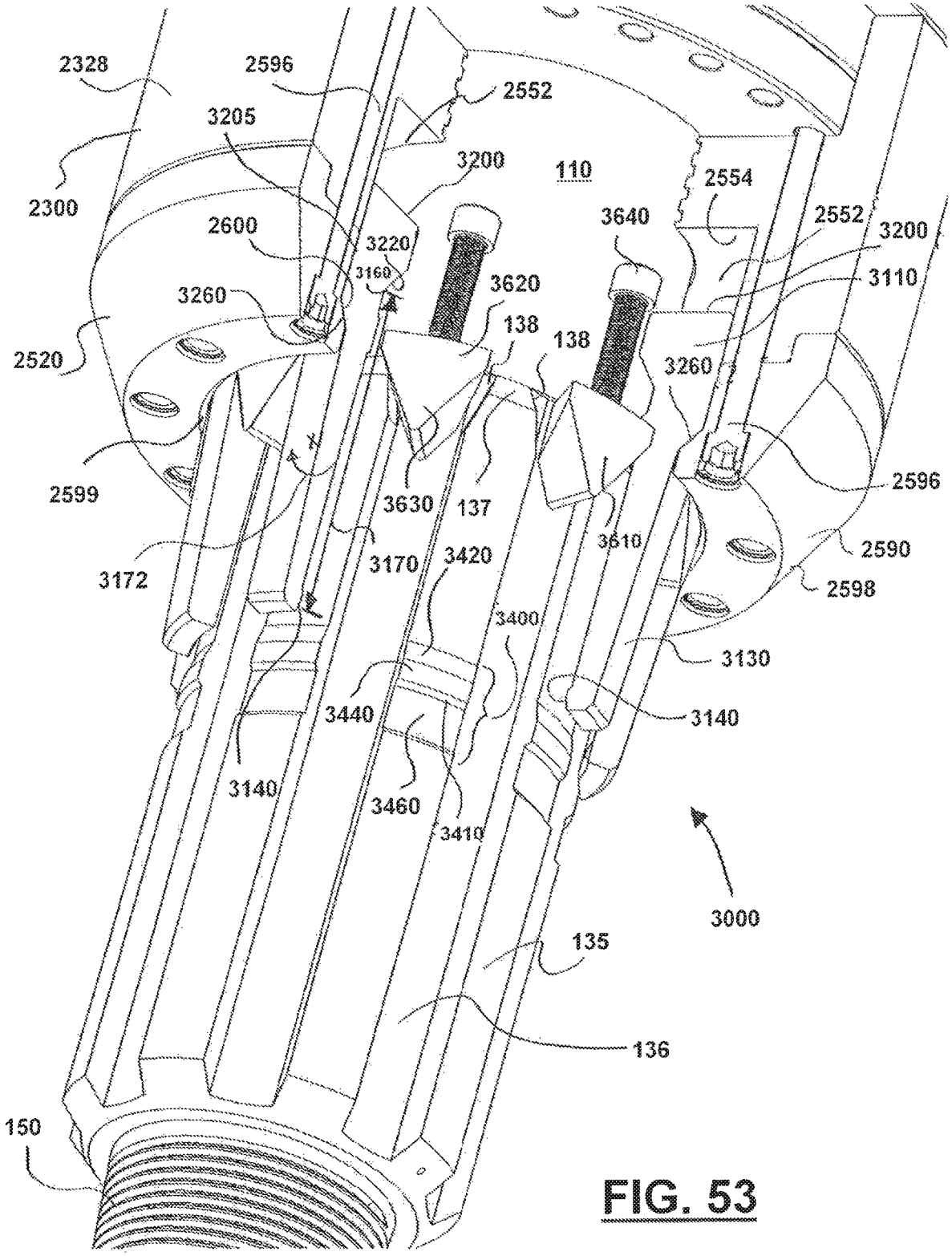
FIG. 53 is an enlarged perspective view of the apparatus of FIG. 49 wherein a section is cut through the sleeve.
Figure 54:
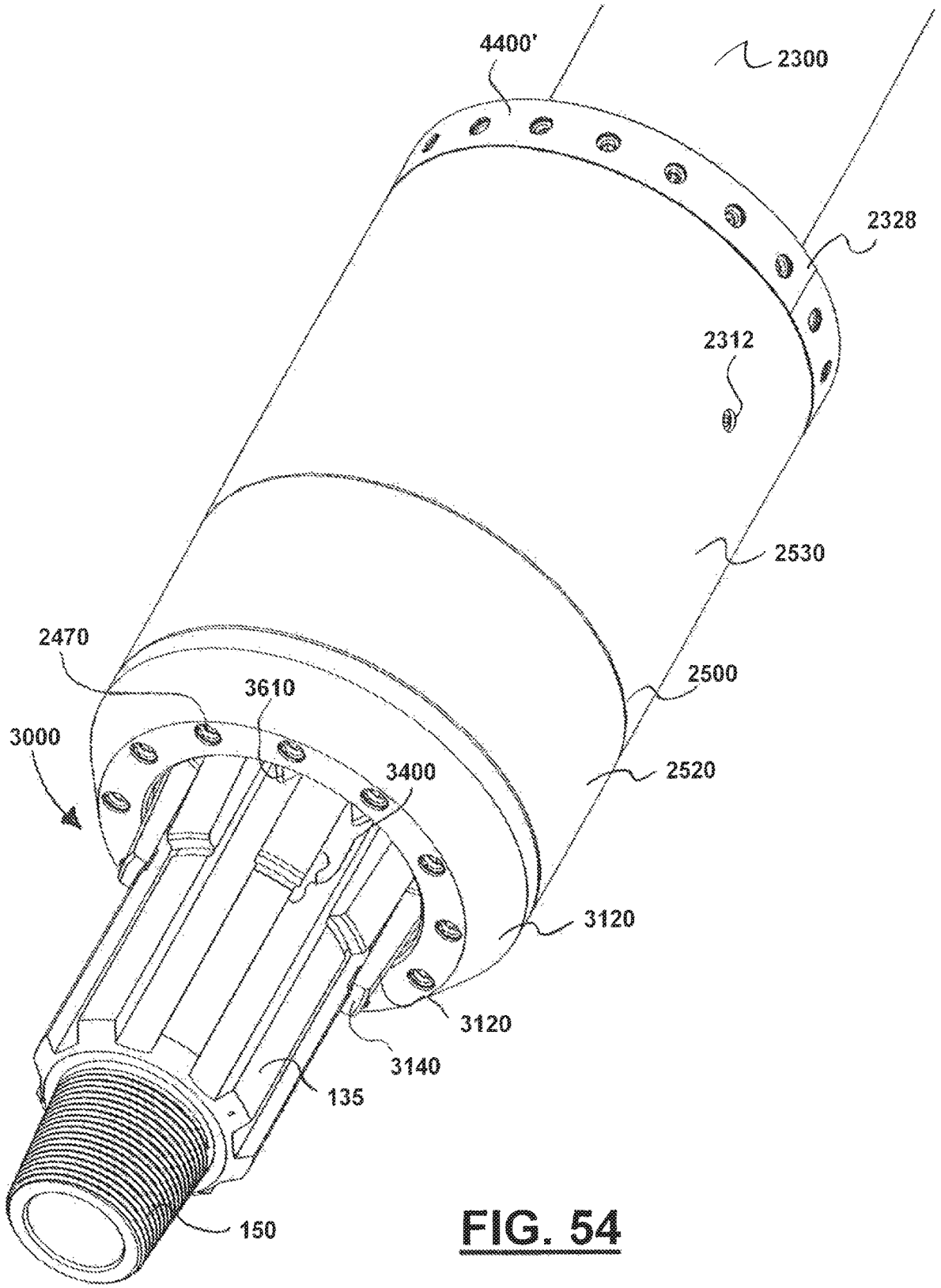
FIG. 54 is a perspective view of the apparatus of FIG. 47.
Figure 55:
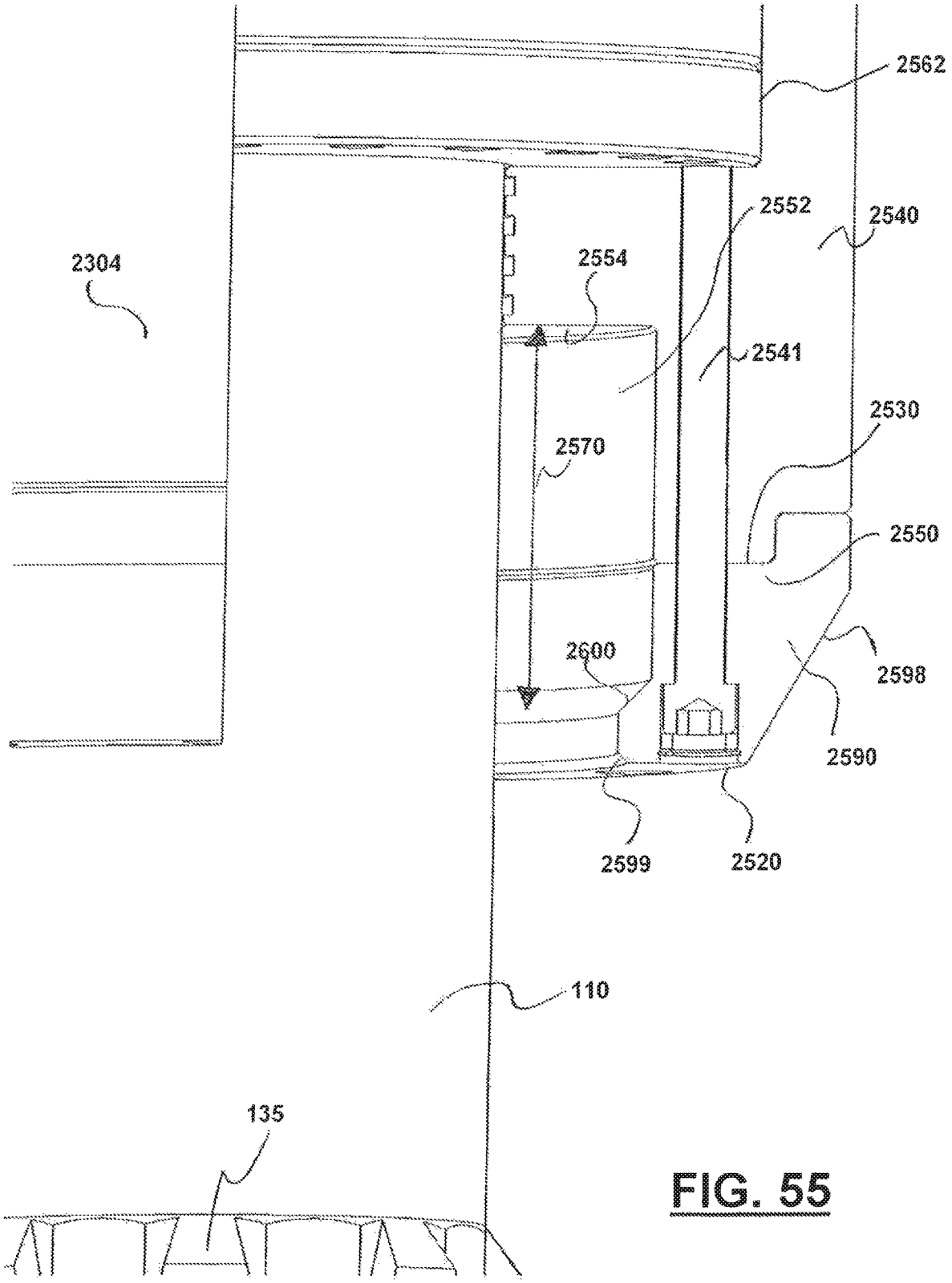
FIG. 55 is a sectional view of the apparatus of FIG. 45 where the locking hub has been removed to better show various components.
Figure 56:
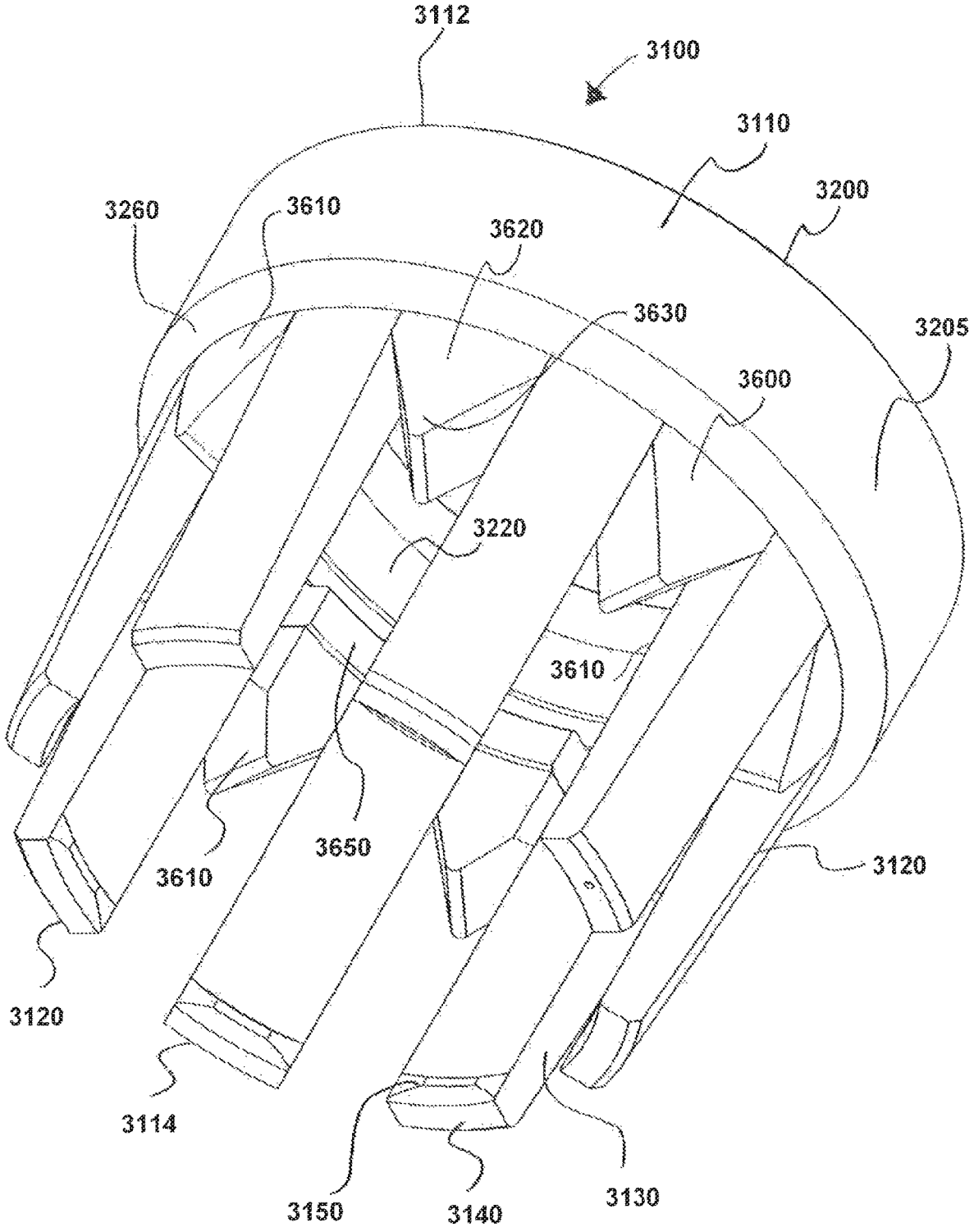
FIG. 56 is a perspective view of a locking hub.
Figure 57:
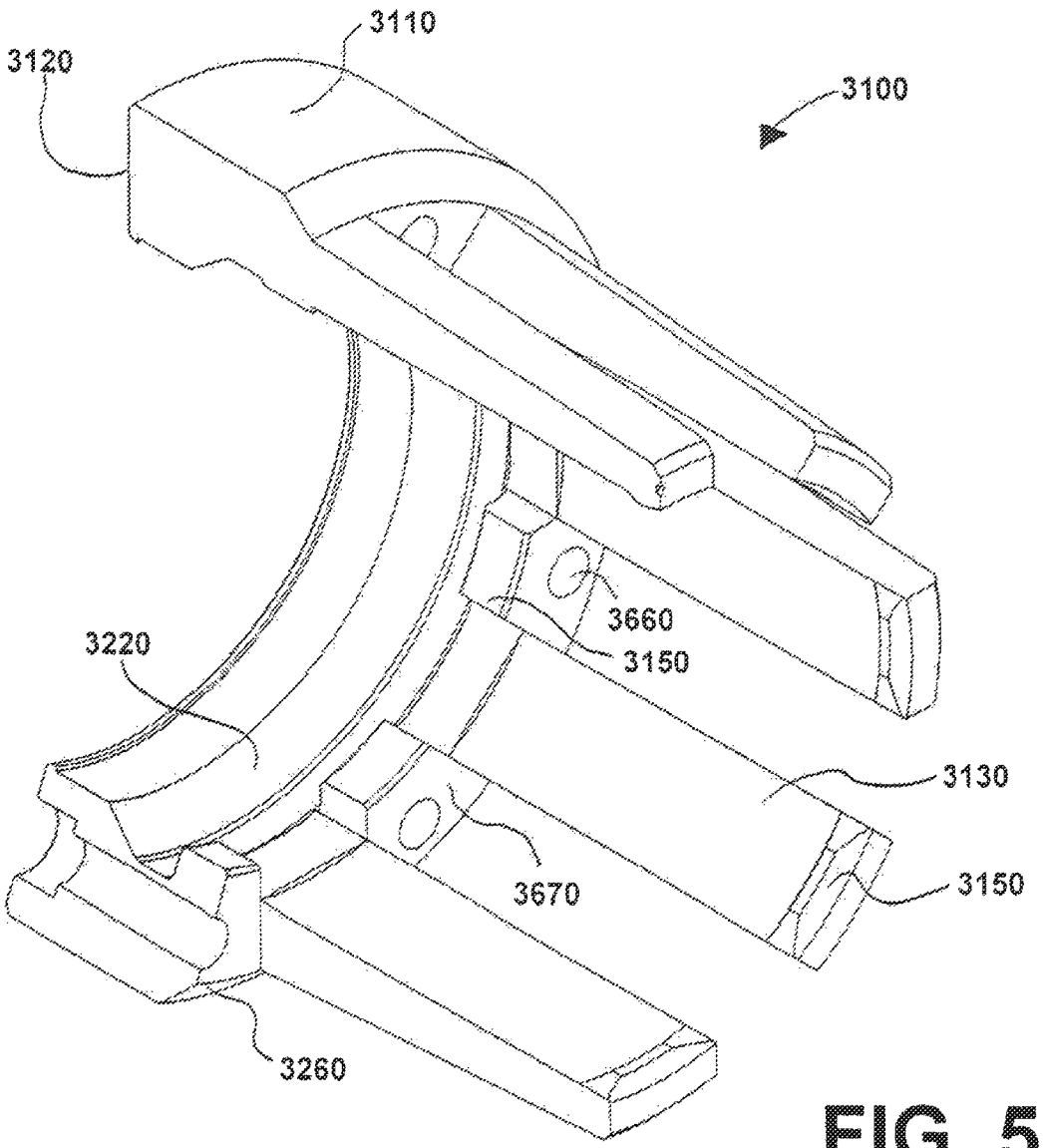
FIG. 57 is a sectioned perspective view of the locking hub of FIG. 56.

FIGS. 45 through 47 illustrate one embodiment where a quick lock/quick unlock system 3000 is placed in a locked state from an unlocked state. FIGS. 48 through 50 illustrate one embodiment where quick lock/quick unlock system 3000 is placed in an unlocked locked state from a locked state. FIG. 51 is an enlarged view of the quick lock/quick unlock system 3000. FIG. 52 is a perspective view of the quick lock/quick unlock system 3000 in an unlocked state. FIG. 53 is an enlarged perspective view of quick lock/quick unlock system 3000 system is very close to being a locked state. FIG. 54 is a perspective view of quick lock/quick unlock system 3000 in a locked state. FIG. 55 is a sectional view of lower end 2304 of sleeve 2300 where first part 3100 of quick lock/quick unlock system has been removed so that the portions of lower end 2304 can be better viewed. FIG. 56 is a perspective view of the first part 3100 (or a locking hub) of quick lock/quick unlock system 3000. FIG. 57 is a sectioned perspective view of locking hub 3100.

Generally, quick lock/quick unlock system 3000 can comprise first part or locking hub 3000 which detachable connects to second part 3400. First part or locking hub 3100 can comprise bearing and locking hub 3110 which includes at least one finger 3130, and preferably a plurality of fingers 3120. Preferably the plurality of fingers 3120 can be symmetrically spread about the radius of locking hub 3000. Where the plurality of fingers are used, each finger can be constructed substantially similar to the other fingers and only one example finger 3130 will be described. As shown in FIG. 53, each finger 3130 can comprise a base 3160, length 3170, and tip 3140. Preferably at the tip 3140 is included latching area 3150. Second part 3400 can comprise angled area 3420, flat area 3440, latching area 3410, and recessed area 3460. Preferably latching area 3150 can detachably interlock with latching area 3410 of second part 3400. Angled area 3420 can assist in latching area 3150 in being asserted into recessed area 3460 and latching with latching area 3410. Arrow 3172 in FIG. 53 schematically indicates that tip 3140 will radially expand when moving over angled area 3420. Tip 3140 will move in the opposite direction as arrow 3172 when tip moves into recessed area 3460. Once interlocked the longitudinal movement of sleeve 2300 will be restricted relative to mandrel 110.

Where second part 3400 of quick connect/quick disconnect system 3000 includes radial discontinuities (such as illustrated in fluting 135 shown in mandrel 110 in FIGS. 45 through 55) a clutching system 3600 can be used to align first part 3100 and second part 3400 for connection purposes. In one embodiment a clutching system 3600 is provided which facilitate alignment of plurality of fingers 3120 with the plurality of latching areas 3410 of second part 3400. As best shown in FIG. 56, clutching system 3600 can include a plurality of alignment members 3610. Each of the alignment members can include a conical, tapered or arrow shaped portion 3630. Each of the alignment members can be attached to bearing and locking hub 3110 through a fastener 3640 (best shown in FIGS. 53 and 56). As best shown in FIG. 53, the aligning or conical, tapered or arrow shaped portions 3630 of the plurality of alignment members 3610 interact with plurality of recessed areas 136 of the fluted areas to align the plurality of fingers 3120 with the plurality of latching areas 3410 of second part 3400. To facilitate this alignment function angled areas 138 can be provided on each of the flutes of the fluted area 135. If partially offset or misaligned, the angled areas can interact with the arrow shaped portions of the plurality of alignment members 3610 and rotationally align the plurality of fingers 3120 for proper locking with the plurality of latching areas 3410 of second part 3400. A plurality of angled areas 137 can also be provided to facilitate rotational alignment. To also facilitate this alignment locking hub 3110 has a degree of longitudinal movement relative to sleeve 2300. As shown in FIG. 53 a recessed area 2552 is provided wherein locking hub 3110 can experience longitudinal (and also rotational movement). Longitudinal movement can is limited in one direction by base 3200 of locking hub 3110 contacting base 2554 of recessed area 2552, and in a second direction by shoulder 3260 contacting interior angled section 2600. Base 3200 and shoulder 3260 are bearing surfaces which facilitate relative movement when in contact with another surface. Additionally, outer diameter 3205 is a bearing surface facilitating rotational movement of locking hub 3110 relative to sleeve 2300. Limiting relative longitudinal movement of locking hub 3110 relative to mandrel 110, first shoulder 3220 will contact the plurality of angled sections 137 of fluted area 135. When base 3200 of locking hub contacts base 2554 sleeve 2300 will be prevented from further movement towards pin end 150 of mandrel 110. Even when in such contact sleeve 2300 can rotating relative to mandrel (and vice versa) by locking hub 3110 rotating relative to sleeve through the bearing surfaces of locking hub 3110.

The plurality of alignment members 3610 also cause bearing or locking hub 3110 to become rotationally static relative to mandrel 110 and fluted area 135. Making locking hub 3110 rotationally static relative to fluted area 135 prevents scratching or scarring by the tips of the fingers rotating relative to the latching area 3410 during locking and/or unlocking. Because the locking hub 3110 is rotationally static relative to the mandrel 110 and the mandrel 110 may be rotating relative to sleeve 2300, locking hub 3110 can rotate relative to sleeve 2300.

FIGS. 45 through 47 illustrate one embodiment where quick lock/quick unlock system 3000 is placed in a locked state from an unlocked state. Sleeve 2300 is assumed to be held in a static state (such as by annular BOP 70 not shown for clarity). Mandrel 110 is moved in the direction of arrow 2320 so that the tips 3140 of plurality of fingers 3120 will move toward the second part 3400 (which can include a plurality of latching areas 3410). By interaction with the plurality of flutes 136, plurality of alignment members 3610 will align plurality of fingers 3120 with the plurality of latching areas 3410. FIG. 46 shows that latching has occurred with further movement in the direction of arrow 2630 until shoulder 3220 contacts plurality angled areas 137 as shown in FIG. 47. Further attempts to move in the direction of arrow 2640 will cause a thrust load to be generated in the direction of arrow 2640 and transferred to sleeve 2300 by locking hub 3100 through base 3200 contacting surface 3554, and ultimately transferring the thrust load to annular BOP 70 holding sleeve 2300 longitudinally static. Arrows 2682 and 2684 schematically indicates that sleeve 2300 and mandrel 110 can rotate relative to each other even when quick lock/quick unlock system 3000 is in a locked state.

FIGS. 48 through 50 illustrate one embodiment where quick lock/quick unlock system 3000 is placed in an unlocked locked state from a locked state. Sleeve 2300 is assumed to be held in a static state (such as by annular BOP 70 not shown for clarity). Mandrel 110 is moved in the direction of arrow 2650 so that locking hub (which is locked on mandrel) is also moved in the direction of arrow 2650 until shoulder 3260 contacts shoulder 2600 (FIG. 49) and the tips 3140 of plurality of fingers 3120 will move away from the second part 3400 (which can include a plurality of latching areas 3410). By interaction with the plurality of flutes 136, plurality of alignment members 3610 will keep aligned plurality of fingers 3120 with the plurality of latching areas 3410. FIG. 49 shows that unlatching has occurred. FIG. 50 shows further movement in the direction of arrow 2670 until plurality of fingers having been moved out of fluted area 135 and reciprocation can occur when quick lock/quick unlock system 3000 is in a locked state.

In one embodiment is provided a quick lock/quick unlock system 3000 wherein the underwater position of the longitudinal length of the sleeve's sealing area (e.g., the nominal length between the catches) can be determined with enough accuracy to allow positioning of the sleeve's effective sealing area in the annular BOP 70 for closing on the sleeve's 2300 sealing area ("L" in FIG. 60). After sleeve 2300 and mandrel 110 have been longitudinally moved relative to each other when annular BOP 70 was closed on sleeve 2300, it is preferred that a system 3000 be provided wherein the underwater position of sleeve 2300 can be determined even where sleeve 3000 has been moved outside of annular BOP 70.

In one embodiment is provided a quick lock/quick unlock system 3000 for locating the relative position between sleeve 2300 and mandrel 110. Because sleeve 2300 can reciprocate relative to mandrel 110 (i.e., the sleeve and mandrel can move relative to each other in a longitudinal direction), it can be important to be able to determine the relative longitudinal position of sleeve 2300 compared to mandrel 110 at some point after sleeve 2300 has been reciprocated relative to mandrel 110 (or vice versa). For example, in various uses of rotating and reciprocating tool 100', the operator may wish to seal annular BOP 70 on sleeve 2300 sometime after sleeve 2300 has been reciprocated relative to mandrel 110 and after sleeve 2300 has been removed from annular BOP 70. To address the risk that the actual position of sleeve 2300 relative to mandrel 110 will be lost while tool 100' is underwater, a quick lock/quick unlock system 3000 can detachably connect sleeve 2300 and mandrel 110. In a locked state, this quick lock/quick unlock system 3000 can reduce the amount of relative longitudinal movement between sleeve 2300 and mandrel 110 (compared to an unlocked state) so that sleeve 2300 can be positioned in annular BOP 70 and annular BOP 70 relatively easily closed on sleeve's 2300 longitudinal sealing area ("L" in FIG. 60). Alternatively, this quick lock/quick unlock system 3000 can lock in place sleeve 2300 relative to mandrel 110 (and not allow a limited amount of relative longitudinal movement). After being changed from a locked state to an unlocked state, sleeve 2300 can experience its unlocked amount of relative longitudinal movement which is referred to as stroke in other parts of this application.

In one embodiment is provided a quick lock/quick unlock system 3000 which allows sleeve 2300 to be longitudinally locked and/or unlocked relative to the mandrel 110 a plurality of times when underwater. In one embodiment the quick lock/quick unlock system 3000 can be activated using annular BOP 70.

In one embodiment sleeve 2300 and mandrel 110 can rotate relative to one another even in both the activated and un-activated states (schematically indicated by arrows 2682, 2684 in FIG. 47). In one embodiment, when in a locked state, the sleeve and mandrel can rotate relative to each other. This relative rotation when locked option can be important where annular BOP 70 is closed on sleeve 2300 at a time when string 85,88 (of which the mandrel 110 is a part) is being rotated. Allowing sleeve 2300 and mandrel 110 to rotate relative to each other, even when in a locked state, minimizes wear/damage to annular BOP 70 caused by a rotationally locked sleeve 300 (e.g., sheer pin in FIG. 10) rotating relative to a closed annular BOP 70. Instead, sleeve 2300 can be held fixed rotationally by closed annular BOP 70, and mandrel 110 (along with string 85,88) rotate relative to the sleeve (as schematically illustrated in FIG. 47).

In one embodiment, when locking system 3000 of sleeve (e.g., first part 3100) is in contact with mandrel 110, locking/unlocking is performed without relative rotational movement between locking system of the sleeve (first part 3100) and mandrel 110—otherwise scoring/scratching of the mandrel at the location of lock can occur. In one embodiment, this can be accomplished by rotational connecting to sleeve 2300 the sleeve's portion of quick lock/quick unlock system 3000 (e.g., locking hub 3100). In one embodiment a locking hub 3100 is provided which is rotationally connected to sleeve 2300.

In one embodiment quick lock/quick unlock system 3000 on rotating and reciprocating tool 100' can be provided allowing the operator to lock sleeve 2300 relative to mandrel 110 when rotating and reciprocating tool 100' is downhole/underwater. Because of the relatively large amount of possible stroke of sleeve 2300 relative to mandrel 110 (i.e., different possible relative longitudinal positions), knowing the relative position of sleeve 2300 with respect to mandrel 110 can be important. This is especially true at the time annular BOP 70 is closed on sleeve 2300. The locking position is important for determining relative longitudinal position of sleeve 2300 along mandrel 110 (and therefore the true underwater depth of sleeve 2300—schematically shown in FIG. 2 as "TD" for tool 100) so that sleeve 2300 can be easily located in annular BOP 70 and annular BOP 70 closed/sealed on sleeve 2300.

During the process of moving the rotating and reciprocating tool 100' underwater and downhole, sleeve 2300 can be locked relative to mandrel 110 by quick lock/quick unlock system 3000. In one embodiment quick lock/quick unlock system 3000 can, relative to mandrel 110, lock sleeve 2300 in a longitudinal direction. In one embodiment sleeve 2300 can be locked in a longitudinal direction with quick lock/quick unlock system 300, but sleeve 2300 can rotate relative to mandrel 110 (schematically shown in FIG. 47) during the time it is locked in a longitudinal direction. In one embodiment quick lock/quick unlock system 3000 can simultaneously lock sleeve 2300 relative to mandrel 110, in both a longitudinal direction and rotationally (not shown but accomplished by non-rotationally attaching locking hub 3100 to sleeve 2300). In one embodiment quick unlock/quick unlock system 3000 can, relative to mandrel 110, lock sleeve 110 rotationally, but at the same time allow sleeve 2300 to move longitudinally (not shown but accomplished by non-rotationally attaching locking hub 3100 to sleeve 2300 and allowing a relative longitudinal movement between locking hub 3100 and sleeve, such as by using recessed area 2552 with fluted areas on locking hub 3100 and recessed area 2552).

Activation by Relative Longitudinal Movement

In one embodiment quick lock/quick unlock system 3000 can be activated (and placed in a locked state) by movement of mandrel 110 relative to sleeve 2300 in a first longitudinal direction (schematically indicated by arrows 2620, 2630, and 2640 in FIGS. 45 through 47). In one embodiment quick lock/quick unlock system 3000 is deactivated (and placed in an unlocked state) by movement of the mandrel 110 relative to sleeve 2300 in a second longitudinal direction, the second longitudinal direction being substantially in the opposite longitudinal direction compared to the first longitudinal direction (schematically indicated by arrows 2650, 2660, and 2670 in FIGS. 48 through 50).

In one embodiment the first longitudinal direction is toward the longitudinal center of sleeve 2300 (schematically indicated by arrows 2620, 2630, and 2640 in FIGS. 45 through 47). In one embodiment the second longitudinal direction is away from the longitudinal center of the mandrel (schematically indicated by arrows 2650, 2660, and 2670 in FIGS. 48 through 50).

In one embodiment quick lock/quick unlock system 3000 can be changed from an activated to a deactivated state when sleeve 2300 is at least partially located in annular BOP 70. In one embodiment quick lock/quick unlock system 3000 can be changed from a deactivated state to an activated state when sleeve 2300 is at least partially located in annular BOP 70.

In one embodiment quick lock/quick unlock system 3000 can be changed from an activated to a deactivated state when annular BOP 70 is closed on sleeve 2300. In one embodiment quick lock/quick unlock system 3000 can be changed from a deactivated state to an activated state when annular BOP 70 is closed on sleeve 2300.

In one embodiment quick lock/quick unlock system 3000 can be changed from an activated to a deactivated state when sleeve 2300 is sealed with respect to annular BOP 70. In one embodiment quick lock/quick unlock system 3000 can be changed from a deactivated state to an activated state when sleeve 2300 is sealed with respect to annular BOP 70.

In one embodiment, at a time when sleeve 2300 is at least partially located in annular BOP 70, quick lock/quick unlock system 3000 can be activated (and placed in a locked state) by movement of sleeve 2300 relative to mandrel 110 in a first longitudinal direction to a locking location (schematically indicated by arrows 2620, 2630, and 2640 in FIGS. 45 through 47). In one embodiment, at a time when sleeve is at least partially located in annular BOP 70, quick lock/quick unlock system is deactivated (and placed in an unlocked state) by movement of sleeve 2300 relative to mandrel 110 in a second longitudinal direction away from the locking location, the second longitudinal direction being substantially in the opposite direction compared to the first longitudinal direction (schematically indicated by arrows 2650, 2660, and 2670 in FIGS. 48 through 50).

In one embodiment, direction at a time when annular BOP 70 is closed on sleeve 2300, quick lock/quick unlock system 3000 is activated (and placed in a locked state) by movement of sleeve 2300 relative to mandrel 110 in a first longitudinal (schematically indicated by arrows 2620, 2630, and 2640 in FIGS. 45 through 47). In one embodiment, at a time when annular BOP 70 is closed on sleeve 2300, quick lock/quick unlock system 3000 is deactivated (and placed in an unlocked state) by movement of sleeve 2300 relative to mandrel 110 in a second longitudinal direction, the second longitudinal direction being substantially in the opposite longitudinal direction compared to the first longitudinal direction (schematically indicated by arrows 2650, 2660, and 2670 in FIGS. 48 through 50).

In one embodiment, at a time when sleeve is sealed with respect to annular BOP 70, quick lock/quick unlock system is activated (and placed in a locked state) by movement of sleeve 2300 relative to mandrel 110 in a first longitudinal direction (schematically indicated by arrows 2620, 2630, and 2640 in FIGS. 45 through 47). In one embodiment, at a time when sleeve 2300 is sealed with respect to annular BOP 70, quick lock/quick unlock system 3000 is deactivated (and placed in an unlocked state) by movement of sleeve 2300 relative to mandrel 110 in a second longitudinal direction, the second longitudinal direction being substantially in the opposite longitudinal direction compared to the first longitudinal direction (schematically indicated by arrows 2650, 2660, and 2670 in FIGS. 48 through 50).

Activation by Moving to a Locking Position

In one embodiment, at a time when sleeve 2300 is at least partially located in annular BOP 70, sleeve 2300 is moved to a locking position relative to mandrel 110. In one embodiment, at a time when sleeve 2300 is at least partially located in annular BOP 70, quick lock/quick unlock system 3000 is changed from a deactivated state to an activated state by moving the sleeve to specified locking position on mandrel 110 (schematically indicated by arrows 2620, 2630, and 2640 in FIGS. 45 through 47). In one embodiment, at a time when sleeve 2300 is at least partially located in annular BOP 70, quick lock/quick unlock system 3000 is changed from an activated state to a deactivated activated state by moving sleeve 2300 away from a specified position on the mandrel 110 (schematically indicated by arrows 2650, 2660, and 2670 in FIGS. 48 through 50).

In one embodiment, at a time when annular BOP 70 is closed on sleeve 2300, sleeve 2300 is moved to a locking position relative to mandrel 110. In one embodiment, at a time when annular BOP 70 is closed on sleeve 2300, quick lock/quick unlock system 3000 is changed from a deactivated state to an activated state by moving sleeve 2300 to a specified locking position on the mandrel (schematically indicated by arrows 2620, 2630, and 2640 in FIGS. 45 through 47). In one embodiment, at a time when annular BOP 70 is closed on sleeve 2300, quick lock/quick unlock system 3000 is changed from an activated state to a deactivated activated state by moving the sleeve away from a specified position on the mandrel (schematically indicated by arrows 2650, 2660, and 2670 in FIGS. 48 through 50).

In one embodiment, at a time when sleeve 2300 is sealed in annular BOP 70, sleeve 2300 is moved to a locking position relative to mandrel 110. In one embodiment, at a time when sleeve 2300 is sealed in annular BOP 70, quick lock/quick unlock system 3000 is changed from a deactivated state to an activated state by moving sleeve 2300 to specified locking position on mandrel 110 (schematically indicated by arrows 2620, 2630, and 2640 in FIGS. 45 through 47). In one embodiment, at a time when sleeve 2300 is sealed in annular BOP 70, quick lock/quick unlock system 3000 is changed from an activated state to a deactivated state by moving sleeve 2300 away from a specified position on mandrel (schematically indicated by arrows 2650, 2660, and 2670 in FIGS. 48 through 50).

Activation by Exceeding a Specified Minimum Locking Force

In one embodiment quick lock/quick unlock system 3000 is activated when at least a first specified minimum longitudinal force is placed on sleeve 2300 relative to mandrel 110. In one embodiment the first specified minimum longitudinal force is used to determine whether sleeve 2300 is locked relative to the mandrel 110. That is, where sleeve 2300 cannot absorb at least the first specified minimum longitudinal force, quick lock/quick unlock system 3000 can be considered in a deactivated state. In one embodiment, the specified minimum longitudinal force is a predetermined force. In various embodiments the specified minimum longitudinal force is between 5,000, 10,000, 15,000, 20,000, 25,000, 30,000, 35,000, 40,000, 45,000, 50,000, 55,000, 60,000, 65,000, 70,000, 75,000, 80,000, 85,000, 90,000, 95,000, 100,000 pounds force (22, 44, 67, 89, 111, 133, 152, 171, 190, 210, 229, 248, 267, 289, 311, 334, 355, 378, 400, 423, and 445 kilo newtons). In one embodiment various ranges of the above referenced forces can be used for the various possible permutations.

In one embodiment quick lock/quick unlock system 3000 is deactivated when at least a second specified minimum longitudinal force is placed on sleeve 2300 relative to mandrel 110. In one embodiment the second specified minimum longitudinal force is used to determine whether sleeve 2300 is locked relative to mandrel 110. That is where sleeve 2300 cannot absorb at least the second specified minimum longitudinal the quick lock/quick unlock system 3000 can be considered in a deactivated state. In one embodiment the first specified minimum longitudinal force is substantially equal to the second specified minimum longitudinal force. In one embodiment the first specified minimum longitudinal force is substantially greater than the second specified minimum longitudinal force. In one embodiment the first specified minimum longitudinal force takes into account the amount of longitudinal friction between sleeve 2300 and mandrel 110. In one embodiment the second specified minimum longitudinal force takes into account the amount of longitudinal friction between sleeve 2300 and mandrel 110. In one embodiment both the first specified minimum longitudinal force and the second specified minimum longitudinal force take into account the amount of longitudinal friction between sleeve 2300 and mandrel 110. In one embodiment the first specified minimum longitudinal force takes into account the longitudinal force applied to sleeve 2300 based on differing pressures above and below annular BOP 70. In one embodiment the second specified minimum longitudinal force takes into account the longitudinal force applied to sleeve 2300 based on differing pressures above and below annular BOP 70. In one embodiment both the first specified minimum longitudinal force and the second specified minimum longitudinal force take into account the longitudinal force applied to sleeve 2300 based on differing pressures above and below annular BOP 70.

Example of a Specified Minimum Locking Force

In one example of operation with deep water wells, annular BOP 70 can be located between 6000 to 7000 feet (1,800 to 2,150 meters) below the rig 10 floor. Quick lock/quick unlock system 3000 can be activated by closing annular BOP 70 on sleeve 2300 and pulling up with a force of approximately 40,000 pounds (178 kilo newtons) (schematically indicated by arrows 2620, 2630, and 2640 in FIGS. 45 through 47). Quick lock/quick unlock system 3000 can be de-activated by closing annular BOP 70 on sleeve 2300 and lowering mandrel 110 relative to sleeve 2300 (schematically indicated by arrows 2650, 2660, and 2670 in FIGS. 48 through 50). When approximately 40,000 pounds (178 kilo newtons) of longitudinal force (e.g., exerted by the weight of string 88 not being supported by rig 10) is created between mandrel 110 and sleeve 2300, quick lock/quick unlock system 3000 can become deactivated and unlock sleeve 2300 from mandrel 110 so that mandrel 110 can be reciprocated relative to sleeve 2300 (where annular BOP 70 is closed on sleeve 2300). For this example, the specified minimum differential longitudinal force of 40,000 pounds (178 kilo newtons) can be used to overcome 10,000 pounds (44 kilo newtons) of longitudinal friction (such as seal friction) and 30,000 pounds (133 kilo newtons) from quick lock/quick unlock system 3000. This minimum longitudinal force (e.g., 40,000 pounds or 178 kilo newtons) can address the risk that sleeve 2300 does not get bumped out of its locked longitudinal position when sleeve 2300 is moved outside of annular BOP 70 (i.e., unlocking quick lock/quick unlock system 3000 and causing the operator to lose the position TD, shown in FIG. 2, of sleeve 2300 relative to mandrel 110). The minimum longitudinal force also ensures that sleeve 2300 will not float up/sink down mandrel 110 as a result of fluid flow around sleeve 2300 when annular BOP 70 is open (such as when returns are taken up riser 80).

Various Options for Allowable Reciprocation when in a Locked State

In one embodiment is provided quick lock/quick unlock system 3000 where sleeve 2300 and mandrel 110 reciprocate relative to each other a specified distance even when locked, however, the amount of relative reciprocation increases when unlocked (schematically shown in FIGS. 46,47 by space in recessed area 2552 and shoulder 2600). In one embodiment the amount of allowable relative reciprocation even in a locked state facilitates operation of a clutching system between the sleeve and mandrel (schematically shown in FIG. 53). In one embodiment the amount of allowable relative reciprocation even in a locked state allows relative longitudinal and rotational movement between a locking hub 3100 and sleeve 2300 to allow a clutching system to align hub 3100 for interlocking with fluted 135 area of mandrel 110. In one embodiment the amount of allowable relative reciprocation even in a locked state is In one embodiment the amount of allowable relative reciprocation even in a locked state is between 0 and 12 inches (0 and 30.48 centimeters), between 0 and 11 inches (0 and 27.94 centimeters), 10, 9, 8, 7, 6, 5, 4, 3, 2, 1, ¾, ½, ¼, ⅛ inches (25.4, 22.86, 20.32, 17.78, 15.24, 12.7, 10.16, 7.62, 5.08, 2.54, 1.91, 1.27, 0.64, 0.32 centimeters). In one embodiment the amount of allowable relative reciprocation even in a locked state is between ⅛ inch (0.32 centimeters) and any of the specified distances up to 12 inches (30.48 centimeters). In other embodiments the amount of allowable relative reciprocation even in a locked state is between ¼ inches (0.64 centimeters) and any of the specified distances up to 12 inches (30.48 centimeters). In other embodiments the amount of allowable relative reciprocation even in a locked state is between ½, ¾, 1, etc. and any of the specified distances. In other embodiments the amount of allowable relative reciprocation even in a locked state is between any possible permutation of the specified distances.

Spring Lock/Unlock

In one embodiment a spring and latch quick lock/quick unlock system 3000 is provided between sleeve 2300 and mandrel 110. The spring can comprise one or more fingers 3120 (or a single finger, or a single ring) which detachably connects to a connector 3400 located on mandrel 110, such as a locking valley 3460. In one embodiment ramp 3420 on mandrel 110 can be provided facilitating the bending of one or more fingers 3120 (or ring) before they lock/latch into the connecting valley 3460. In one embodiment is provided a backstop 137 to resist longitudinal movement of sleeve 2300 relative to mandrel 110 after the one or more fingers 3120 (or ring) have locked/latched into the valley 3460.

In one embodiment is provided a quick lock/quick unlock system which includes a hub rotationally connected to the sleeve, and the hub can have a plurality of fingers, the mandrel can have a longitudinal bearing area and a locking area (located adjacent to the bearing area). In one embodiment the fingers can pass over the bearing area without touching the bearing area. In one embodiment the fingers can be radially expanded by the locking area, and then lock in the locking area. In one embodiment longitudinal movement of the sleeve relative to the mandrel can be restricted by the shoulder area. In one embodiment longitudinal movement of the hub relative to the mandrel can be restricted by the shoulder area. In one embodiment longitudinal movement of the sleeve relative to the mandrel can be restricted by the shoulder area contacting the hub and the hub contacting thrusting against the sleeve.

Figure 58:
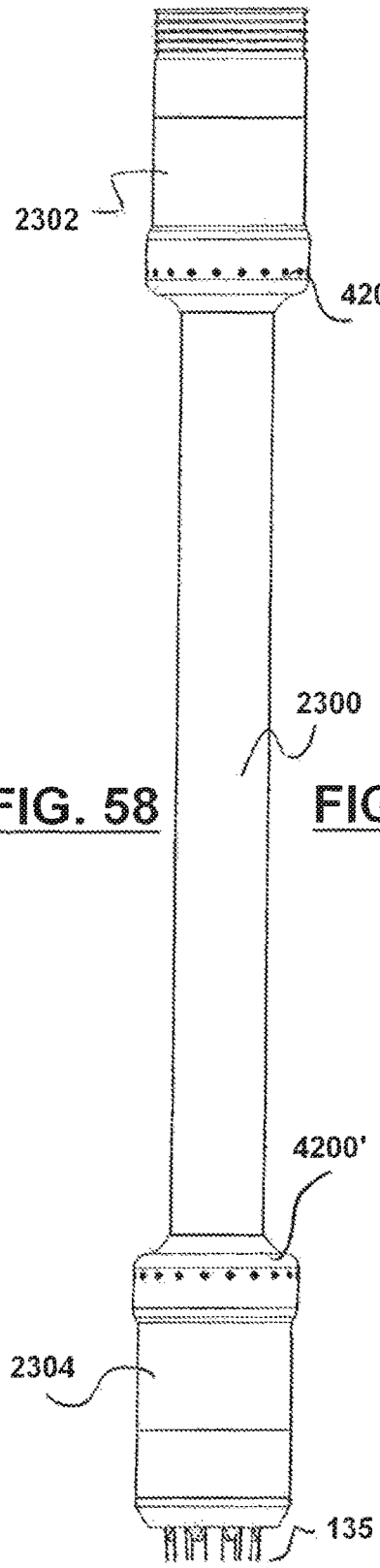
FIGS. 58 through 60 show various embodiments of a generic sleeve with specialized removable adaptors for different annular BOPs.
Figure 59:
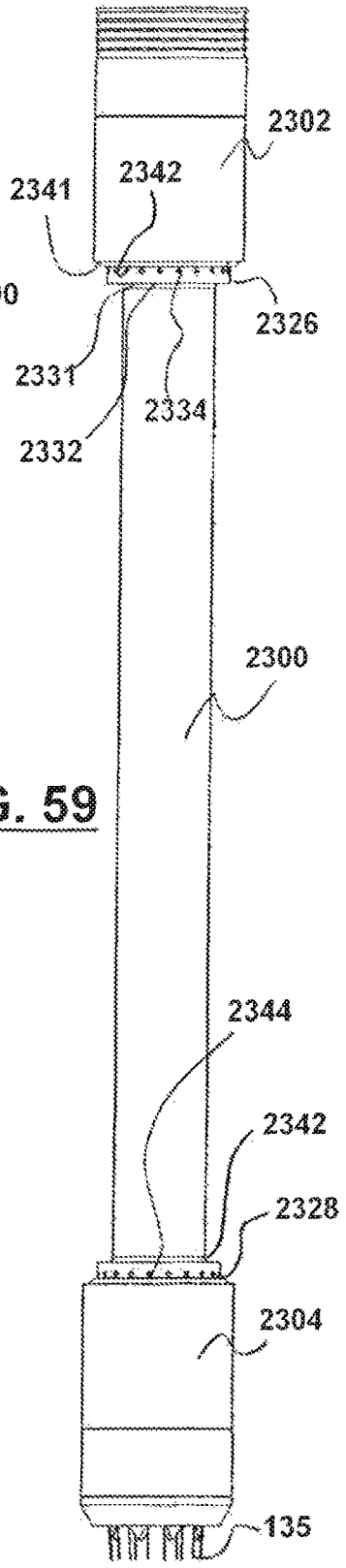

FIGS. 58 through 60 show various embodiments of a generic sleeve with specialized removable adaptors for different annular BOPs. FIG. 59 shows the generic sleeve 2300 which can accommodate various specialized removable adaptors. Different manufacturers of annular BOP 70 have different designs for their respective annular BOPs and annular seals 71. Accordingly, a catch for one of these seals 71 may, if not designed properly, may actually damage the annular seal 71. Typically, it is where a longitudinal thrust load is placed by the sleeve on the annular seal 71 (i.e., the catch areas). However, sleeve 2300 is an expensive piece of equipment to manufacture and it is desirably to have a generic sleeve 2300 which can be specialized for various annular BOP 70 configurations.

Sleeve 2300 can include upper and lower catches 2326, 2328. Upper catch 2326 can include a plurality of openings 2334 for detachably connecting one or more specialized adaptors. Lower catch 2328 can include a plurality of openings 2344 for detachably connecting one or more specialized adaptors. FIGS. 58 and 60 show two possible specialized adaptors 4200 and 4400. Adaptor 4200 can be used for an annular BOP manufactured by Shaffer. Adaptor 4400 can be used for an annular BOP manufactured by Hydril.

Figure 61:
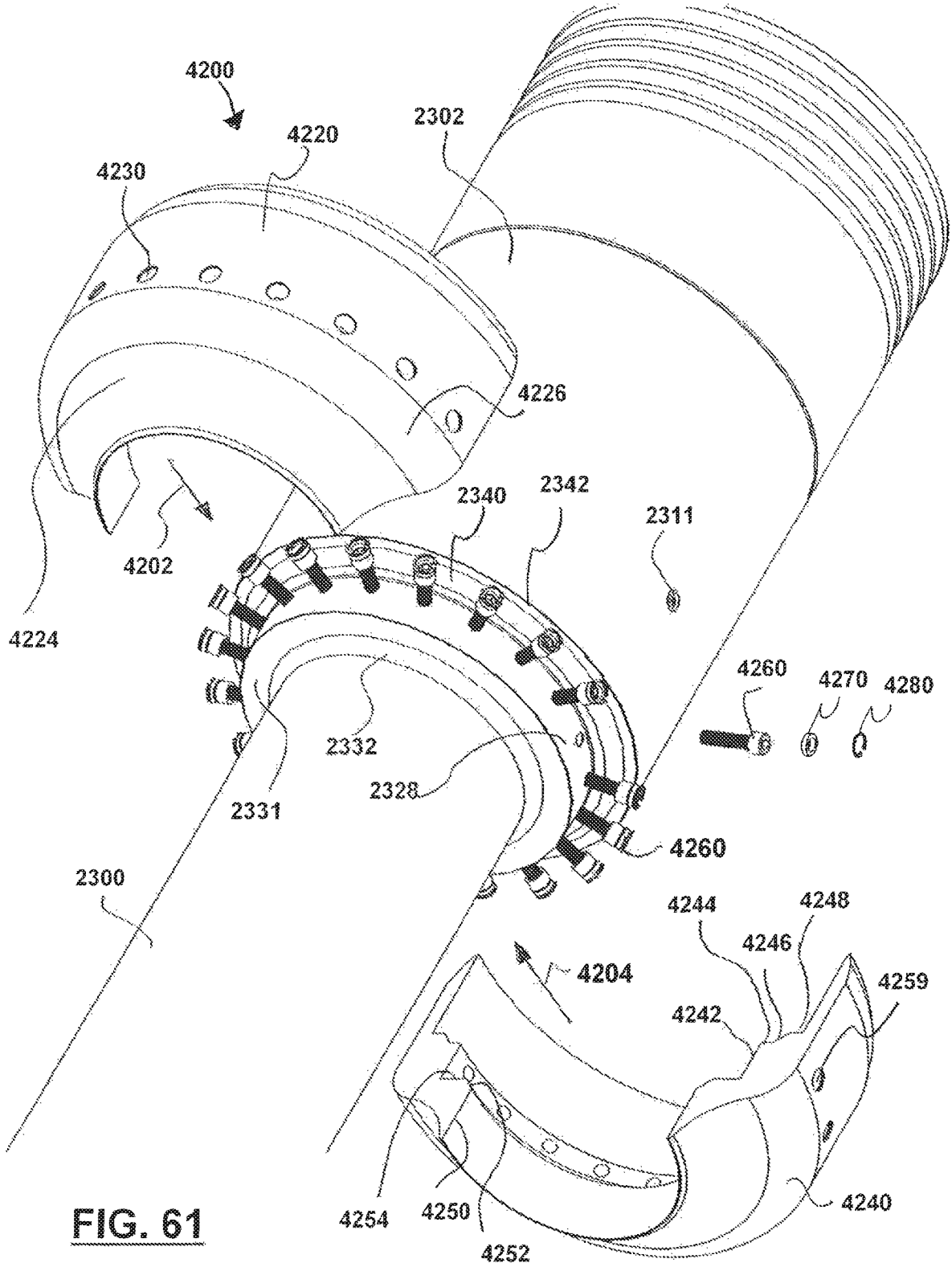
FIG. 61 is an exploded perspective view of one specialized removable adaptor for an annular BOP.

FIG. 61 is an exploded perspective view of one specialized removable adaptor 4200 for an annular BOP 70. As shown in FIG. 61 specialized catch adapter 4200 can comprise first section 4220 and second section 4240 which can be detachably connected to sleeve 2300 as indicated by arrows 4202 and 4204. First section 4220 can comprise inner diameter 4222, rounded area 4224, second rounded area 4226, and a plurality of openings 4230. First and second sections can be constructed substantially like each other. Second section 4226 can comprise interior 4242, base 4244, angled section 4246, diameter 4250, angled area 4252, and base 4254. Second section 4226 can also include a plurality of openings 4259 for connecting it to sleeve 2300. First and second sections 4220 and 4240 are shown as being two separate pieces, but can be a single piece, such as where they are hinged together. A plurality of fasteners 4260 can be used to detachably connect first section 4220 and/or second section 4240 to sleeve 2300. A plurality of washers 4270 and snap rings 4280 can also be used. The snap rings 4280 can be used to prevent one or more of the fasteners 4260 from becoming loose and falling downhole.

Figure 62:
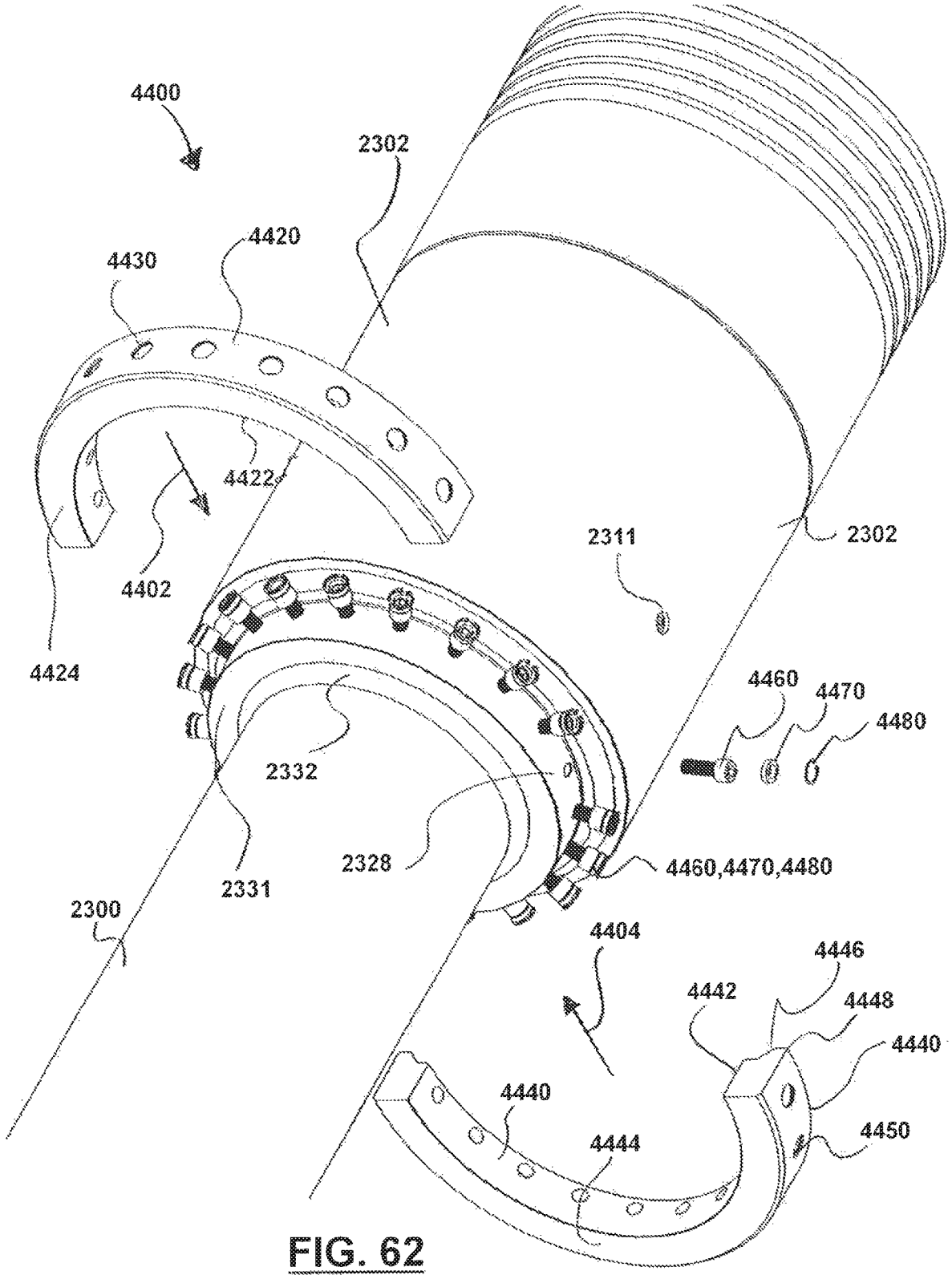
FIG. 62 is an exploded perspective view of a second specialized removable adaptor for a second annular BOP.
Figure 63:
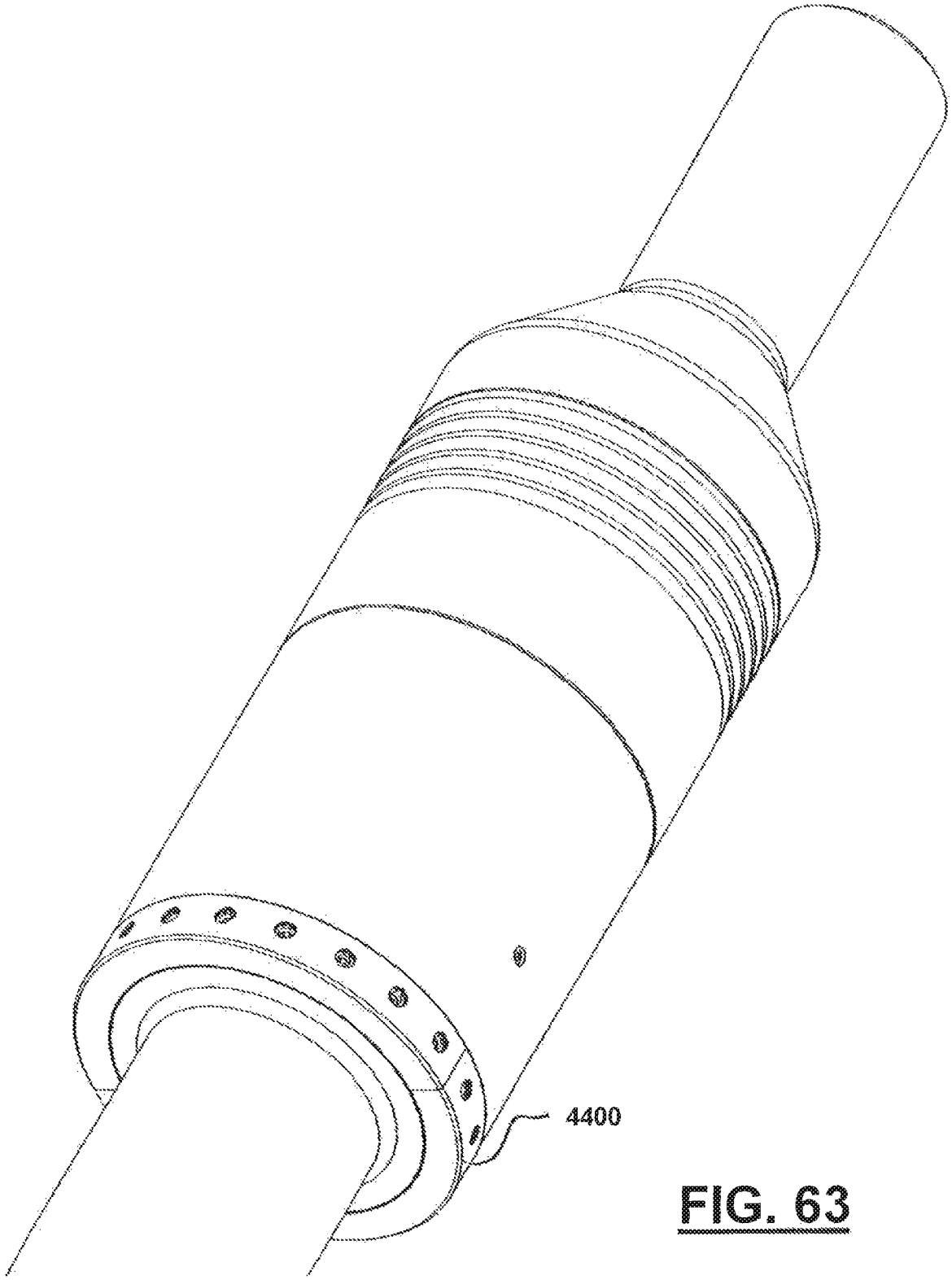
FIG. 63 is a perspective view of the specialized removable adaptor attached to the sleeve.
Figure 64:
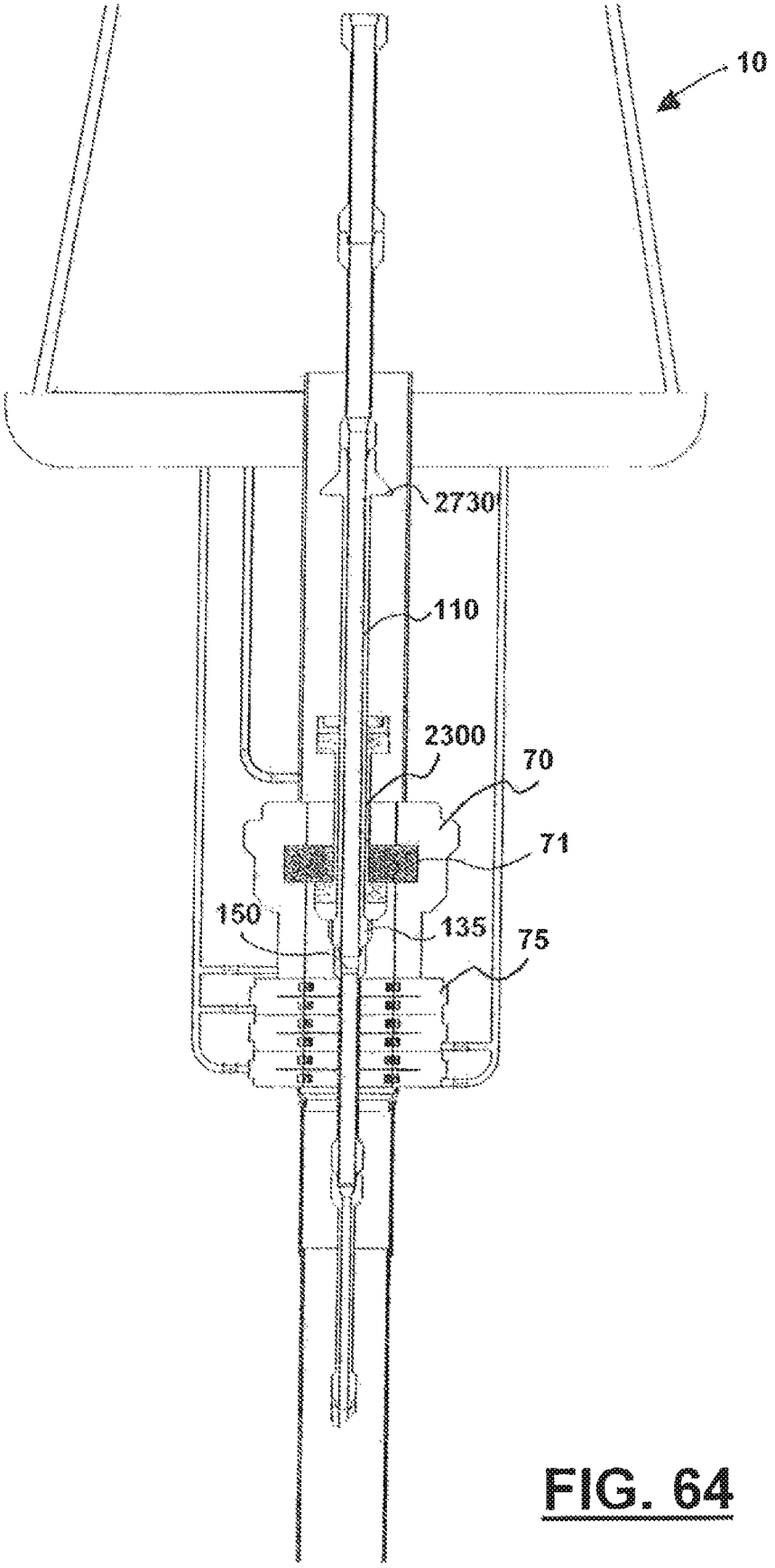
FIG. 64 is a schematic diagram illustrating one embodiment of the method and apparatus.

FIG. 62 is an exploded perspective view of a second specialized removable adaptor 4400 for a second annular BOP 70'. FIG. 63 is a perspective view of the specialized removable adaptor 4400 attached to sleeve 2300. As shown in FIG. 62 specialized catch adapter 4400 can comprise first section 4420 and second section 4440 which can be detachably connected to sleeve 2300 as indicated by arrows 4402 and 4404. First section 4420 can comprise inner diameter 4422, base area 4424, and a plurality of openings 4430. First and second sections can be constructed substantially like each other. Second section 4440 can comprise interior 4442, base 4444, angled section 4446, and base 4448. Second section 4440 can also include a plurality of openings 4450 for connecting it to sleeve 2300. First and second sections 4420 and 4440 are shown as being two separate pieces, but can be a single piece, such as where they are hinged together. A plurality of fasteners 4460 can be used to detachably connect first section 4420 and/or second section 4440 to sleeve 2300. A plurality of washers 4470 and snap rings 4480 can also be used. The snap rings 4480 can be used to prevent one or more of the fasteners 4460 from becoming loose and falling downhole.

Figure 65:
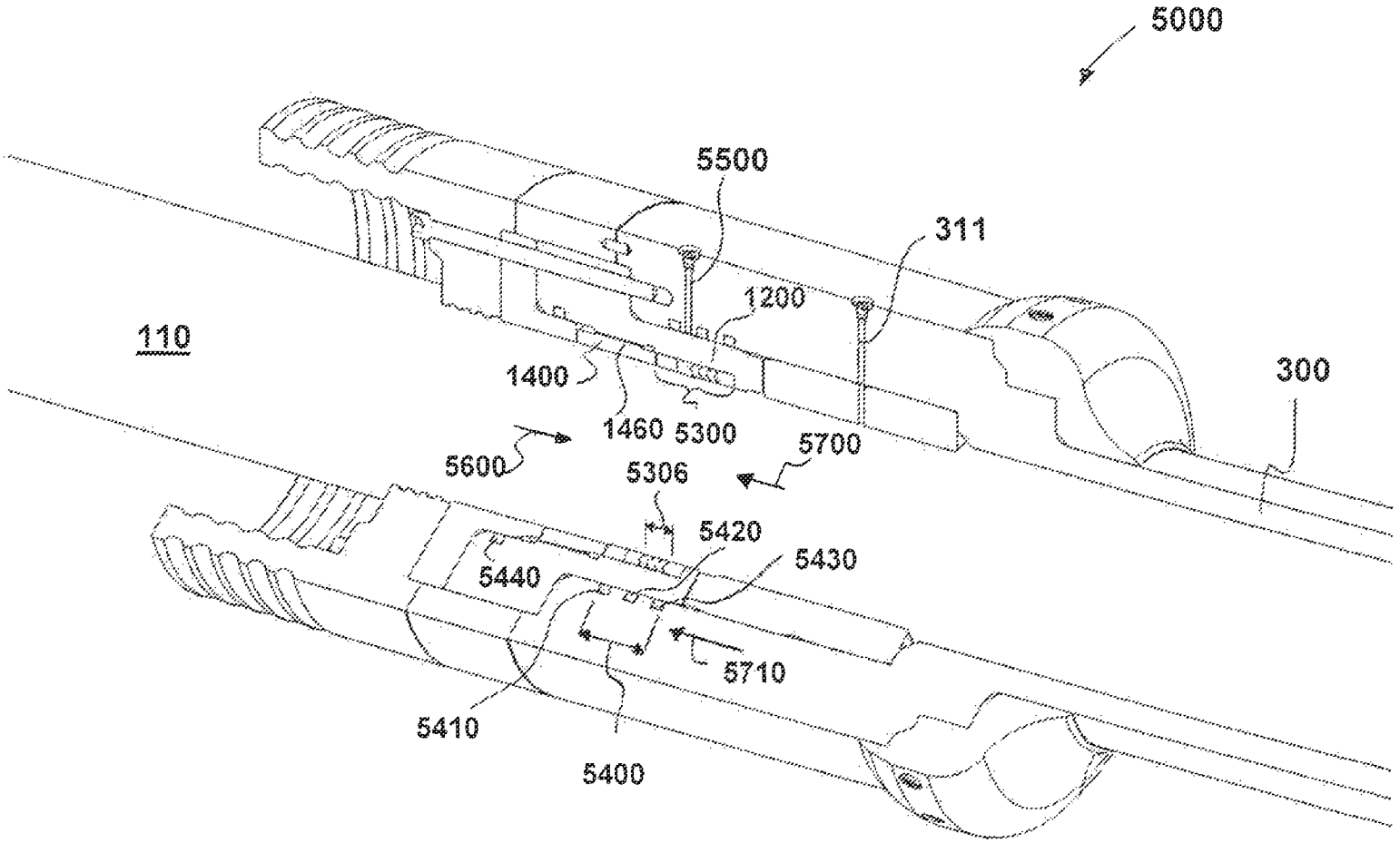
FIG. 65 is a sectional perspective view of the upper part of an alternative rotating and reciprocating swivel with alternative packing assembly.
Figure 66:
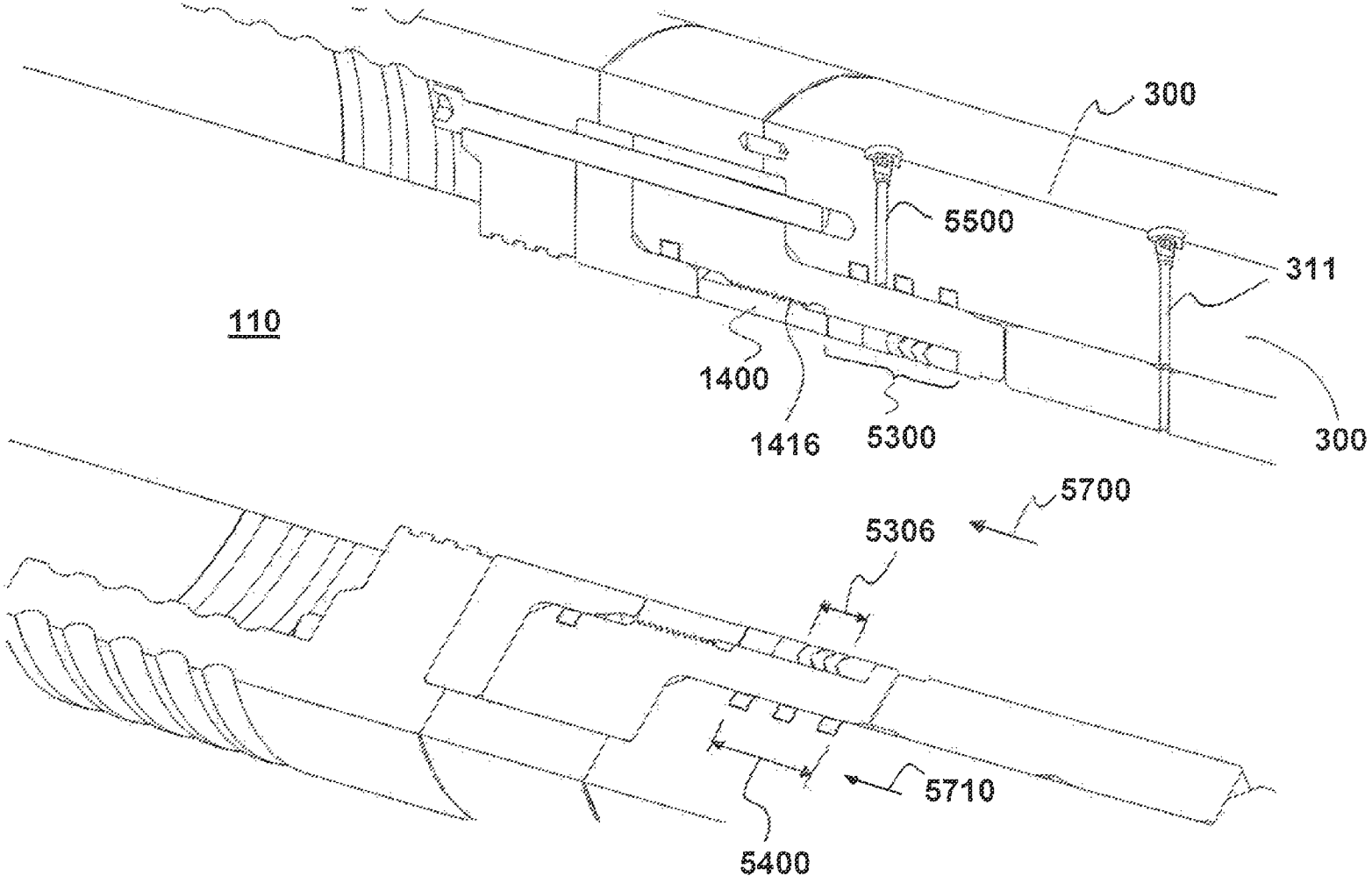
FIG. 66 is a closeup view of the swivel of FIG. 65.
Figure 67:
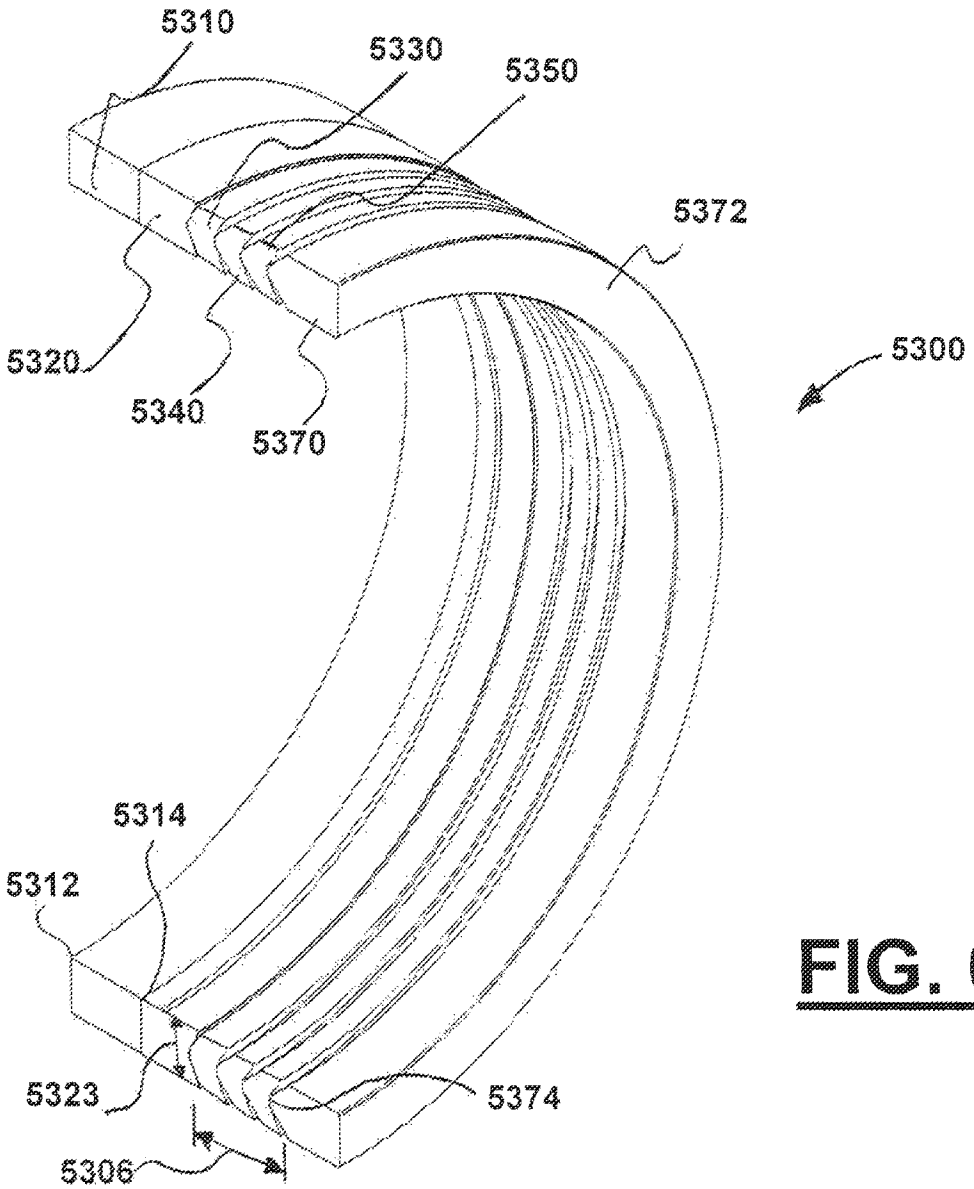
FIG. 67 is a sectional perspective view of the packing unit for the swivel of FIG. 65.
Figure 68:
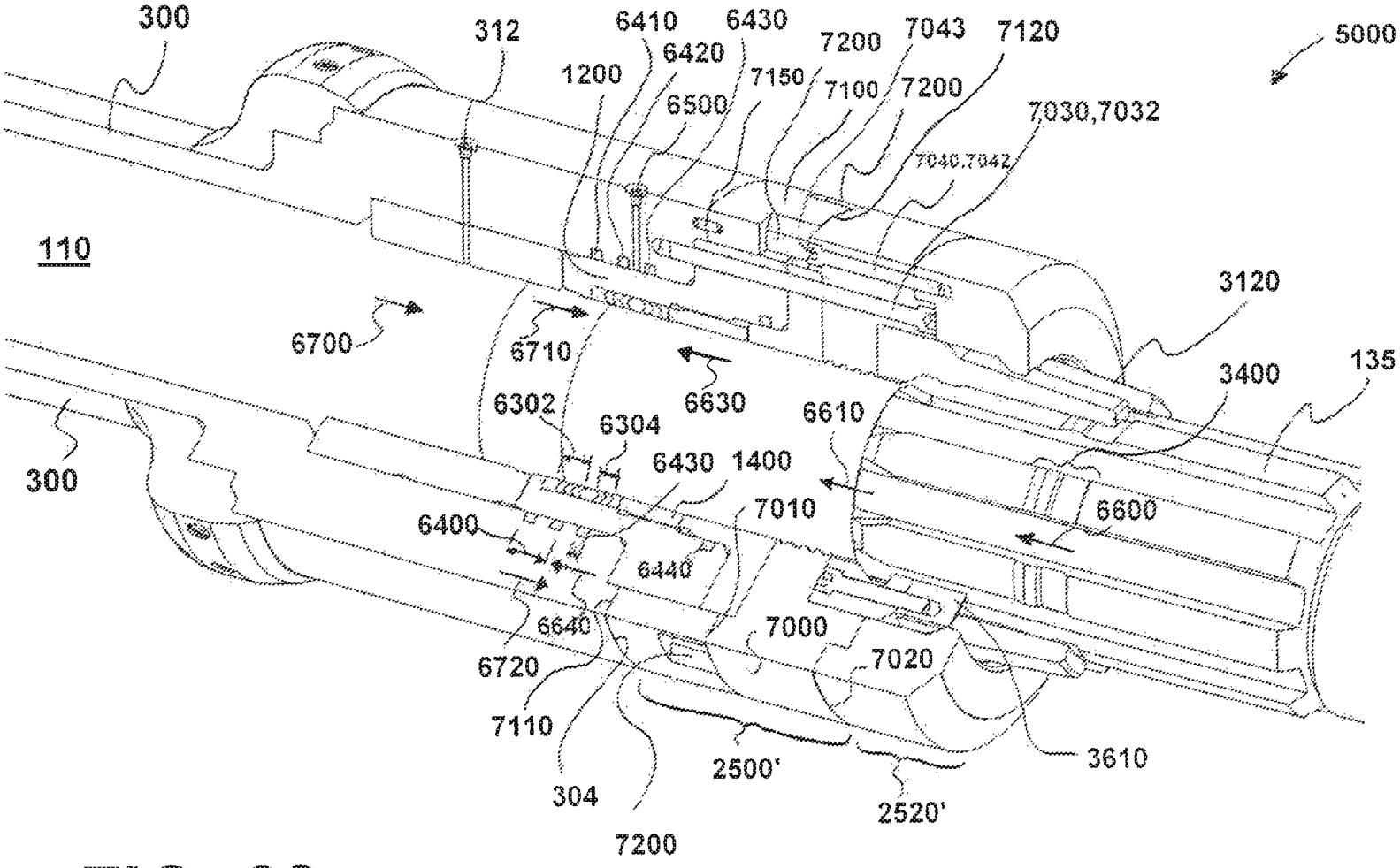
FIG. 68 is a sectional perspective view of the upper part of an alternative swivel with alternative packing assembly.
Figure 69:
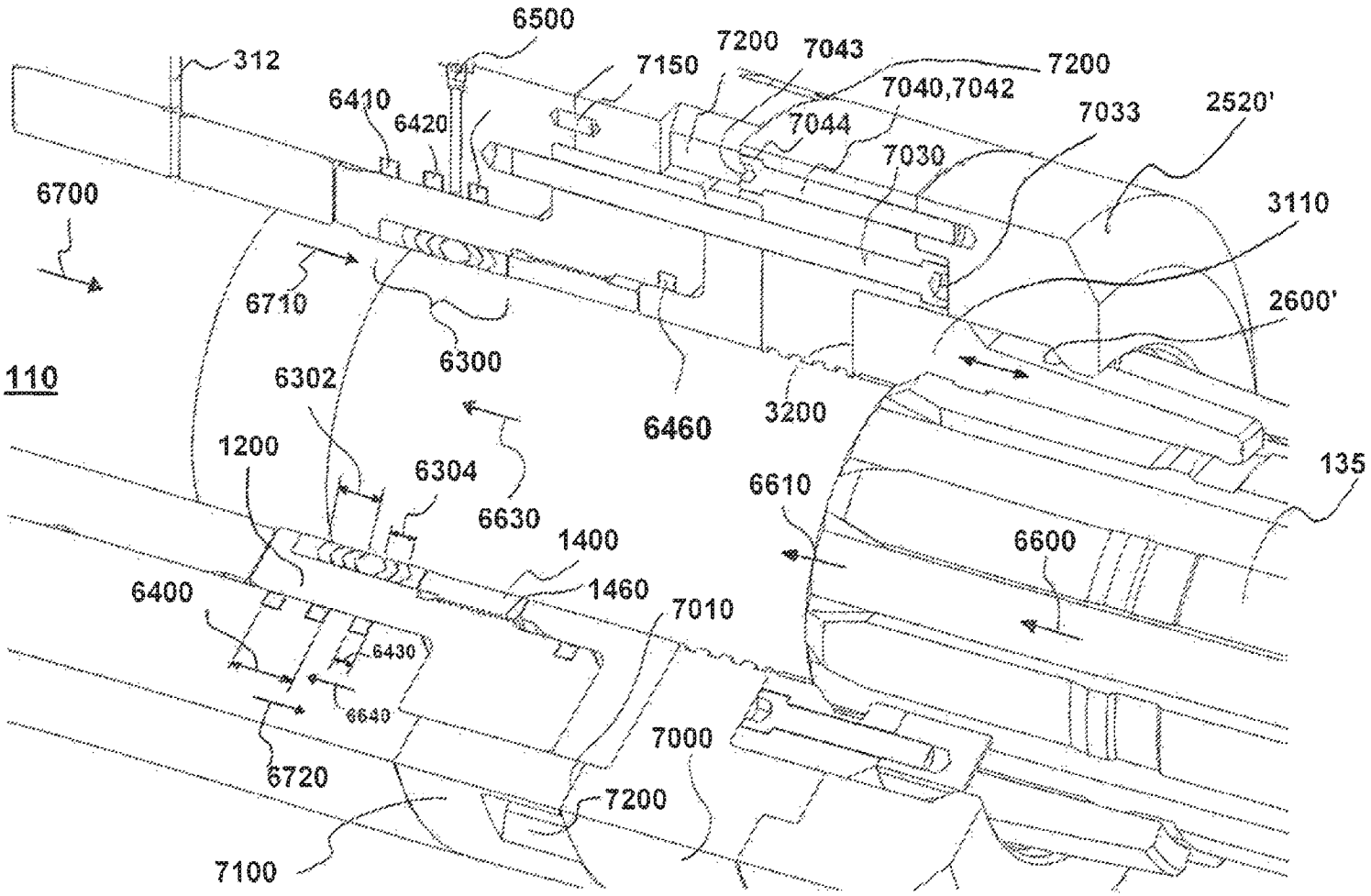
FIG. 69 is a closeup view of the swivel of FIG. 68.
Figure 70:
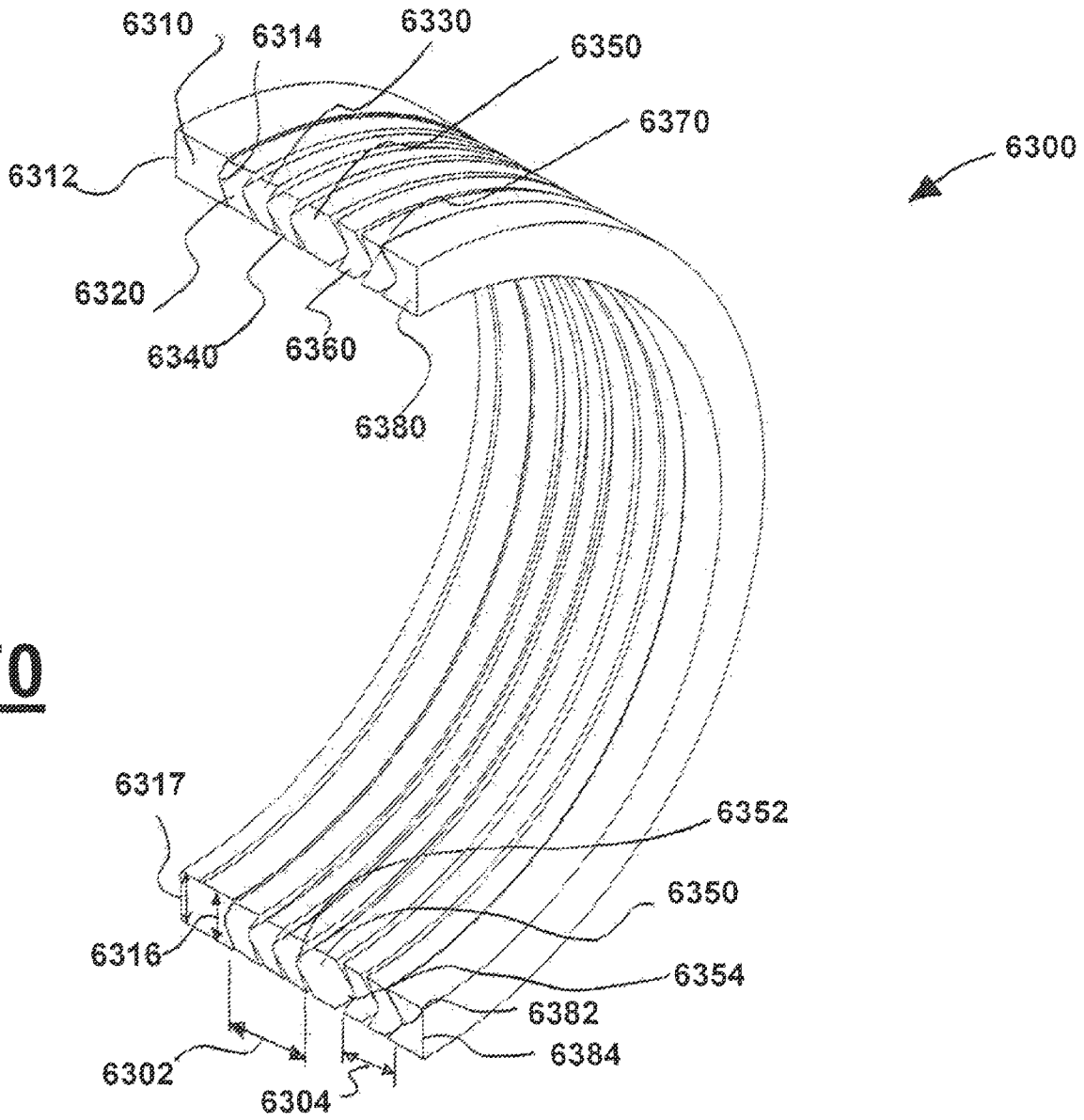
FIG. 70 is a sectional perspective view of the packing unit for the swivel of FIG. 68.

FIG. 65 is a sectional perspective view of the upper part of an alternative sleeve 300 for rotating and reciprocating swivel 5000 with alternative packing assembly 5300. FIG. 66 is a closeup view of sleeve 300. FIG. 67 is a sectional perspective view of packing unit 5300. FIG. 68 is a sectional perspective view of the upper part of sleeve 300 for swivel 5000 with alternative packing assembly 6300. FIG. 69 is a closeup view of sleeve 300. FIG. 70 is a sectional perspective view of packing unit 6300.

FIG. 67 is a sectional perspective view showing one embodiment of a packing unit 5300, which can preferably be used in the box end of an alternative embodiment of rotating and reciprocating swivel 5000 (see FIGS. 65 through 70). Packing unit 5300 can comprise male packing ring 5370, plurality of seals 5306, female packing ring 5320, spacer ring 5310, and packing retainer nut 1400 (not shown for clarity). Packing retainer nut 1400 can be threadably connected to packing housing 1200 at threaded connection 1460. Tightening packing retainer nut 1400 squeezes plurality of seals 5306 between packing housing 1200 and retainer nut 1400 thereby increasing sealing between sleeve or housing 300 (through packing housing 1200) and swivel mandrel 110.

Spacer unit 5310 can comprise first end 5312, second end 5314, and is preferably from SAE 660 BRONZE or SAE 954 Aluminum Bronze. Female backup ring (or packing ring) 5320 is preferably comprised of a bearing grade peek material (such as material number 781 supplied by CDI Seals out of Humble, Tex.). Packing ring 5330 is preferable a bronze filled teflon seal (such as material number 714 supplied by CDI Seals out of Humble, Tex.). Packing rings 5340 and 5350 are preferable teflon seals (such as material number 711 supplied by CDI Seals out of Humble, Tex.). Male packing ring 5370 which can comprise first end 5372 and second end 5374 and is preferably machined from SAE 660 BRONZE or SAE 954 Aluminum Bronze with a flat head 5374 and 45 degrees from the vertical. Seals can be Chevron type "VS" packing rings.

FIG. 70 is a sectional perspective view showing one embodiment for packing unit 6300. Packing unit 6300 can comprise male packing ring 6350, plurality of seals 6302, 6304, female packing rings 6310,6380, male packing ring 6350, and packing retainer nut 1400 (not shown for clarity). Plurality of seals 6302 can seal in the opposite direction of plurality of seals 6304. Packing retainer nut 1400 can be threadably connected to packing housing 1200 at threaded connection 1460. Tightening packing retainer nut 1400 squeezes plurality of seals 6302,6304 between packing housing 1200 and retainer nut 1400 thereby increasing sealing between sleeve or housing 300 (through packing housing 1200) and swivel mandrel 110.

Female backup ring (or packing ring) 6310 can comprise first end 6312, second end 6314, and is preferably comprised of a bearing grade peek material (such as material number 781 supplied by CDI Seals out of Humble, Tex.). Packing ring 6320 is preferable a bronze filled teflon seal (such as material number 714 supplied by CDI Seals out of Humble, Tex.). Packing rings 6330 and 6340 are preferable teflon seals (such as material number 711 supplied by CDI Seals out of Humble, Tex.). Male packing ring 6350 which can comprise first end 6352 and second end 6354 and is preferably machined from SAE 660 BRONZE or SAE 954 Aluminum Bronze with a flat heads 6353,6355 and both being 45 degrees from the vertical. Packing ring 6360 is preferable comprised of teflon (such as material number 711 supplied by CDI Seals out of Humble, Tex.). Packing ring 6370 is preferable a bronze filled teflon seal (such as material number 714 supplied by CDI Seals out of Humble, Tex.). Female backup ring (or packing ring) 6380 can comprise first end 6382, second end 6384, and is preferably comprised of a bearing grade peek material (such as material number 781 supplied by CDI Seals out of Humble, Tex.). Seals can be Chevron type "VS" packing rings.

Alternatively, packing rings 634 and 6360 can be comprised of Viton (such as material number 951 supplied by CDI Seals out of Humble, Tex.).

Static seals 6400 (polypack seals 6410 and 6420) can seal from fluid flow in the direction of arrow 6640). Static seal 6430 (polypack seal 6430) seals from fluid flow in the direction of arrow 6720). Similarly, static seals 5400 (polypack seals 5410, 5420, and 5430) seal from fluid flow in the direction of arrow 5710, and can serve as a backup for static seals 6400. The static seals can be conventionally available polypack seals such as those provided by parker and having polymite (#N651-375110000) or Molythene (#4615-37510000).

Packing unit 5300 (and plurality of seals 5306) is set up to block fluid flow in the direction of arrow 5700, but not block fluid flow in the opposite direction (i.e., arrow 5600). In one embodiment sealing against fluid pressure in the direction of arrow 5700 is much greater than sealing against fluid pressure in the opposite direction (e.g., 1.5 times greater, 2, 3, 4, 5, 6, 7, 8, 9, 10, 20, 30, 40, 50, 60, 70, 80, 90, 100, 1000, and greater, along with any range between these specified factors). Accordingly, fluid (and fluid pressure) can flow through seals 5306 in the direction of arrow 5600 as schematically shown in FIG. 65) and reach plurality of seals 6302 in the direction of arrows 6700 and 6710 (as schematically shown in FIG. 68). It is expected that fluid pressure on the pin end of rotating and reciprocating swivel 5000 will be higher than pressure on the box end. Therefore, allowing fluid and pressure to flow in the direction of arrow 5600 through plurality of seals 5306 will decrease the net pressure seen by plurality of seals 6302 (the net pressure being the difference between the pressure on the pin end of plurality of seals 6302 and the box end of the plurality of seals 6302).

By reducing the net pressure to be sealed against, the expected life of seals 6302 is extended, and the expected frictional resistance created by seals 6302 is reduced. Furthermore, the pressure from fluid in the interstitial space between sleeve or housing 300 and mandrel 110 reduces the net force which sleeve 300 must resist in bending compared to a pressure outside of sleeve 300. Accordingly, the size of sleeve 300 can be reduced based on the lowered net forces it will see.

Additionally, plurality of seals 5306 (in the box end of sleeve 300) and spaced apart from the primary seal set (plurality of seals 6302 on the pin end of sleeve 300), and can serve as a redundant seal set in the event of the failure of the primary seal set 6302. In this case of failure of primary seal set 6302, redundant plurality of seals 5306 will be almost completely a fresh set of seals because plurality of seals 5306 do not start to substantially seal unless and until primary plurality of seals 6302 fails (because there is no net pressure in the direction of arrow 5700 in FIG. 65). Furthermore, even if the primary seal set 6302 fails, backup seal set 5306 will only see a net pressure against which it must seal (the net pressure being the difference between the pressure on the box end of plurality of seals 5306 and the pin end of the plurality of seals 5306).

Additionally, even where primary seal set 6302 fails, the pressure from fluid in the interstitial space between sleeve or housing 300 and mandrel 110 reduces the net force which sleeve 300 must resist in bending compared to an outside pressure on sleeve 300—although now it is expected that the interstitial pressure will be greater than the pressure on the outside of sleeve or housing 300.

In the unusual circumstance where the pressure from the box end (in the direction of arrows 5600, 6700, and 6710) is greater than the pressure from the pin end (in the direction of arrows 660, 6610, 6630, and 5700), then plurality of seals 6304 will seal against this net pressure in the direction of the pin end.

FIGS. 68 and 69 show an alternative construction for lower retainer cap 2500' and tip 2520' of retainer cap where the first plurality of fasteners/bolts 7032 and second plurality of fasteners/bolts 7042 are restricted from falling downhole (e.g., not exposed to the well bore).

Here, retainer cap 2500' can comprise thrust bearing 7000 and spacer ring 7100. Thrust bearing 7000 can comprise first end 7010, second end 7020, first plurality of openings 7030, second plurality of openings 7050. Spacer ring 7100 can comprise first end 7110, second end 7120, and plurality of openings 7200. Spacer ring 7100 can also include a dowel opening 7140 for an alignment/positioning dowel 7150. Retainer cap 2500' can be connected to sleeve or housing 300 by first plurality of fasteners 7032 which pass through first plurality of openings 7030. Tip 2520' can be connected to retainer cap 2500' through second plurality of fasteners 7042 which pass through second plurality of openings 7040 and thread into tip 2520'. Plurality of fasteners can have heads 7044 with driving portions 7043. Here, a plurality of openings 7200 can coincide with the heads of the second plurality of fasteners 7042 for allowing these fasteners to be tightened (such as by using driving portion 7043). The longitudinal lengths of the plurality of openings 7200 is preferably substantially shorter than the longitudinal lengths of second plurality of fasteners 7042. This will prevent one or more of the second plurality of fasteners from falling out of alternative swivel 5000 and swivel cap 2500' if one or more fasteners 7042 become loosened. One or more dowels 7150 can be used to align plurality of openings 7200 with second plurality of openings 7040.

Pressure Relief Mode

FIGS. 71 through 75 show an alternative embodiment which includes an internal pressure relief mode. In a pressure relief mode, pressure in the interstitial space between the sleeve 2300 and mandrel 110 can be gradually relieved.

This gradual relief of interstitial pressure allows the rotating and reciprocating swivel tool not to be pressurized when removed from the riser or well bore.

In one embodiment, as the rotating and reciprocating swivel tool is pulled up the hole and riser, differential pressure between the tool's interstitial space (between the internal diameter of the sleeve and the external diameter of the mandrel) and the hole or the riser can be relieved by interstitial pressure leaking out of the interstitial space and into the hole or the riser. This relieving of interstitial pressure can be gradual as the pressure in the hole or riser is gradually decreased as the rotating and reciprocating swivel tool comes closer to the surface. The decrease in hole or riser pressure is caused by the movement of the tool up the hole or riser and closer to the rig.

In one embodiment interstitial pressure is relieved at the lower end of the mandrel. In one embodiment the lower end of the mandrel is the pin end.

In one embodiment the pressure relief mode can be activated by positioning the sleeve relative to the mandrel at a predesignated pressure relief position. In one embodiment the pressure relief mode can be deactivated by changing the longitudinal position of the mandrel relative to the sleeve and away from the pressure relief position.

In one embodiment, to transition into a pressure relief mode for the interstitial space between the sleeve and the mandrel, the seals are moved over a pressure relief portion of the mandrel. In one embodiment to transition out of the pressure relief mode, the seals are moved away from the pressure relief portion of the mandrel.

In one embodiment a pressure relieving portion of the mandrel can be provided wherein the sealing effect of the seals can be reduced or circumvented. In one embodiment a pressure relief groove can be provided (such as on the mandrel) which can relieve pressure from the interstitial space when at least a portion of the packing is longitudinally positioned over the groove. In one embodiment the pressure relief groove is an area of reduced diameter on the mandrel.

In one embodiment a pressure relief channel can be provided on the mandrel which spans a specified longitudinal length of the mandrel. In one embodiment a plurality of pressure relief channels can be provided. In one embodiment at least one pressure relief path is provided on the mandrel.

In one embodiment the packing on the lower end of sleeve includes two sets of seals sealing in opposite longitudinal directions. In one embodiment the packing includes seal sets sealing in only one longitudinal direction.

In one embodiment longitudinally locking the sleeve relative to the mandrel (e.g., such as by using a quick lock/quick unlocking system or latching system), transitions the sleeve and mandrel into an interstitial pressure relief mode wherein the packing between the sleeve and mandrel allows at least some fluid (e.g., on the pin end) to migrate out of interstitial space between sleeve and mandrel. In one embodiment this interstitial fluid flow relieves pressure the interstitial space between the sleeve and mandrel, and prevents the rotating and reciprocating swivel tool from being pressurized when the tool is pulled out of the hole.

In one embodiment, when the sleeve and mandrel are "locked" (or the quick lock/quick unlock system is activated), there remains a limited amount of allowed longitudinal movement between the sleeve and the mandrel (e.g., between about ½, 1, 1½, 2, 2½, 3, 3½, 4, 4½, 5, 5½, and 6 inches) before the quick lock/quick unlock system is deactivated. In one embodiment, the pressure relief mode can be transitioned from a pressure relief mode to a non-pressure relief mode; and vice versa based on longitudinal movement within the limited amount of allowed longitudinal movement while the quick lock/quick unlock system is activated. In one embodiment the pressure relief mode is activated at all times when the quick lock/quick unlock system remains locked.

In one embodiment at least two sets of seals on the lower end of the sleeve are used, each set sealing fluid flow in opposite longitudinal directions. In embodiment the seals set(s) on the lower end seal fluid in only one longitudinal direction. In one embodiment fluid flow is sealed in the longitudinal direction of from the lower end of the mandrel to the upper end of the mandrel.

In one embodiment the pressure relief mode can only be entered when the quick lock/quick unlock system is activated thereby locking the sleeve and mandrel. In one embodiment when the quick lock/quick unlock system is deactivated, the seals on the lower end of the sleeve will be sealed at least until the quick lock/quick unlock system is again locked thereby locking the sleeve on the mandrel.

Figure 71:
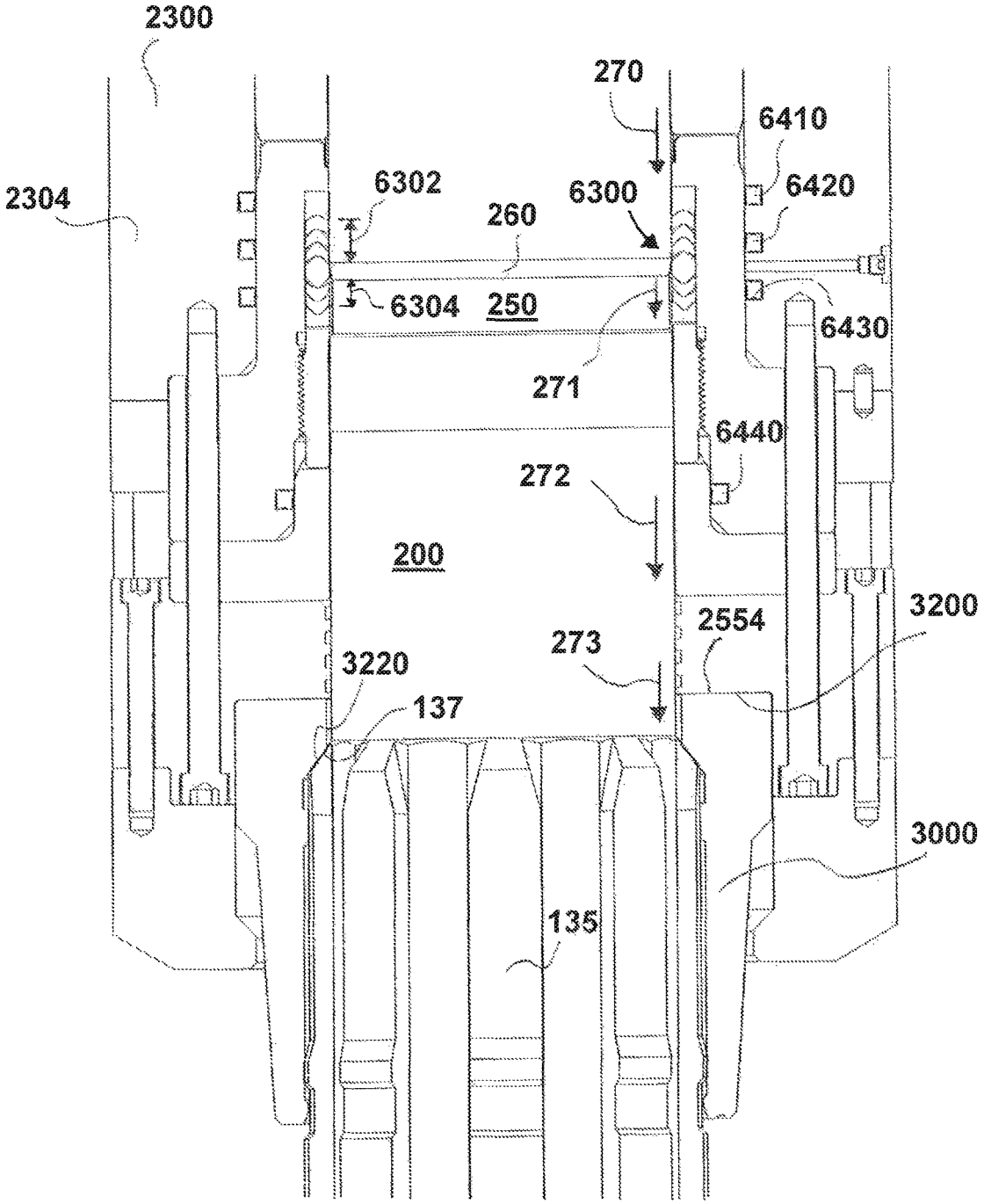
FIG. 71 is a sectional view of an alternative swivel configuration which has entered a pressure relief mode.
Figure 72:
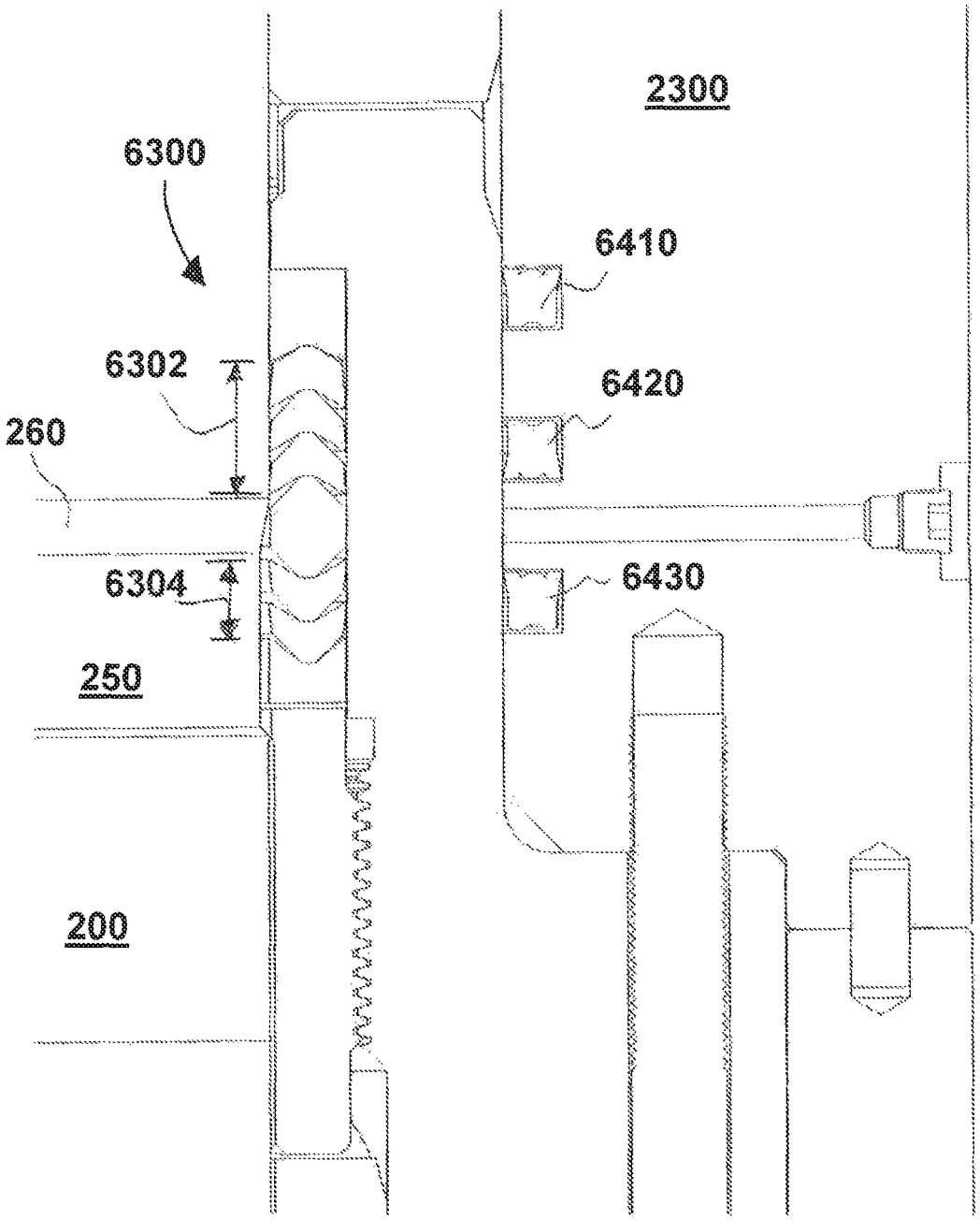
FIG. 72 is a closeup sectional view of the swivel configuration of FIG. 71.
Figure 73:
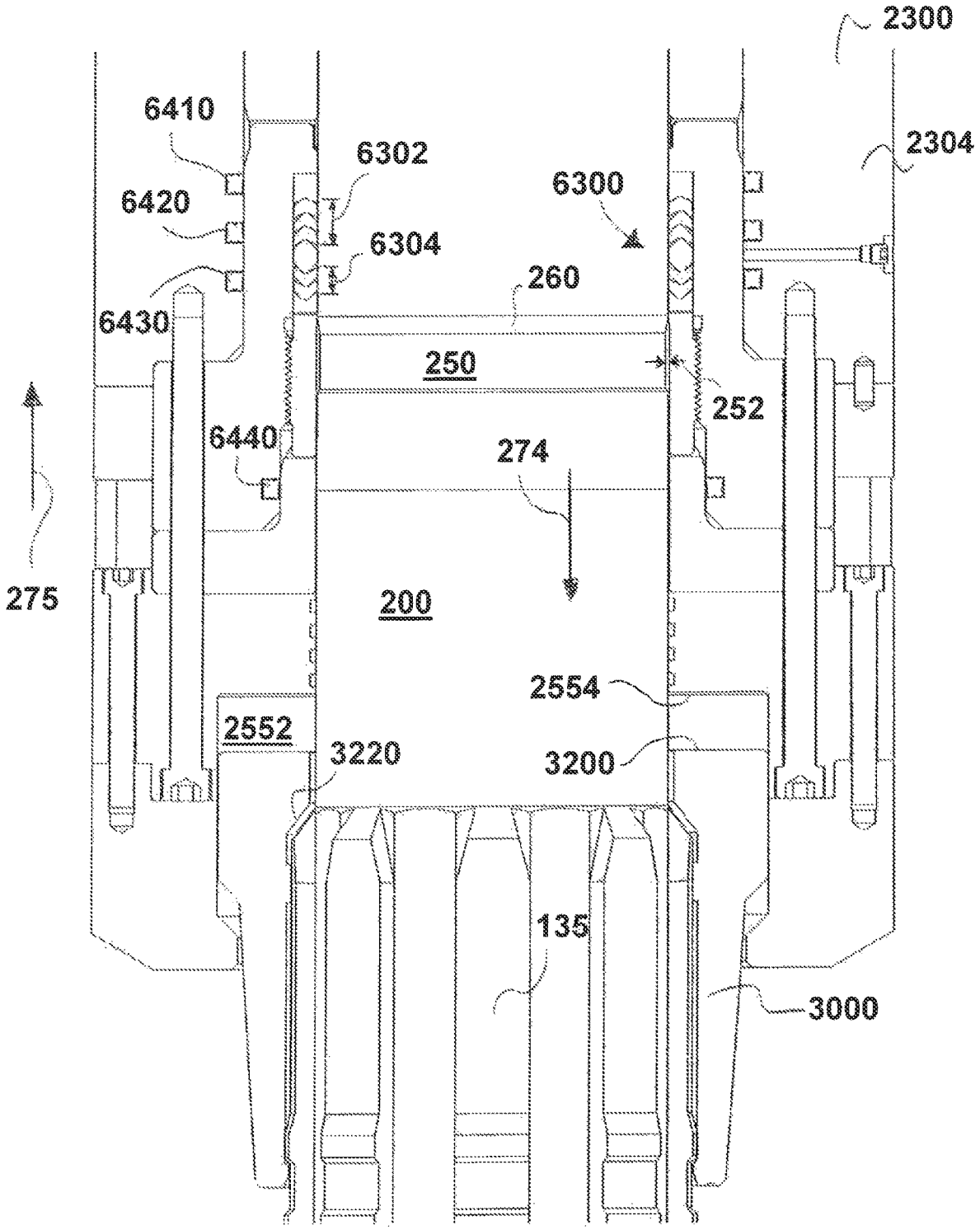
FIG. 73 is a sectional view of an alternative swivel configuration which can enter a pressure relief mode.
Figure 74:
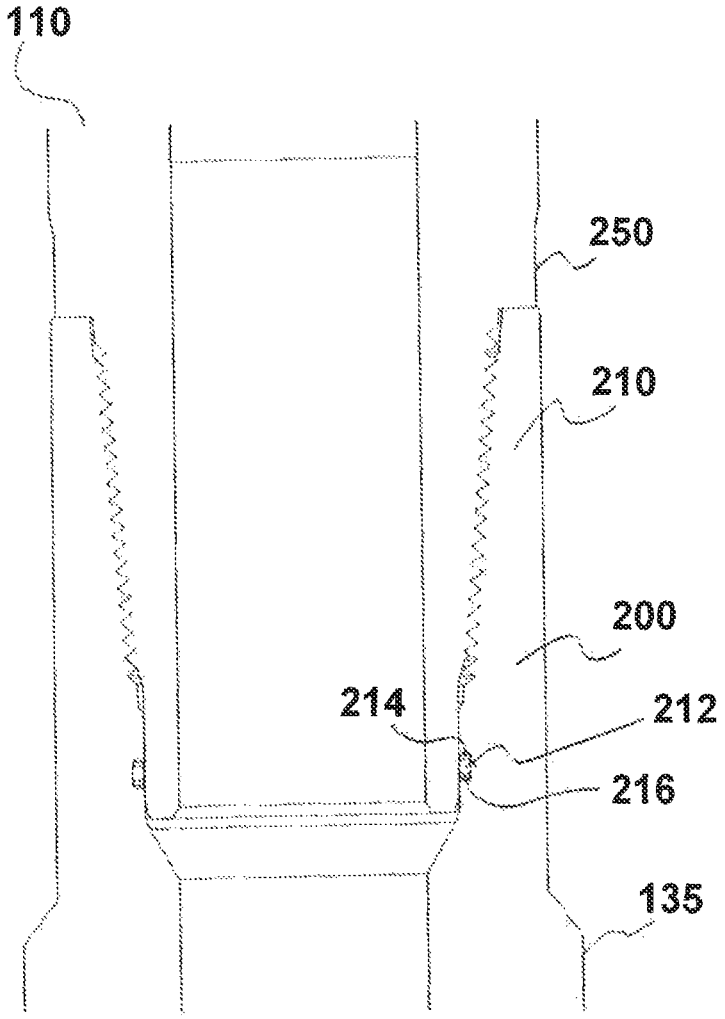
FIG. 74 is a sectional view of the connection between the pin end saver sub portion of the mandrel for the swivel of FIG. 71.
Figure 75:
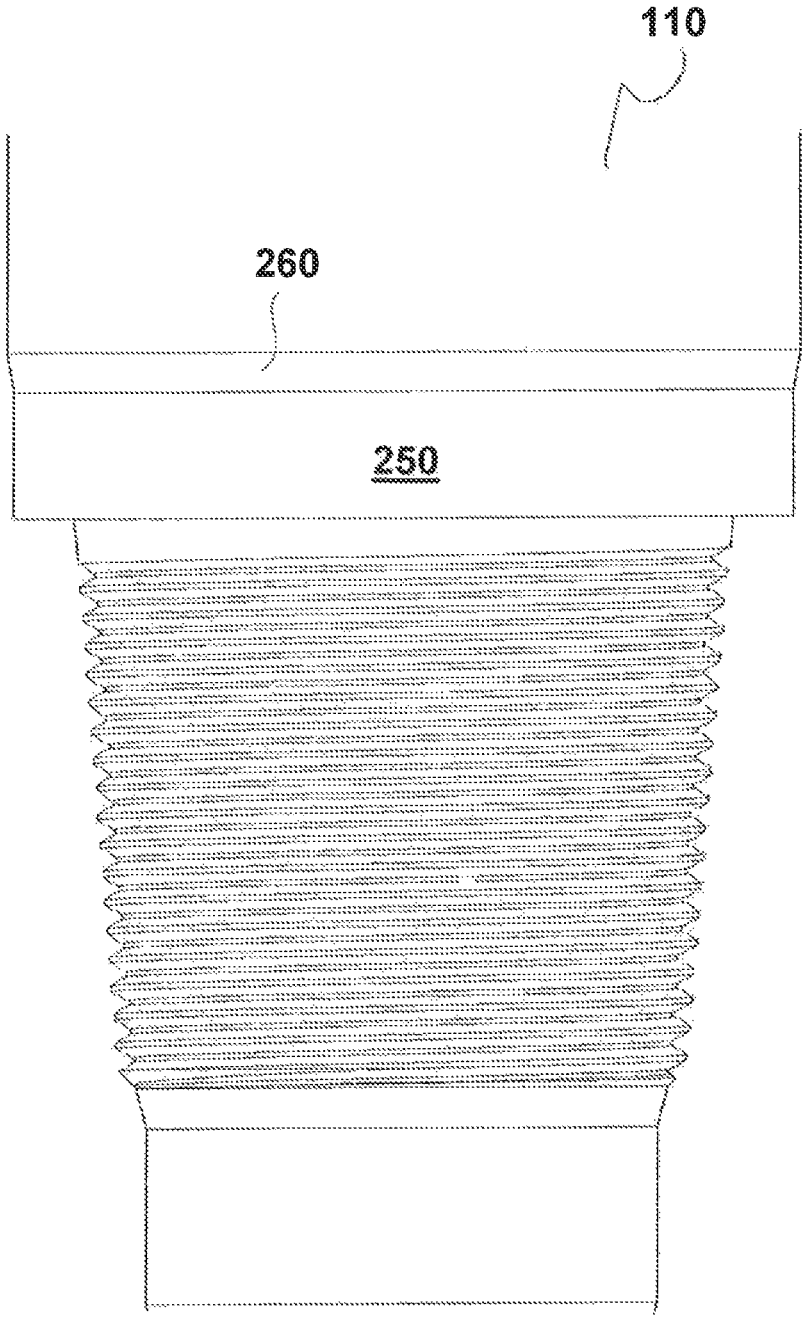
FIG. 75 is a view of the lower end of the mandrel of FIG. 71 with the saver sub portion removed.

FIG. 71 shows a sectional view of the lower end 2304 of sleeve 2300 along with an alternative embodiment of mandrel 110. FIG. 72 is a close up view of FIG. 71. FIG. 73 is another section view of the lower end 2304 of sleeve 2300 along with alternative mandrel 110 but with mandrel 110 lowered relative to sleeve 2300. FIG. 74 is a sectional view of the connection between alternative mandrel 110 and its lower section 200. FIG. 75 is a side view of the lower portion of alternative mandrel 110 with lower section 200 removed.

As can be seen in FIG. 71, second plurality of seals 6304 is positioned in peripheral recess 250. As shown in FIG. 73, peripheral recess 250 forms a gap 252 between the internal bore of sleeve 2300 and the external diameter of mandrel 110. When second plurality of seals 6304 are longitudinally positioned over peripheral recess or groove 250, their sealing ability is considerably reduced or eliminated. Additionally, because first plurality of seals 6302 are set up to seal in the opposite longitudinal direction as arrow 270, fluid can flow in the directions of arrows 270, 271, 272, and 273. This is because first plurality of seals 6302 do not effectively seal against fluid flow in the direction of arrow 270 and the sealing efficacy of second plurality of seals 6304 is severely reduced or eliminated when second plurality of seals are longitudinally positioned over groove or recess 250. Accordingly, where there is an elevated fluid pressure in the interstitial space between the internal diameter of sleeve 2300 and the external diameter of mandrel 110 (the interstitial space shown in FIG. 65), pressurized fluid in this interstitial space can "leak" out the lower end of sleeve 2300 and mandrel 110 first in the direction of arrow 270 (through first plurality of seals 6302 because these seals are not designed to effectively seal flow in this direction, but seal flow in the opposite longitudinal direction), second in the direction of arrow 271 (through second plurality of seals being positioned over peripheral recess or groove 250), and then out through the lower end of sleeve 2300 and mandrel 110 as schematically indicated by arrows 272 and 273 (because there is no effective sealing between the sleeve 2300 and mandrel 110 at these locations). Because pressurized fluid in the interstitial space can "leak" out of the interstitial space such interstitial space can effectively be depressurized. It should be noted that the sealing effect of first plurality of seals 6302 is not zero eliminated for fluid flow in the direction of arrow 270. However, these seals are designed/set up to seal against fluid flow in the opposite longitudinal direction as arrow 270, and are expected to only seal against only a relatively small amount of differential pressure in the direction of arrow 270 (such as about 10, 25, 50, 75, 100, 200, 300, 400, 500, 600, 700, 800, 900, or 1,000 psi). Similarly, peripheral groove or recess 250 may not completely eliminate the sealing effect of second plurality of seals 6304, and one may expect to see some sealing (such as about 10, 25, 50, 75, 100, 200, 300, 400, 500, 600, 700, 800, 900, or 1000 psi).

In one embodiment the sealing effect of first plurality of seals 6302 is about zero in the longitudinal direction of arrow 270. In one embodiment the sealing ability of second plurality of seals 6304 is eliminated when positioned over peripheral groove or recess 250.

In one embodiment both sets of seals 6302 and 6304 are positioned over peripheral recess or groove 250.

One advantage of using two sets of seals 6302 and 6304 which seal in opposite longitudinal directions is that the sleeve 2300 and mandrel 110, even in pressure relief mode, can still be sealed against fluid flow in the in the opposite longitudinal direction of arrow 270. This double sealing ability assists in maintaining separate vertical fluid columns after lowering the tool downhole and into an annular BOP (which is then closed on sleeve 2300). In the configuration shown in FIGS. 71 and 72, first plurality of seals 6302 will resist fluid flow in a longitudinal direction which is opposite to arrow 271 where the down hole pressure (i.e., pressure below the annular BOP) is increased. This will prevent fluid transfer from the upper and lower vertical columns of fluid (above and below the closed/sealed annular BOP).

Where second plurality of seals are moved away from peripheral recess or groove 250 a full two way longitudinal sealing effect will be seen with first and second plurality of seals 6302,6304. FIG. 73 is section view of the lower end 2304 of sleeve 2300 along with alternative mandrel 110 but with mandrel 110 lowered relative to sleeve 2300 as schematically indicated by arrow 274. Here, second plurality of seals 6304 have been moved away from peripheral recess 250 and second plurality of seals 6304 will now also seal from fluid flow in the longitudinal direction of arrow 274. It is noted that in FIG. 73 quick lock/quick unlock system (e.g., latching mechanism 300) is still "locked" on mandrel 110. Further longitudinal movement of mandrel 110 relative to sleeve 2300 in the direction of arrow 274 will "unlock" sleeve from mandrel and now longitudinal reciprocation between mandrel 110 and sleeve 2300 can occur with both first and second seals 6302, 6304 providing sealing.

FIG. 74 is a sectional view of the connection between alternative mandrel 110 and its lower section 200. Lower section 200 can include fluted area 135 and can be used as a saver sub for mandrel 110. That is, if the threads on the pin end of lower section 200 are damaged (or the fluted) area only this saver sub or lower section need by replaced which is much less expensive than replacing the remaining portion of mandrel 110 (which can be 80 feet long). An o-ring seal 212 and two backup rings 214,216 can be used to seal the connection. O-ring seal 212 can be a Parker "O" Ring comprising niton (part number V1238-95 2-349). Backup rings can be Hercules part number 590-249 (high performance).

FIG. 75 is a side view of the lower portion of alternative mandrel 110 with lower section 200 removed. Here, peripheral recess or groove 250 is shown with shoulder 260. Shoulder 260 can ease the transition of seals being positioned in and out of peripheral recess or groove 250.

The poly pak seals can be Parker poly pak comprising polymite (part number N651-3751000) or comprising molythane (part number 4615-3751000).

Closed Sleeve Bearing End Cap

Figure 76:
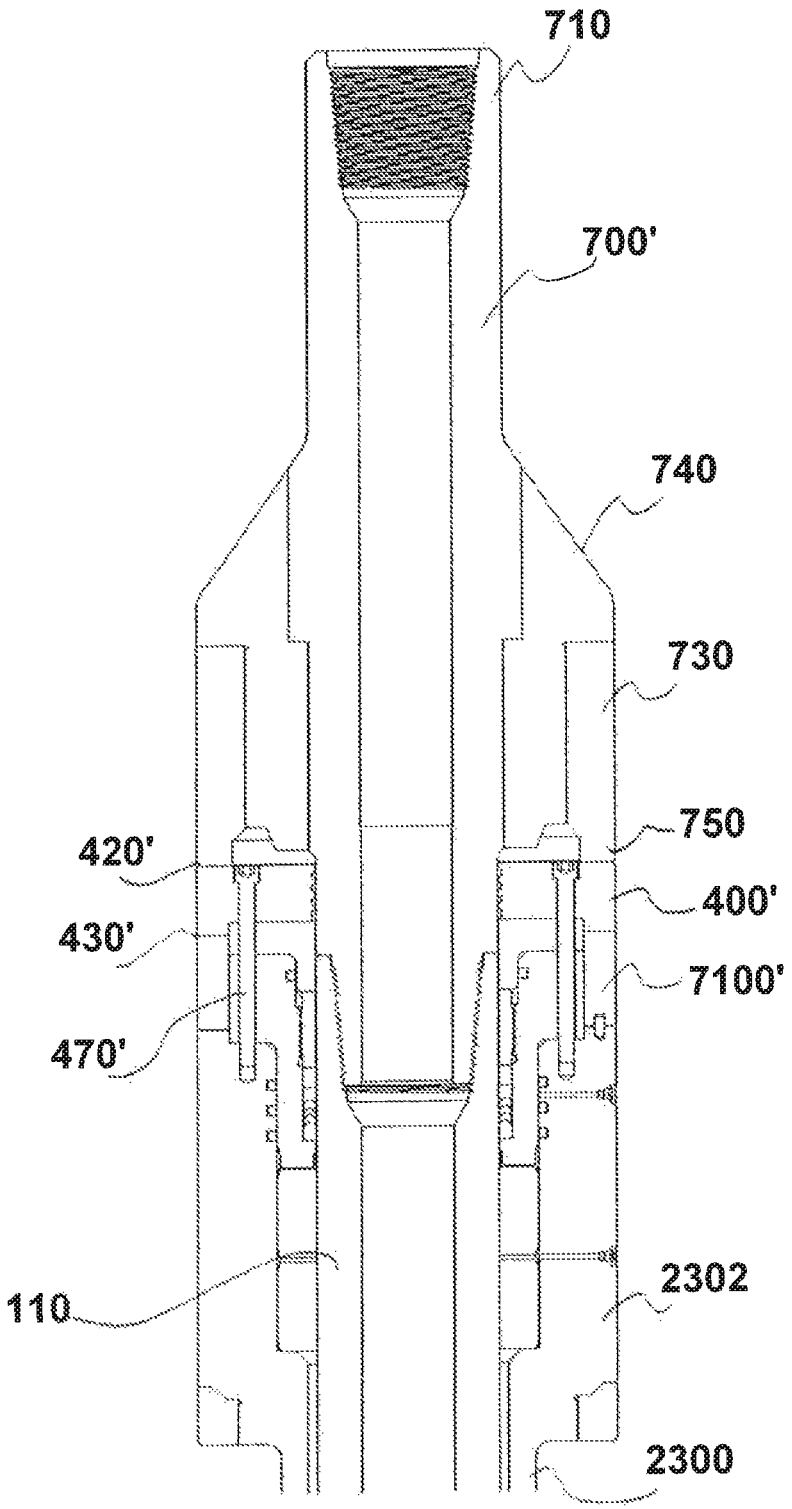
FIG. 76 is a sectional view of an alternative swivel configuration where the upper retaining cape of the sleeve is closed.
Figure 77:
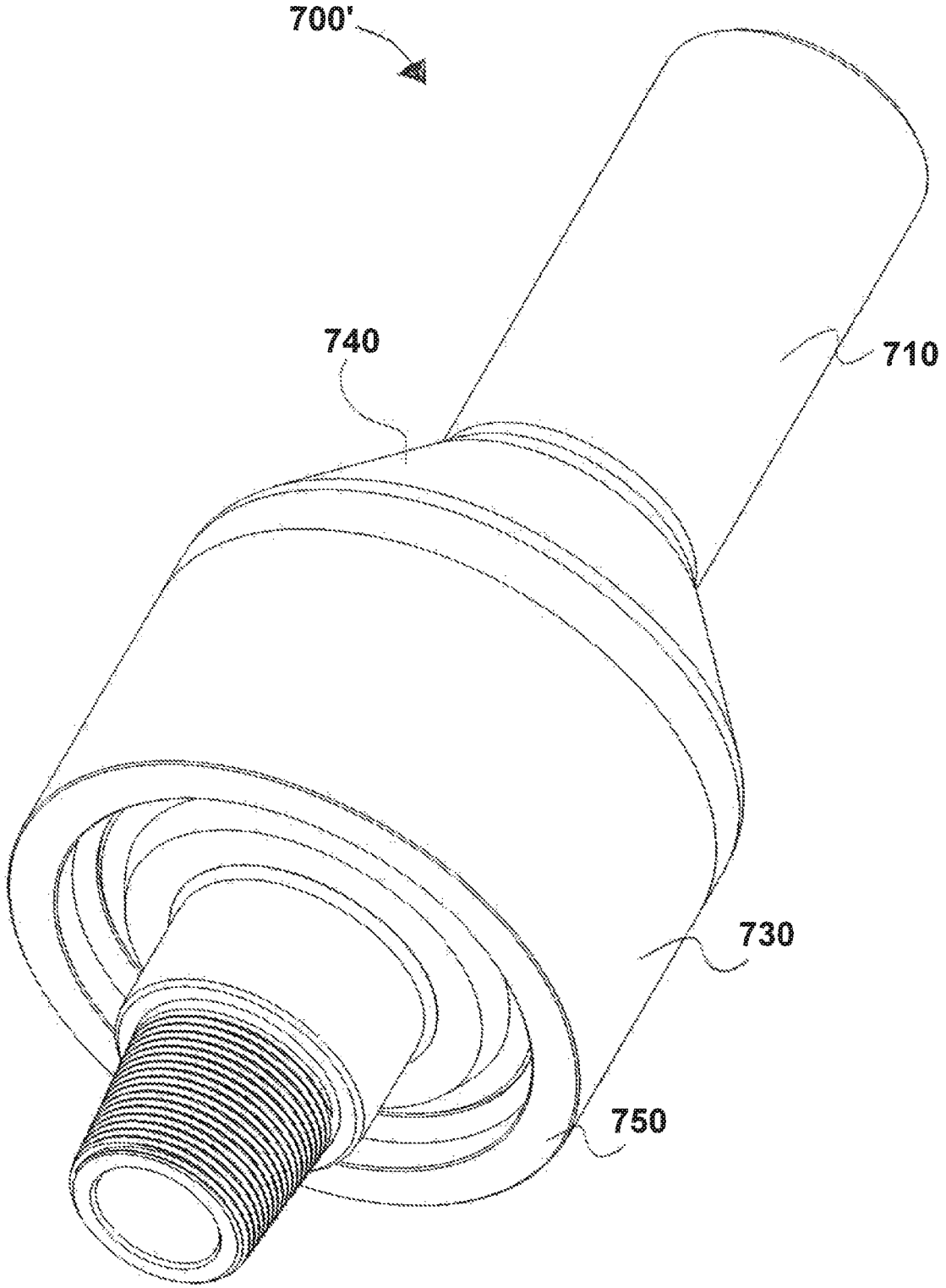
FIG. 77 is a perspective view of the upper limiting sub for the swivel of FIG. 71.
Figure 78:
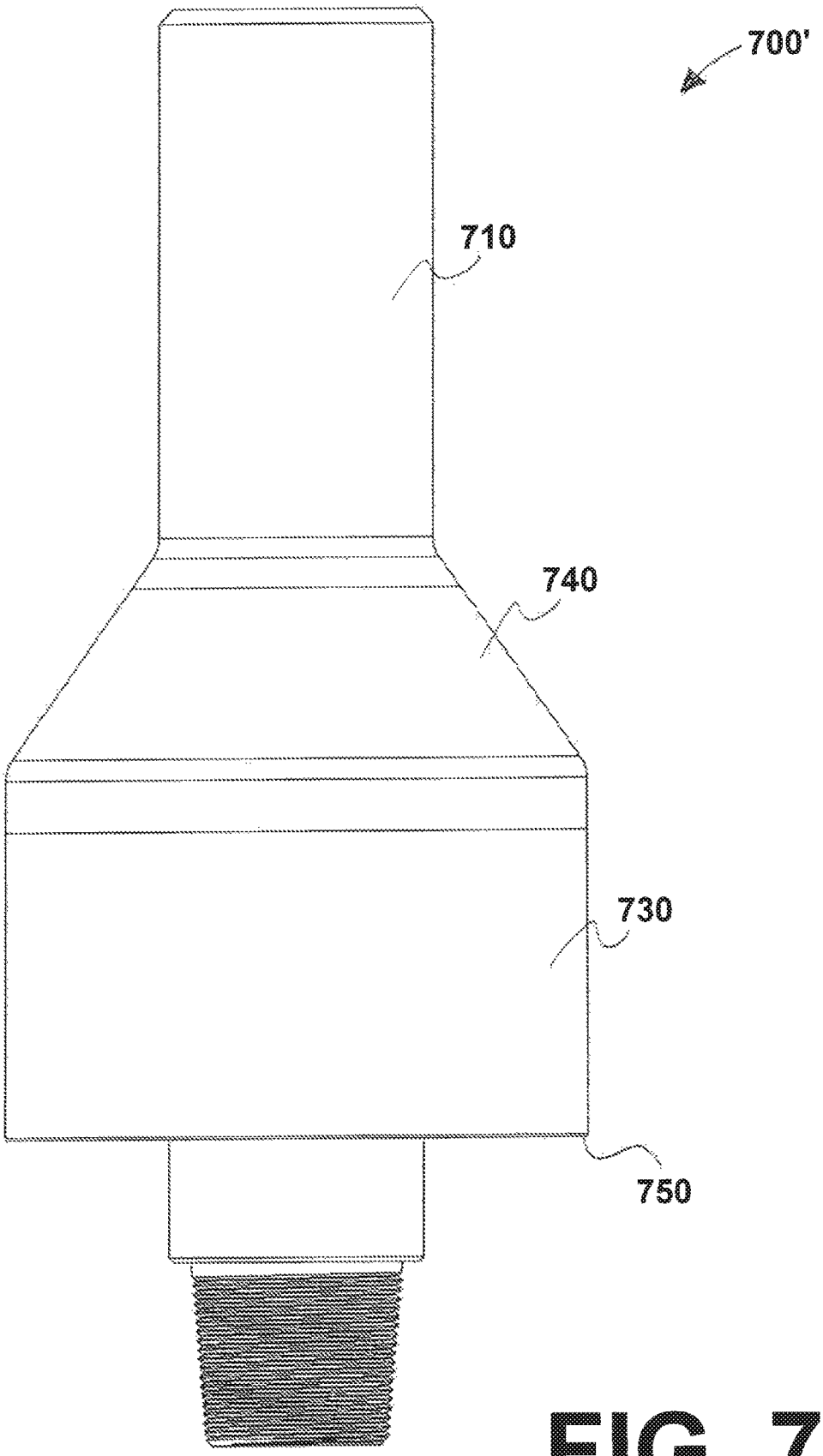
FIG. 78 is a side view of the upper limiting sub of FIG. 77.
Figure 79:
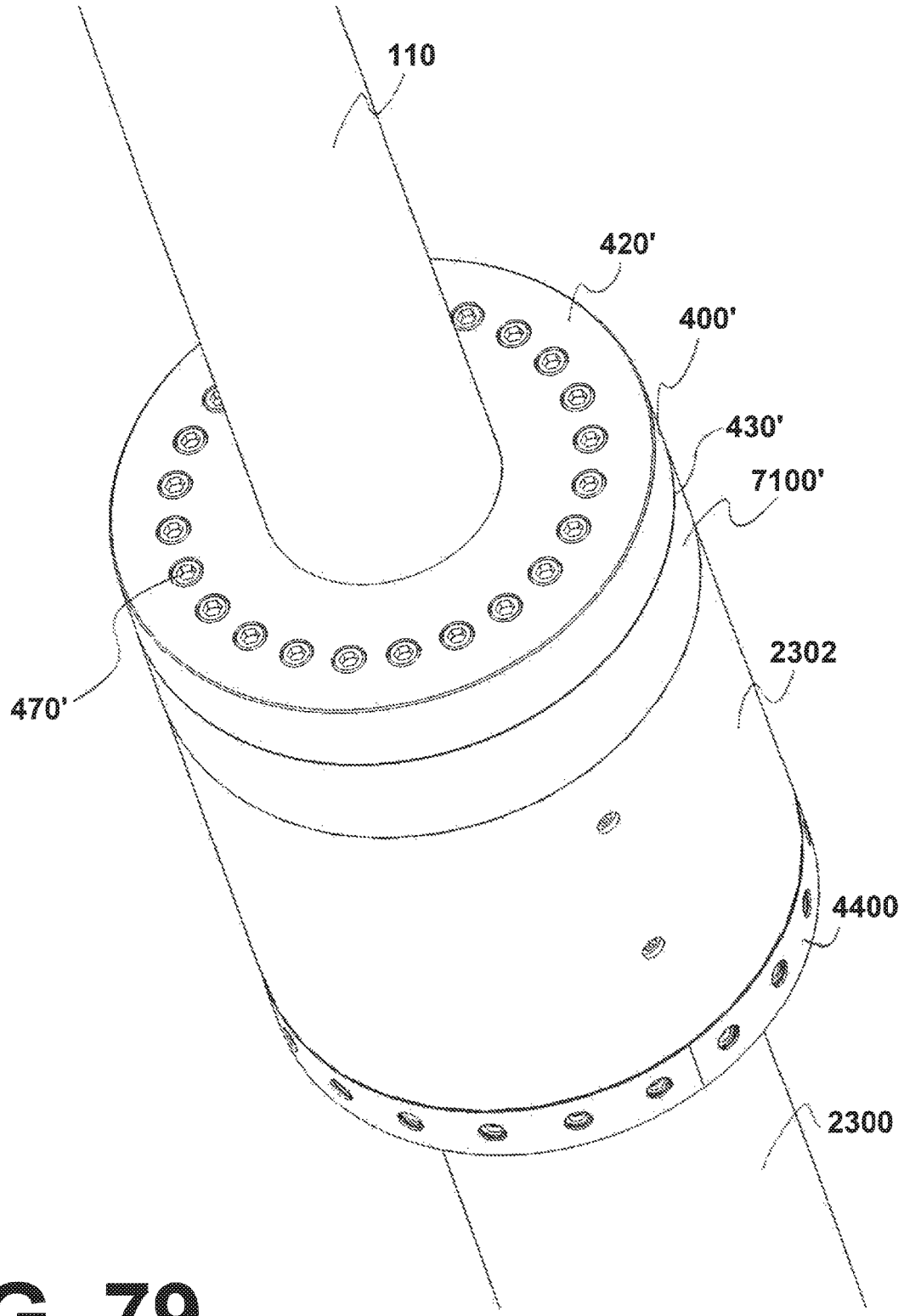
FIG. 79 is a perspective view of the box end of the sleeve of FIG. 76.
Figure 80:
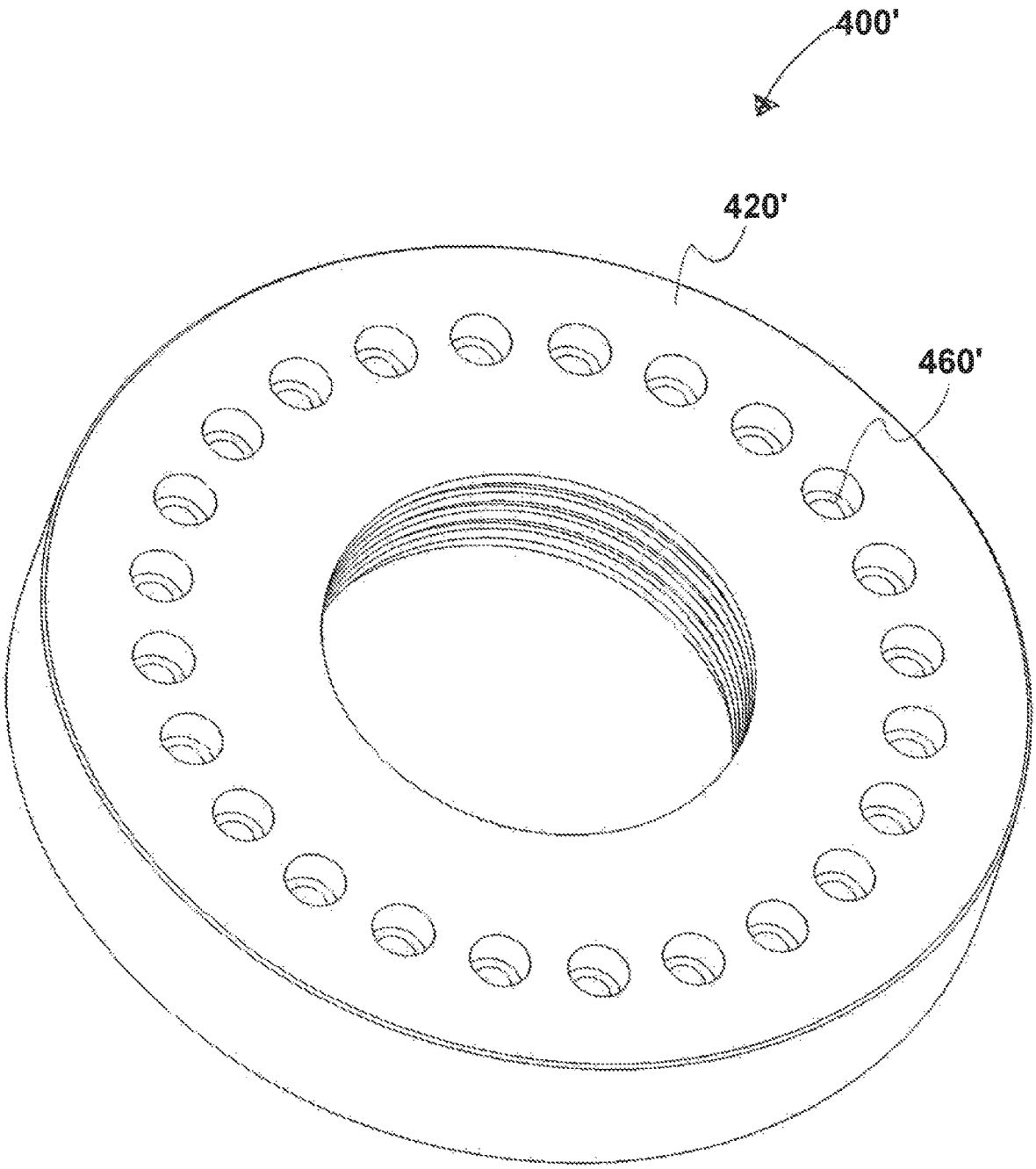
FIG. 80 is a perspective view of the upper end of the upper retaining cap of FIG. 76.
Figure 81:
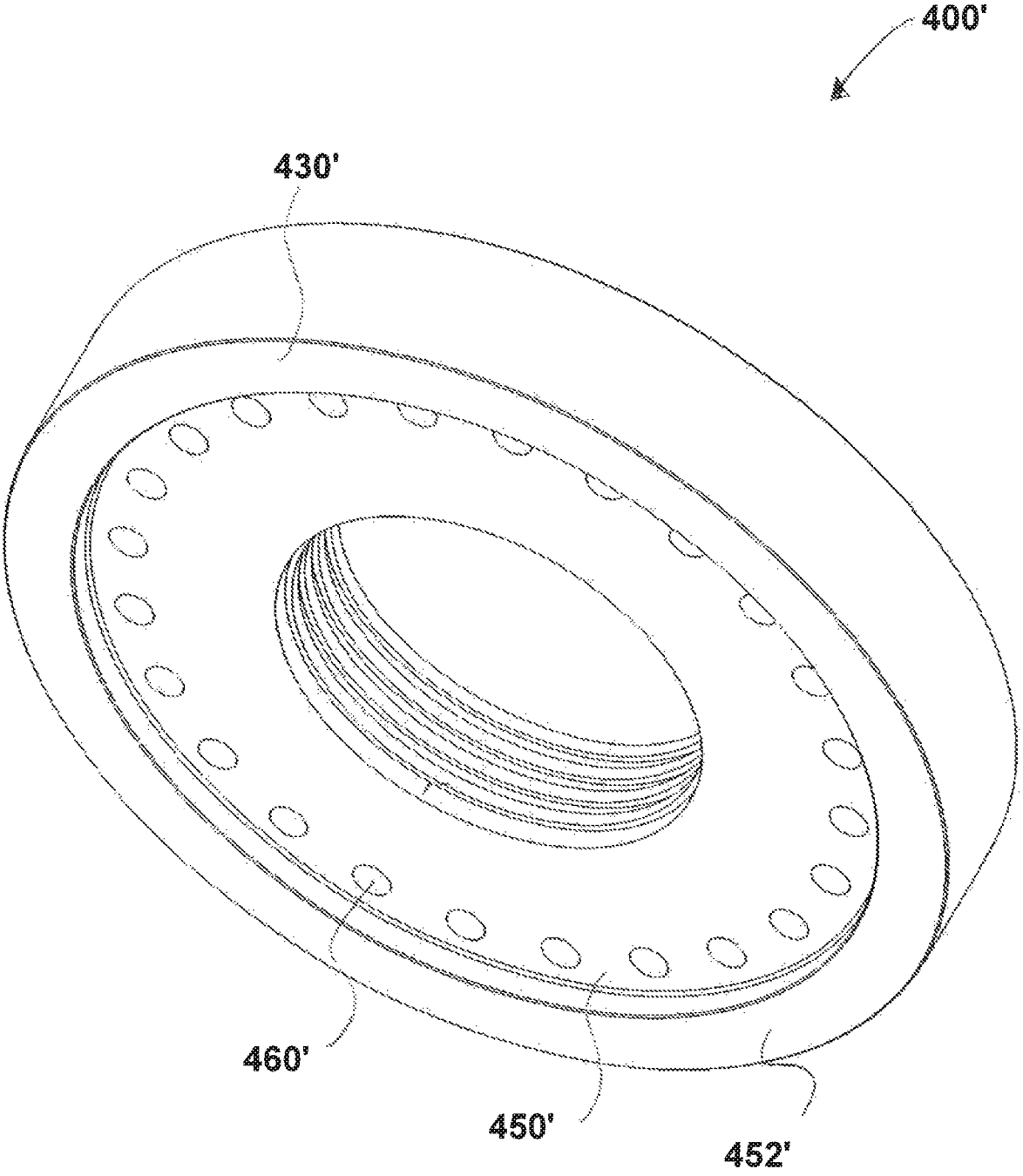
FIG. 81 is a perspective view of the lower end of the upper retaining cap of FIG. 80.

FIGS. 76 through 81 show an alternative version of the upper section of alternative mandrel 110 along with an alternative end cap 400' for sleeve 2300. Alternative end cap 400' is a "closed" end cap which will resist accumulation of debris or other items (which may have fallen into open versions of the end cap). FIG. 76 is a sectional view of the upper section of alternative mandrel 110 along with an alternative end cap 400' for sleeve 2300. FIG. 77 is an alternative embodiment for the limiting sub 700' for alternative mandrel 110. FIG. 78 is a side view of the limiting sub 700' of FIG. 77. FIG. 79 is a perspective view of sleeve 2300 on mandrel 100, the sleeve including upper end cap 400'. FIGS. 80 and 81 are perspective views of the upper and lower portions of end cap 400'.

Upper end cap 400' can comprise upper portion 420' and lower portion 430'. A plurality of openings 460' can be included for accommodating a plurality of bolts 470 (each opening having a recessed area for accommodating the head of a bolt). On the lower end can be included recessed area 450' and base 452'. Base 452' can rest against spacer ring 7100' as shown in FIG. 76. Although not shown upper portion 420' can include a plurality of bearing inserts (preferably teflon) around its outer perimeter such as those inserts used in the thrust bearings. Preferably, upper end cap 400' can be comprised of bronze.

Upper limiting sub 700' can comprise upper portion 710, frustoconical portion 740, and enlarged section 730. Enlarged section 730 can include base 750 which can contact upper end cap 400' when sleeve 2300 is moved longitudinally to its upper extent such that contact is made with upper limiting sub 700'. If such contact is made and relative rotation is being performed between mandrel 110 and sleeve 2300, then relative rotation will occur between upper limiting sub 700' and upper end cap 400' when these two are in contact. In this case upper end cap serves as a bearing for this relative rotation and the teflon inserts further reduce friction and wear on these two pieces. Preferably, because contact between relatively moving upper limiting sub 700' and upper end cap 400' occurs between base 750 and the portion of end cap 400' in contact with base 750, the friction reducing inserts need only be placed where such contact occurs.

While certain novel features of this invention shown and described herein are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

The following is a parts list of reference numerals or part numbers and corresponding descriptions as used herein:

LIST FOR REFERENCE NUMERALS

| Reference Numeral | Description |
|---|---|
| 10 | drilling rig/well drilling apparatus |
| 20 | drilling fluid line |
| 22 | drilling fluid or mud |
| 30 | rotary table |
| 40 | well bore |

-continued

| Reference Numeral | Description |
|---|---|
| 50 | drill pipe |
| 60 | drill string or well string or work string |
| 70 | annular blowout preventer |
| 71 | annular seal unit |
| 75 | stack |
| 80 | riser |
| 85 | upper drill or work string |
| 86 | lower drill or work string |
| 87 | seabed |
| 88 | well head |
| 90 | upper volumetric section |
| 92 | lower volumetric section |
| 94 | displacement fluid |
| 96 | completion fluid |
| 100 | swivel |
| 110 | mandrel |
| 113 | arrow |
| 114 | arrow |
| 115 | arrow |
| 116 | arrow |
| 117 | arrow |
| 118 | arrow |
| 120 | upper end |
| 130 | lower end |
| 135 | fluted area |
| 136 | plurality of recessed areas |
| 137 | angled area or thrust shoulder |
| 138 | angled area (radial alignment) |
| 140 | box connection |
| 150 | pin connection |
| 160 | central longitudinal passage |
| 162 | connection between upper and lower end |
| 164 | connection from upper end (pin) |
| 166 | connection from lower end (box) |
| 168 | seal |
| 170 | seal |
| 180 | H - length allowed for movement by sleeve or housing over mandrel |
| 200 | pin end sub |
| 210 | upper |
| 212 | seal |
| 214 | back-up ring |
| 216 | back-up ring |
| 220 | lower |
| 250 | recessed area |
| 252 | gap |
| 260 | shoulder |
| 270 | arrow |
| 271 | arrow |
| 272 | arrow |
| 273 | arrow |
| 274 | arrow |
| 275 | arrow |
| 300 | swivel sleeve or housing |
| 302 | upper end |
| 304 | lower end |
| 310 | interior section |
| 311 | upper lubrication port |
| 312 | lower lubrication port |
| 315 | gap |
| 322 | check valve |
| 324 | check valve |
| 326 | upper catch, shoulder, flange |
| 328 | lower catch, shoulder, flange |
| 331 | upper base |
| 332 | upper radiused area |
| 341 | lower base |
| 342 | lower radiused area |
| 350 | L1 - overall length of sleeve or housing with attachments on upper and lower ends |
| 360 | L2 - length between upper and lower catches, shoulders, flanges |
| 370 | shoulder |
| 372 | recessed area |
| 373 | seal |
| 374 | recessed area |

-continued

| Reference Numeral | Description |
|---|---|
| 375 | seal |
| 380 | shoulder |
| 382 | recessed area |
| 383 | seal |
| 384 | recessed area |
| 385 | seal |
| 400 | upper retainer cap |
| 405 | plurality of ribs |
| 420 | tip of retainer cap |
| 430 | base of retainer cap |
| 450 | recessed area |
| 460 | plurality of bolt holes |
| 470 | first plurality of bolts |
| 472 | second plurality of bolts |
| 474 | spacer ring |
| 500 | lower retainer cap |
| 510 | upper surface of retainer cap |
| 520 | tip of retainer cap |
| 530 | base of retainer cap |
| 540 | housing |
| 541 | first plurality of fasteners |
| 542 | first plurality of openings |
| 543 | second plurality of fasteners |
| 544 | second plurality of openings |
| 550 | first end |
| 552 | recessed area |
| 560 | second end |
| 562 | recessed area |
| 570 | bearing or thrust hub |
| 572 | first end |
| 574 | second end |
| 576 | plurality of tips and recessed areas |
| 578 | angled section |
| 590 | cover |
| 592 | first end |
| 594 | second end |
| 595 | recessed area |
| 596 | plurality of openings |
| 598 | exterior angled section |
| 599 | beveled section |
| 600 | plurality of openings for shear pins |
| 610 | plurality of shear pins |
| 611 | plurality of tips |
| 612 | plurality of snap rings |
| 614 | adhesive |
| 620 | arrow |
| 630 | arrow |
| 640 | arrow |
| 650 | arrow |
| 660 | arrow |
| 670 | arrow |
| 680 | arrow |
| 700 | joint of pipe |
| 710 | upper portion |
| 720 | lower portion |
| 730 | enlarged area |
| 740 | frustoconical area |
| 750 | protruding section |
| 800 | saver sub |
| 1000 | bearing and packing assembly |
| 1100 | bearing |
| 1110 | outer surface |
| 1120 | inner surface |
| 1122 | inner diameter |
| 1130 | first end |
| 1140 | second end |
| 1150 | opening |
| 1160 | pathway |
| 1180 | recessed areas |
| 1182 | inserts |
| 1190 | plurality of recessed areas |
| 1192 | base |
| 1200 | packing housing |
| 1210 | first end |
| 1220 | second end |
| 1230 | plurality of tips |

-continued

| Reference Numeral | Description |
|---|---|
| 1240 | first opening |
| 1242 | perimeter recess |
| 1243 | seal (such as polypack) |
| 1250 | second opening |
| 1252 | threaded area |
| 1250 | second opening |
| 1252 | shoulder |
| 1300 | packing stack |
| 1305 | packing unit |
| 1310 | spacer |
| 1312 | first end of spacer |
| 1314 | second end of spacer |
| 1316 | enlarged section of spacer |
| 1320 | female packing end ring |
| 1322 | plurality of seals |
| 1326 | plurality of grooves |
| 1330 | packing ring |
| 1340 | packing ring |
| 1350 | packing ring |
| 1360 | packing ring |
| 1370 | male packing ring |
| 1372 | first end of male packing ring |
| 1374 | second end of male packing ring |
| 1400 | packing retainer nut |
| 1410 | first end |
| 1420 | plurality of tips |
| 1430 | plurality of recessed areas |
| 1440 | second end |
| 1450 | base |
| 1460 | threaded area |
| 1500 | end cap |
| 1510 | first end |
| 1520 | plurality of openings |
| 1530 | second end |
| 1540 | plurality of tips |
| 1550 | plurality of recessed areas |
| 1560 | mechanical seal |
| 1580 | dummy pipe |
| 1590 | testing plate |
| 1596 | radial injection port |
| 1592 | seal |
| 1594 | seal |
| 1598 | arrow |
| 2300 | swivel sleeve or housing |
| 2302 | upper end |
| 2304 | lower end |
| 2310 | interior section |
| 2311 | upper lubrication port |
| 2312 | lower lubrication port |
| 2315 | gap |
| 2322 | check valve |
| 2324 | check valve |
| 2326 | upper catch, shoulder, flange |
| 2328 | lower catch, shoulder, flange |
| 2331 | base |
| 2332 | radiused area |
| 2334 | plurality of openings |
| 2341 | base |
| 2342 | radiused area |
| 2344 | plurality of openings |
| 2350 | L1 - overall length of sleeve or housing with attachments on upper and lower ends |
| 2360 | L2 - length between upper and lower catches, shoulders, flanges |
| 2370 | shoulder |
| 2372 | recessed area |
| 2373 | seal |
| 2374 | recessed area |
| 2375 | seal |
| 2380 | shoulder |
| 2382 | recessed area |
| 2383 | seal |
| 2384 | recessed area |
| 2385 | seal |
| 2400 | upper retainer cap |
| 2405 | plurality of ribs |

-continued

| Reference Numeral | Description |
|---|---|
| 2420 | tip of retainer cap |
| 2430 | base of retainer cap |
| 2450 | recessed area |
| 2460 | plurality of bolt holes |
| 2470 | first plurality of bolts |
| 2472 | second plurality of bolts |
| 2500 | lower retainer cap |
| 2510 | upper surface of retainer cap |
| 2520 | tip of retainer cap |
| 2530 | base of retainer cap |
| 2540 | housing |
| 2541 | first plurality of fasteners |
| 2542 | first plurality of openings |
| 2543 | second plurality of fasteners |
| 2544 | second plurality of openings |
| 2550 | first end |
| 2552 | recessed area |
| 2554 | base of recessed area |
| 2560 | second end |
| 2562 | recessed area |
| 2570 | length between base of recessed area to interior angled section of cover |
| 2590 | cover |
| 2592 | first end |
| 2594 | second end |
| 2595 | recessed area |
| 2596 | plurality of openings |
| 2598 | exterior angled section |
| 2599 | beveled section |
| 2600 | interior angled section |
| 2612 | plurality of snap rings |
| 2614 | adhesive |
| 2620 | arrow |
| 2630 | arrow |
| 2640 | arrow |
| 2650 | arrow |
| 2660 | arrow |
| 2670 | arrow |
| 2680 | arrow |
| 2682 | arrow |
| 2684 | arrow |
| 2700 | joint of pipe |
| 2710 | upper portion |
| 2720 | lower portion |
| 2730 | enlarged area |
| 2740 | frustoconical area |
| 2750 | protruding section |
| 2800 | saver sub |
| 3000 | quick lock/quick unlock system |
| 3100 | first part |
| 3110 | bearing and locking hub |
| 3112 | first end |
| 3114 | second end |
| 3120 | plurality of fingers |
| 3130 | example finger |
| 3140 | tip |
| 3150 | latching area of finger |
| 3160 | base of finger |
| 3170 | length of finger |
| 3172 | arrow |
| 3200 | base |
| 3205 | outer diamater |
| 3210 | inner diameter |
| 3220 | first shoulder or angled section |
| 3260 | second shoulder or angled section |
| 3400 | second part |
| 3410 | latching area |
| 3420 | angled area |
| 3440 | flat area |
| 3460 | recessed area |
| 3600 | clutching member |
| 3610 | plurality of alignment members |
| 3620 | example of alignment member |
| 3630 | arrow shaped portion |
| 3640 | fastener |
| 3650 | plurality of bases for alignment members |

-continued

| Reference Numeral | Description |
|---|---|
| 3660 | plurality of threaded openings |
| 3670 | example base for alignment member |
| 4000 | generic catches |
| 4010 | base |
| 4020 | connector |
| 4030 | base |
| 4040 | connector |
| 4200 | specialized catch |
| 4202 | arrow |
| 4204 | arrow |
| 4220 | first section |
| 4222 | inner diameter |
| 4224 | rounded area |
| 4226 | second rounded area |
| 4230 | plurality of openings |
| 4232 | inner diameter |
| 4234 | rounded area |
| 4236 | second rounded area |
| 4240 | second section |
| 4242 | interior |
| 4244 | base |
| 4246 | angled section |
| 4248 | second base |
| 4250 | diameter |
| 4252 | angled area |
| 4254 | base |
| 4259 | plurality of openings |
| 4260 | plurality of fasteners |
| 4270 | plurality of washers |
| 4280 | plurality of snap rings |
| 4400 | specialized catch |
| 4402 | arrow |
| 4404 | arrow |
| 4420 | first section |
| 4422 | interior |
| 4424 | base |
| 4426 | angled section |
| 4430 | plurality of openings |
| 4440 | second section |
| 4442 | interior |
| 4444 | base |
| 4446 | angled section |
| 4448 | second base |
| 4450 | plurality of openings |
| 4460 | plurality of fasteners |
| 4470 | plurality of washers |
| 4480 | plurality of snap rings |
| 5000 | rotating and reciprocating swivel |
| 5300 | packing stack |
| 5306 | plurality of seals |
| 5310 | spacer |
| 5312 | first end of spacer |
| 5314 | second end of spacer |
| 5320 | female packing end ring |
| 5323 | enlarged section of female packing ring |
| 5330 | packing ring |
| 5340 | packing ring |
| 5350 | packing ring |
| 5370 | male packing ring |
| 5372 | first end of male packing ring |
| 5374 | second end of male packing ring |
| 5400 | plurality of polypack seals |
| 5410 | polypack seal |
| 5420 | polypack seal |
| 5430 | polypack seal |
| 5440 | polypack seal |
| 5500 | hydrostatic testing port |
| 5600 | arrow |
| 5700 | arrow |
| 5710 | arrow |
| 5720 | arrow |
| 6300 | packing stack |
| 6302 | first plurality of seals |
| 6304 | second plurality of seals |
| 6310 | female packing end ring |
| 6312 | first end of female packing end ring |

-continued

| Reference Numeral | Description |
|---|---|
| 6314 | second end of female packing end ring |
| 6316 | enlarged section of female packing end ring |
| 6317 | reduced section of female packing end ring |
| 6320 | packing ring |
| 6330 | packing ring |
| 6340 | packing ring |
| 6350 | male packing ring |
| 6352 | first end of male packing ring |
| 6354 | second end of male packing ring |
| 6360 | packing ring |
| 6370 | packing ring |
| 6380 | female packing ring |
| 6382 | first end of female packing ring |
| 6384 | second end of female packing ring |
| 6400 | plurality of polypack seals |
| 6410 | polypack seal |
| 6420 | polypack seal |
| 6430 | polypack seal |
| 6440 | polypack seal |
| 6500 | hydrostatic testing port |
| 6600 | arrow |
| 6610 | arrow |
| 6630 | arrow |
| 6640 | arrow |
| 6700 | arrow |
| 6710 | arrow |
| 6720 | arrow |
| 7000 | thrust bearing |
| 7010 | first end |
| 7020 | second end |
| 7030 | first plurality of openings |
| 7032 | first plurality of fasteners/bolts |
| 7033 | driving portion |
| 7040 | second plurality of openings |
| 7042 | second plurality of fasteners/bolts |
| 7043 | driving portion |
| 7044 | bolt head |
| 7100 | spacer ring |
| 7110 | first end |
| 7120 | second end |
| 7140 | dowel opening |
| 7150 | dowel |
| 7200 | plurality of openings |
| BJ | ball joint |
| BL | booster line |
| CM | choke manifold |
| CL | diverter line |
| CM | choke manifold |
| D | diverter |
| DL | diverter line |
| F | rig floor |
| IB | inner barrel |
| KL | kill line |
| MP | mud pit |
| MB | mud gas buster or separator |
| OB | outer barrel |
| R | riser |
| RF | flow line |
| S | floating structure or rig |
| SJ | slip or telescoping joint |
| SS | shale shaker |
| W | wellhead |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A method of using a reciprocating swivel in a drill or work string, the method comprising the following steps:

(a) lowering a rotating and reciprocating swivel tool to a BOP, the swivel tool comprising a mandrel and a sleeve, the sleeve being reciprocable relative to the mandrel and the swivel tool including a quick lock/quick unlock system which has locked and unlocked states, the swivel tool including an interstitial space between the sleeve and the mandrel, the interstitial space having an interstitial pressure relief mode and an interstitial non-pressure relief mode, the swivel tool being reversibly switchable between pressure relief and non-pressure relief modes;

(b) after step "a", having the BOP close on the sleeve;

(c) causing relative longitudinal movement between the sleeve and the mandrel and activating the quick lock/quick unlock system to cause the quick lock/quick unlock to change from an unlocked to a locked state.

2. The method of claim 1, wherein in step "a", the sleeve is longitudinally locked relative to the mandrel.

3. The method of claim 1, wherein, after step "b" and before step "c", the sleeve is unlocked longitudinally relative to the mandrel.

4. The method of claim 1, wherein, after step "c", the sleeve is longitudinally locked relative to the mandrel.

5. The method of claim 1, wherein during step "c" operations are performed in the wellbore.

6. The method of claim 1, wherein after step "c" operations are performed in the wellbore.

7. The method of claim 1, wherein after step "c" the swivel tool is fluidly connected to a string having a bore and fluid is pumped through at least part of the string's bore.

8. The method of claim 1, wherein the quick lock/quick unlock system is radially aligned before being activated and in a locked state.

9. The method of claim 1, wherein the quick lock/quick unlock system can rotate relative to the sleeve when activated and in a locked state.

10. The method of claim 1, wherein the sleeve includes at least one catch for restricting relative longitudinal movement between the sleeve and the BOP when the BOP is sealed on the sleeve.

11. The method of claim 10, wherein the sleeve includes two catches spaced apart on the longitudinal ends of the sleeve.

12. The method of claim 10, wherein the at least one catch includes a detachable attachment, the detachable attachment being configured to mate with the BOP.

13. The method of claim 12, wherein the detachable attachment includes two pieces which are detachably connectable to the sleeve.

14. The method of claim 12, wherein a plurality of detachable attachments are includes for allowing the catch to fit a plurality of BOPs, the BOPs being manufactured by a plurality of manufacturers.

15. A method of using a reciprocating swivel in a drill or work string, the method comprising the following steps:

(a) lowering a rotating and reciprocating swivel tool to a BOP, the swivel tool comprising a mandrel and a sleeve, the sleeve being reciprocable relative to the mandrel and the swivel tool including a quick lock/quick unlock system which has locked and unlocked states;

(b) after step "a", having the BOP close on the sleeve; and causing relative longitudinal movement between the sleeve and the mandrel and causing the quick lock/quick unlock system to change from an unlocked state to a locked state; (c) after step "b", moving the sleeve outside of the BOP;

(d) after step "c", moving the sleeve inside of the BOP and having the BOP close on the sleeve; and (e) causing relative longitudinal movement between the sleeve and the mandrel and activating the quick lock/quick unlock system.

16. The method of claim 15, wherein in step "a", the sleeve is longitudinally locked relative to the mandrel.

17. The method of claim 15, wherein, after step "b", the sleeve is unlocked longitudinally relative to the mandrel.

18. The method of claim 15, wherein, after step "c", the sleeve is longitudinally locked relative to the mandrel.

19. The method of claim 15, wherein during step "c" operations are performed in the wellbore.

* * * * *